US006868906B1

(12) United States Patent
Vail, III et al.

(10) Patent No.: US 6,868,906 B1
(45) **Date of Patent: *Mar. 22, 2005**

(54) CLOSED-LOOP CONVEYANCE SYSTEMS FOR WELL SERVICING

(75) Inventors: William Banning Vail, III, Bothell, WA (US); James E. Chitwood, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/162,302

(22) Filed: Jun. 4, 2002

Related U.S. Application Data

(63) Continuation-in-part of application No. 09/487,197, filed on Jan. 19, 2000, now Pat. No. 6,397,946, which is a continuation-in-part of application No. 09/295,808, filed on Apr. 20, 1999, now Pat. No. 6,263,987, which is a continuation-in-part of application No. 08/708,396, filed on Sep. 3, 1996, now Pat. No. 5,894,897, which is a continuation-in-part of application No. 08/323,152, filed on Oct. 14, 1994, now Pat. No. 5,551,521.

(60) Provisional application No. 60/384,964, filed on Jun. 3, 2002, provisional application No. 60/367,638, filed on Mar. 26, 2002, provisional application No. 60/353,457, filed on Jan. 31, 2002, and provisional application No. 60/313,654, filed on Aug. 19, 2001.

(51) Int. Cl.[7] ..... E21B 44/06; E21B 43/00

(52) U.S. Cl. ..... 166/250.01; 166/250.15; 166/65.1; 166/667; 340/853.3

(58) Field of Search ..... 166/250.01, 250.15, 166/373, 53, 65.1, 66.7, 77.2, 313, 52, 369; 340/853.3, 854.6, 855.3

(56) References Cited

U.S. PATENT DOCUMENTS 1,842,638 A 1/1932 Wigle (List continued on next page.)

FOREIGN PATENT DOCUMENTS

EP 0 564 500 B1 10/1994

(List continued on next page.)

OTHER PUBLICATIONS

U.S. Appl. No. 10/618,093, filed Jul. 11, 2003, Boyle.

(List continued on next page.)

*Primary Examiner*—Frank Tsay
(74) *Attorney, Agent, or Firm*—Moser, Patterson & Sheridan, L.L.P.

(57) ABSTRACT

A closed-loop system is used to perform a variety of well services. The well services include well completion services, production and maintenance services, and enhanced recovery services. A closed-loop system to complete an oil and gas well is an automated system under computer control that executes a sequence of programmed steps, but those steps depend in part upon information obtained from at least one downhole sensor that is communicated to the surface to optimize and/or change the steps executed by the computer to complete the well. A tractor conveyor with a Retrieval Sub is a tractor deployer that may be used to deploy completion devices and other devices within the wellbore to perform well services. The tractor deployer may be operated from a wireline, or from an umbilical. The umbilical may be made from composite materials and it may be a neutrally buoyant in any well fluids present. The umbilical provides power and data communications downhole. The umbilical may also be coiled tubing possessing electrical conductors. Other conveyance systems are provided to deploy completion devices and other devices within the wellbore to perform well services. The closed-loop system may also be used to monitor and control production of hydrocarbons from the wellbore.

29 Claims, 37 Drawing Sheets

U.S. PATENT DOCUMENTS

| | | | | |
|---|---|---|---|---|
| 1,917,135 | A | 7/1933 | Littell | |
| 2,214,429 | A | 9/1940 | Miller | 166/16 |
| 2,522,444 | A | 9/1950 | Grable | 166/16 |
| 2,610,690 | A | 9/1952 | Beatty | 166/16 |
| 2,621,742 | A | 12/1952 | Brown | 166/1 |
| 2,650,314 | A | 8/1953 | Hennigh et al. | 310/67 |
| 2,668,689 | A | 2/1954 | Cormany | 255/35 |
| 2,692,059 | A | 10/1954 | Bolling, Jr. | 214/2.5 |
| 2,738,011 | A | 3/1956 | Mabry | 166/144 |
| 2,743,495 | A | 5/1956 | Eklund | 22/202 |
| 3,036,530 | A | 5/1962 | Mills et al. | 104/155 |
| 3,122,811 | A | 3/1964 | Gilreath | 24/263 |
| 3,123,160 | A | 3/1964 | Kammerer | 175/82 |
| 3,159,219 | A | 12/1964 | Scott | 166/156 |
| 3,380,528 | A | 4/1968 | Timmons | 166/14 |
| 3,392,609 | A | 7/1968 | Bartos | 81/57 |
| 3,518,903 | A | 7/1970 | Ham et al. | 81/57.16 |
| 3,550,684 | A | 12/1970 | Cubberly, Jr. | 166/250 |
| 3,552,508 | A | 1/1971 | Brown | |
| 3,552,509 | A | 1/1971 | Brown | 175/258 |
| 3,552,510 | A | 1/1971 | Brown | 175/261 |
| 3,559,739 | A | 2/1971 | Hutchison | 166/311 |
| 3,570,598 | A | 3/1971 | Johnson | 166/178 |
| 3,603,411 | A | 9/1971 | Link | |
| 3,603,412 | A | 9/1971 | Kammerer, Jr. et al. | 175/260 |
| 3,603,413 | A | 9/1971 | Grill et al. | 175/261 |
| 3,656,564 | A | 4/1972 | Brown | 175/228 |
| 3,692,126 | A | 9/1972 | Rushing et al. | 175/259 |
| 3,729,057 | A | 4/1973 | Werner | 175/262 |
| 3,747,675 | A | 7/1973 | Brown | 166/237 |
| 3,808,916 | A | 5/1974 | Porter et al. | 81/57.19 |
| 3,827,512 | A | 8/1974 | Edmond | |
| 3,838,613 | A | 10/1974 | Wilms | 81/57.34 |
| 3,870,114 | A | 3/1975 | Pulk et al. | 175/258 |
| 3,885,679 | A | 5/1975 | Swoboda, Jr. et al. | 214/1 |
| 3,888,319 | A | 6/1975 | Bourne, Jr. et al. | |
| 3,890,905 | A | 6/1975 | Calvin | |
| 3,933,108 | A | 1/1976 | Baugh | 114/5 |
| 3,945,444 | A | 3/1976 | Knudson | 175/92 |
| 3,964,556 | A | 6/1976 | Gearhart et al. | 175/45 |
| 3,969,950 | A | 7/1976 | Rau et al. | |
| 3,980,143 | A | 9/1976 | Swartz et al. | 173/100 |
| 4,006,777 | A | 2/1977 | LaBauve | 166/250 |
| 4,009,561 | A | 3/1977 | Young | 57/6 |
| 4,031,750 | A | 6/1977 | Youmans et al. | |
| 4,049,066 | A | 9/1977 | Richey | 175/323 |
| 4,054,426 | A | 10/1977 | White | 51/309 |
| 4,063,602 | A | 12/1977 | Howell et al. | 175/7 |
| 4,064,939 | A | 12/1977 | Marquis | 166/253 |
| 4,071,086 | A | 1/1978 | Bennett | |
| 4,077,525 | A | 3/1978 | Callegari et al. | 214/2.5 |
| 4,082,144 | A | 4/1978 | Marquis | 166/250 |
| 4,085,808 | A | 4/1978 | Kling | 175/94 |
| 4,100,968 | A | 7/1978 | Delano | 166/315 |
| 4,113,236 | A | 9/1978 | Neinast | 254/134.5 |
| 4,116,274 | A | 9/1978 | Rankin et al. | 166/250 |
| 4,133,396 | A | 1/1979 | Tschirky | 175/57 |
| 4,142,739 | A | 3/1979 | Billingsley | 285/18 |
| 4,144,396 | A | 3/1979 | Okano et al. | 560/246 |
| 4,173,457 | A | 11/1979 | Smith | 51/309 |
| 4,175,619 | A | 11/1979 | Davis | 166/291 |
| 4,192,380 | A | 3/1980 | Smith | |
| 4,194,383 | A | 3/1980 | Huzyak | 72/245 |
| 4,227,197 | A | 10/1980 | Nimmo et al. | 343/878 |
| 4,243,099 | A | 1/1981 | Rodgers, Jr. | |
| 4,256,146 | A | 3/1981 | Genini et al. | 138/111 |
| 4,257,442 | A | 3/1981 | Claycomb | 137/238 |
| 4,262,693 | A | 4/1981 | Giebeler | 137/494 |
| 4,274,777 | A | 6/1981 | Scaggs | 414/22 |
| 4,281,722 | A | 8/1981 | Tucker et al. | 175/57 |
| 4,287,949 | A | 9/1981 | Lindsey, Jr. | 166/212 |
| 4,291,772 | A | 9/1981 | Beynet | 175/5 |
| 4,315,553 | A | 2/1982 | Stallings | 175/207 |
| 4,320,915 | A | 3/1982 | Abbott et al. | 294/96 |
| 4,336,415 | A | 6/1982 | Walling | 174/47 |
| 4,384,627 | A | 5/1983 | Ramirez-Jauregui | 175/260 |
| 4,408,669 | A | 10/1983 | Wiredal | 175/258 |
| 4,413,682 | A | 11/1983 | Callihan et al. | 166/382 |
| 4,430,892 | A | 2/1984 | Owings | 73/151 |
| 4,440,220 | A | 4/1984 | McArthur | 166/85 |
| 4,460,053 | A | 7/1984 | Jurgens et al. | 175/329 |
| 4,463,814 | A | 8/1984 | Horstmeyer et al. | |
| 4,470,470 | A | 9/1984 | Takano | 175/260 |
| 4,472,002 | A | 9/1984 | Beney et al. | 308/3.9 |
| 4,474,243 | A | 10/1984 | Gaines | 166/362 |
| 4,534,426 | A | 8/1985 | Hooper | 175/65 |
| 4,544,041 | A | 10/1985 | Rinaldi | 175/57 |
| 4,545,443 | A | 10/1985 | Wiredal | 175/258 |
| 4,570,709 | A | 2/1986 | Wittrisch | |
| 4,580,631 | A | 4/1986 | Baugh | 166/208 |
| 4,583,603 | A | 4/1986 | Dorleans et al. | 175/324 |
| 4,589,495 | A | 5/1986 | Langer et al. | 166/383 |
| 4,604,724 | A | 8/1986 | Shaginian et al. | 364/478 |
| 4,605,077 | A | 8/1986 | Boyadjieff | 175/85 |
| 4,624,306 | A | 11/1986 | Traver et al. | |
| 4,630,691 | A | 12/1986 | Hooper | 175/65 |
| 4,643,377 | A | 2/1987 | Christianson | |
| 4,651,837 | A | 3/1987 | Mayfield | |
| 4,652,195 | A | 3/1987 | McArthur | 414/22 |
| 4,655,286 | A | 4/1987 | Wood | 166/285 |
| 4,671,358 | A | 6/1987 | Lindsey, Jr. et al. | 166/291 |
| 4,676,310 | A | 6/1987 | Scherbatskoy et al. | 166/65.1 |
| 4,686,653 | A | 8/1987 | Staron et al. | |
| 4,686,873 | A | 8/1987 | Lang et al. | 81/57.35 |
| 4,691,587 | A | 9/1987 | Farrand et al. | 74/493 |
| 4,725,179 | A | 2/1988 | Woolslayer et al. | 414/22 |
| 4,735,270 | A | 4/1988 | Fenyvesi | 175/113 |
| 4,760,882 | A | 8/1988 | Novak | 166/295 |
| 4,762,187 | A | 8/1988 | Haney | 175/71 |
| 4,765,416 | A | 8/1988 | Bjerking et al. | 175/71 |
| 4,813,495 | A | 3/1989 | Leach | 175/6 |
| 4,832,552 | A | 5/1989 | Skelly | 414/22.54 |
| 4,840,128 | A | 6/1989 | McFarlane et al. | 108/50 |
| 4,842,081 | A | 6/1989 | Parant | 175/23 |
| 4,843,945 | A | 7/1989 | Dinsdale | 81/57.34 |
| 4,854,386 | A | 8/1989 | Baker et al. | 166/289 |
| 4,880,058 | A | 11/1989 | Lindsey et al. | 166/289 |
| 4,883,125 | A | 11/1989 | Wilson et al. | 166/291 |
| 4,909,741 | A | 3/1990 | Schasteen et al. | 439/13 |
| 4,921,386 | A | 5/1990 | McArthur | 414/22.51 |
| 4,960,173 | A | 10/1990 | Cognevich et al. | |
| 4,962,822 | A | 10/1990 | Pascale | |
| 4,997,042 | A | 3/1991 | Jordan et al. | 166/379 |
| 5,009,265 | A | 4/1991 | Bailey et al. | 166/118 |
| 5,018,451 | A | 5/1991 | Hapstack | |
| 5,022,472 | A | 6/1991 | Bailey et al. | 175/195 |
| 5,027,914 | A | 7/1991 | Wilson | 175/406 |
| 5,040,619 | A | 8/1991 | Jordan et al. | |
| 5,049,020 | A | 9/1991 | McArthur | 414/22.51 |
| 5,060,542 | A | 10/1991 | Hauk | 81/57.34 |
| 5,060,737 | A | 10/1991 | Mohn | 175/104 |
| 5,069,297 | A | 12/1991 | Krueger et al. | 175/65 |
| 5,074,366 | A | 12/1991 | Karlsson et al. | 175/76 |
| 5,082,069 | A | 1/1992 | Seiler et al. | 175/5 |
| 5,096,465 | A | 3/1992 | Chen et al. | 51/295 |
| 5,111,893 | A | 5/1992 | Kvello-Aune | 175/258 |
| 5,121,694 | A | 6/1992 | Zollinger | |
| 5,148,875 | A | 9/1992 | Karlsson et al. | 175/62 |
| 5,156,213 | A | 10/1992 | George et al. | 166/297 |
| 5,160,925 | A | 11/1992 | Dailey et al. | 340/853.3 |
| 5,168,942 | A | 12/1992 | Wydrinski | 175/50 |

5,172,765 A 12/1992 Sas-Jaworsky et al. ..... 166/384
5,176,180 A 1/1993 Williams et al. ..... 138/172
5,176,518 A 1/1993 Hordijk et al. ..... 434/37
5,184,676 A 2/1993 Graham et al.
5,186,265 A 2/1993 Henson et al. ..... 175/107
5,191,939 A 3/1993 Stokley ..... 166/379
5,197,553 A 3/1993 Leturno
5,209,302 A 5/1993 Robichaux et al. ..... 166/355
5,209,304 A 5/1993 Nice
5,234,052 A 8/1993 Coone et al. ..... 166/155
5,255,741 A 10/1993 Alexander ..... 166/278
5,255,751 A 10/1993 Stogner ..... 175/203
5,271,472 A 12/1993 Leturno ..... 175/107
5,282,653 A 2/1994 LaFleur et al. ..... 285/110
5,285,008 A 2/1994 Sas-Jaworsky et al. ..... 174/47
5,285,204 A 2/1994 Sas-Jaworsky ..... 340/854.9
5,291,956 A 3/1994 Mueller et al. ..... 175/67
5,294,228 A 3/1994 Willis et al. ..... 414/22.55
5,297,833 A 3/1994 Willis et al. ..... 294/102.2
5,305,830 A 4/1994 Wittrisch ..... 166/250
5,320,178 A 6/1994 Cornette ..... 175/19
5,323,858 A 6/1994 Jones et al. ..... 166/291
5,332,048 A 7/1994 Underwood et al.
5,339,899 A 8/1994 Ravi et al. ..... 166/250
5,343,950 A 9/1994 Hale et al.
5,343,951 A 9/1994 Cowan et al. ..... 166/293
5,353,872 A 10/1994 Wittrisch ..... 166/250
5,354,150 A 10/1994 Canales ..... 405/154
5,355,967 A 10/1994 Mueller et al. ..... 175/65
5,368,113 A 11/1994 Schulze-Beckinghausen ..... 175/162
5,375,668 A 12/1994 Hallundbaek
5,379,835 A 1/1995 Streich ..... 166/181
5,386,746 A 2/1995 Hauk ..... 81/57.34
5,392,715 A 2/1995 Pelrine ..... 104/138.2
5,398,760 A 3/1995 George et al. ..... 166/297
5,412,568 A 5/1995 Schultz ..... 364/422
5,452,923 A 9/1995 Smith ..... 285/145
5,472,057 A 12/1995 Winfree ..... 175/57
5,497,840 A 3/1996 Hudson ..... 175/72
5,535,824 A 7/1996 Hudson ..... 166/207
5,535,838 A 7/1996 Keshavan et al. ..... 175/374
5,547,029 A 8/1996 Rubbo et al. ..... 166/375
5,547,314 A 8/1996 Ames
5,551,521 A 9/1996 Vail, III ..... 175/65
5,553,672 A 9/1996 Smith, Jr. et al. ..... 166/382
5,560,437 A 10/1996 Dickel et al. ..... 175/40
5,582,259 A 12/1996 Barr ..... 175/73
5,584,343 A 12/1996 Coone ..... 166/387
5,613,567 A 3/1997 Hudson ..... 175/72
5,615,747 A 4/1997 Vail, III ..... 175/379
5,651,420 A 7/1997 Tibbitts et al. ..... 175/102
5,661,888 A 9/1997 Hanslik ..... 29/407.02
5,662,170 A 9/1997 Donovan et al. ..... 166/358
5,662,182 A 9/1997 McLeod et al. ..... 175/258
5,667,011 A 9/1997 Gill et al. ..... 166/295
5,667,023 A 9/1997 Harrell et al. ..... 175/45
5,667,026 A 9/1997 Lorenz et al. ..... 175/162
5,711,382 A 1/1998 Hansen et al. ..... 175/52
5,720,356 A 2/1998 Gardes ..... 175/62
5,732,776 A 3/1998 Tubel et al. ..... 166/250.15
5,735,348 A 4/1998 Hawkins, III ..... 166/285
5,743,344 A 4/1998 McLeod et al. ..... 175/259
5,746,276 A 5/1998 Stuart ..... 173/1
5,769,160 A 6/1998 Owens ..... 166/65.1
5,785,134 A 7/1998 McLeod et al. ..... 175/258
5,794,703 A 8/1998 Newman et al.
5,804,713 A 9/1998 Kluth ..... 73/152.01
5,809,549 A 9/1998 Sprehe ..... 175/71
5,828,003 A 10/1998 Thomeer et al. ..... 174/69
5,829,520 A 11/1998 Johnson ..... 166/250.01
5,833,002 A 11/1998 Holcombe
5,836,409 A 11/1998 Vail, III ..... 175/379
5,839,330 A 11/1998 Stokka ..... 81/57.33
5,839,519 A 11/1998 Spedale, Jr. ..... 175/57
5,842,149 A 11/1998 Harrell et al.
5,842,530 A 12/1998 Smith et al. ..... 175/162
5,845,722 A 12/1998 Makohl et al. ..... 175/101
5,860,474 A 1/1999 Stoltz et al. ..... 166/50
5,890,537 A 4/1999 Lavaure et al.
5,894,897 A 4/1999 Vail, III ..... 175/318
5,907,664 A 5/1999 Wang et al. ..... 395/86
5,908,049 A 6/1999 Williams et al. ..... 138/125
5,913,337 A 6/1999 Williams et al. ..... 138/125
5,921,285 A 7/1999 Quigley et al. ..... 138/125
5,921,332 A 7/1999 Spedale, Jr. ..... 175/415
5,931,231 A 8/1999 Mock ..... 166/377
5,947,213 A 9/1999 Angle et al. ..... 175/24
5,950,742 A 9/1999 Caraway ..... 175/57
5,954,131 A 9/1999 Sallwasser
5,957,225 A 9/1999 Sinor ..... 175/57
5,971,079 A 10/1999 Mullins ..... 166/387
6,000,472 A 12/1999 Albright et al. ..... 166/380
6,026,911 A 2/2000 Angle et al. ..... 175/24
6,059,051 A 5/2000 Jewkes et al. ..... 175/76
6,059,053 A 5/2000 McLeod ..... 175/258
6,061,000 A 5/2000 Edwards ..... 340/854.6
6,062,326 A 5/2000 Strong et al. ..... 175/402
6,065,550 A 5/2000 Gardes ..... 175/62
6,082,461 A 7/2000 Newman et al.
6,089,323 A 7/2000 Newman et al.
6,119,772 A 9/2000 Pruet ..... 166/81.1
6,148,664 A 11/2000 Baird ..... 73/152.38
6,158,531 A 12/2000 Vail, III ..... 175/318
6,170,573 B1 1/2001 Brunet et al. ..... 166/153
6,172,010 B1 1/2001 Argillier et al. ..... 507/102
6,173,787 B1 1/2001 Wittrisch
6,179,055 B1 1/2001 Sallwasser et al.
6,179,058 B1 1/2001 Wittrisch
6,182,776 B1 2/2001 Asberg ..... 175/300
6,189,621 B1 2/2001 Vail, III ..... 166/385
6,192,980 B1 2/2001 Tubel et al. ..... 166/65.1
6,196,336 B1 3/2001 Fincher et al. ..... 175/101
6,206,112 B1 3/2001 Dickinson, III et al. ..... 175/67
6,216,533 B1 4/2001 Woloson et al. ..... 73/152.47
6,220,117 B1 4/2001 Butcher ..... 76/108.2
6,225,719 B1 5/2001 Hallundbaek
6,234,257 B1 5/2001 Ciglenec et al. ..... 175/50
6,241,028 B1 6/2001 Bijleveld et al.
6,241,031 B1 6/2001 Beaufort et al.
6,257,332 B1 7/2001 Vidrine et al.
6,263,987 B1 7/2001 Vail, III ..... 175/318
6,273,189 B1 8/2001 Gissler et al.
6,296,066 B1 10/2001 Terry et al.
6,311,792 B1 11/2001 Scott et al. ..... 175/162
6,315,051 B1 11/2001 Ayling ..... 166/380
6,318,470 B1 11/2001 Chang et al.
6,325,148 B1 12/2001 Trahan et al. ..... 166/297
6,343,649 B1 2/2002 Beck et al. ..... 166/250.01
6,345,669 B1 2/2002 Buyers et al.
6,347,674 B1 2/2002 Bloom et al. ..... 175/51
6,354,373 B1 3/2002 Vercaemer et al. ..... 166/277
6,357,485 B2 3/2002 Quigley et al. ..... 138/125
6,359,569 B2 3/2002 Beck et al. ..... 340/856.3
6,371,203 B2 4/2002 Frank et al. ..... 166/207
6,374,924 B1 4/2002 Hanton et al. ..... 176/6
6,378,627 B1 4/2002 Tubel et al. ..... 175/24
6,378,630 B1 4/2002 Ritorto et al. ..... 175/173
6,378,633 B1 4/2002 Moore et al. ..... 175/325.5
6,397,946 B1 6/2002 Vail, III ..... 166/250.01
6,405,798 B1 6/2002 Barrett et al. ..... 166/250.01
6,408,943 B1 6/2002 Schultz et al. ..... 166/285

| | | | | |
|---|---|---|---|---|
| 6,412,554 | B1 | 7/2002 | Allen et al. | 166/80.1 |
| 6,412,574 | B1 | 7/2002 | Wardley et al. | 175/7 |
| 6,419,014 | B1 | 7/2002 | Meek et al. | 166/255.2 |
| 6,419,033 | B1 | 7/2002 | Hahn et al. | 175/61 |
| 6,427,776 | B1 | 8/2002 | Hoffman et al. | 166/311 |
| 6,443,241 | B1 | 9/2002 | Juhasz et al. | 175/52 |
| 6,443,247 | B1 | 9/2002 | Wardley | 175/402 |
| 6,464,004 | B1 | 10/2002 | Crawford et al. | 166/250.01 |
| 6,484,818 | B2 | 11/2002 | Alft et al. | 175/45 |
| 6,497,280 | B2 | 12/2002 | Beck et al. | 166/250.07 |
| 6,509,301 | B1 | 1/2003 | Vollmer | 507/236 |
| 6,527,047 | B1 | 3/2003 | Pietras | 166/77.51 |
| 6,527,064 | B1 | 3/2003 | Hallundbaek | 175/320 |
| 6,536,520 | B1 | 3/2003 | Snider et al. | 166/78.1 |
| 6,536,522 | B2 | 3/2003 | Birckhead et al. | 166/250.15 |
| 6,538,576 | B1 | 3/2003 | Schultz et al. | 340/859.6 |
| 6,543,538 | B2 | 4/2003 | Tolman et al. | 166/284 |
| 6,547,017 | B1 | 4/2003 | Vail, III | 175/379 |
| 6,554,064 | B1 | 4/2003 | Restarick et al. | 166/250.01 |
| 6,591,471 | B1 | 7/2003 | Hollingsworth et al. | 29/407.09 |
| 2001/0000101 | A1 | 4/2001 | Lovato et al. | |
| 2001/0013412 | A1 | 8/2001 | Tubel | |
| 2001/0040054 | A1 | 11/2001 | Haugen et al. | |
| 2001/0042625 | A1 | 11/2001 | Appleton | |
| 2001/0047883 | A1 | 12/2001 | Hanton et al. | |
| 2002/0066556 | A1 | 6/2002 | Goode et al. | |
| 2002/0074127 | A1 | 6/2002 | Birckhead et al. | |
| 2002/0074132 | A1 | 6/2002 | Juhasz et al. | |
| 2002/0134555 | A1 | 9/2002 | Allen et al. | |
| 2002/0157829 | A1 | 10/2002 | Davis et al. | |
| 2002/0162690 | A1 | 11/2002 | Hanton et al. | |
| 2002/0189806 | A1 | 12/2002 | Davidson et al. | |
| 2002/0189863 | A1 | 12/2002 | Wardley | |
| 2003/0034177 | A1 | 2/2003 | Chitwood et al. | |
| 2003/0056991 | A1 | 3/2003 | Hahn et al. | |
| 2003/0070841 | A1 | 4/2003 | Merecka et al. | |

FOREIGN PATENT DOCUMENTS

| | | | | |
|---|---|---|---|---|
| EP | 0 571 045 | B1 | 8/1998 | E21B/7/06 |
| EP | 1 050 661 | | 11/2000 | E21B/7/18 |
| GB | 2 216 926 | A | 10/1989 | E21B/7/20 |
| GB | 2 216 926 | B | 8/1992 | E21B/7/20 |
| GB | 2 216 926 | B | 12/1992 | E21B/7/20 |
| GB | 2 357 101 | A | 6/2001 | E21B/7/06 |
| RU | 1618870 | | 1/1991 | E21B/33/14 |
| WO | WO 91/16520 | | 10/1991 | |
| WO | WO 93/18277 | | 9/1993 | |
| WO | WO 95/21987 | | 8/1995 | |
| WO | WO 96/28635 | | 9/1996 | E21B/17/14 |
| WO | WO 97/08418 | | 3/1997 | E21B/4/18 |
| WO | WO 98/01651 | | 1/1998 | E21B/23/00 |
| WO | WO 98/06927 | | 2/1998 | |
| WO | WO 98/55730 | | 12/1998 | E21B/23/00 |
| WO | WO 00/05483 | | 2/2000 | E21B/19/16 |
| WO | WO 00/11309 | | 3/2000 | E21B/19/16 |
| WO | WO 00/11310 | | 3/2000 | E21B/19/16 |
| WO | WO 00/11311 | | 3/2000 | E21B/19/16 |
| WO | WO 00/28188 | | 5/2000 | E21B/7/06 |
| WO | WO 00/37771 | | 6/2000 | E21B/43/10 |
| WO | WO 00/50730 | | 8/2000 | E21B/10/66 |
| WO | WO 01/12946 | | 2/2001 | E21B/19/00 |
| WO | WO 01/12946 | A | 2/2001 | E21B/19/00 |
| WO | WO 01/46550 | | 6/2001 | E21B/7/20 |
| WO | WO 01/48352 | | 7/2001 | E21B/23/00 |
| WO | WO 01/48352 | A1 | 7/2001 | E21B/23/00 |
| WO | WO 01/79650 | | 10/2001 | E21B/10/60 |
| WO | WO 01/81708 | | 11/2001 | E21B/10/32 |
| WO | WO 01/94738 | | 12/2001 | E21B/7/20 |
| WO | WO 01/94739 | A1 | 12/2001 | E21B/7/20 |
| WO | WO 02/03155 | | 1/2002 | G05B/19/4068 |
| WO | WO 02/03156 | | 1/2002 | G05B/19/418 |
| WO | WO 02/086287 | | 10/2002 | E21B/47/01 |

OTHER PUBLICATIONS

U.S. Appl. No. 10/382,080, filed Mar. 5, 2003, Haugen.

U.S. Appl. No. 10/382,353, filed Mar. 5, 2003, Shahin et al.

U.S. Appl. No. 10/335,957, filed Dec. 31, 2002, Gledhill et al.

U.S. Appl. No. 10/331,964, filed Dec. 30, 2002, Galloway et al.

U.S. Appl. No. 10/325,636, filed Dec. 20, 2002, Galloway et al.

U.S. Appl. No. 10/319,792, filed Dec. 13, 2002, Galloway et al.

U.S. Appl. No. 10/269,661, filed Oct. 11, 2002, Haugen et al.

Rotary Steerable Technology—Technology Gains Momentum, Oil & Gas Journal, Dec. 28, 1998.

Directional Drilling, M. Mims, World Oil, May 1999, pp. 40–43.

Multilateral Classification System w/Example Applications, Alan MacKenzie & Cliff Hogg, World Oil, Jan. 1999, pp. 55–61.

Rotary Drilling, Open–Hole Fishing, Unit III, Lesson 2, Third Edition.

Rotary Drilling, Casing and Cementing, Unit II, Lesson 4, Second Edition.

Rotary Drilling, Drilling a Straight Hole, Unit II, Lesson 3, Second Edition.

Rotary Drilling, The Bit, Unit I, Lesson 2, Third Edition.

Rotary Drilling, Blowout Prevention, Unit III, Lesson 3, Third Edition.

Well Servicing and Workover, Artificial Lift Methods, Lesson 5, Petroleum Extension Service, The University of Texas at Austin.

Rotary Drilling, Drilling Mud, Unit II, Lesson 2, Third Edition.

Rotary Drilling, Subsea Blowout Preventers and Marine Riser Systems, Unit III, Lesson 4.

Well Servicing and Workover, Control of Formation Pressure, Lesson 9, Petroleum Extension Service, The University of Texas at Austin.

Well Servicing and Workover, Production Rig Equipment, Lesson 6, Petroleum Extension Service, The University of Texas at Austin.

Well Servicing and Workover, Petroleum Geology and Reservoirs, Lesson 2, Petroleum Extension Service, The University of Texas at Austin.

Well Servicing and Workover, Well Logging Methods, Lesson 3, Petroleum Extension Service, The University of Texas at Austin.

Well Servicing and Workover, Introduction to Oil Well Service and Workover, Lesson 1, Petroleum Extension Service, The University of Texas at Austin.

Well Servicing and Workover, Well Completion Methods, Lesson 4, Petroleum Extension Service, The University of Texas at Austin.

Rotary Drilling, Controlled Directional Drilling, Unit II, Lesson 1, Third Edition.

Well Servicing and Workover, Well Stimulation Treatments, Lesson 11, Petroleum Extension Service, The University of Texas at Austin.

Rotary Drilling, Making Hole, Unit II, Lesson 1, Second Edition.

Well Servicing and Workover, Well Cleanout and Repair Methods, Lesson 8, Petroleum Extension Service, The University of Texas at Austin.

Well Servicing and Workover, Well Servicing and Repair, Lesson 7, Petroleum Extension Service, The University of Texas at Austin.

Rotary Drilling, Circulating Systems, Unit I, Lesson 8, Third Edition.

Well Servicing and Workover, Well Service and Workover Profitability, Lesson 12, Petroleum Extension Service, The University of Texas at Austin.

Rotary Drilling, Testing and Completing, Unit II, Lesson 5, Second Edition.

Well Servicing and Workover, Fishing Tools and Techniques, Lesson 10, Petroleum Extension Service, The University of Texas at Austin.

Tarr, et al., "Casing–while–drilling: The next step change in well construction", World Oil, Oct. 1999, pp. 34–40.

de León Mojarro, "Breaking a Paradigm: Drilling with Tubin Gas Wells", SPE Paper 40051, SPE Annual Technical Conference and Exhibition, Mar. 3–5, 1998, pp. 465–472.

de León Mojarro, "Drilling/completing with tubing cuts well costs by 30%", World Oil, Jul. 1998, pp. 145–150.

Littleton, "Refined Slimhole Drilling Technology Renews Operator Interest", Petroleum Engineer International, Jun. 1992, pp. 19–26.

Anon., "Slim Holes Fat Savings", Journal of Petroleum Technology, Sep. 1993, pp. 816–819.

Anon., "Slim Holes, Slimmer Prospect", Journal of Petroleum Technology, Nov. 1995, pp. 949–952.

Vogt et al., "Drilling Liner Technology for Depleted Reservoir", SPE Paper 36827, SPE Annual Technical Conference and Exhibition, Oct. 22–24, pp. 127–132.

Jafer et al., "Discussion and Comparison of Performance of Horizontal Wells in Bouri Field", SPE Paper 36927, SPE Annual Technical Conference and Exhibition, Oct. 22–24, 1996, pp. 465–473.

Sinor et al., "Rotary Liner Drilling for Depleted Reservoirs", IADC/SPE Paper 39399, IADC/SPE Drilling Conference, Mar. 3–6, 1998, pp. 879–888.

Tessari et al., "Casing Drilling—A Revolutionary Approach to Reducing Well Costs", SPE/IADC Paper 52789, SPE/IADC Drilling Conference, Mar. 9–11, 1999, pp. 221–229.

Laurent et al., "A New Generation Drilling Rig: Hydraulically Powered and Computer Controlled", CADE/CAODC Paper 99–120, CADE/CAODC Spring Drilling Conference, Apr. 7 & 8, 1999, 14 pages.

Madell et al., "Casing Drilling An Innovative Approach to Reducing Drilling Costs", CADE/CAODC Paper 99–121, CADE/CAODC Spring Drilling Conference, Apr. 7 & 8, 1999, pp. 1–12.

Boykin, "The Role of Worldwide Drilling Organization and the Road to the Future", SPE/IACD Paper 37630, SPE/IADC Drilling Conference, Mar. 4–6, 1997, pp. 489–498.

Mojarro et al., "Drilling/completing with tubing cuts well costs by 30%", World Oil, Jul. 1998, pp. 145–150.

Sinor et al., "Rotary Liner Drilling for Depleted Reservoirs", IADC/SPE Paper 39399, IADC/SPE Drilling Conference, Mar. 3–6, 1998, pp. 1–13.

Editor, "Innovation Starts At The Top At Tesco", The American Oil & Gas Reporter, Apr., 1998, p. 65.

Santos, et al., "Consequences and Relevance of Drillstring Vibration on Wellbore Stability", SPE/IADC Paper 52820, SPE/IADC Drilling Conference, Mar. 9–11, 1999, pp. 25–31.

Silverman, "Novel Drilling Method—Casing Drilling Process Eliminates Tripping String", Petroleum Engineer International, Mar. 1999, p. 15.

Silverman, "Drilling Technology—Retractable Bit Eliminates Drill String Trips", Petroleum Engineering International, Apr. 1999, p. 15.

Laurent et al., "A New Generation Drilling Rig: Hydraulically Powered and Computer Controlled", CADE/CAODC Paper 99–120, CADE/CAODC Spring Drilling Conference, Apr. 7 & 8, 1999, 14 pages.

Madell et al., "Casing Drilling An Innovative Approach to Reducing Drilling Costs", CADE/CAODC Paper 99–121, CADE/CAODC Spring Drilling Conference, Apr. 7 & 8, 1999, pp. 1–12.

Tessari et al., "Focus: Drilling—Drilling with casing promises major benefits", Oil & Gas Journal, May 17, 1999, pp. 58–62.

Laurent et al., "Hydraulic rig supports casing drilling", World Oil, Sep. 1999, pp. 61–68.

Perdue et al., "Casing technology improves", Hart's E & P, Nov. 1999, pp. 135–136.

Warren et al., "Casing Drilling Application Design Considerations", IADC/SPE Paper 59179, IADC/SPE Drilling Conference, Feb. 23–25, 2000 pp. 1–11.

Warren et al., "Drilling Technology: Part 1—Casing drilling with directional steering in the US Gulf of Mexico", Offshore, Jan. 2001, pp. 50–52.

Warren et al., "Drilling Technology: Part II—Casing drilling with directional steering in the US Gulf of Mexico", Offshore, Feb. 2001, pp. 40–42.

Shepard et al., "Casing Drilling: An Emerging Technology", IADC/SPE Paper 67731, SPE/IADC Drilling Conference, Feb. 27–Mar. 1, 2001, pp. 1–13.

Editor, "Tesco finishes field trial program", Drilling Contractor, Mar./Apr. 2001, p. 53.

Warren et al., "Casing Drilling Technology Moves to More Challenging Application", AADE Paper 01–NC–HO–32, AADE National Drilling Conference, Mar. 27–29, 2001, pp. 1–10.

Shephard et al., "Casing Drilling: An Emerging Technology", SPE Drilling & Completion, Mar. 2002, pp. 4–14.

Shephard et al., "Casing Drilling Successfully applied in Southern Wyoming", World Oil, Jun. 2002, pp. 33–41.

Filippov et al., "Expandable Tubular Solutions", SPE Paper 56500, SPE Annual Technical Conference and Exhibition, Oct. 3–6, 1999, pp. 1–16.

Lohoefer et al., "Expandable Liner Hanger Provides Cost–Effective Alternative Solution", IADC/SPE Paper 59151, IADC/SPE Drilling Conference, Feb. 23–25, 2000, pp. 1–12.

Daigle et al., "Expandable Tubulars: Field Examples of Application in Well Construction and Remediation", SPE Paper 62958, SPE Annual Technical Conference and Exhibition, Oct. 1–4, 2000, pp. 1–14.

Dupal et al., "Solid Expandable Tubular Technology—A Year of Case Histories in the Drilling Environment", SPE/IADC Paper 67770; SPE/IADC Drilling Conference, Feb. 27–Mar. 1, 2001, pp. 1–16.

Vail, III, U.S. Disclosusre Document No. 452,648, filed Mar. 5, 1999, p. 11.

Coronado et al., "Development of a One–Trip ECP Cement Inflation and Stage Cementing System for Open Hole Completions", IADC/SPE paper 39345, IADC/SPE Drilling Conference, Mar. 3–6, 1998, pp. 473–481.
Fuller et al., "Innovative Way to Cement a Liner Utilizing a New Liner String Liner Cementing Process", IADC/SPE paper 39349 IADC/SPE Drilling Conference, Mar. 3–6, 1998, pp. 501–504.
Coronado et al., "A One–Trip External–Casing–Packer Cement–Inflation and Stage–Cementing System", Journal of Petroleum Technology, Aug. 1998, pp. 76–77.
Cablesa, Inc., Wireline Catalogue, 2000, 6 pages.
Camesa, Inc., "Electromechanical Cable", Dec. 1998, pp. 1–32.
The Rochester Corporation, "Well Logging Cables", Jul. 1999, 9 pages.
Quigley, "Coiled Tubing and Its Applications", SPE Short Course, Houston, TX, Oct. 3, 1999, 9 pages.
"World Oil's Coiled Tubing Handbook", Gulf Publishing Co., 1993, p. 3, p. 5, pp. 45–50.
Sas–Joworsky et al., "Development of Composite Coiled Tubing for Oilfield Services", SPE Paper 26536, SPE Annual Technical Conference and Exhibition, Oct. 3–6, 1993, pp. 1–15.
Hallundbaek, "Well Tractors for Highly Deviated and Horizontal Wells", SPE Paper 028871, SPE European Petroleum Conference, Oct. 25–27, 1994, pp. 57–62.
Leising et al., "Extending the Reach of Coiled Tubing Drilling (Thrusters, Equalizers and Tractors)", SPE/IADC Paper 37656, SPE/IADC Drilling Conference, Mar. 4–6, 1997, pp. 677–690.
Bayfield et al., "Burst and Collapse of a Sealed Mutilateral Junction: Numerical Simulations", SPE/IADC Paper 52873, SPE/IADC Drilling Conference, Mar. 9–11, 1999, 8 pages.
Marker et al. "Anaconda: Joint Development Project Leads to Digitally Controlled Composite Coiled Tubing Drilling System", SPE Paper 60750, SPE/ICoTA Coiled Tubing Roundtable, Apr. 5–6, 2000, pp. 1–9.
Bullock et al., "Using Expandable Solid Tubulars to Solve Well Construction Challenges in Deep Waters and Maturing Properties", IBP Paper 275 00, Rio Oil & Gas Conference, Oct. 16–19, 2000, pp. 1–4.
Cales et al., "Subsidence Remediation—Extending Well Life Through the Use of Solid Expandable Casing Systems", AADE Paper 01–NC–HO–24, American Association of Drilling Engineers, Mar. 2001 Conference, pp. 1–16.
McSpadden et al., "Field Validation of 3–Dimensional Drag Model for Tractor and Cable–Conveyed Well Intervention", SPE Paper 71560, SPE Annual Technical Conference and Exhibition, Sep. 30–Oct. 3, 2001, pp. 1–8.
Coats et al., "The Hybrid Drilling Unit: An Overview of an Integrated Composite Coiled Tubing and Hydraulic Workover Drilling System", SPE Paper 74349, SPE International Petroleum Conference and Exhibition, Feb. 10–12, 2002, pp. 1–7.
Sander et al., "Project Management and Technology Provide Enhanced Performance for Shallow Horizontal Wells", IADC/SPE Paper 74466, IADC/SPE Drilling Conference, Feb. 26–28, 2002, pp. 1–9.
Coats et al., "The Hybrid Drilling System: Incorporating Composite Coiled Tubing and Hydraulic Workover Technologies into One Integrated Drilling System", IADC/SPE Paper 74538, IADC/SPE Drilling Conference, Feb. 26–28, 2002, pp. 1–7.
Welltec, Inc., Product Literature, May 2003, 64 pages.
Editor, "New downhole tractor put to work", World Oil, Jun. 2000, pp. 75–76.
Henderson, et al., "Cost Saving Benefits of Using a Fully Bi–Directional Tractor System", SPE/Petroleum Society of CIM Paper 65467, SPE/Petroleum Society of CIM International Conference on Horizontal Well Technology, Nov. 6–8, 2000, pp. 1–3.
Editor, "Shell runs smart robot tractor", Hart's E & P, Oct. 2002, p. 28.
SmarTract, Inc., Product Literature, May 2003, 2 pages.
Forest, et al., "Subsea Equipment For Deep Water Drilling Using Dual Gradient Mud System," SPE/IADC Drilling Conference, Amsterdam, The Netherlands, Feb. 27, 2001–Mar. 01, 2001, 8 pages.
World's First Drilling With Casing Operation From A Floating Drilling Unit, Sep. 2003, 1 page.
Camesa, Inc., "Electromechanical Cable," Dec. 1998, pp. 1–32.
The Rochester Corporation, "Well Logging Cables," Jul. 1999, 9 pages.
Quigley, "Coiled Tubing And Its Applications," SPE Short Course, Houston, Texas, Oct. 3, 1999, 9 pages.
"World Oil's Coiled Tubing Handbook," Gulf Publishing Co., 1993, p. 3, p. 5, pp. 45–50.
Sas–Joworsky, et al., "Development Of Composite Coiled Tubing For Oilfield Services," SPE Paper 26536, SPE Annual Technical Conference And Exhibition, Oct. 3–6, 1993, pp. 1–15.
Hallundbaek, "Well Tractors For Highly Deviated And Horizontal Wells," SPE paper 028871, SPE European Petroleum Conference, Oct. 25–27, 1994, pp. 57–62.
Leising, et al., "Extending The Reach Of Coiled Tubing Drilling (Thrusters, Equalizers And Tractors)," SPE/IADC Paper 37656, SPE/IADC Drilling Conference, Mar. 4–6, 1997, pp. 677–690.
Bayfiled, et al., "Burst And Collapse Of A Sealed Mutilateral Junction: Numerical Simulations," SPE/IADC Paper 52873, SPE/IADC Drilling Conference, Mar. 9–11, 1999, 8 pages.
Marker, et al. "Anaconda: Joint Development Project Leads to Digitally Controlled Composite Coiled Tubing Drilling System," SPE paper 60750, SPE/ICOTA Coiled Tubing Roundtable, Apr. 5–6, 2000, pp. 1–9.
Bullock, et al., "Using Expandable Solid Tubulars To Solve Well Construction Challenges In Deep Waters And Maturing Properties," IBP Paper 275 00, Rio Oil & Gas Conference, Oct. 16–19, 2000, pp. 1–4.
Cales, et al., Subsidence Remediation—Extending Well Life Through The Use Of Solid Expandable Casing Systems, AADE Paper 01–NC–HO–24, American Association Of Drilling Engineers, Mar. 2001 Conference, pp. 1–16.
McSpadden, et al., "Field Validation Of 3–Dimensional Drag Model For Tractor And Cable–Conveyed Well Intervention," SPE Paper 71560, SPE Annual Technical Conference And Exhibition, Sep. 30–Oct. 3, 2001, pp. 1–8.

CLOSED-LOOP CONVEYANCE SYSTEMS FOR WELL SERVICING

PRIORITY FROM U.S. PROVISIONAL PATENT APPLICATIONS

The present application claims priority from and the benefit of U.S. Provisional Patent Application No. 60/384,964, filed Jun. 3, 2002, that is entitled "Umbilicals for Well Conveyance Systems and Additional Smart Shuttles and Related Drilling Systems", which is fully incorporated herein by reference.

The present application claims priority from and the benefit of U.S. Provisional Patent Application No. 60/367,638, filed Mar. 26, 2002, that is entitled "Smart Shuttle Systems and Drilling Systems", which is fully incorporated herein by reference.

The present application claims priority from and the benefit of U.S. Provisional Patent Application No. 60/353,457, filed Jan. 31, 2002, which is entitled "Additional Smart Shuttle Systems", which is fully incorporated herein by reference.

The present application also claims priority from and the benefit of U.S. Provisional Patent Application No. 60/313,654, filed Aug. 19, 2001, that is entitled "Smart Shuttle Systems", which is fully incorporated herein by reference.

Priority from U.S. Patent Applications

The present application is a continuation-in-part (C.I.P.) application of application Ser. No. 09/487,197, filed Jan. 19, 2000, that is entitled "Closed-Loop System to Complete Oil and Gas Wells", now U.S. Pat. No. 6,397,946, that issued on Jun. 4, 2002, which is fully incorporated herein by reference.

Application Ser. No. 09/487,197 is corrected to be, by a Certificate of Correction, a continuation-in-part of application Ser. No. 09/295,808, filed Apr. 20, 1999, that is entitled "One Pass Drilling and Completion of Extended Reach Lateral Wellbores with Drill Bit Attached to Drill String to Produce Hydrocarbons from Offshore Platforms", now U.S. Pat. No. 6,263,987, that issued on Jul. 24, 2001, which is fully incorporated herein by reference.

Application Ser. No. 09/295,808 is a continuation-in-part of application Ser. No. 08/708,396, filed Sep. 3, 1996, that is entitled "Method and Apparatus for Cementing Drill Strings in Place for One Pass Drilling and Completion of Oil and Gas Wells", now U.S. Pat. No. 5,894,897, that issued on Apr. 20, 1999, which is fully incorporated herein by reference.

Application Ser. No. 08/708,396 is a continuation-in-part of application Ser. No. 08/323,152, filed Oct. 14, 1994, that is entitled "Method and Apparatus for Cementing Drill Strings in Place for One Pass Drilling and Completion of Oil and Gas Wells", now U.S. Pat. No. 5,551,521, that issued on Sep. 3, 1996, which is fully incorporated herein by reference.

Applicant claims priority from and the benefit of the above four applications having Ser. Nos. 09/487,197, 09/295,808, 08/708,396, and 08/323,152.

Related Applications

The present application relates to application Ser. No. 09/375,479, filed Aug. 16, 1999, that is entitled "Smart Shuttles to Complete Oil and Gas Wells", now U.S. Pat. No. 6,189,621, that issued on Feb. 20, 2001, which is fully incorporated herein by reference.

The present application further relates to PCT Application Serial No. PCT/US00/22095, filed Aug. 9, 2000, that is entitled "Smart Shuttles to Complete Oil and Gas Wells", which is fully incorporated herein by reference. This PCT Application corresponds to Ser. No. 09/375,479.

The present application also relates to application Ser. No. 09/294,077, filed Apr. 18, 1999, that is entitled "One Pass Drilling and Completion of Wellbores with Drill Bit Attached to Drill String to Make Cased Wellbores to Produce Hydrocarbons", now U.S. Pat. No. 6,158,531, that issued on Dec. 12, 2000, which is fully incorporated herein by reference.

Related U.S. Disclosure Documents

This application further relates to disclosure in U.S. Disclosure Document No. 362582, filed on Sep. 30, 1994, that is entitled 'RE: Draft of U.S. Patent Application Entitled "Method and Apparatus for Cementing Drill Strings in Place for One Pass Drilling and Completion of Oil and Gas Wells"', an entire copy of which is incorporated herein by reference.

This application further relates to disclosure in U.S. Disclosure Document No. 445686, filed on Oct. 11, 1998, having the title that reads exactly as follows: 'RE:—Invention Disclosure— entitled "William Banning Vail III, Oct. 10, 1998"', an entire copy of which is incorporated herein by reference.

This application further relates to disclosure in U.S. Disclosure Document No. 451044, filed on Feb. 8, 1999, that is entitled 'RE: —Invention Disclosure—"Drill Bit Having Monitors and Controlled Actuators"', an entire copy of which is incorporated herein by reference.

This application further relates to disclosure in U.S. Disclosure Document No. 451292, filed on Feb. 10, 1999, that is entitled 'RE: —Invention Disclosure—"Method and Apparatus to Guide Direction of Rotary Drill Bit" dated Feb. 9, 1999"', an entire copy of which is incorporated herein by reference.

This application further relates to disclosure in U.S. Disclosure Document No. 452648 filed on Mar. 5, 1999 that is entitled 'RE: "—Invention Disclosure— Feb. 28, 1999 One-Trip-Down-Drilling Inventions Entirely Owned by William Banning Vail III"', an entire copy of which is incorporated herein by reference.

This application further relates to disclosure in U.S. Disclosure Document No. 455731 filed on May 2, 1999 that is entitled 'RE: —INVENTION DISCLOSURE— entitled "Summary of One-Trip-Down-Drilling Inventions", an entire copy of which is incorporated herein by reference.

This application further relates to disclosure in U.S. Disclosure Document No. 458978 filed on Jul. 13, 1999 that is entitled in part "RE: —INVENTION DISCLOSURE MAILED JUL. 13, 1999", an entire copy of which is incorporated herein by reference.

This application further relates to disclosure in U.S. Disclosure Document No. 459470 filed on Jul. 20, 1999 that is entitled in part 'RE: —INVENTION DISCLOSURE ENTITLED "Different Methods and Apparatus to "Pump-down" . . . "', an entire copy of which is incorporated herein by reference.

This application further relates to disclosure in U.S. Disclosure Document No. 462818 filed on Sep. 23, 1999 that is entitled in part "Directional Drilling of Oil and Gas Wells Provided by Downhole Modulation of Mud Flow", an entire copy of which is incorporated herein by reference.

This application further relates to disclosure in U.S. Disclosure Document No. 465344 filed on Nov. 19, 1999 that is entitled in part "Smart Cricket Repeaters in Drilling Fluids for Wellbore Communications While Drilling Oil and Gas Wells", an entire copy of which is incorporated herein by reference.

This application further relates to disclosure in U.S. Disclosure Document No. 474370 filed on May 16, 2000 that is entitled in part "Casing Drilling with Standard MWD/LWD Drilling Assembly Latched into Casing Having Releasable Standard Sized Drill Bit", an entire copy of which is incorporated herein by reference.

This application further relates to disclosure in U.S. Disclosure Document No. 475584 filed on Jun. 13, 2000 that is entitled in part "Lower Portion of Standard LWD/MWD Rotary Drill String with Rotary Steering System and Rotary Drill Bit Latched into ID of Larger Casing Having Undercutter to Drill Oil and Gas Wells Whereby the Lower Portion is Retrieved upon Completion of the Wellbore", an entire copy of which is incorporated herein by reference.

This application further relates to disclosure in U.S. Disclosure Document No. 475681 filed on Jun. 17, 2000 that is entitled in part "ROV Conveyed Smart Shuttle System Deployed by Workover Ship for Subsea Well Completion and Subsea Well Servicing", an entire copy of which is incorporated herein by reference.

This application further relates to disclosure in U.S. Disclosure Document No. 496050 filed on Jun. 25, 2001 that is entitled in part "SDCI Drilling and Completion Patents and Technology and SDCI Subsea Re-Entry Patents and Technology", an entire copy of which is incorporated herein by reference.

This application further relates to disclosure in U.S. Disclosure Document No. 480550 filed on Oct. 2, 2000 that is entitled in part "New Draft Figures for New Patent Applications", an entire copy of which is incorporated herein by reference.

This application further relates to disclosure in U.S. Disclosure Document No. 493141 filed on May 2, 2001 that is entitled in part "Casing Boring Machine with Rotating Casing to Prevent Sticking Using a Rotary Rig", an entire copy of which is incorporated herein by reference.

This application further relates to disclosure in U.S. Disclosure Document No. 492112 filed on Apr. 12, 2001 that is entitled in part "Smart Shuttles Conveyed Drilling Systems", an entire copy of which is incorporated herein by reference.

This application further relates to disclosure in U.S. Disclosure Document No. 495112 filed on Jun. 11, 2001 that is entitled in part "Liner/Drainhole Drilling Machine", an entire copy of which is incorporated herein by reference.

This application further relates to disclosure in U.S. Disclosure Document No. 494374 filed on May 26, 2001 that is entitled in part "Continuous Casting Boring Machine", an entire copy of which is incorporated herein by reference.

This application further relates to disclosure in U.S. Disclosure Document No. 495111 filed on Jun. 11, 2001 that is entitled in part "Synchronous Motor Injector System", an entire copy of which is incorporated herein by reference.

And yet further, this application also relates to disclosure in U.S. Disclosure Document No. 497719 filed on Jul. 27, 2001 that is entitled in part "Many Uses for The Smart Shuttle™ and Well Locomotive", an entire copy of which is incorporated herein by reference.

Various references are referred to in the above defined U.S. Disclosure Documents. For the purposes herein, the term "reference cited in applicant's U.S. Disclosure Documents" shall mean those particular references that have been explicitly listed and/or defined in any of applicant's above listed U.S. Disclosure Documents and/or in the attachments filed with those U.S. Disclosure Documents. Applicant explicitly includes herein by reference entire copies of each and every "reference cited in applicant's U.S. Disclosure Documents". In particular, applicant includes herein by reference entire copies of each and every U.S. Patent cited in U.S. Disclosure Document No. 452648, including all its attachments, that was filed on Mar. 5, 1999. To best knowledge of applicant, all copies of U.S. Patents that were ordered from commercial sources that were specified in the U.S. Disclosure Documents are in the possession of applicant at the time of the filing of the application herein.

Applications for U.S. Trademarks have been filed in the USPTO for several terms used in this application. An application for the Trademark "Smart Shuttle™" was filed on Feb. 14, 2001 that is Serial No. 76/213676, an entire copy of which is incorporated herein by reference. The "Smart Shuttle™" is also called the "Well Locomotive™". An application for the Trademark "Well Locomotive™" was filed on Feb. 20, 2001 that is Serial Number 76/218211, an entire copy of which is incorporated herein by reference. An application for the Trademark of "Downhole Rig" was filed on Jun. 11, 2001 that is Serial Number 76/274726, an entire copy of which is incorporated herein by reference. An application for the Trademark "Universal Completion Devices" was filed on Jul. 24, 2001 that is Serial Number 76/293175, an entire copy of which is incorporated herein by reference. An application for the Trademark "Downhole BOP" was filed on Aug. 17, 2001 that is Serial Number 76/305201, an entire copy of which is incorporated herein by reference.

Accordingly, in view of the Trademark Applications, the term "smart shuttle" will be capitalized as "Smart Shuttle"; the term "well locomotive" will be capitalized as "Well Locomotive"; the term "universal completion device" will be capitalized as "Universal Completion Device"; and the term "downhole bop" will be capitalized as "Downhole BOP".

BACKGROUND OF THE INVENTION

1. Field of Invention

The fundamental field of the invention relates to apparatus and methods of operation that substantially reduce the number of steps and the complexity to drill and complete oil and gas wells. Because of the extraordinary breadth of the fundamental field of the invention, there are many related separate fields of the invention.

Accordingly, the field of invention relates to apparatus that uses the steel drill string attached to a drilling bit during drilling operations used to drill oil and gas wells for a second purpose as the casing that is cemented in place during typical oil and gas well completions. The field of invention further relates to methods of operation of apparatus that provides for the efficient installation of a cemented steel cased well during one single pass down into the earth of the steel drill string. The field of invention further relates to methods of operation of the apparatus that uses the typical mud passages already present in a typical drill bit, including any watercourses in a "regular bit", or mud jets in a "jet bit", that allow mud to circulate during typical drilling operations for the second independent, and the distinctly separate, purpose of passing cement into the annulus between the casing and the well while cementing the drill string into place during one single drilling pass into the earth. The field of invention further relates to apparatus and methods of operation that provides the pumping of cement down the drill string, through the mud passages in the drill bit, and into the annulus between the formation and the drill string for the purpose of cementing the drill string and the drill bit into place during one single drilling pass into the formation. The field of invention further relates to a one-way cement valve and related devices installed near the drill bit of the drill string that allows the cement to set up efficiently while the drill string and drill bit are cemented into place during one single drilling pass into the formation. The field of invention further relates to the use of a slurry material instead of cement to complete wells during the one pass drilling of oil and gas wells, where the term "slurry material" may be any one, or more, of at least the following substances: cement, gravel, water, "cement clinker", a "cement and copolymer mixture", a "blast furnace slag mixture", and/or any mixture thereof; or any known substance that flows under sufficient pressure. The field of invention further relates to the use of slurry materials for the following type of generic well completions: open-hole well completions; typical cemented well completions having perforated casings; gravel well completions having perforated casings; and for any other related well completions. The field of invention also relates to using slurry materials to complete extended reach wellbores and extended reach lateral wellbores. The field of invention also relates to using slurry materials to complete extended reach wellbores and extended reach lateral wellbores from offshore platforms.

The field of the invention further relates to the use of retrievable instrumentation packages to perform LWD/MWD logging and directional drilling functions while the well is being drilled, which are particularly useful for the one pass drilling of oil and gas wells, and which are also useful for standard well completions, and which can also be retrieved by a wireline attached to a Smart Shuttle having retrieval apparatus. The field of the invention further relates to the use of Smart Shuttles having retrieval apparatus that are capable of deploying and installing into pipes smart completion devices that are used to automatically complete oil and gas wells after the pipes are disposed in the wellbore, which are useful for one pass drilling and for standard cased well completions, and these pipes include the following: a drill pipe, a drill string, a casing, a casing string, tubing, a liner, a liner string, a steel pipe, a metallic pipe, or any other pipe used for the completion of oil and gas wells. The field of the invention further relates to Smart Shuttles that use internal pump means to pump fluid from below the Smart Shuttle, to above it, to cause the Smart Shuttle to move within the pipe to conveniently install smart completion devices.

The field of invention disclosed herein also relates to using progressive cavity pumps and electrical submersible motors to make Smart Shuttles. The field of invention further relates to closed-loop systems used to complete oil and gas wells, where the term "to complete a well" means "to finish work on a well and bring it into productive status". In this field of the invention, a closed-loop system to complete an oil and gas well is an automated system under computer control that executes a sequence of programmed steps, but those steps depend in part upon information obtained from at least one downhole sensor that is communicated to the surface to optimize and/or change the steps executed by the computer to complete the well.

The field of invention further relates to a closed-loop system that executes the steps during at least one significant portion of the well completion process and the completed well is comprised of at least a borehole in a geological formation surrounding a pipe located within the borehole, and this pipe may be any one of the following: a metallic pipe; a casing string; a casing string with any retrievable drill bit removed from the wellbore; a casing string with any drilling apparatus removed from the wellbore; a casing string with any electrically operated drilling apparatus retrieved from the wellbore; a casing string with any bicenter bit removed from the wellbore; a steel pipe; an expandable pipe; an expandable pipe made from any material; an expandable metallic pipe; an expandable metallic pipe with any retrievable drill bit removed from the wellbore; an expandable metallic pipe with any drilling apparatus removed from the wellbore; an expandable metallic pipe with any electrically operated drilling apparatus retrieved from the wellbore; an expandable metallic pipe with any bicenter bit removed from the wellbore; a plastic pipe; a fiberglass pipe; any type of composite pipe; any composite pipe that encapsulates insulated wires carrying electricity and/or any tubes containing hydraulic fluid; a composite pipe with any retrievable drill bit removed from the wellbore; a composite pipe with any drilling apparatus removed from the wellbore; a composite pipe with any electrically operated drilling apparatus retrieved from the wellbore; a composite pipe with any bicenter bit removed from the wellbore; a drill string; a drill string possessing a drill bit that remains attached to the end of the drill string after completing the wellbore; a drill string with any retrievable drill bit removed from the wellbore; a drill string with any drilling apparatus removed from the wellbore; a drill string with any electrically operated drilling apparatus retrieved from the wellbore; a drill string with any bicenter bit removed from the wellbore; a coiled tubing; a coiled tubing possessing a mud-motor drilling apparatus that remains attached to the coiled tubing after completing the wellbore; a coiled tubing left in place after any mud-motor drilling apparatus has been removed; a coiled tubing left in place after any electrically operated drilling apparatus has been retrieved from the wellbore; a liner made from any material; a liner with any retrievable drill bit removed from the wellbore; a liner with any liner drilling apparatus removed from the wellbore; a liner with any electrically operated drilling apparatus retrieved from the liner; a liner with any bicenter bit removed from the wellbore; any other pipe made of any material with any type of drilling apparatus removed from the pipe; or any other pipe made of any material with any type of drilling apparatus removed from the wellbore.

The field of invention further relates to a closed-loop system that executes the steps during at least one significant portion of the well completion process and the completed well is comprised of at least a borehole in a geological formation surrounding a pipe that may be accessed through other pipes including surface pipes, production lines, subsea production lines, etc.

Following the closed-loop well completion, the field of invention further relates to using well completion apparatus to monitor and/or control the production of hydrocarbons from the within wellbore.

The field of invention also relates to closed-loop systems to complete oil and gas wells that are useful for the one pass drilling and completion of oil and gas wells.

The field of the invention further relates to the closed-loop control of a tractor deployer that may also be used to complete an oil and gas well.

The invention further relates to the tractor deployer that is used to complete a well, perform production and maintenance services on a well, and to perform enhanced recovery services on a well.

And finally, the invention further relates to the tractor deployer that is connected to surface instrumentation by a substantially neutrally buoyant umbilical made from composite materials.

2. Description of the Prior Art

At the time of the filing of the application herein, the applicant is unaware of any prior art that is particularly relevant to the invention other than that cited in the above defined "related" U.S. Patents, the "related" co-pending U.S. Patent Applications, and the "related" U.S. Disclosure Documents that are specified in the first paragraphs of this application.

SUMMARY OF THE INVENTION

In disclosure of related cases, apparatus and methods of operation of that apparatus are disclosed that allow for cementation of a drill string with attached drill bit into place during one single drilling pass into a geological formation. The process of drilling the well and installing the casing becomes one single process that saves installation time and reduces costs during oil and gas well completion procedures. Apparatus and methods of operation of the apparatus are disclosed that use the typical mud passages already present in a typical rotary drill bit, including any watercourses in a "regular bit", or mud jets in a "jet bit", for the second independent purpose of passing cement into the annulus between the casing and the well while cementing the drill string in place. This is a crucial step that allows a "Typical Drilling Process" involving some 14 steps to be compressed into the "New Drilling Process" that involves only 7 separate steps as described in the Description of the Preferred Embodiments below. The New Drilling Process is now possible because of "Several Recent Changes in the Industry" also described in the Description of the Preferred Embodiments below. In addition, the New Drilling Process also requires new apparatus to properly allow the cement to cure under ambient hydrostatic conditions. That new apparatus includes a Latching Subassembly, a Latching Float Collar Valve Assembly, the Bottom Wiper Plug, and the Top Wiper Plug. Suitable methods of operation are disclosed for the use of the new apparatus. Methods are further disclosed wherein different types of slurry materials are used for well completion that include at least cement, gravel, water, a "cement clinker", and any "blast furnace slag mixture". Methods are further disclosed using a slurry material to complete wells including at least the following: open-hole well completions; cemented well completions having a perforated casing; gravel well completions having perforated casings; extended reach wellbores; extended reach lateral wellbores; and extended reach lateral wellbores completed from offshore drilling platforms.

In yet further disclosure in related cases involving the one pass drilling and completion of wellbores that is also useful for other well completion purposes, Smart Shuttles are used to complete the oil and gas wells. Following drilling operations into a geological formation, a steel pipe is disposed in the wellbore. In the following, any pipe may be used, but an example of steel pipe is used in the following examples for the purposes of simplicity only. The steel pipe may be a standard casing installed into the wellbore using typical industry practices. Alternatively, the steel pipe may be a drill string attached to a rotary drill bit that is to remain in the wellbore following completion during so-called "one pass drilling operations". Further, the steel pipe may be a drill pipe from which has been removed a retrievable or retractable drill bit. Or, the steel pipe may be a coiled tubing having a mud motor drilling apparatus at its end. Using typical procedures in the industry, the well is "completed" by placing into the steel pipe various standard completion devices, some of which are conveyed into place with the drilling rig. Here, instead, Smart Shuttles are used to convey into the steel pipe various smart completion devices used to complete the oil and gas well. The Smart Shuttles are then used to install various smart completion devices. And the Smart Shuttles may be used to retrieve from the wellbore various smart completion devices. Smart Shuttles may be attached to a wireline, coiled tubing, or to a wireline installed within coiled tubing, and such applications are called "tethered Smart Shuttles". Smart Shuttles may be robotically independent of the wireline, etc., provided that large amounts of power are not required for the completion device, and such devices are called "untethered shuttles". The smart completion devices are used in some cases to machine portions of the steel pipe. Completion substances, such as cement, gravel, etc. are introduced into the steel pipe using smart wiper plugs and Smart Shuttles as required. Smart Shuttles may be robotically and automatically controlled from the surface of the earth under computer control so that the completion of a particular oil and gas well proceeds automatically through a progression of steps. A wireline attached to a Smart Shuttle may be used to energize devices from the surface that consume large amounts of power. Pressure control at the surface is maintained by use of a suitable lubricator device that has been modified to have a Smart Shuttle chamber suitably accessible from the floor of the drilling rig. A particular Smart Shuttle of interest is a wireline conveyed Smart Shuttle that possesses an electrically operated internal pump that pumps fluid from below the shuttle to above the shuttle that causes the Smart Shuttle to pump itself down into the well. Suitable valves that open allow for the retrieval of the Smart Shuttle by pulling up on the wireline. Similar comments apply to coiled tubing conveyed Smart Shuttles. Using Smart Shuttles to complete oil and gas wells reduces the amount of time the drilling rig is used for standard completion purposes. The Smart Shuttles therefore allow the use of the drilling rig for its basic purpose—the drilling of oil and gas wells.

In disclosure herein, a closed-loop system is used to complete oil and gas wells. The term "to complete a well" means "to finish work on a well and bring it into productive status". A closed-loop system to complete an oil and gas well is an automated system under computer control that executes a sequence of programmed steps, but those steps depend in part upon information obtained from at least one downhole sensor that is communicated to the surface to optimize and/or change the steps executed by the computer to complete the well. The closed-loop system executes the steps during at least one significant portion of the well completion process. A type of Smart Shuttle comprised of a progressive cavity pump and an electrical submersible motor is particularly useful for such closed-loop systems. The completed well is comprised of at least a borehole in a geological formation surrounding a pipe located within the borehole. The pipe may be a metallic pipe; a casing string; a casing string with any retrievable drill bit removed from the wellbore; a steel pipe; a drill string; a drill string possessing a drill bit that remains attached to the end of the drill string after completing the wellbore; a drill string with any retrievable drill bit removed from the wellbore; a coiled tubing; a coiled tubing possessing a mud-motor drilling apparatus that remains attached to the coiled tubing after completing the wellbore; or a liner. Following the closed-loop well completion, apparatus monitoring the production of hydrocarbons from the within wellbore may be used to control the production of hydrocarbons from the wellbore. The closed-loop completion of oil and gas wells provides apparatus and methods of operation to substantially reduce the number of steps, the complexity, and the cost to complete oil and gas wells.

Accordingly, the closed-loop completion of oil and gas wells is a substantial improvement over present technology in the oil and gas industries.

The closed-loop control of a tractor deployer may also be used to complete an oil and gas well. Tractor deployer is used to complete a well, perform production and maintenance services on a well, and to perform enhanced recovery services on a well. The well servicing tractor deployer may be connected to surface instrumentation by a neutrally buoyant umbilical. Some of these umbilicals are made from composite materials.

DESCRIPTION OF THE PREFERRED EMBODIMENTS

The following disclosure related to FIGS. 1–5 is substantially repeated herein from co-pending Ser. No. 09/295,808. This repeated disclosure related to FIGS. 1–5 is useful information so that the preferred embodiments of the invention herein may be economically described in terms of previous definitions related to those FIGS. 1–5.

In FIGS. 1–5, apparatus and methods of operation of that apparatus are disclosed herein in the preferred embodiments of the invention that allow for cementation of a drill string with attached drill bit into place during one single drilling pass into a geological formation. The method of drilling the well and installing the casing becomes one single process that saves installation time and reduces costs during oil and gas well completion procedures as documented in the following description of the preferred embodiments of the invention. Apparatus and methods of operation of the apparatus are disclosed herein that use the typical mud passages already present in a typical rotary drill bit, including any watercourses in a "regular bit", or mud jets in a "jet bit", for the second independent purpose of passing cement into the annulus between the casing and the well while cementing the drill string in place. Slurry materials may be used for completion purposes in extended lateral wellbores. Therefore, the following text is substantially quoted from co-pending Ser. No. 09/295,808 related to FIGS. 1–5.

Figure 1:
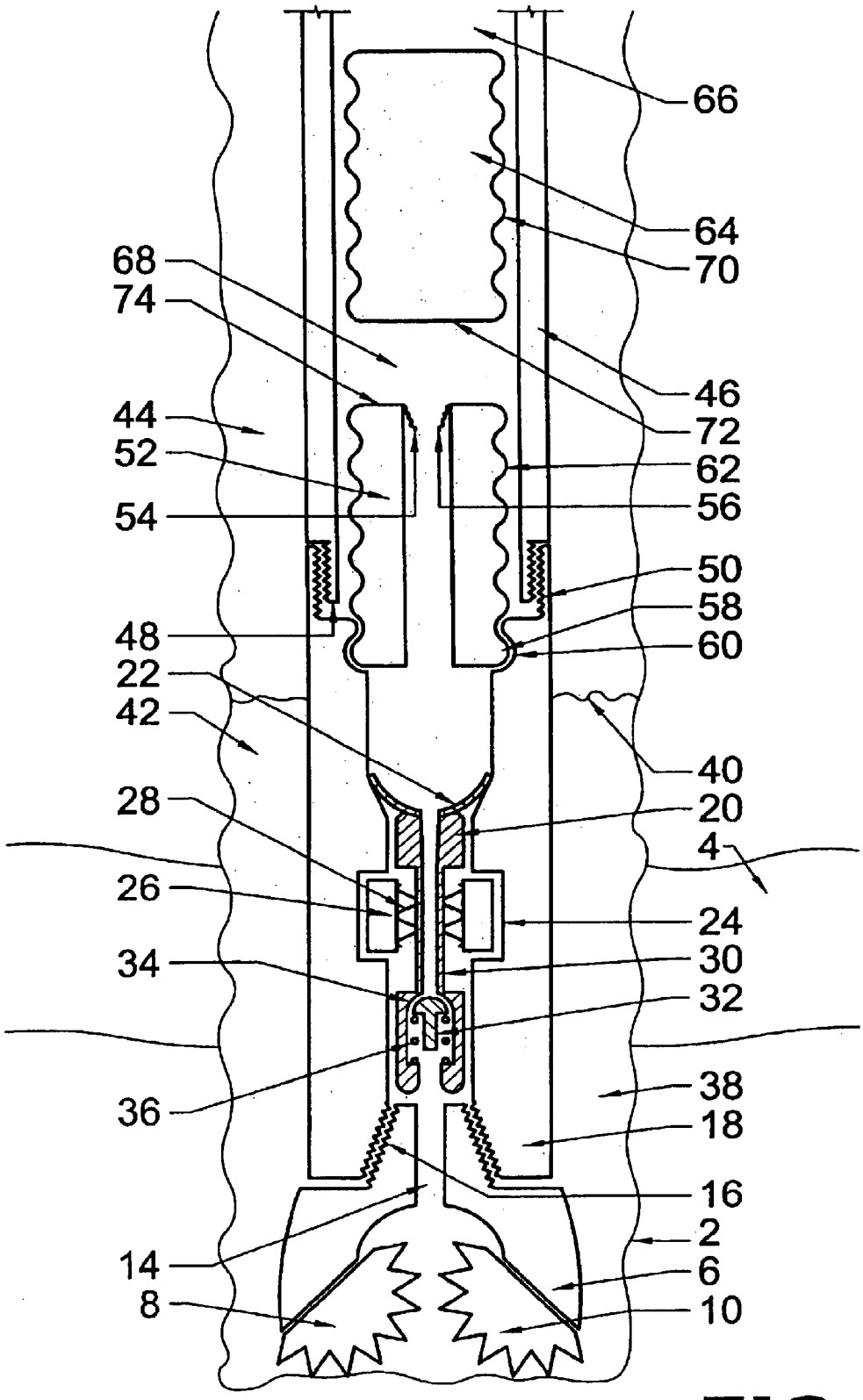
FIG. 1 shows a section view of a rotary drill string having a rotary drill bit in the process of being cemented in place during one drilling pass into formation by using a Latching Float Collar Valve Assembly that has been pumped into place above the rotary drill bit that is a preferred embodiment of the invention.

FIG. 1 shows a section view of a drill string in the process of being cemented in place during one drilling pass into formation. A borehole 2 is drilled though the earth including geological formation 4. The borehole is drilled with a milled tooth rotary drill bit 6 having milled steel roller cones 8, 10, and 12 (not shown for simplicity). A standard water passage 14 is shown through the rotary cone drill bit. This rotary bit could equally be a tungsten carbide insert roller cone bit having jets for waterpassages, the principle of operation and the related apparatus being the same for either case for the preferred embodiment herein.

The threads 16 on rotary drill bit 6 are screwed into the Latching Subassembly 18. The Latching Subassembly is also called the Latching Sub for simplicity herein. The Latching Sub is a relatively thick-walled steel pipe having some functions similar to a standard drill collar.

The Latching Float Collar Valve Assembly 20 is pumped downhole with drilling mud after the depth of the well is reached. The Latching Float Collar Valve Assembly is pumped downhole with mud pressure pushing against the Upper Seal 22 of the Latching Float Collar Valve Assembly. The Latching Float Collar Valve Assembly latches into place into Latch Recession 24. The Latch 26 of the Latching Float Collar Valve Assembly is shown latched into place with Latching Spring 28 pushing against Latching Mandrel 30. When the Latch 26 is properly seated into place within the Latch Recession 24, the clearances and materials of the Latch and mating Latch Recession are to be chosen such that very little cement will leak through the region of the Latch Recession 24 of the Latching Subassembly 18 under any back-pressure (upward pressure) in the well. Many means can be utilized to accomplish this task, including fabricating the Latch 26 from suitable rubber compounds, suitably designing the upper portion of the Latching Float Collar Valve Assembly 20 immediately below the Upper Seal 22, the use of various O-rings within or near Latch Recession 24, etc.

The Float 32 of the Latching Float Collar Valve Assembly seats against the Float Seating Surface 34 under the force from Float Collar Spring 36 that makes a one-way cement valve. However, the pressure applied to the mud or cement from the surface may force open the Float to allow mud or cement to be forced into the annulus generally designated as 38 in FIG. 1. This one-way cement valve is a particular example of "a one-way cement valve means installed near the drill bit" which is a term defined herein. The one-way cement valve means may be installed at any distance from the drill bit but is preferentially installed "near" the drill bit.

FIG. 1 corresponds to the situation where cement is in the process of being forced from the surface through the Latching Float Collar Valve Assembly. In fact, the top level of cement in the well is designated as element 40. Below 40, cement fills the annulus of the borehole. Above 40, mud fills the annulus of the borehole. For example, cement is present at position 42 and drilling mud is present at position 44 in FIG. 1.

Relatively thin-wall casing, or drill pipe, designated as element 46 in FIG. 1, is attached to the Latching Sub. The bottom male threads of the drill pipe 48 are screwed into the female threads 50 of the Latching Sub.

The drilling mud was wiped off the walls of the drill pipe in the well with Bottom Wiper Plug 52. The Bottom Wiper Plug is fabricated from rubber in the shape shown. Portions 54 and 56 of the Upper Seal of the Bottom Wiper Plug are shown in a ruptured condition in FIG. 1. Initially, they sealed the upper portion of the Bottom Wiper Plug. Under pressure from cement, the Bottom Wiper Plug is pumped down into the well until the Lower Lobe of the Bottom Wiper Plug 58 latches into place into Latching Sub Recession 60 in the Latching Sub. After the Bottom Wiper Plug latches into place, the pressure of the cement ruptures The Upper Seal of the Bottom Wiper Plug. A Bottom Wiper Plug Lobe 62 is shown in FIG. 1. Such lobes provide an efficient means to wipe the mud off the walls of the drill pipe while the Bottom Wiper Plug is pumped downhole with cement.

Top Wiper Plug 64 is being pumped downhole by water 66 under pressure in the drill pipe. As the Top Wiper Plug 64 is pumped down under water pressure, the cement remaining in region 68 is forced downward through the Bottom Wiper Plug, through the Latching Float Collar Valve Assembly, through the waterpassages of the drill bit and into the annulus in the well. A Top Wiper Plug Lobe 70 is shown in FIG. 1. Such lobes provide an efficient means to wipe the cement off the walls of the drill pipe while the Top Wiper Plug is pumped downhole with water.

After the Bottom Surface 72 of the Top Wiper Plug is forced into the Top Surface 74 of the Bottom Wiper Plug, almost the entire "cement charge" has been forced into the annulus between the drill pipe and the hole. As pressure is reduced on the water, the Float of the Latching Float Latching Float Collar Valve Assembly seals against the Float Seating Surface 34. As the water pressure is reduced on the inside of the drill pipe, then the cement in the annulus between the drill pipe and the hole can cure under ambient hydrostatic conditions. This procedure herein provides an example of the proper operation of a "one-way cement valve means".

Therefore, the preferred embodiment in FIG. 1 provides apparatus that uses the steel drill string attached to a drilling bit during drilling operations used to drill oil and gas wells for a second purpose as the casing that is cemented in place during typical oil and gas well completions.

The preferred embodiment in FIG. 1 provides apparatus and methods of operation of the apparatus that results in the efficient installation of a cemented steel cased well during one single pass down into the earth of the steel drill string thereby making a steel cased borehole or cased well.

The steps described herein in relation to the preferred embodiment in FIG. 1 provide a method of operation that uses the typical mud passages already present in a typical rotary drill bit, including any watercourses in a "regular bit", or mud jets in a "jet bit", that allow mud to circulate during typical drilling operations for the second independent, and the distinctly separate, purpose of passing cement into the annulus between the casing and the well while cementing the drill string into place during one single pass into the earth.

The preferred embodiment of the invention further provides apparatus and methods of operation that results in the pumping of cement down the drill string, through the mud passages in the drill bit, and into the annulus between the formation and the drill string for the purpose of cementing the drill string and the drill bit into place during one single drilling pass into the formation.

The apparatus described in the preferred embodiment in FIG. 1 also provide a one-way cement valve and related devices installed near the drill bit of the drill string that allows the cement to set up efficiently while the drill string and drill bit are cemented into place during one single drilling pass into the formation.

Methods of operation of apparatus disclosed in FIG. 1 have been disclosed that use the typical mud passages already present in a typical rotary drill bit, including any watercourses in a "regular bit", or mud jets in a "jet bit", for the second independent purpose of passing cement into the annulus between the casing and the well while cementing the drill string in place. This is a crucial step that allows a "Typical Drilling Process" involving some 14 steps to be compressed into the "New Drilling Process" that involves only 7 separate steps as described in detail below. The New Drilling Process is now possible because of "Several Recent Changes in the Industry" also described in detail below.

Typical procedures used in the oil and gas industries to drill and complete wells are well documented. For example, such procedures are documented in the entire "Rotary Drilling Series" published by the Petroleum Extension Service of The University of Texas at Austin, Austin, Tex. that is incorporated herein by reference in its entirety comprised of the following: Unit I—"The Rig and Its Maintenance" (12 Lessons); Unit II—"Normal Drilling Operations" (5 Lessons); Unit III—Nonroutine Rig Operations (4 Lessons); Unit IV—Man Management and Rig Management (1 Lesson); and Unit V—Offshore Technology (9 Lessons). All of the individual Glossaries of all of the above Lessons in their entirety are also explicitly incorporated herein, and all definitions in those Glossaries shall be considered to be explicitly referenced and/or defined herein.

Additional procedures used in the oil and gas industries to drill and complete wells are well documented in the series entitled "Lessons in Well Servicing and Workover" published by the Petroleum Extension Service of The University of Texas at Austin, Austin, Tex. that is incorporated herein by reference in its entirety comprised of all 12 Lessons. All of the individual Glossaries of all of the above Lessons in their entirety are also explicitly incorporated herein, and any and all definitions in those Glossaries shall be considered to be explicitly referenced and/or defined herein.

With reference to typical practices in the oil and gas industries, a typical drilling process may therefore be described in the following.

Typical Drilling Process

From an historical perspective, completing oil and gas wells using rotary drilling techniques have in recent times comprised the following typical steps:

Step 1. With a pile driver or rotary rig, install any necessary conductor pipe on the surface for attachment of the blowout preventer and for mechanical support at the wellhead.

Step 2. Install and cement into place any surface casing necessary to prevent washouts and cave-ins near the surface, and to prevent the contamination of freshwater sands as directed by state and federal regulations.

Step 3. Choose the dimensions of the drill bit to result in the desired sized production well. Begin rotary drilling of the production well with a first drill bit. Simultaneously circulate drilling mud into the well while drilling. Drilling mud is circulated downhole to carry rock chips to the surface, to prevent blowouts, to prevent excessive mud loss into formation, to cool the bit, and to clean the bit. After the first bit wears out, pull the drill string out, change bits, lower the drill string into the well and continue drilling. It should be noted here that each "trip" of the drill bit typically requires many hours of rig time to accomplish the disassembly and reassembly of the drill string, pipe segment by pipe segment. Here, each pipe segment may consist of several pipe joints.

Step 4. Drill the production well using a succession of rotary drill bits attached to the drill string until the hole is drilled to its final depth.

Step 5. After the final depth is reached, pull out the drill string and its attached drill bit.

Step 6. Perform open-hole logging of the geological formations to determine the quantitative amounts of oil and gas present. This typically involves making physical measurements that are used to determine the porosity of the rock, the electrical resistivity of the water present, the electrical resistivity of the rock, the total amounts of oil and gas present, the relative amounts of oil and gas present, and the use of Archie's Equations (or their equivalent representation, or their approximation by other algebraic expressions, or their substitution for similar geophysical analysis). Here, such open-hole physical measurements include electrical measurements, inductive measurements, acoustic measurements, natural gamma ray measurements, neutron measurements, and other types of nuclear measurements, etc. Such measurements may also be used to determine the permeability of the rock. If no oil and gas is present from the analysis of such open-hole logs, an option can be chosen to cement the well shut. If commercial amounts of oil and gas are present, continue the following steps.

Step 7. Typically reassemble the drill bit and the drill string in the well to clean the well after open-hole logging.

Step 8. Pull out the drill string and its attached drill bit.

Step 9. Attach the casing shoe into the bottom male pipe threads of the first length of casing to be installed into the well. This casing shoe may or may not have a one-way valve ("casing shoe valve") installed in its interior to prevent fluids from back-flowing from the well into the casing string.

Step 10. Typically install the float collar onto the top female threads of the first length of casing to be installed into the well which has a one-way valve ("float collar valve") that allows the mud and cement to pass only one way down into the hole thereby preventing any fluids from back-flowing from the well into the casing string. Therefore, a typical installation has a casing shoe attached to the bottom and the float collar valve attached to the top portion of the first length of casing to be lowered into the well. The float collar and the casing shoe are often installed into one assembly for convenience that entirely replace this first length of casing. Please refer to the book entitled "Casing and Cementing", Unit II, Lesson 4, Second Edition, of the Rotary Drilling Series, Petroleum Extension Service, The University of Texas at Austin, Austin, Tex., 1982 (hereinafter defined as "Ref.1", an entire copy of which is incorporated herein by reference. In particular, please refer to pages 28–35 of that book (Ref. 1). All of the individual definitions of words and phrases in the Glossary of Ref. 1 are also explicitly and separately incorporated herein in their entirety by reference.

Step 11. Assemble and lower the production casing into the well while back filling each section of casing with mud as it enters the well to overcome the buoyancy effects of the air filled casing (caused by the presence of the float collar valve), to help avoid sticking problems with the casing, and to prevent the possible collapse of the casing due to accumulated build-up of hydrostatic pressure.

Step 12. To "cure the cement under ambient hydrostatic conditions", typically execute a two-plug cementing procedure involving a first Bottom Wiper Plug before and a second Top Wiper Plug behind the cement that also minimizes cement contamination problems comprised of the following individual steps:

A. Introduce the Bottom Wiper Plug into the interior of the steel casing assembled in the well and pump down with cement that cleans the mud off the walls and separates the mud and cement (Ref. 1, pages 28–35).

B. Introduce the Top Wiper Plug into the interior of the steel casing assembled into the well and pump down with water under pump pressure thereby forcing the cement through the float collar valve and any other one-way valves present (Ref. 1, pages 28–35).

C. After the Bottom Wiper Plug and the Top Wiper Plug have seated in the float collar, release the pump pressure on the water column in the casing that results in the closing of the float collar valve which in turn prevents cement from backing up into the interior of the casing. The resulting interior pressure release on the inside of the casing upon closure of the float collar valve prevents distortions of the casing that might prevent a good cement seal (Ref. 1, page 30). In such circumstances, "the cement is cured under ambient hydrostatic conditions".

Step 13. Allow the cement to cure.

Step 14. Follow normal "final completion operations" that include installing the tubing with packers and perforating the casing near the producing zones. For a description of such normal final completion operations, please refer to the book entitled "Well Completion Methods", Well Servicing and Workover, Lesson 4, from the series entitled "Lessons in Well Servicing and Workover", Petroleum Extension Service, The University of Texas at Austin, Austin, Tex., 1971 (hereinafter defined as "Ref. 2"), an entire copy of which is incorporated herein by reference. All of the individual definitions of words and phrases in the Glossary of Ref. 2 are also explicitly and separately incorporated herein in their entirety by reference. Other methods of completing the well are described therein that shall, for the purposes of this application herein, also be called "final completion operations".

Several Recent Changes in the Industry

Several recent concurrent changes in the industry have made it possible to reduce the number of steps defined above. These changes include the following:

a. Until recently, drill bits typically wore out during drilling operations before the desired depth was reached by the production well. However, certain drill bits have recently been able to drill a hole without having to be changed. For example, please refer to the book entitled "The Bit", Unit I, Lesson 2, Third Edition, of the Rotary Drilling Series, The University of Texas at Austin, Austin, Tex., 1981 (hereinafter defined as "Ref. 311), an entire copy of which is incorporated herein by reference. All of the individual definitions of words and phrases in the Glossary of Ref. 3 are also explicitly and separately incorporated herein in their entirety by reference. On page 1 of Ref. 3 it states: "For example, often only one bit is needed to make a hole in which the casing will be set." On page 12 of Ref. 3 it states in relation to tungsten carbide insert roller cone bits: "Bit runs as long as 300 hours have been achieved; in some instances, only one or two bits have been needed to drill a well to total depth." This is particularly so since the advent of the sealed bearing tri-cone bit designs appeared in 1959 (Ref. 3, page 7) having tungsten carbide inserts (Ref. 3, page 12). Therefore, it is now practical to talk about drill bits lasting long enough for drilling a well during one pass into the formation, or "one pass drilling".

b. Until recently, it has been impossible or impractical to obtain sufficient geophysical information to determine the presence or absence of oil and gas from inside steel pipes in wells. Heretofore, either standard open-hole logging tools or Measurement-While-Drilling ("MWD") tools were used in the open hole to obtain such information. Therefore, the industry has historically used various open-hole tools to measure formation characteristics. However, it has recently become possible to measure the various geophysical quantities listed in Step 6 above from inside steel pipes such as drill strings and casing strings. For example, please refer to the book entitled "Cased Hole Log Interpretation Principles/Applications", Schlumberger Educational Services, Houston, Tex., 1989, an entire copy of which is incorporated herein by reference. Please also refer to the article entitled "Electrical Logging: State-of-the-Art", by Robert E. Maute, The Log Analyst, May–June 1992, pages 206–227, an entire copy of which is incorporated herein by reference.

Because drill bits typically wore out during drilling operations until recently, different types of metal pipes have historically evolved which are attached to drilling bits, which, when assembled, are called "drill strings". Those drill strings are different than typical "casing strings" run into the well. Because it was historically absolutely necessary to do open-hole logging to determine the presence or absence of oil and gas, the fact that different types of pipes were used in "drill strings" and "casing strings" was of little consequence to the economics of completing wells. However, it is possible to choose the "drill string" to be acceptable for a second use, namely as the "casing string" that is to be installed after drilling has been completed.

New Drilling Process

Therefore, the preferred embodiments of the invention herein reduces and simplifies the above 14 steps as follows:

Repeat Steps 1–2 above.

Steps 3–5 (Revised). Choose the drill bit so that the entire production well can be drilled to its final depth using only one single drill bit. Choose the dimensions of the drill bit for desired size of the production well. If the cement is to be cured under ambient hydrostatic conditions, attach the drill bit to the bottom female threads of the Latching Subassembly ("Latching Sub"). Choose the material of the drill string from pipe material that can also be used as the casing string. Here, any pipe made of any material may be used including metallic pipe, composite pipe, fiberglass pipe, and hybrid pipe made of a mixture of different materials, etc. As an example, a composite pipe may be manufactured from carbon fiber-epoxy resin materials. Attach the first section of drill pipe to the top female threads of the Latching Sub. Then rotary drill the production well to its final depth during "one pass drilling" into the well. While drilling, simultaneously circulate drilling mud to carry the rock chips to the surface, to prevent blowouts, to prevent excessive mud loss into formation, to cool the bit, and to clean the bit.

Step 6 (Revised). After the final depth of the production well is reached, perform logging of the geological formations to determine the amount of oil and gas present from inside the drill pipe of the drill string. This typically involves measurements from inside the drill string of the necessary geophysical quantities as summarized in Item "b." of "Several Recent Changes in the Industry". If such logs obtained from inside the drill string show that no oil or gas is present, then the drill string can be pulled out of the well and the well filled in with cement. If commercial amounts of oil and gas are present, continue the following steps.

Steps 7–11 (Revised). If the cement is to be cured under ambient hydrostatic conditions, pump down a Latching Float Collar Valve Assembly with mud until it latches into place in the notches provided in the Latching Sub located above the drill bit.

Steps 12–13 (Revised). To "cure the cement under ambient hydrostatic conditions", typically execute a two-plug cementing procedure involving a first Bottom Wiper Plug before and a second Top Wiper Plug behind the cement that also minimizes cement contamination comprised of the following individual steps:

A. Introduce the Bottom Wiper Plug into the interior of the drill string assembled in the well and pump down with cement that cleans the mud off the walls and separates the mud and cement.

B. Introduce the Top Wiper Plug into the interior of the drill string assembled into the well and pump down with water thereby forcing the cement through any Float Collar Valve Assembly present and through the watercourses in "a regular bit" or through the mud nozzles of a "jet bit" or through any other mud passages in the drill bit into the annulus between the drill string and the formation.

C. After the Bottom Wiper Plug, and Top Wiper Plug have seated in the Latching Float Collar Valve Assembly, release the pressure on the interior of the drill string that results in the closing of the float collar which in turn prevents cement from backing up in the drill string. The resulting pressure release upon closure of the float collar prevents distortions of the drill string that might prevent a good cement seal as described earlier. I.e., "the cement is cured under ambient hydrostatic conditions".

Repeat Step 14 above.

Therefore, the "New Drilling Process" has only 7 distinct steps instead of the 14 steps in the "Typical Drilling Process". The "New Drilling Process" consequently has fewer steps, is easier to implement, and will be less expensive. The "New Drilling Process" takes less time to drill a well. This faster process has considerable commercial significance.

The preferred embodiment of the invention disclosed in FIG. 1 requires a Latching Subassembly and a Latching Float Collar Valve Assembly. An advantage of this approach is that the Float 32 of the Latching Float Collar Valve Assembly and the Float Seating Surface 34 in FIG. 1 are installed at the end of the drilling process and are not subject to any wear by mud passing down during normal drilling operations.

Another preferred embodiment of the invention provides a float and float collar valve assembly permanently installed within the Latching Subassembly at the beginning of the drilling operations. However, such a preferred embodiment has the disadvantage that drilling mud passing by the float and the float collar valve assembly during normal drilling operations could subject the mutually sealing surfaces to potential wear. Nevertheless, a float collar valve assembly can be permanently installed above the drill bit before the drill bit enters the well.

Permanently Installed One-Way Valve

Figure 2:
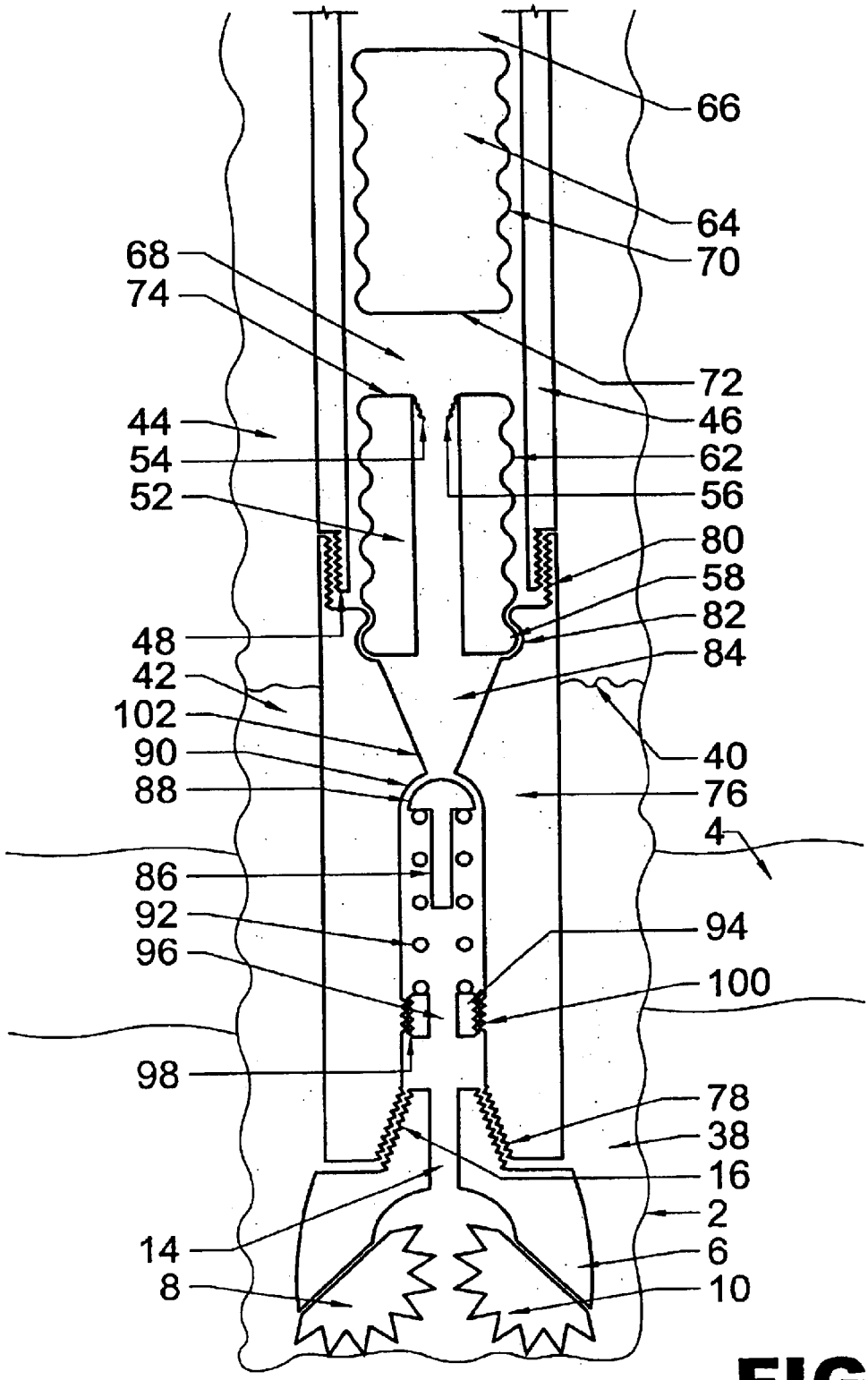
FIG. 2 shows a section view of a rotary drill string having a rotary drill bit in the process of being cemented into place during one drilling pass into formation by using a Permanently Installed Float Collar Valve Assembly that is permanently installed above the rotary drill bit that is a preferred embodiment of the invention.

FIG. 2 shows another preferred embodiment of the invention that has such a float collar valve assembly permanently installed above the drill bit before the drill bit enters the well. FIG. 2 shows many elements common to FIG. 1. The Permanently Installed Float Collar Valve Assembly 76, hereinafter abbreviated as the "PIFCVA", is installed into the drill string on the surface of the earth before the drill bit enters the well. On the surface, the threads 16 on the rotary drill bit 6 are screwed into the lower female threads 78 of the PIFCVA. The bottom male threads of the drill pipe 48 are screwed into the upper female threads 80 of the PIFCVA. The PIFCVA Latching Sub Recession 82 is similar in nature and function to element 60 in FIG. 1. The fluids flowing thorough the standard water passage 14 of the drill bit flow through PIFCVA Guide Channel 84. The PIFCVA Float 86 has a Hardened Hemispherical Surface 88 that seats against the hardened PIFCVA Float Seating Surface 90 under the force PIFCVA Spring 92. Surfaces 88 and 90 may be fabricated from very hard materials such as tungsten carbide. Alternatively, any hardening process in the metallurgical arts may be used to harden the surfaces of standard steel parts to make suitable hardened surfaces 88 and 90. The lower surfaces of the PIFCVA Spring 92 seat against the upper portion of the PIFCVA Threaded Spacer 94 that has PIFCVA Threaded Spacer Passage 96. The PIFCVA Threaded Spacer 94 has exterior threads that thread into internal threads 100 of the PIFCVA (that is assembled into place within the PIFCVA prior to attachment of the drill bit to the PIFCVA). Surface 102 facing the lower portion of the PIFCVA Guide Channel 84 may also be made from hardened materials, or otherwise surface hardened, so as to prevent wear from the mud flowing through this portion of the channel during drilling.

Once the PIFCVA is installed into the drill string, then the drill bit is lowered into the well and drilling commenced. Mud pressure from the surface opens PIFCVA Float 86. The steps for using the preferred embodiment in FIG. 2 are slightly different than using that shown in FIG. 1. Basically, the "Steps 7–11 (Revised)" of the "New Drilling Process" are eliminated because it is not necessary to pump down any type of Latching Float Collar Valve Assembly of the type described in FIG. 1. In "Steps 3–5 (Revised)" of the "New Drilling Process", it is evident that the PIFCVA is installed into the drill string instead of the Latching Subassembly appropriate for FIG. 1. In Steps 12–13 (Revised) of the "New Drilling Process", it is also evident that the Lower Lobe of the Bottom Wiper Plug 58 latches into place into the PIFCVA Latching Sub Recession 82.

The PIFCVA installed into the drill string is another example of a one-way cement valve means installed near the drill bit to be used during one pass drilling of the well. Here, the term "near" shall mean within 500 feet of the drill bit. Consequently, FIG. 2 describes a rotary drilling apparatus to drill a borehole into the earth comprising a drill string attached to a rotary drill bit and one-way cement valve means installed near the drill bit to cement the drill string and rotary drill bit into the earth to make a steel cased well. Here, in this preferred embodiment, the method of drilling the borehole is implemented with a rotary drill bit having mud passages to pass mud into the borehole from within a steel drill string that includes at least one step that passes cement through such mud passages to cement the drill string into place to make a steel cased well.

The drill bits described in FIG. 1 and FIG. 2 are milled steel toothed roller cone bits. However, any rotary bit can be used with the invention. A tungsten carbide insert roller cone bit can be used. Any type of diamond bit or drag bit can be used. The invention may be used with any drill bit described in Ref. 3 above that possesses mud passages, waterpassages, or passages for gas. Any type of rotary drill bit can be used possessing such passageways. Similarly, any type of bit whatsoever that utilizes any fluid or gas that passes through passageways in the bit can be used whether or not the bit rotates.

As another example of " . . . any type of bit whatsoever . . . " described in the previous sentence, a new type of drill bit invented by the inventor of this application can be used for the purposes herein that is disclosed in U.S. Pat. No. 5,615,747, that is entitled "Monolithic Self Sharpening Rotary Drill Bit Having Tungsten Carbide Rods Cast in Steel Alloys", that issued on Apr. 1, 1997 (hereinafter Vail{747}), an entire copy of which is incorporated herein by reference. That new type of drill bit is further described in a Continuing Application of Vail{747} that is now U.S. Pat. No. 5,836,409, that is also entitled "Monolithic Self Sharpening Rotary Drill Bit Having Tungsten Carbide Rods Cast in Steel Alloys", that issued on the date of Nov. 17, 1998 (hereinafter Vail{409}), an entire copy of which is incorporated herein by reference. That new type of drill bit is further described in a Continuation-in-Part Application of Vail{409} that is Ser. No. 09/192,248, that has the filing date of Nov. 16, 1998, that is entitled "Rotary Drill Bit Compensating for Changes in Hardness of Geological Formations", an entire copy of which is incorporated herein by reference. As yet another example of " . . . any type of bit whatsoever . . . " described in the last sentence of the previous paragraph, FIG. 3 shows the use of the invention using coiled-tubing drilling techniques.

Coiled Tubing Drilling

Figure 3:
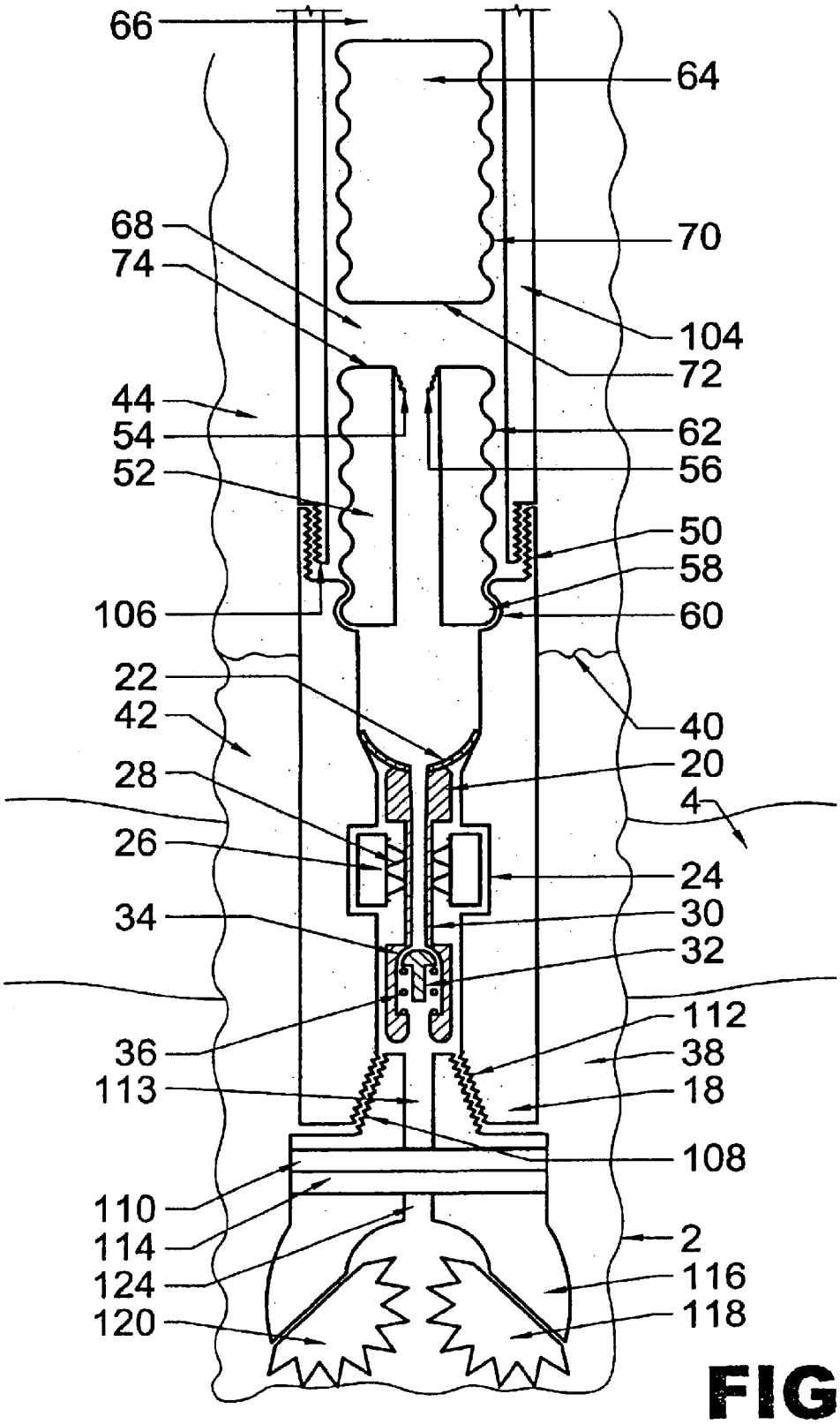
FIG. 3 shows a section view of a tubing conveyed mud motor drilling apparatus in the process of being cemented into place during one drilling pass into formation by using a Latching Float Collar Valve Assembly that has been pumped into place above the mud motor assembly that is a preferred embodiment of the invention.

FIG. 3 shows another preferred embodiment of the invention that is used for certain types of coiled-tubing drilling applications. FIG. 3 shows many elements common to FIG. 1. It is explicitly stated at this point that all the standard coiled-tubing drilling arts now practiced in the industry are incorporated herein by reference. Not shown in FIG. 3 is the coiled tubing drilling rig on the surface of the earth having among other features, the coiled tubing unit, a source of mud, mud pump, etc. In FIG. 3, the well has been drilled.

This well can be: (a) a freshly drilled well; or (b) a well that has been sidetracked to a geological formation from within a casing string that is an existing cased well during standard re-entry applications; or (c) a well that has been sidetracked from within a tubing string that is in turn suspended within a casing string in an existing well during certain other types of re-entry applications. Therefore, regardless of how drilling is initially conducted, in an open hole, or from within a cased well that may or may not have a tubing string, the apparatus shown in FIG. 3 drills a borehole 2 through the earth including through geological formation 4.

Before drilling commences, the lower end of the coiled tubing 104 is attached to the Latching Subassembly 18. The bottom male threads of the coiled tubing 106 thread into the female threads of the Latching Subassembly 50.

The top male threads 108 of the Stationary Mud Motor Assembly 110 are screwed into the lower female threads 112 of Latching Subassembly 18. Mud under pressure flowing through channel 113 causes the Rotating Mud Motor Assembly 114 to rotate in the well. The Rotating Mud Motor Assembly 114 causes the Mud Motor Drill Bit Body 116 to rotate. In a preferred embodiment, elements 110, 114 and 116 are elements comprising a mud-motor drilling apparatus. That Mud Motor Drill Bit Body holds in place milled steel roller cones 118, 120, and 122 (not shown for simplicity). A standard water passage 124 is shown through the Mud Motor Drill Bit Body. During drilling operations, as mud is pumped down from the surface, the Rotating Mud Motor Assembly 114 rotates causing the drilling action in the well. It should be noted that any fluid pumped from the surface under sufficient pressure that passes through channel 113 goes through the mud motor turbine (not shown) that causes the rotation of the Mud Motor Drill Bit Body and then flows through standard water passage 124 and finally into the well.

The steps for using the preferred embodiment in FIG. 3 are slightly different than using that shown in FIG. 1. In drilling an open hole, "Steps 3–5 (Revised)" of the "New Drilling Process" must be revised here to site attachment of the Latching Subassembly to one end of the coiled tubing and to site that standard coiled tubing drilling methods are employed. The coiled tubing can be on the coiled tubing unit at the surface for this step or the tubing can be installed into a wellhead on the surface for this step. In "Step 6 (Revised)" of the "New Drilling Process", measurements are to be performed from within the coiled tubing when it is disposed in the well. In "Steps 12–13 (Revised)" of the "New Drilling Process", the Bottom Wiper Plug and the Top Wiper Plug are introduced into the upper end of the coiled tubing at the surface. The coiled tubing can be on the coiled tubing unit at the surface for these steps or the tubing can be installed into a wellhead on the surface for these steps. In sidetracking from within an existing casing, in addition to the above steps, it is also necessary to lower the coiled tubing drilling apparatus into the cased well and drill through the casing into the adjacent geological formation at some predetermined depth. In sidetracking from within an existing tubing string suspended within an existing casing string, it is also necessary to lower the coiled tubing drilling apparatus into the tubing string and then drill through the tubing string and then drill through the casing into the adjacent geological formation at some predetermined depth.

Therefore, FIG. 3 shows a tubing conveyed mud motor drill bit apparatus to drill a borehole into the earth having a tubing attached to a mud motor driven rotary drill bit. A one-way cement valve means installed above the drill bit is used to cement the drill string and rotary drill bit into the earth to make a tubing encased well. The tubing conveyed mud motor drill bit apparatus is also called a tubing conveyed mud motor drilling apparatus, that is also called a tubing conveyed mud motor driven rotary drill bit apparatus. Put another way, FIG. 3 shows a section view of a coiled tubing conveyed mud motor driven rotary drill bit apparatus in the process of being cemented into place during one drilling pass into formation. This apparatus is cemented into place by using a Latching Float Collar Valve Assembly that has been pumped into place above the rotary drill bit. Methods of operating the tubing conveyed mud motor drilling apparatus in FIG. 3 include a method of drilling a borehole with a coiled tubing conveyed mud motor driven rotary drill bit having mud passages to pass mud into the borehole from within the tubing that includes at least one step that passes cement through the mud passages to cement the tubing into place to make a tubing encased well.

In the "New Drilling Process", Step 14 is to be repeated, and that step is quoted in part in the following paragraph as follows:

> 'Step 14. Follow normal "final completion operations" that include installing the tubing with packers and perforating the casing near the producing zones. For a description of such normal final completion operations, please refer to the book entitled "Well Completion Methods", Well Servicing and Workover, Lesson 4, from the series entitled "Lessons in Well Servicing and Workover", Petroleum Extension Service, The University of Texas at Austin, Austin, Tex., 1971 (hereinafter defined as "Ref. 2"), an entire copy of which is incorporated herein by reference. All of the individual definitions of words and phrases in the Glossary of Ref. 2 are also explicitly and separately incorporated herein in their entirety by reference. Other methods of completing the well are described therein that shall,
>
> for the purposes of this application herein, also be called "final completion operations".'

With reference to the last sentence above, there are indeed many 'Other methods of completing the well that for the purposes of this application herein, also be called "final completion operations"'. For example, Ref. 2 on pages 10–11 describe "Open-Hole Completions". Ref. 2 on pages 13–17 describe "Liner Completions". Ref. 2 on pages 17–30 describe "Perforated Casing Completions" that also includes descriptions of centralizers, squeeze cementing, single zone completions, multiple zone completions, tubingless completions, multiple tubingless completions, and deep well liner completions among other topics.

Similar topics are also discussed in a previously referenced book entitled "Testing and Completing", Unit II, Lesson 5, Second Edition, of the Rotary Drilling Series, Petroleum Extension Service, The University of Texas at Austin, Austin, Tex., 1983 (hereinafter defined as "Ref. 4"), an entire copy of which is incorporated herein by reference. All of the individual definitions of words and phrases in the Glossary of Ref. 1 are also explicitly and separately incorporated herein in their entirety by reference.

For example, on page 20 of Ref. 4, the topic "Completion Design" is discussed. Under this topic are described various different "Completion Methods". Page 21 of Ref. 4 describes "Open-hole completions". Under the topic of "Perforated completion" on pages 20–22, are described both standard cementing completions and gravel completions using slotted liners.

Well Completions with Slurry Materials

Standard cementing completions are described above in the new "New Drilling Process". However, it is evident that any slurry like material or "slurry material" that flows under pressure, and behaves like a multicomponent viscous liquid like material, can be used instead of "cement" in the "New Drilling Process". In particular, instead of "cement", water, gravel, or any other material can be used provided it flows through pipes under suitable pressure.

At this point, it is useful to review several definitions that are routinely used in the industry. First, the glossary of Ref. 4 defines several terms of interest.

The Glossary of Ref. 4 defines the term "to complete a well" to be the following: "to finish work on a well and bring it to productive status. See well completion."

The Glossary of Ref. 4 defines the term "well completion" to be the following: "1. the activities and methods of preparing a well for the production of oil and gas; the method by which one or more flow paths for hydrocarbons is established between the reservoir and the surface. 2. the systems of tubulars, packers, and other tools installed beneath the wellhead in the production casing, that is, the tool assembly that provides the hydrocarbon flow path or paths." To be precise for the purposes herein, the term "completing a well" or the term "completing the well" are each separately equivalent to performing all the necessary steps for a "well completion".

The Glossary of Ref. 4 defines the term "gravel" to be the following: "in gravel packing, sand or glass beads of uniform size and roundness."

The Glossary of Ref. 4 defines the term "gravel packing" to be the following: "a method of well completion in which a slotted or perforated liner, often wire-wrapper, is placed in the well and surrounded by gravel. If open-hole, the well is sometimes enlarged by underreaming at the point were the gravel is packed. The mass of gravel excludes sand from the wellbore but allows continued production."

Other pertinent terms are defined in Ref. 1.

The Glossary of Ref. 1 defines the term "cement" to be the following: "a powder, consisting of alumina, silica, lime, and other substances that hardens when mixed with water. Extensively used in the oil industry to bond casing to walls of the wellbore."

The Glossary of Ref. 1 defines the term "cement clinker" to be the following: "a substance formed by melting ground limestone, clay or shale, and iron ore in a kiln. Cement clinker is ground into a powdery mixture and combined with small accounts of gypsum or other materials to form a cement".

The Glossary of Ref. 1 defines the term "slurry" to be the following: "a plastic mixture of cement and water that is pumped into a well to harden; there it supports the casing and provides a seal in the wellbore to prevent migration of underground fluids."

The Glossary of Ref. 1 defines the term "casing" as is typically used in the oil and gas industries to be the following: "steel pipe placed in an oil or gas well as drilling progresses to prevent the wall of the hole from caving in during drilling, to prevent seepage of fluids, and to provide a means of extracting petroleum if the well is productive". Of course, in light of the invention herein, the "drill pipe, becomes the "casing" . . . so the above definition needs modification under certain usages herein.

U.S. Pat. No. 4,883,125, that issued on Nov. 28, 1994, that is entitled "Cementing Oil and Gas Wells Using Converted Drilling Fluid", an entire copy of which is incorporated herein by reference, describes using "a quantity of drilling fluid mixed with a cement material and a dispersant such as a sulfonated styrene copolymer with or without an organic acid". Such a "cement and copolymer mixture" is yet another example of a "slurry material" for the purposes herein.

U.S. Pat. No. 5,343,951, that issued on Sep. 6, 1994, that is entitled "Drilling and Cementing Slim Hole Wells", an entire copy of which is incorporated herein by reference, describes "a drilling fluid comprising blast furnace slag and water" that is subjected thereafter to an activator that is "generally, an alkaline material and additional blast furnace slag, to produce a cementitious slurry which is passed down a casing and up into an annulus to effect primary cementing." Such an "blast furnace slag mixture" is yet another example of a "slurry material" for the purposes herein.

Therefore, and in summary, a "slurry material", may be any one, or more, of at least the following substances as rigorously defined above: cement, gravel, water, cement clinker, a "slurry" as rigorously defined above, a "cement and copolymer mixture", a "blast furnace slag mixture", and/or any mixture thereof. Virtually any known substance that flows under sufficient pressure may be defined the purposes herein as a " slurry material".

Therefore, in view of the above definitions, it is now evident that the "New Drilling Process" may be performed with any "slurry material". The slurry material may be used in the "New Drilling Process" for open-hole well completions; for typical cemented well completions having perforated casings; and for gravel well completions having perforated casings; and for any other such well completions.

Accordingly, a preferred embodiment of the invention is the method of drilling a borehole with a rotary drill bit having mud passages for passing mud into the borehole from within a steel drill string that includes at least the one step of passing a slurry material through those mud passages for the purpose of completing the well and leaving the drill string in place to make a steel cased well.

Further, another preferred embodiment of the inventions is the method of drilling a borehole into a geological formation with a rotary drill bit having mud passages for passing mud into the borehole from within a steel drill string that includes at least one step of passing a slurry material through the mud passages for the purpose of completing the well and leaving the drill string in place following the well completion to make a steel cased well during one drilling pass into the geological formation.

Yet further, another preferred embodiment of the invention is a method of drilling a borehole with a coiled tubing conveyed mud motor driven rotary drill bit having mud passages for passing mud into the borehole from within the tubing that includes at the least one step of passing a slurry material through the mud passages for the purpose of completing the well and leaving the tubing in place to make a tubing encased well.

And further, yet another preferred embodiment of the invention is a method of drilling a borehole into a geological formation with a coiled tubing conveyed mud motor driven rotary drill bit having mud passages for passing mud into the borehole from within the tubing that includes at least the one step of passing a slurry material through the mud passages for the purpose of completing the well and leaving the tubing in place following the well completion to make a tubing encased well during one drilling pass into the geological formation.

Yet further, another preferred embodiment of the invention is a method of drilling a borehole with a rotary drill bit having mud passages for passing mud into the borehole from within a steel drill string that includes at least steps of: attaching a drill bit to the drill string; drilling the well with the rotary drill bit to a desired depth; and completing the well with the drill bit attached to the drill string to make a steel cased well.

Still further, another preferred embodiment of the invention is a method of drilling a borehole with a coiled tubing conveyed mud motor driven rotary drill bit having mud passages for passing mud into the borehole from within the tubing that includes at least the steps of: attaching the mud motor driven rotary drill bit to the coiled tubing; drilling the well with the tubing conveyed mud motor driven rotary drill bit to a desired depth; and completing the well with the mud motor driven rotary drill bit attached to the drill string to make a steel cased well.

And still further, another preferred embodiment of the invention is the method of one pass drilling of a geological formation of interest to produce hydrocarbons comprising at least the following steps: attaching a drill bit to a casing string; drilling a borehole into the earth to a geological formation of interest; providing a pathway for fluids to enter into the casing from the geological formation of interest; completing the well adjacent to the formation of interest with at least one of cement, gravel, chemical ingredients, mud; and passing the hydrocarbons through the casing to the surface of the earth while the drill bit remains attached to the casing.

The term "extended reach boreholes" is a term often used in the oil and gas industry. For example, this term is used in U.S. Pat. No. 5,343,950, that issued Sep. 6, 1994, having the Assignee of Shell Oil Company, that is entitled "Drilling and Cementing Extended Reach Boreholes". An entire copy of U.S. Pat. No. 5,343,950 is incorporated herein by reference. This term can be applied to very deep wells, but most often is used to describe those wells typically drilled and completed from offshore platforms. To be more explicit, those "extended reach boreholes" that are completed from offshore platforms may also be called for the purposes herein "extended reach lateral boreholes". Often, this particular term, "extended reach lateral boreholes", implies that substantial portions of the wells have been completed in one more or less "horizontal formation". The term "extended reach lateral borehole" is equivalent to the term "extended reach lateral wellbore" for the purposes herein. The term "extended reach borehole" is equivalent to the term "extended reach wellbore" for the purposes herein. The invention herein is particularly useful to drill and complete "extended reach wellbores" and "extend reach lateral wellbores".

Therefore, the preferred embodiments above generally disclose the one pass drilling and completion of wellbores with drill bit attached to drill string to make cased wellbores to produce hydrocarbons. The preferred embodiments above are also particularly useful to drill and complete "extended reach wellbores" and "extended reach lateral wellbores".

Figure 4:
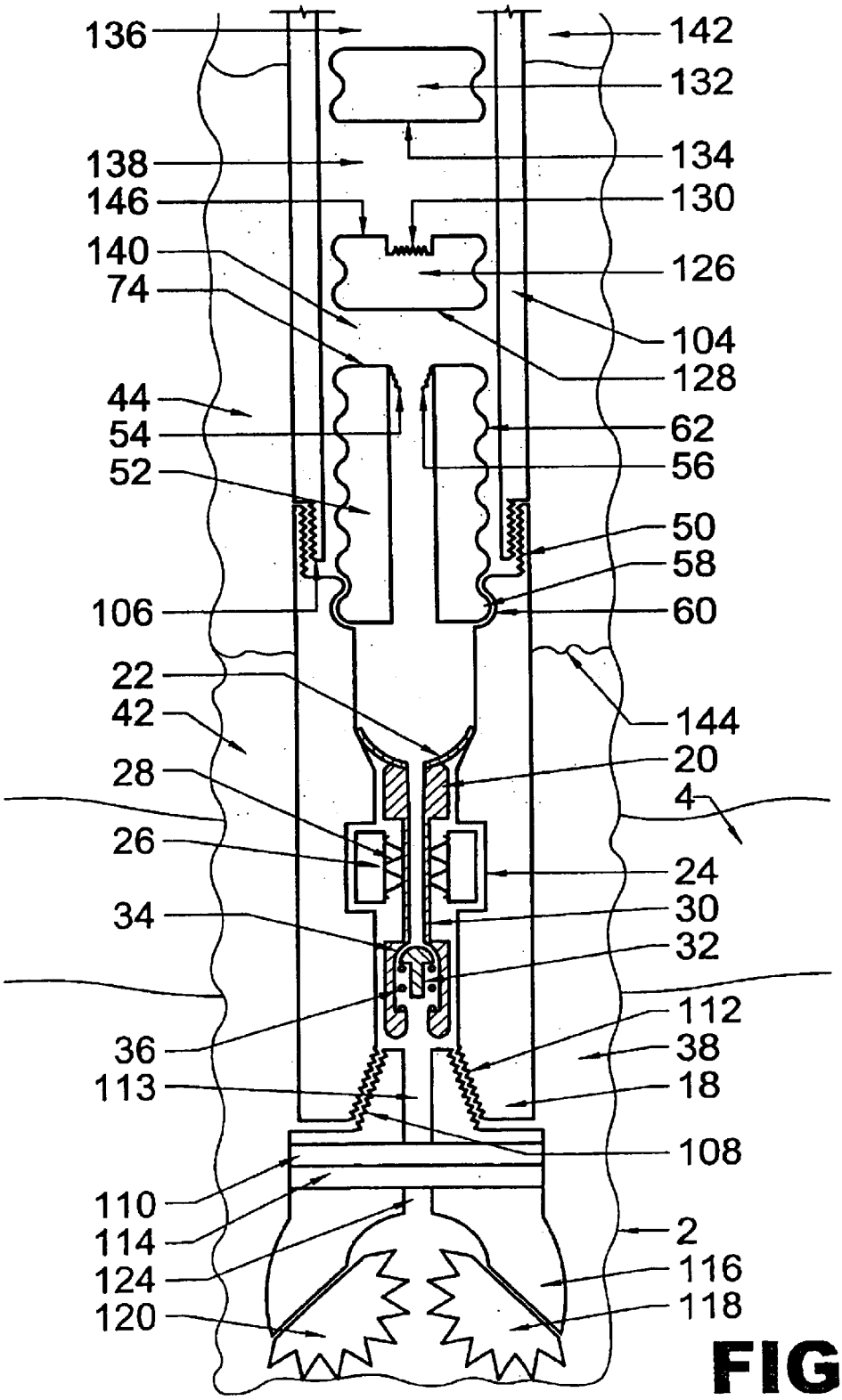
FIG. 4 shows a section view of a tubing conveyed mud motor drilling apparatus that in addition has several wiper plugs in the process of sequentially completing the well with gravel and then with cement during the one pass drilling and completion of the wellbore.

For methods and apparatus particularly suitable for the one pass drilling and completion of extended reach lateral wellbores please refer to FIG. 4. FIG. 4 shows another preferred embodiment of the invention that is closely related to FIG. 3. Those elements numbered in sequence through element number 124 have already been defined previously. In FIG. 4, the previous single "Top Wiper Plug 64" in FIGS. 1, 2, and 3 has been removed, and instead, it has been replaced with two new wiper plugs, respectively called "Wiper Plug A" and "Wiper Plug B". Wiper Plug A is labeled with numeral 126, and Wiper Plug A has a bottom surface that is defined as the Bottom Surface of Wiper Plug A that is numeral 128. The Upper Plug Seal of Wiper Plug A is labeled with numeral 130, and as it is shown in FIG. 4, is not ruptured. The Upper Plug Seal of Wiper Plug A that is numeral 130 functions analogously to elements 54 and 56 of the Upper Seal of the Bottom Wiper Plug 52 that are shown in ruptured conditions in FIGS. 1, 2 and 3.

In FIG. 4, Wiper Plug B is labeled with numeral 132. It has a lower surface that is called the "Bottom Surface of Wiper Plug B" that is labeled with numeral 134. Wiper Plug A and Wiper Plug B are introduced separately into the interior of the tubing to pass multiple slurry materials into the wellbore to complete the well.

Using analogous methods described above in relation to FIGS. 1, 2, and 3, water 136 in the tubing is used to push on Wiper Plug B (element 132), that in turn pushes on cement 138 in the tubing, that in turn is used to push on gravel 140, that in turn pushes on the Float 32, that in turn forces gravel into the wellbore past Float 32, that in turn forces mud 142 upward in the annulus of the wellbore. An explicit boundary between the mud and gravel is shown in the annulus of the wellbore in FIG. 4, and that boundary is labeled with numeral 144.

After the Bottom Surface of Wiper Plug A that is element 128 positively "bottoms out" on the Top Surface 74 of the Bottom Wiper Plug, then a predetermined amount of gravel has been injected into the wellbore forcing mud 142 upward in the annulus. Thereafter, forcing additional water 136 into the tubing will cause the Upper Plug Seal of Wiper Plug A (element 130) to rupture, thereby forcing cement 138 to flow toward the Float 32. Forcing yet additional water 136 into the tubing will in turn cause the Bottom Surface of Wiper Plug B 134 to "bottom out" on the Top Surface of Wiper Plug A that is labeled with numeral 146. At this point in the process, mud has been forced upward in the annulus of wellbore by gravel. The purpose of this process is to have suitable amounts of gravel and cement placed sequentially into the annulus between the wellbore for the completion of the tubing encased well and for the ultimate production of oil and gas from the completed well. This process is particularly useful for the drilling and completion of extended reach lateral wellbores with a tubing conveyed mud motor drilling apparatus to make tubing encased wellbores for the production of oil and gas.

Figure 5:
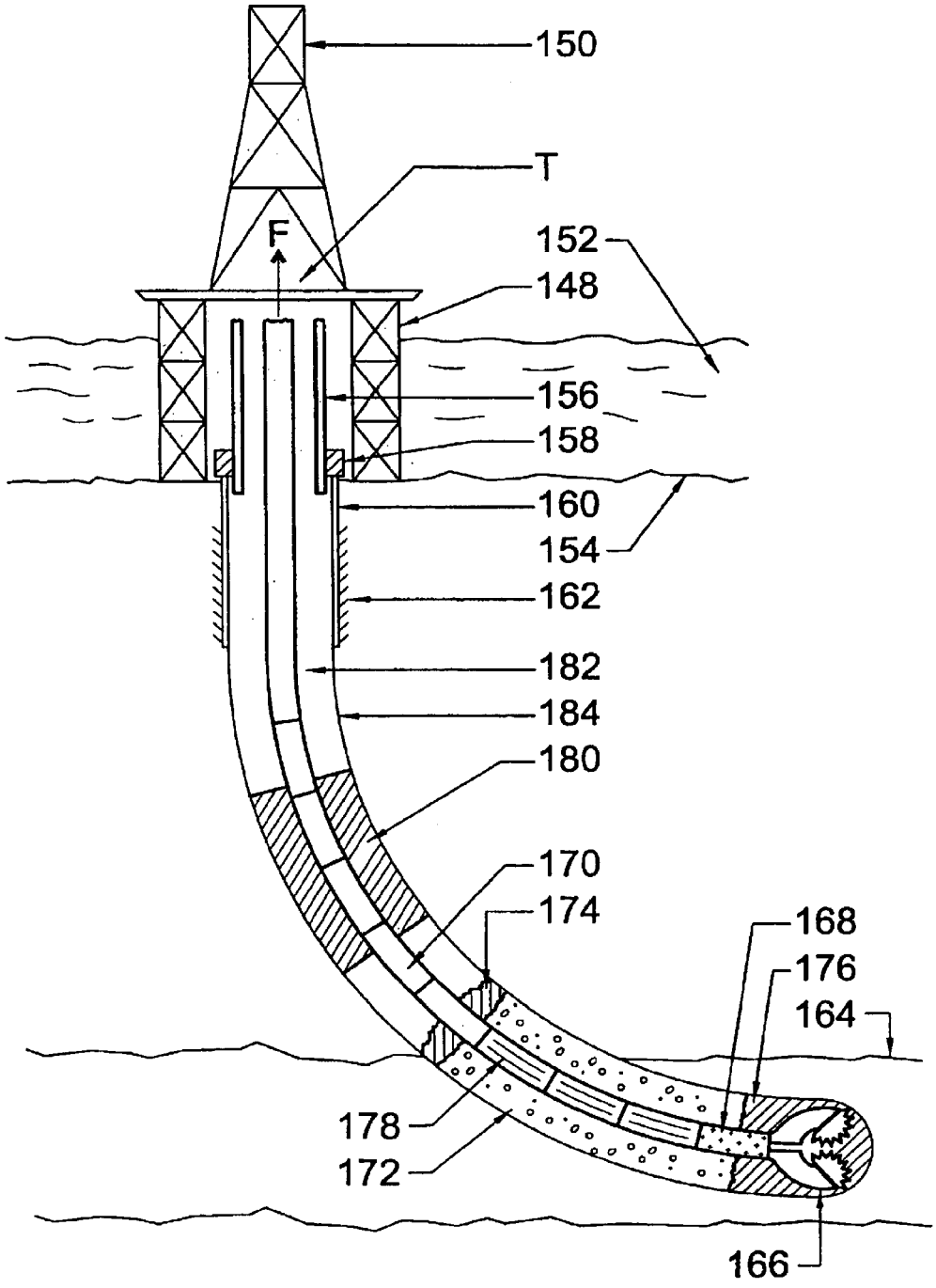
FIG. 5 shows a section view of an apparatus for the one pass drilling and completion of extended reach lateral wellbores with drill bit attached to a rotary drill string to produce hydrocarbons from offshore platforms.

It is clear that FIG. 1 could be modified with suitable Wiper Plugs A and B as described above in relation to FIG. 4. Put simply, in light of the disclosure above, FIG. 4 could be suitably altered to show a rotary drill bit attached to lengths of casing. However, in an effort to be brief, that detail will not be further described. Instead, FIG. 5 shows one "snapshot" in the one pass drilling and completion of an extended reach lateral wellbore with drill bit attached to the drill string that is used to produce hydrocarbons from offshore platforms. This figure was substantially disclosed in U.S. Disclosure Document No. 452648 that was filed on Mar. 5, 1999.

Extended Reach Lateral Wellbores

In FIG. 5, An offshore platform 148 has a rotary drilling rig 150 surrounded by ocean 152 that is attached to the bottom of the sea 154. Riser 156 is attached to blow-out preventer 158. Surface casing 160 is cemented into place with cement 162. Other conductor pipe, surface casing, intermediate casings, liner strings, or other pipes may be present, but are not shown for simplicity. The drilling rig 150 has all typical components of a normal drilling rig as defined in the figure entitled "The Rig and its Components" opposite of page 1 of the book entitled "The Rotary Rig and Its Components", Third Edition, Unit I, Lesson 1, that is part of the "Rotary Drilling Series" published by the Petroleum Extension Service, Division of Continuing Education, The University of Texas at Austin, Austin, Tex., 1980, 39 pages, and entire copy of which is incorporated herein by reference.

FIG. 5 shows that oil bearing formation 164 has been drilled into with rotary drill bit 166. Drill bit 166 is attached to a "Completion Sub" having the appropriate float collar valve assembly, or other suitable float collar device, or which has one or more suitable latch recessions such as element 24 in FIG. 1 for the purposes previously described, and which has other suitable completion devices as required that are shown in FIGS. 1, 2, 3, and 4. That "Completion Sub" is labeled with numeral 168 in FIG. 5. Completion Sub 168 is in turn attached to many lengths of drill pipe, one of which is labeled with numeral 170 in FIG. 5. The drill pipe is supported by usual drilling apparatus provided by the drilling rig. Such drilling apparatus provides an upward force at the surface labeled with legend "F" in FIG. 5, and the drill string is turned with torque provided by the drilling apparatus of the drilling rig, and that torque is figuratively labeled with the legend "T" in FIG. 5.

The previously described methods and apparatus were used to first, in sequence, force gravel 172 in the portion of the oil bearing formation 164 having producible hydrocarbons. If required, a cement plug formed by a "squeeze job" is figuratively shown by numeral 174 in FIG. 5 to prevent contamination of the gravel. Alternatively, an external casing packer, or other types of controllable packer means may be used for such purposes as previously disclosed by applicant in U.S. Disclosure Document No. 445686, filed on Oct. 11, 1998. Yet further, the cement plug 174 can be pumped into place ahead of the gravel using the above procedures using yet another wiper plug as may be required.

The cement 176 introduced into the borehole through the mud passages of the drill bit using the above defined methods and apparatus provides a seal near the drill bit, among other locations, that is desirable under certain situations.

Slots in the drill pipe have been opened after the drill pipe reached final depth. The slots can be milled with a special milling cutter having thin rotating blades that are pushed against the inside of the pipe. As an alternative, standard perforations may be fabricated in the pipe using standard perforation guns of the type typically used in the industry. Yet further, special types of expandable pipe may be manufactured that when pressurized from the inside against a cement plug near the drill bit or against a solid strong wiper plug, or against a bridge plug, suitable slots are forced open. Or, different materials may be used in solid slots along the length of steel pipe when the pipe is fabricated that can be etched out with acid during the well completion process to make the slots and otherwise leaving the remaining steel pipe in place. Accordingly, there are many ways to make the required slots. One such slot is labeled with numeral 178 in FIG. 5, and there are many such slots.

Therefore, hydrocarbons in zone 164 are produced through gravel 172 that flows through slots 178 and into the interior of the drill pipe to implement the one pass drilling and completion of an extended reach lateral wellbore with drill bit attached to drill string to produce hydrocarbons from an offshore platform. For the purposes of this preferred embodiment, such a completion is called a "gravel pack" completion, whether or not cement 174 or cement 176 are introduced into the wellbore.

It should be noted that in some embodiments, cement is not necessarily needed, and the formations may be "gravel pack" completed, or may be open-hole completed. In some situations, the float, or the one-way valve, need not be required depending upon the pressures in the formation.

FIG. 5 also shows a zone that has been cemented shut with a "squeeze job", a term known in the industry representing perforating and then forcing cement into the annulus using suitable packers in order to cement certain formations. This particular cement introduced into the annulus of the wellbore in FIG. 5 is shown as element 180. Such additional cementations may be needed to isolate certain formations as is typically done in the industry. As a final comment, the annulus 182 of the open hole 184 may otherwise be completed using typical well completion procedures in the oil and gas industries.

Therefore, FIG. 5 and the above description discloses a preferred method of drilling an extended reach lateral wellbore from an offshore platform with a rotary drill bit having mud passages for passing mud into the borehole from within a steel drill string that includes at least one step of passing a slurry material through the mud passages for the purpose of completing the well and leaving the drill string in place to make a steel cased well to produce hydrocarbons from the offshore platform. As stated before, the term "slurry material" may be any one, or more, of at least the following substances: cement, gravel, water, "cement clinker", a "cement and copolymer mixture", a "blast furnace slag mixture", and/or any mixture thereof; or any known substance that flows under sufficient pressure.

Further, the above provides disclosure of a method of drilling an extended reach lateral wellbore from an offshore platform with a rotary drill bit having mud passages for passing mud into the borehole from within a steel drill string that includes at least the steps of passing sequentially in order a first slurry material and then a second slurry material through the mud passages for the purpose of completing the well and leaving the drill string in place to make a steel cased well to produce hydrocarbons from offshore platforms.

Yet another preferred embodiment of the invention provides a method of drilling an extended reach lateral wellbore from an offshore platform with a rotary drill bit having mud passages for passing mud into the borehole from within a steel drill string that includes at least the step of passing a multiplicity of slurry materials through the mud passages for the purpose of completing the well and leaving the drill string in place to make a steel cased well to produce hydrocarbons from the offshore platform.

It is evident from the disclosure in FIGS. 3 and 4, that a tubing conveyed mud motor drilling apparatus may replace the rotary drilling apparatus in FIG. 5. Consequently, the above has provided another preferred embodiment of the invention that discloses the method of drilling an extended reach lateral wellbore from an offshore platform with a coiled tubing conveyed mud motor driven rotary drill bit having mud passages for passing mud into the borehole from within the tubing that includes at least one step of passing a slurry material through the mud passages for the purpose of completing the well and leaving the tubing in place to make a tubing encased well to produce hydrocarbons from the offshore platform.

And yet further, another preferred embodiment of the invention provides a method of drilling an extended reach lateral wellbore from an offshore platform with a coiled tubing conveyed mud motor driven rotary drill bit having mud passages for passing mud into the borehole from within the tubing that includes at least the steps of passing sequentially in order a first slurry material and then a second slurry material through the mud passages for the purpose of completing the well and leaving the tubing in place to make a tubing encased well to produce hydrocarbons from the offshore platform.

And yet another preferred embodiment of the invention discloses passing a multiplicity of slurry materials through the mud passages of the tubing conveyed mud motor driven rotary drill bit to make a tubing encased well to produce hydrocarbons from the offshore platform.

For the purposes of this disclosure, any reference cited above is incorporated herein in its entirely by reference herein. Further, any document, article, or book cited in any such above defined reference is also incorporated herein in its entirety by reference herein.

It should also be stated that the invention pertains to any type of drill bit having any conceivable type of passage way for mud that is attached to any conceivable type of drill pipe that drills to a depth in a geological formation wherein the drill bit is thereafter left at the depth when the drilling stops and the well is completed. Any type of drilling apparatus that has at least one passage way for mud that is attached to any type of drill pipe is also an embodiment of this invention, where the drilling apparatus specifically includes any type of rotary drill bit, any type of mud driven drill bit, any type of hydraulically activated drill bit, or any type of electrically energized drill bit, or any drill bit that is any combination of the above. Any type of drilling apparatus that has at least one passage way for mud that is attached to any type of casing is also an embodiment of this invention, and this includes any metallic casing, any composite casing, and any plastic casing. Any type of drill bit attached to any type of drill pipe, or pipe, made from any material is an embodiment of this invention, where such pipe includes a metallic pipe; a casing string; a casing string with any retrievable drill bit removed from the wellbore; a casing string with any drilling apparatus removed from the wellbore; a casing string with any electrically operated drilling apparatus retrieved from the wellbore; a casing string with any bicenter bit removed from the wellbore; a steel pipe; an expandable pipe; an expandable pipe made from any material; an expandable metallic pipe; an expandable metallic pipe with any retrievable drill bit removed from the wellbore; an expandable metallic pipe with any drilling apparatus removed from the wellbore; an expandable metallic pipe with any electrically operated drilling apparatus retrieved from the wellbore; an expandable metallic pipe with any bicenter bit removed from the wellbore; a plastic pipe; a fiberglass pipe; any type of composite pipe; any composite pipe that encapsulates insulated wires carrying electricity and/or any tubes containing hydraulic fluid; a composite pipe with any retrievable drill bit removed from the wellbore; a composite pipe with any drilling apparatus removed from the wellbore; a composite pipe with any electrically operated drilling apparatus retrieved from the wellbore; a composite pipe with any bicenter bit removed from the wellbore; a drill string; a drill string possessing a drill bit that remains attached to the end of the drill string after completing the wellbore; a drill string with any retrievable drill bit removed from the wellbore; a drill string with any drilling apparatus removed from the wellbore; a drill string with any electrically operated drilling apparatus retrieved from the wellbore; a drill string with any bicenter bit removed from the wellbore; a coiled tubing; a coiled tubing possessing a mud-motor drilling apparatus that remains attached to the coiled tubing after completing the wellbore; a coiled tubing left in place after any mud-motor drilling apparatus has been removed; a coiled tubing left in place after any electrically operated drilling apparatus has been retrieved from the wellbore; a liner made from any material; a liner with any retrievable drill bit removed from the wellbore; a liner with any liner drilling apparatus removed from the wellbore; a liner with any electrically operated drilling apparatus retrieved from the liner; a liner with any bicenter bit removed from the wellbore; any other pipe made of any material with any type of drilling apparatus removed from the pipe; or any other pipe made of any material with any type of drilling apparatus removed from the wellbore. Any drill bit attached to any drill pipe that remains at depth following well completion is further an embodiment of this invention, and this specifically includes any retractable type drill bit, or retrievable type drill bit, that because of failure, or choice, remains attached to the drill string when the well is completed.

Figure 16:
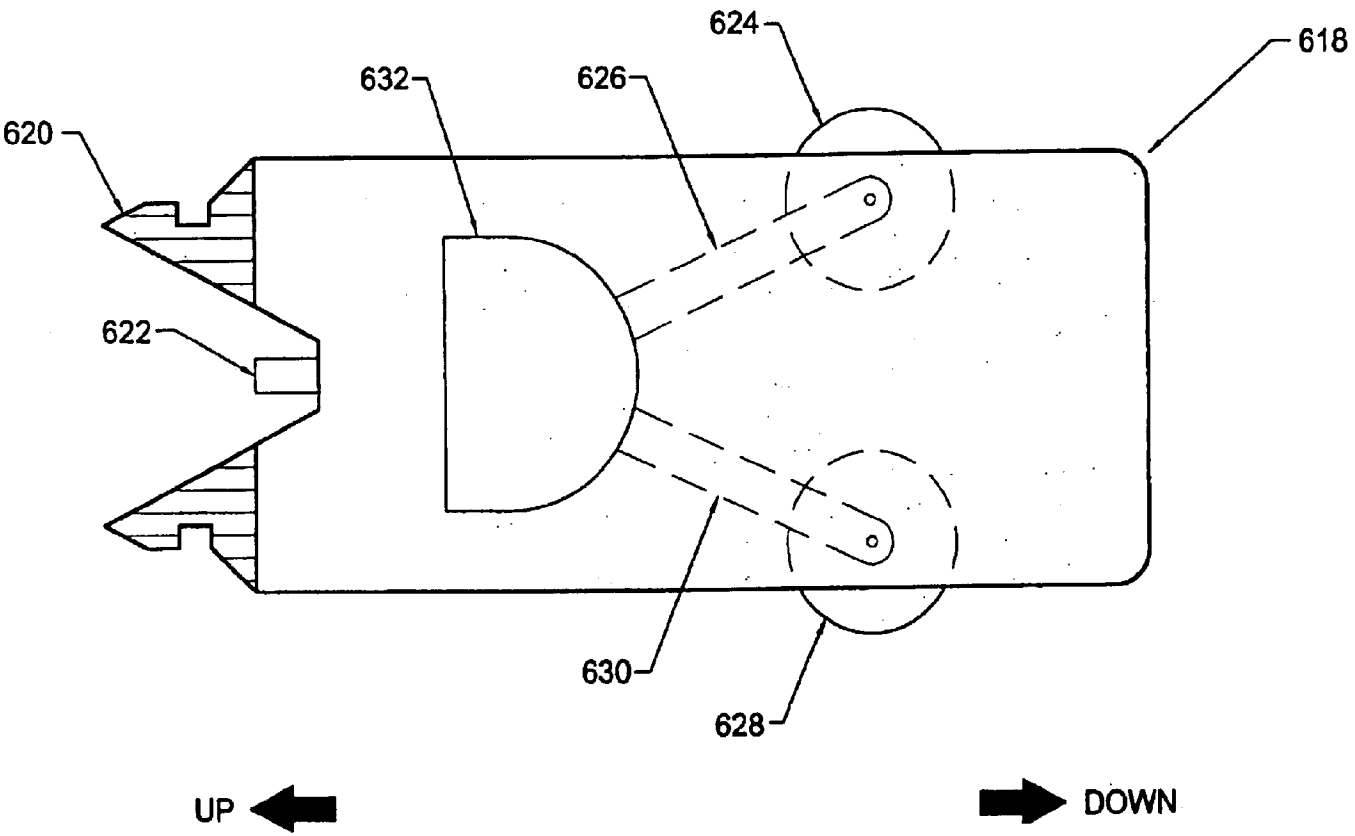
FIG. 16 shows a section view of the Casing Saw that can be attached to the Retrieval Sub and conveyed downhole with the Smart Shuttle.
Figure 17:
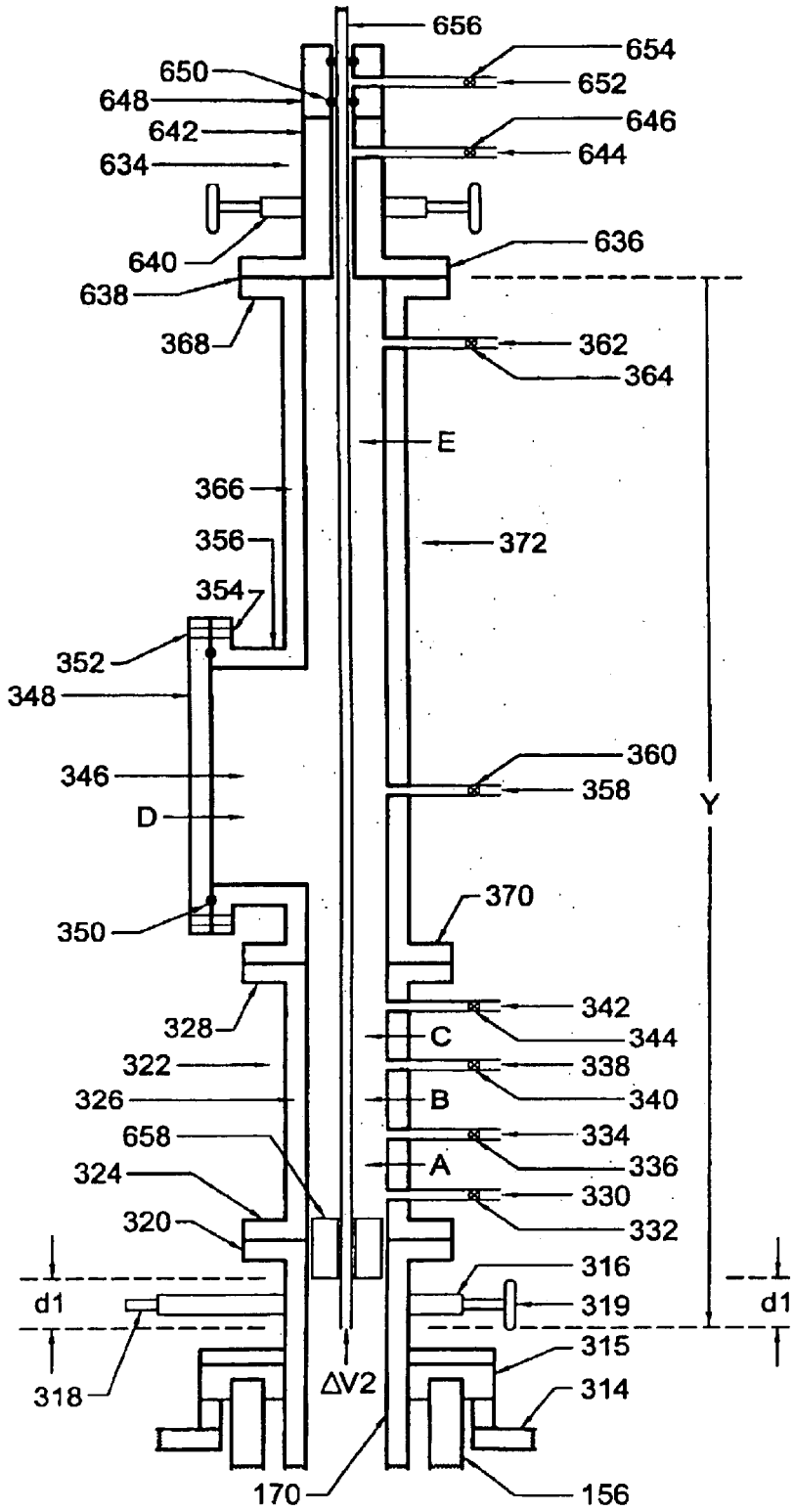
FIG. 17 shows a section view of the wellhead, the Wiper Plug Pump-Down Stack, the Smart Shuttle Chamber, the Coiled Tubing Lubricator System, and the pump-down single zone packer apparatus suspended by the coiled tubing in the well before commencing the final single-zone completion of the well which in this case pertains to the one pass drilling and completion of wellbores, but that is also useful for standard cased well completions.
Figure 17A:
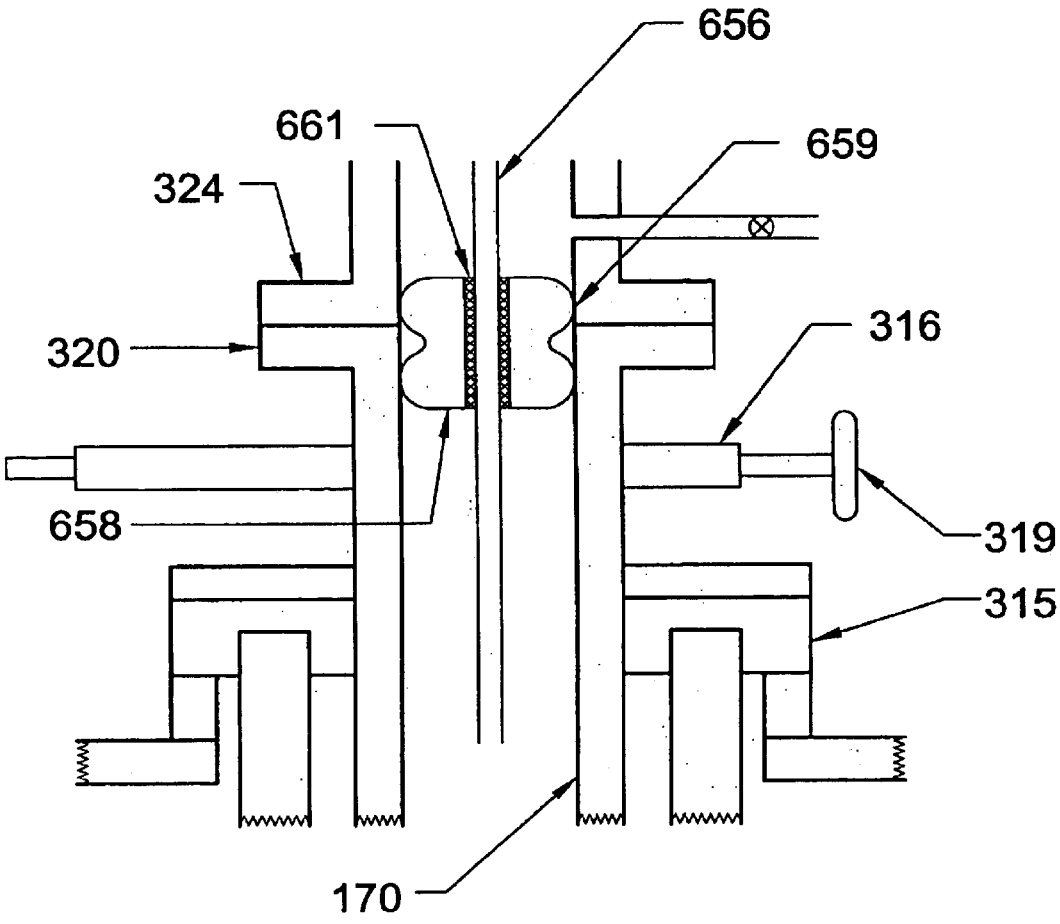
FIG. 17A shows an expanded view of the pump-down single zone packer apparatus that is shown in FIG. 17.

As had been referenced earlier, the above disclosure related to FIGS. 1–5 had been substantially repeated herein from co-pending Ser. No. 09/295,808, and this disclosure is used so that the new preferred embodiments of the invention can be economically described in terms of those figures. It should also be noted that the following disclosure related to FIGS. 6, 7, 8, 9, 10, 11, 12, 13, 14, 15, 16, 17, and 18 is also substantially repeated herein from co-pending Ser. No. 09/375,479. However, FIGS. 17A and 18A are figures that did not appear in Ser. No. 09/375,479. FIGS. 19–26 have not appeared in any previous U.S. patent application although various embodiments have appeared in relevant U.S. Disclosure Documents.

Before describing those new features, perhaps a bit of nomenclature should be discussed at this point. In various descriptions of preferred embodiments herein described, inventor frequently uses the designation of "one pass drilling", that is also called "One-Trip-Drilling" for the purposes herein, and otherwise also called "One-Trip-Down-Drilling" for the purposes herein. For the purposes herein, a first definition of the phrases "one pass drilling", "One-Trip-Drilling", and "One-Trip-Down-Drilling" mean the process that results in the last long piece of pipe put in the wellbore to which a drill bit is attached is left in place after total depth is reached, and is completed in place, and oil and gas is ultimately produced from within the wellbore through that long piece of pipe. Of course, other pipes, including risers, conductor pipes, surface casings, intermediate casings, etc., may be present, but the last very long pipe attached to the drill bit that reaches the final depth is left in place and the well is completed using this first definition. This process is directed at dramatically reducing the number of steps to drill and complete oil and gas wells.

Figure 6:
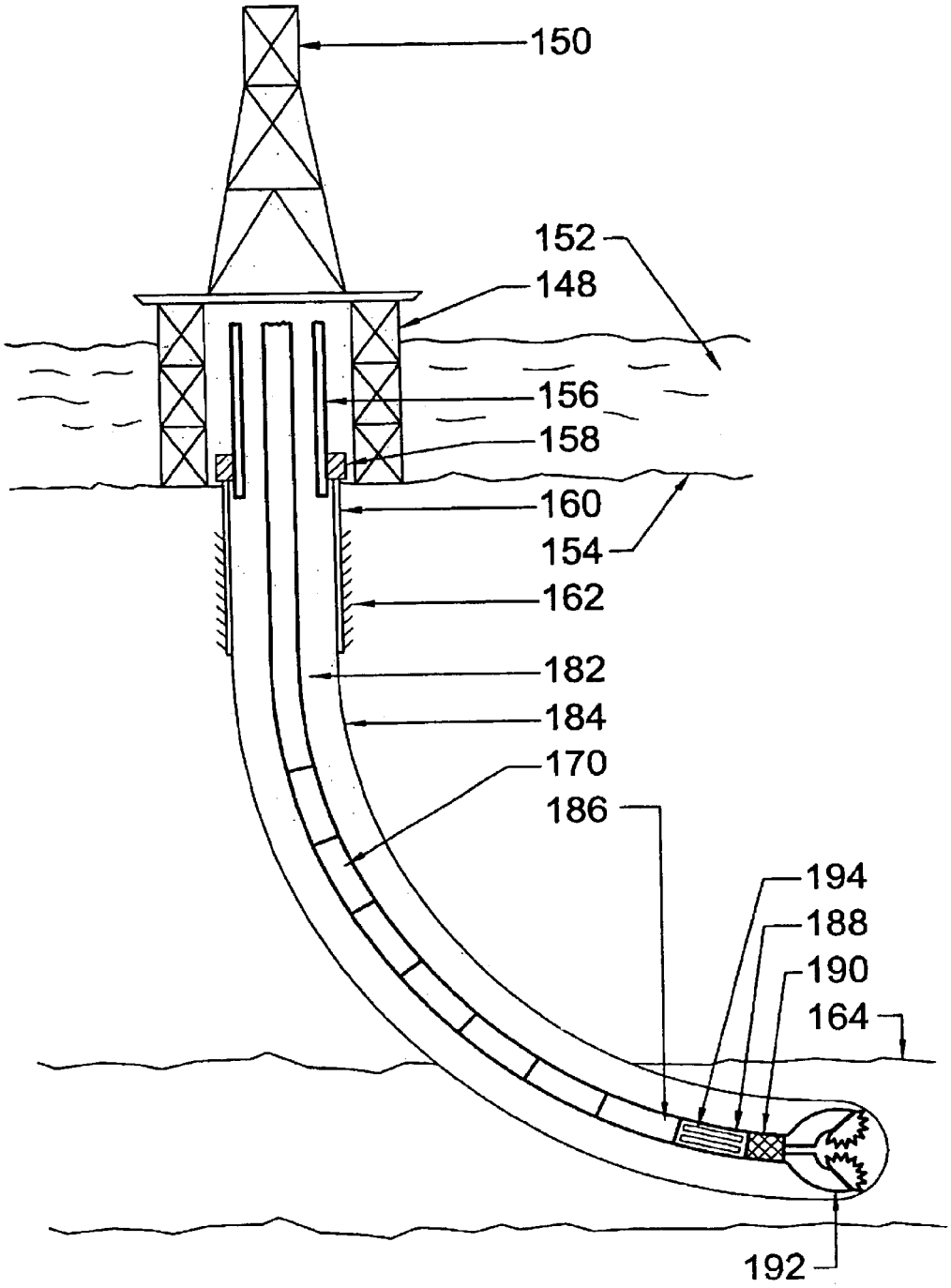
FIG. 6 shows a section view of a embodiment of the invention that is particularly configured so that Measurement-While-Drilling (MWD) and Logging-While-Drilling (LWD) can be done during rotary drilling operations with a Retrievable Instrumentation Package installed in place within a Smart Drilling and Completion Sub near the drill bit which is useful for the one pass drilling and completion of wellbores and which is also useful for standard well drilling procedures.

Please note that several steps in the One-Trip-Down-Drilling process had already been finished in FIG. 5. However, it is instructive to take a look at one preferred method of well completion that leads to the configuration in FIG. 5. FIG. 6 shows one of the earlier steps in that preferred embodiment of well completion that leads to the configuration shown in FIG. 5. Further, FIG. 6 shows an embodiment of the invention that may be used with MWD/LWD measurements as described below.

Retrievable Instrumentation Packages

FIG. 6 shows an embodiment of the invention that is particularly configured so that Measurement-While-Drilling (MWD) and Logging-While-Drilling (LWD) can be done during the drilling operations, but that following drilling operations employing MWD/LWD measurements, Smart Shuttles may be used thereafter to complete oil and gas production from the offshore platform using procedures and apparatus described in the following. Numerals 150 through 184 had been previously described in relation to FIG. 5. In addition in FIG. 6, the last section of standard drill pipe 186 is connected by threaded means to Smart Drilling and Completion Sub 188, that in turn is connected by threaded means to Bit Adaptor Sub 190, that is in turn connected by threaded means to rotary drill bit 192. As an option, this drill bit may be chosen by the operator to be a "Smart Bit" as described in the following.

The Smart Drilling and Completion Sub has provisions for many features. Many of these features are optional, so that some or all of them may be used during the drilling and completion of any one well. Many of those features are described in detail in U.S. Disclosure Document No. 452648 filed on Mar. 5, 1999 that has been previously recited above. In particular, that U.S. Disclosure Document discloses the utility of "Retrievable Instrumentation Packages" that is described in detail in FIGS. 7 and 7A therein. Specifically, the preferred embodiment herein provides Smart Drilling and Completion Sub 188 that in turn surrounds the Retrievable Instrumentation Package 194 as shown in FIG. 6.

As described in U.S. Disclosure Document No. 452648, to maximize the drilling distance of extended reach lateral drilling, a preferred embodiment of the invention possess the option to have means to perform measurements with sensors to sense drilling parameters, such as vibration, temperature, and lubrication flow in the drill bit—to name just a few. The sensors may be put in the drill bit 192, and if any such sensors are present, the bit is called a "Smart Bit" for the purposes herein. Suitable sensors to measure particular drilling parameters, particularly vibration, may also be placed in the Retrievable Instrumentation Package 194 in FIG. 6. So, the Retrievable Instrumentation Package 194 may have "drilling monitoring instrumentation" that is an example of "drilling monitoring instrumentation means".

Any such measured information in FIG. 6 can be transmitted to the surface. This can be done directly from the drill bit, or directly from any locations in the drill string having suitable electronic receivers and transmitters ("repeaters"). As a particular example, the measured information may be relayed from the Smart Bit to the Retrievable Instrumentation Package for final transmission to the surface. Any measured information in the Retrievable Instrumentation Package is also sent to the surface from its transmitter. As set forth in the above U.S. Disclosure Documents No. 452648, an actuator in the drill bit in certain embodiments of the invention can be controlled from the surface that is another optional feature of Smart Bit 192 in FIG. 6. If such an actuator is in the drill bit, and/or if the drill bit has any type communication means, then the bit is also called a Smart Bit for the purposes herein. As various options, commands could be sent directly to the drill bit from the surface or may be relayed from the Retrievable Instrumentation Package to the drill bit. Therefore, the Retrievable Instrumentation Package may have "drill bit control instrumentation" that is an example of a "drill bit control instrumentation means" which is used to control such actuators in the drill bit.

In one preferred embodiment of the invention, commands sent to any Smart Bit to change the configuration of the drill bit to optimize drilling parameters in FIG. 6 are sent from the surface to the Retrievable Instrumentation Package using a "first communication channel" which are in turn relayed by repeater means to the rotary drill bit 192 that itself in this case is a "Smart Bit" using a "second communications channel". Any other additional commands sent from the surface to the Retrievable Instrumentation Package could also be sent in that "first communications channel". As another preferred embodiment of the invention, information sent from any Smart Bit that provides measurements during drilling to optimize drilling parameters can be sent from the Smart Bit to the Retrievable Instrumentation Package using a "third communications channel", which are in turn relayed to the surface from the Retrievable Instrumentation Package using a "fourth communication channel". Any other information measured by the Retrievable Instrumentation Package such as directional drilling information and/or information from MWD/LWD measurements would also be added to that fourth communications channel for simplicity. Ideally, the first, second, third, and fourth communications channels can send information in real time simultaneously. Means to send information includes acoustic modulation means, electromagnetic means, etc., that includes any means typically used in the industry suitably adapted to make the first, second, third, and fourth communications channels. In principle, any number of communications channels "N" can be used, all of which can be designed to function simultaneously. The above is one description of a "communications instrumentation". Therefore, the Retrievable Instrumentation Package has "communications instrumentation" that is an example of "communications instrumentation means".

In a preferred embodiment of the invention the Retrievable Instrumentation package includes a "directional assembly" meaning that it possesses means to determine precisely the depth, orientation, and all typically required information about the location of the drill bit and the drill string during drilling operations. The "directional assembly" may include accelerometers, magnetometers, gravitational measurement devices, or any other means to determine the depth, orientation, and all other information that has been obtained during typical drilling operations. In principle this directional package can be put in many locations in the drill string, but in a preferred embodiment of the invention, that information is provided by the Retrievable Instrumentation Package. Therefore, the Retrievable Instrumentation Package has a "directional measurement instrumentation" that is an example of a "directional measurement instrumentation means".

As another option, and as another preferred embodiment, and means used to control the directional drilling of the drill bit, or Smart Bit, in FIG. 6 can also be similarly incorporated in the Retrievable Instrumentation Package. Any hydraulic contacts necessary with formation can be suitably fabricated into the exterior wall of the Smart Drilling and Completion Sub 188. Therefore, the Retrievable Instrumentation Package may have "directional drilling control apparatus and instrumentation" that is an example of "directional drilling control apparatus and instrumentation means".

As an option, and as a preferred embodiment of the invention, the characteristics of the geological formation can be measured using the device in FIG. 6. In principle, MWD ("Measurement-While-Drilling") or LWD ("Logging-While-Drilling") packages can be put in the drill string at many locations. In a preferred embodiment shown in FIG. 6, the MWD and LWD electronics are made a part of the Retrievable Instrumentation Package inside the Smart Drilling and Completion Sub 188. Not shown in FIG. 6, any sensors that require external contact with the formation such as electrodes to conduct electrical current into the formation, acoustic modulator windows to let sound out of the assembly, and other special windows suitable for passing natural gamma rays, gamma rays from spectral density tools, neutrons, etc., which are suitably incorporated into the exterior walls of the Smart Drilling and Completion Sub. Therefore, the Retrievable Instrumentation Package may have "MWD/LWD instrumentation" that is an example of "MWD/LWD instrumentation means".

Yet further, the Retrievable Instrumentation Package may also have active vibrational control devices. In this case, the "drilling monitoring instrumentation" is used to control a feedback loop that provides a command via the "communications instrumentation" to an actuator in the Smart Bit that adjusts or changes bit parameters to optimize drilling, and avoid "chattering", etc. See the article entitled "Directional drilling performance improvement", by M. Mims, World Oil, May 1999, pages 40–43, an entire copy of which is incorporated herein. Therefore, the Retrievable Instrumentation Package may also have "active feedback control instrumentation and apparatus to optimize drilling parameters" that is an example of "active feedback and control instrumentation and apparatus means to optimize drilling parameters".

Therefore, the Retrieval Instrumentation Package in the Smart Drilling and Completion Sub in FIG. 6 may have one or more of the following elements:

(a) mechanical means to pass mud through the body of 188 to the drill bit;

(b) retrieving means, including latching means, to accept and align the Retrievable Instrumentation Package within the Smart Drilling and Completion Sub;

(c) "drilling monitoring instrumentation" or "drilling monitoring instrumentation means";

(d) "drill bit control instrumentation" or "drill bit control instrumentation means";

(e) "communications instrumentation" or "communications instrumentation means";

(f) "directional measurement instrumentation" or "directional measurement instrumentation means";

(g) "directional drilling control apparatus and instrumentation" or "directional drilling control apparatus and instrumentation means";

(h) "MWD/LWD instrumentation" or "MWD/LWD instrumentation means" which provide typical geophysical measurements which include induction measurements, laterolog measurements, resistivity measurements, dielectric measurements, magnetic resonance imaging measurements, neutron measurements, gamma ray measurements; acoustic measurements, etc.

(i) "active feedback and control instrumentation and apparatus to optimize drilling parameters" or "active feedback and control instrumentation and apparatus means to optimize drilling parameters";

(j) an on-board power source in the Retrievable Instrumentation Package or "on-board power source means in the Retrievable Instrumentation Package";

(k) an on-board mud-generator as is used in the industry to provide energy to (j) above or "mud-generator means".

(l) batteries as are used in the industry to provide energy to (j) above or "battery means";

For the purposes of this invention, any apparatus having one or more of the above features (a), (b) . . . , (j), (k), or (l), AND which can also be removed from the Smart Drilling and Completion Sub as described below in relation to FIG. 7, shall be defined herein as a Retrievable Instrumentation Package, that is an example of a retrievable instrument package means.

Figure 7:
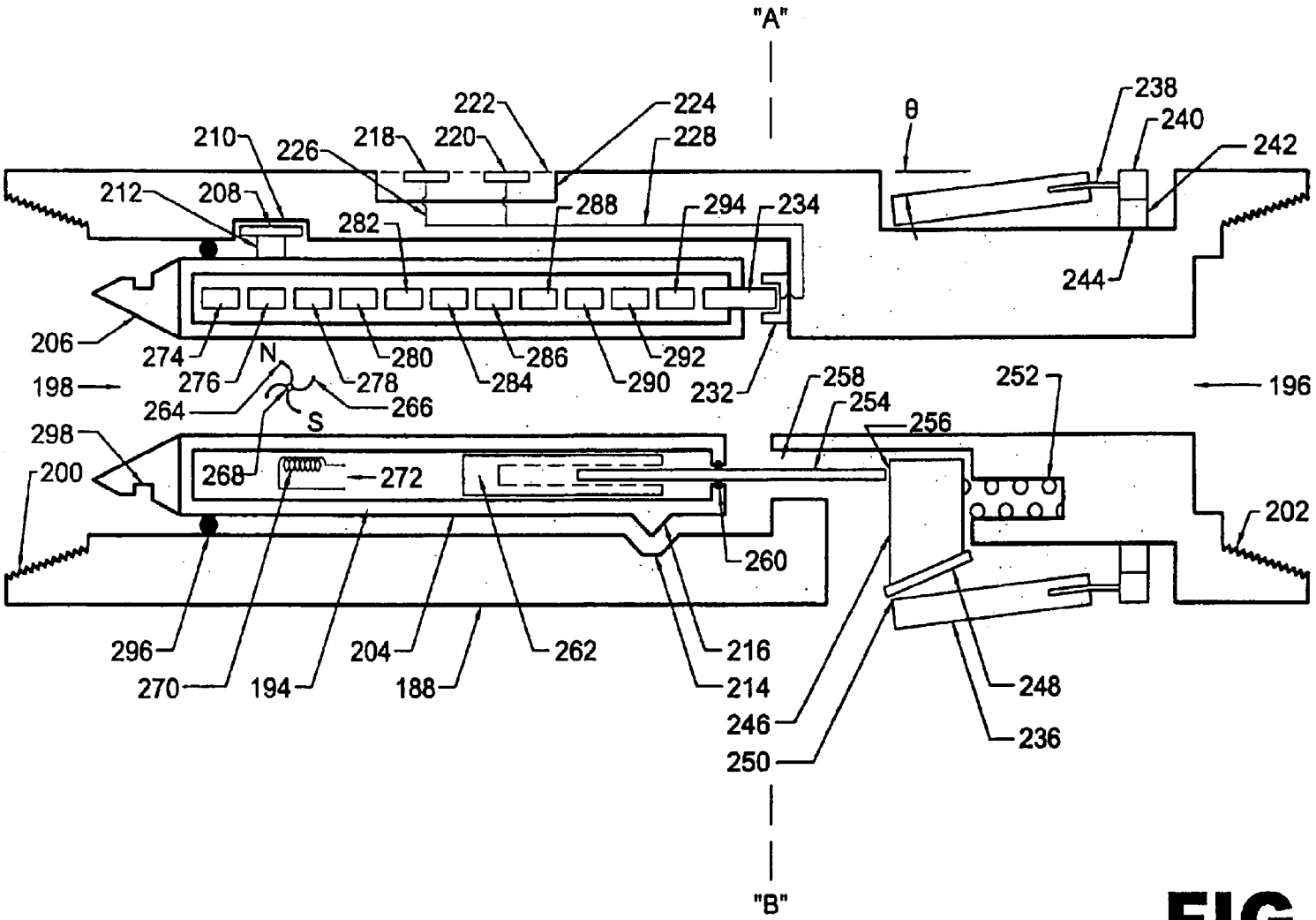
FIG. 7 shows a section view of the Retrievable Instrumentation Package and the Smart Drilling and Completion Sub that also has directional drilling control apparatus and instrumentation which is useful for the one pass drilling and completion of wellbores and which is also useful for standard well drilling operations.

FIG. 7 shows a preferred embodiment of the invention that is explicitly configured so that following drilling operations that employ MWD/LWD measurements of formation properties during those drilling operations, Smart Shuttles may be used thereafter to complete oil and gas production from the offshore platform. As in FIG. 6, Smart Drilling and Completion Sub 188 has disposed inside it Retrievable Instrumentation Package 194. The Smart Drilling and Completion Sub has mud passage 196 through it. The Retrievable Instrumentation Package has mud passage 198 through it. The Smart Drilling and Completion Sub has upper threads 200 that engage the last section of standard drill pipe 186 in FIG. 6. The Smart Drilling and Completion Sub has lower threads 202 that engage the upper threads of the Bit Adaptor Sub 190 in FIG. 6.

In FIG. 7, the Retrievable Instrumentation Package has high pressure walls 204 so that instrumentation in the package is not damaged by pressure in the wellbore. It has an inner payload radius r1, an outer payload radius r2, and overall payload length L that are not shown for the purposes of brevity. The Retrievable Instrumentation Package has retrievable means 206 that allows a wireline conveyed device from the surface to "lock on" and retrieve the Retrievable Instrumentation Package. Element 206 is the "Retrieval Means Attached to the Retrievable Instrumentation Package".

As shown in FIG. 7, the Retrievable Instrumentation Package may have latching means 208 that is disposed in latch recession 210 that is actuated by latch actuator means 212. The latching means 208 and latch recession 210 may function as described above in previous embodiments or they may be electronically controlled as required from inside the Retrievable Instrumentation Package.

Guide recession 214 in the Smart Drilling and Completion Sub is used to guide into place the Retrievable Instrumentation Package having alignment spur 216. These elements are used to guide the Retrievable Instrumentation Package into place and for other purposes as described below. These are examples of "alignment means".

Acoustic transmitter/receiver 218 and current conducting electrode 220 are used to measure various geological parameters as is typical in the MWD/LWD art in the industry, and they are "potted" in insulating rubber-like compounds 222 in the wall recession 224 shown in FIG. 7. Various MWD/LWD measurements are provided including induction measurements, laterolog measurements, resistivity measurements, dielectric measurements, magnetic resonance imaging measurements, neutron measurements, gamma ray measurements; acoustic measurements, etc. Power and signals for acoustic transmitter/receiver 218 and current conducting electrode 220 are sent over insulated wire bundles 226 and 228 to mating electrical connectors 232 and 234. Electrical connector 234 is a high pressure connector that provides power to the MWD/LWD sensors and brings their signals into the pressure free chamber within the Retrievable Instrumentation Package as are typically used in the industry. Geometric plane "A" "B" is defined by those legends appearing in FIG. 7 for reasons which will be explained later.

A first directional drilling control apparatus and instrumentation is shown in FIG. 7. Cylindrical drilling guide 236 is attached by flexible spring coupling device 238 to moving bearing 240 having fixed bearing race 242 that is anchored to the housing of the Smart Drilling and Completion Sub near the location specified by the numeral 244. Sliding block 246 has bearing 248 that makes contact with the inner portion of the cylindrical drilling guide at the location specified by numeral 250 that in turn sets the angle θ. The cylindrical drilling guide 236 is free to spin when it is in physical contact with the geological formation. So, during rotary drilling, the cylindrical drilling guide spins about the axis of the Smart Drilling and Completion Sub that in turn rotates with the remainder of the drill string. The angle θ sets the direction in the x-y plane of the drawing in FIG. 7. Sliding block 246 is spring loaded with spring 252 in one direction (to the left in FIG. 7) and is acted upon by piston 254 in the opposite direction (to the right as shown in FIG. 7). Piston 254 makes contact with the sliding block at the position designated by numeral 256 in FIG. 7. Piston 254 passes through bore 258 in the body of the Smart Drilling and Completion Sub and enters the Retrievable Instrumentation Package through o-ring 260. Hydraulic piston actuator assembly 262 actuates the hydraulic piston 254 under electronic control from instrumentation within the Retrievable Instrumentation Package as described below. The position of the cylindrical drilling guide 236 and its angle θ is held stable in the two dimensional plane specified in FIG. 7 by two competing forces described as (a) and (b) in the following: (a) the contact between the inner portion of the cylindrical drilling guide 236 and the bearing 248 at the location specified by numeral 250; and (b) the net "return force" generated by the flexible spring coupling device 238. The return force generated by the flexible spring coupling device is zero only when the cylindrical drilling guide 236 is parallel to the body of the Smart Drilling and Completion Sub.

There is a second such directional drilling control apparatus located rotationally 90 degrees from the first apparatus shown in FIG. 7 so that the drill bit can be properly guided in all directions for directional drilling purposes. However, this second assembly is not shown in FIG. 7 for the purposes of brevity. This second assembly sets the angle θ in analogy to the angle θ defined above. The directional drilling apparatus in FIG. 7 is one example of "directional drilling control means". Directional drilling in the oil and gas industries is also frequently called "geosteering", particularly when geophysical information is used in some way to direct the direction of drilling, and therefore the apparatus in FIG. 7 is also an example of a "geosteering means".

For a general review of the status of developments on directional drilling control systems in the industry, and their related uses, particularly in offshore environments, please refer to the following references: (a) the article entitled "ROTARY-STEERABLE TECHNOLOGY—Part 1, Technology gains momentum", by T. Warren, Oil and Gas Journal, Dec. 21, 1998, pages 101–105, an entire copy of which is incorporated herein by reference; (b) the article entitled "ROTARY-STEERABLE TECHNOLOGY—Conclusion, Implementation issues concern operators", by T. Warren, Oil and Gas Journal, Dec. 28, 1998, pages 80–83, an entire copy of which is incorporated herein by reference; (c) the entire issue of World Oil dated December 1998 entitled in part on the front cover "Marine Drilling Rigs, What's Ahead in 1999", an entire copy of which is incorporated herein by reference; (d) the entire issue of World Oil dated July 1999 entitled in part on the front cover "Offshore Report" and "New Drilling Technology", an entire copy of which is incorporated herein in by reference; and (e) the entire issue of The American Oil and Gas Reporter dated June 1999 entitled in part on the front cover "Offshore & Subsea Technology", an entire copy of which is incorporated herein by reference; (f) U.S. Pat. No. 5,332,048, having the inventors of Underwood et. al., that issued on Jul. 26, 1994 entitled in part "Method and Apparatus for Automatic Closed Loop Drilling System", an entire copy of which is incorporated herein by reference; (g) and U.S. Pat. No. 5,842,149 having the inventors of Harrell et. al., that issued on Nov. 24, 1998, that is entitled "Closed Loop Drilling System", an entire copy of which is incorporated herein by reference. Furthermore, all references cited in the above defined documents (a) and (b) and (c) and (d) and (e) and (f) and (g) in this paragraph are also incorporated herein in their entirety by reference. Specifically, all 17 references cited on page 105 of the article defined in (a) and all 3 references cited on page 83 of the article defined in (b) are incorporated herein by reference. For further reference, rotary steerable apparatus and rotary steerable systems may also be called "rotary steerable means", a term defined herein. Further, all the terms that are used, or defined in the above listed references (a), (b), (c), (d), and (e) are incorporated herein in their entirety.

FIG. 7 also shows a mud-motor electrical generator. The mud-motor generator is only shown FIGURATIVELY in FIG. 7. This mud-motor electrical generator is incorporated within the Retrievable Instrumentation Package so that the mud-motor electrical generator is substantially removed when the Retrievable Instrumentation Package is removed from the Smart Drilling and Completion Sub. Such a design can be implemented using a split-generator design, where a permanent magnet is turned by mud flow, and pick-up coils inside the Retrievable Instrumentation Package are used to sense the changing magnetic field resulting in a voltage and current being generated. Such a design does not necessary need high pressure seals for turning shafts of the mud-motor electrical generator itself. To figuratively show a preferred embodiment of the mud-motor electrical generator in FIG. 7, element 264 is a permanently magnetized turbine blade having magnetic polarity N and S as shown. Element 266 is another such permanently magnetized turbine blade having similar magnetic polarity, but the N and S are not marked on element 266 in FIG. 7. These two turbine blades spin about a bearing at the position designated by numeral 268 where the two turbine blades cross in FIG. 7. The details for the support of that shaft are not shown in FIG. 7 for the purposes of brevity. The mud flowing through the mud passage 198 of the Retrievable Instrumentation Package causes the magnetized turbine blades to spin about the bearing at position 268. A pick-up coil mounted on magnetic bar material designated by numeral 270 senses the changing magnetic field caused by the spinning magnetized turbine blades and produces electrical output 272 that in turn provides time varying voltage V(t) and time varying current I(t) to yet other electronics described below that is used to convert these waveforms into usable power as is required by the Retrievable Instrumentation Package. The changing magnetic field penetrates the high pressure walls 204 of the Retrievable Instrumentation Package. For the figurative embodiment of the mud-motor electrical generator shown in FIG. 7, non-magnetic steel walls are probably better to use than walls made of magnetic materials. Therefore, the Retrievable Instrumentation Package and the Smart Drilling and Completion Sub may have a mud-motor electrical generator for the purposes herein.

The following block diagram elements are also shown in FIG. 7: element 274, the electronic instrumentation to sense, accept, and align (or release) the "Retrieval Means Attached to the Retrievable Instrumentation Package" and to control the latch actuator means 212 during acceptance (or release); element 276, "power source" such as batteries and/or electronics to accept power from mud-motor electrical generator system and to generate and provide power as required to the remaining electronics and instrumentation in the Retrievable Instrumentation Package; element 278, "downhole computer" controlling various instrumentation and sensors that includes downhole computer apparatus that may include processors, software, volatile memories, non-volatile memories, data buses, analogue to digital converters as required, input/output devices as required, controllers, battery back-ups, etc.; element 280, "communications instrumentation" as defined above; element 282, "directional measurement instrumentation" as defined above; element 284, "drilling monitoring instrumentation" as defined above; element 286, "directional drilling control apparatus and instrumentation" as defined above; element 288, "active feedback and control instrumentation to optimize drilling parameters", as defined above; element 290, general purpose electronics and logic to make the system function properly including timing electronics, driver electronics, computer interfacing, computer programs, processors, etc.; element 292, reserved for later use herein; and element 294 "MWD/LWD instrumentation", as defined above.

FIG. 7 also shows optional mud seal 296 on the outer portion of the Retrievable Instrumentation Package that prevents drilling mud from flowing around the outer portion of that Package. Most of the drilling mud as shown in FIG. 7 flows through mud passages 196 and 198. Mud seal 296 is shown figuratively only in FIG. 7, and may be a circular mud ring, but any type of mud sealing element may be used, including the designs of elastomeric mud sealing elements normally associated with wiper plugs as described above and as used in the industry for a variety of purposes.

It should be evident that the functions attributed to the single Smart Drilling and Completion Sub 188 and Retrievable Instrumentation Package 194 may be arbitrarily assigned to any number of different subs and different pressure housings as is typical in the industry. However, "breaking up" the Smart Drilling and Completion Sub and the Retrievable Instrumentation Package are only minor variations of the preferred embodiment described herein.

Perhaps it is also worth noting that a primary reason for inventing the Retrievable Instrumentation Package 194 is because in the event of One-Trip-Down-Drilling, then the drill bit and the Smart Drilling and Completion Sub are left in the wellbore to save the time and effort to bring out the drill pipe and replace it with casing. However, if the MWD/LWD instrumentation is used as in FIG. 7, the electronics involved is often considered too expensive to abandon in the wellbore. Further, major portions of the directional drilling control apparatus and instrumentation and the mud-motor electrical generator are also relatively expensive, and those portions often need to be removed to minimize costs. Therefore, the Retrievable Instrumentation Package 194 is retrieved from the wellbore before the well is thereafter completed to produce hydrocarbons.

The preferred embodiment of the invention in FIG. 7 has one particular virtue that is of considerable value. When the Retrievable Instrumentation Package 194 is pulled to the left with the Retrieval Means Attached to the Retrievable Instrumentation Package 206, then mating connectors 232 and 234 disengage, and piston 254 is withdrawn through the bore 258 in the body of the Smart Drilling and Completion Sub. The piston 254 had made contact with the sliding block 246 at the location specified by numeral 256, and when the Retrievable Instrumentation Package 194 is withdrawn, the piston 254 is free to be removed from the body of the Smart Drilling and Completion Sub. The Retrievable Instrumentation Package "splits" from the Smart Drilling and Completion Sub approximately along plane "A" "B" defined in FIG. 7. In this way, most of the important and expensive electronics and instrumentation can be removed after the desired depth is reached. With suitable designs of the directional drilling control apparatus and instrumentation, and with suitable designs of the mud-motor electrical generator, the most expensive portions of these components can be removed with the Retrievable Instrumentation Package.

The preferred embodiment in FIG. 7 has yet another important virtue. If there is any failure of the Retrievable Instrumentation Package before the desired depth has been reached, it can be replaced with another unit from the surface without removing the pipe from the well using methods to be described in the following. This feature would save considerable time and money that is required to "trip out" a standard drill string to replace the functional features of the instrumentation now in the Retrievable Instrumentation Package.

In any event, after the total depth is reached in FIG. 6, and if the Retrievable Instrumentation Package had MWD and LWD measurement packages as described in FIG. 7, then it is evident that sufficient geological information is available vs. depth to complete the well and to commence hydrocarbon production. Then, the Retrievable Instrumentation Package can be removed from the pipe using techniques to be described in the following.

It should also be noted that in the event that the wellbore had been drilled to the desired depth, but on the other hand, the MWD and LWD information had NOT been obtained from the Retrievable Instrumentation Package during that drilling, and following its removal from the pipe, then measurements of the required geological formation properties can still be obtained from within the steel pipe using the logging techniques described above under the topic of "Several Recent Changes in the Industry"—and please refer to item (b) under that category. Logging through steel pipes and logging through casings to obtain the required geophysical information are now possible.

In any event, let us assume that at this point in the One-Trip-Down-Drilling Process that the following is the situation: (a) the wellbore has been drilled to final depth; (b) the configuration is as shown in FIG. 6 with the Retrievable Instrumentation Package at depth; and (c) complete geophysical information has been obtained with the Retrievable Instrumentation Package.

As described earlier in relation to FIG. 7, the Retrievable Instrumentation Package has retrieval means 206 that allows a wireline conveyed device operated from the surface to "lock on" and retrieve the Retrievable Instrumentation Package. Element 206 is the "Retrieval Means Attached to the Retrievable Instrumentation Package" in FIG. 7. As one form of the preferred embodiment shown in FIG. 7, element 206 may have retrieval grove 298 that will assist the wireline conveyed device from the surface to "lock on" and retrieve the Retrievable Instrumentation Package.

Smart Shuttles

Figure 8:
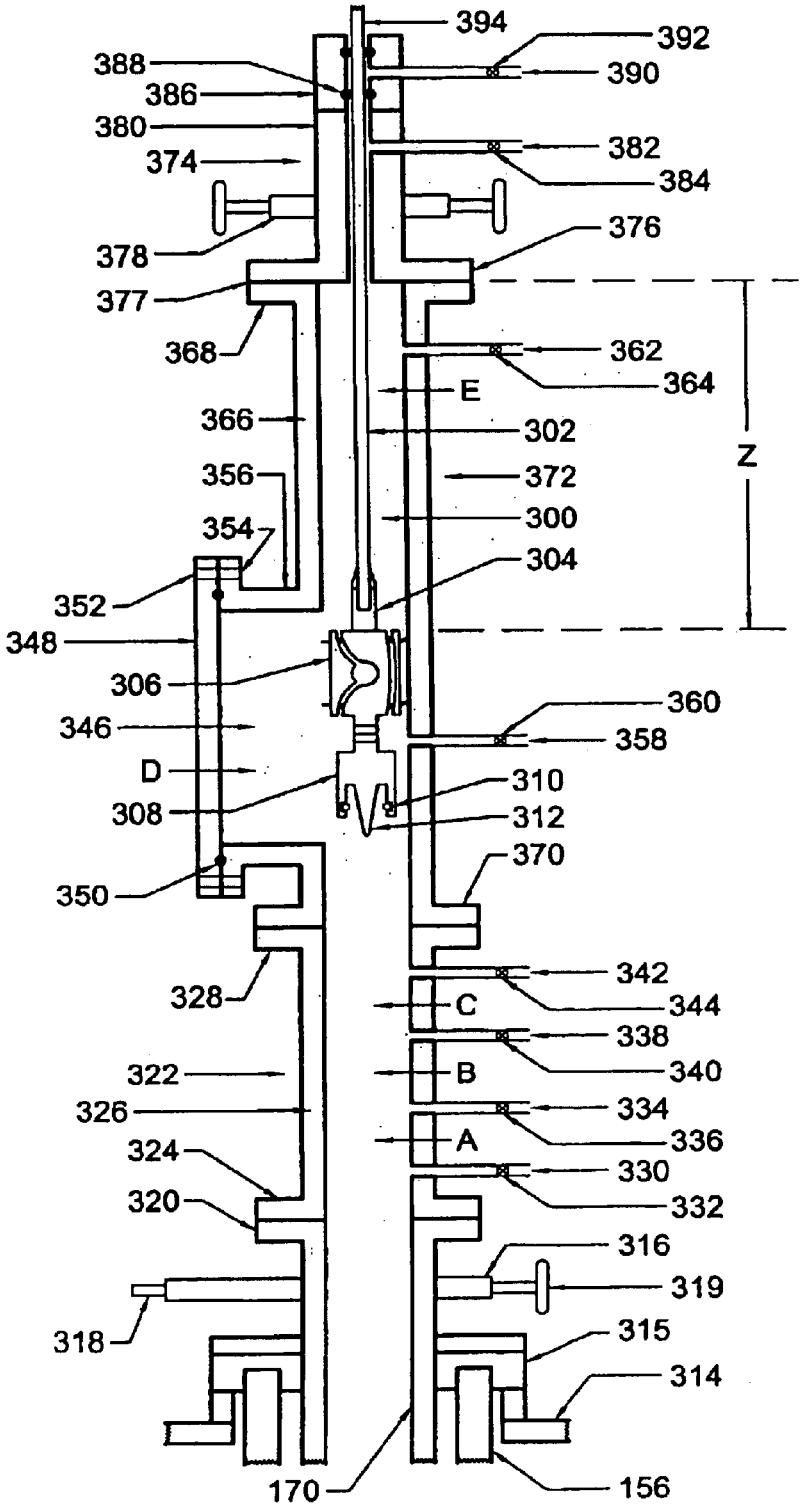
FIG. 8 shows a section view of the wellhead, the Wiper Plug Pump-Down Stack, the Smart Shuttle Chamber, the Wireline Lubricator System, the Smart Shuttle and the Retrieval Sub suspended by the wireline which is useful for the one pass drilling and completion of wellbores, and which is also useful for the completion of wells using cased well completion procedures.

FIG. 8 shows an example of such a wireline conveyed device operated from the surface of the earth used to retrieve devices within the steel drill pipe that is generally designated by numeral 300. A wireline 302, typically having 7 electrical conductors with an armor exterior, is attached to the cablehead, generally labeled with numeral 304 in FIG. 8. Cablehead 304 is in turn attached to the Smart Shuttle that is generally shown as numeral 306 in FIG. 8, which in turn is connected to an attachment. In this case, the attachment is the "Retrieval & Installation Subassembly", otherwise abbreviated as the "Retrieval/Installation Sub", also simply abbreviated as the "Retrieval Sub", and it is generally shown as numeral 308 in FIG. 8. The Smart Shuttle is used for a number of different purposes, but in the case of FIG. 8, and in the sequence of events described in relation to FIGS. 6 and 7, it is now appropriate to retrieve the Retrievable Instrumentation Package installed in the drill string as shown in FIGS. 6 and 7. To that end, please note that electronically controllable retrieval snap ring assembly 310 is designed to snap into the retrieval grove 298 of element 206 when the mating nose 312 of the Retrieval Sub enters mud passage 198 of the Retrievable Instrumentation Package. Mating nose 312 of the Retrieval Sub also has retrieval sub electrical connector 313 (not shown in FIG. 8) that provides electrical commands and electrical power received from the wireline and from the Smart Shuttle as is appropriate. (For the record, the retrieval sub electrical connector 313 is not shown explicitly in FIG. 8 because the scale of that drawing is too large, but electrical connector 313 is explicitly shown in FIG. 9 where the scale is appropriate.)

FIG. 8 shows a portion of an entire system to automatically complete oil and gas wells. This system is called the "Automated Smart Shuttle Oil and Gas Completion System", or also abbreviated as the "Automated Smart Shuttle System", or the "Smart Shuttle Oil and Gas Completion System". In FIG. 8, the floor of the offshore platform 314 is attached to riser 156 having riser hanger apparatus 315 as is typically used in the industry. The drill string 170 is composed of many lengths of drill pipe and a first blow-out preventer 316 is suitably installed on an upper section of the drill pipe using typical art in the industry. This first blow-out preventer 316 has automatic shut off apparatus 318 and manual back-up apparatus 319 as is typical in the industry. A top drill pipe flange 320 is installed on the top of the drill string.

The "Wiper Plug Pump-Down Stack" is generally shown as numeral 322 in FIG. 8. The reason for the name for this assembly will become clear in the following. Wiper Plug Pump-Down Stack" 322 is comprised various elements including the following: lower pump-down stack flange 324, cylindrical steel pipe wall 326, upper pump-down stack flange 328, first inlet tube 330 with first inlet tube valve 332, second inlet tube 334 with second inlet tube valve 336, third-inlet tube 338 with third inlet tube valve 340, with primary injector tube 342 with primary injector tube valve 344. Particular regions within the "Wiper Plug Pump-Down Stack" are identified respectively with legends A, B and C that are shown in FIG. 8. Bolts and bolt patterns for the lower pump-down stack flange 324, and its mating part that is top drill pipe flange 320, are not shown for simplicity. Bolts and bolt patterns for the upper pump down stack flange 328, and its respective mating part to be describe in the following, are also not shown for simplicity. In general in FIG. 8, flanges may have bolts and bolt patterns, but those are not necessarily shown for the purposes of simplicity.

The "Smart Shuttle Chamber" 346 is generally shown in FIG. 8. Smart Shuttle chamber door 348 is pressure sealed with a one-piece O-ring identified with the numeral 350. That O-ring is in a standard O-ring grove as is used in the industry. Bolt hole 352 through the Smart Shuttle chamber door mates with mounting bolt hole 354 on the mating flange body 356 of the Smart Shuttle Chamber. Tightened bolts will firmly hold the Smart Shuttle chamber door 348 against the mating flange body 356 that will suitably compress the one-piece O-ring 350 to cause the Smart Shuttle Chamber to seal off any well pressure inside the Smart Shuttle Chamber.

Smart Shuttle Chamber 346 also has first Smart Shuttle chamber inlet tube 358 and first Smart Shuttle chamber inlet tube valve 360. Smart Shuttle Chamber 346 also has second Smart Shuttle chamber inlet tube 362 and second Smart Shuttle chamber inlet tube valve 364. Smart Shuttle Chamber 346 has upper Smart Shuttle chamber cylindrical wall 366 and upper smart Shuttle Chamber flange 368 as shown in FIG. 8. The Smart Shuttle Chamber 346 has two general regions identified with the legends D and E in FIG. 8. Region D is the accessible region where accessories may be attached or removed from the Smart Shuttle, and region E has a cylindrical geometry below second Smart Shuttle chamber inlet tube 362. The Smart Shuttle and its attachments can be "pulled up" into region E from region D for various purposes to be described later. Smart Shuttle Chamber 346 is attached by the lower Smart Shuttle flange 370 to upper pump-down stack flange 328. The entire assembly from the lower Smart Shuttle flange 370 to the upper Smart Shuttle chamber flange 368 is called the "Smart Shuttle Chamber System" that is generally designated with the numeral 372 in FIG. 8. The Smart Shuttle Chamber System 372 includes the Smart Shuttle Chamber itself that is numeral 346 which is also referred to as region D in FIG. 8.

The "Wireline Lubricator System" 374 is also generally shown in FIG. 8. Bottom flange of wireline lubricator system 376 is designed to mate to upper Smart Shuttle chamber flange 368. These two flanges join at the position marked by numeral 377. In FIG. 8, the legend Z shows the depth from this position 377 to the top of the Smart Shuttle. Measurement of this depth Z, and knowledge of the length L1 of the Smart Shuttle (not shown in FIG. 8 for simplicity), and the length L2 of the Retrieval Sub (not shown in FIG. 8 for simplicity), and all other pertinent lengths L3, L4, . . . , of any apparatus in the wellbore, allows the calculation of the "depth to any particular element in the wellbore" using standard art in the industry.

The Wireline Lubricator System in FIG. 8 has various additional features, including a second blow-out preventer 378, lubricator top body 380, fluid control pipe 382 and its fluid control valve 384, a hydraulic packing gland generally designated by numeral 386 in FIG. 8, having gland sealing apparatus 388, grease packing pipe 390 and grease packing valve 392. Typical art in the industry is used to fabricate and operate the Wireline Lubricator System, and for additional information on such systems, please refer to FIG. 9, page 11, of Lesson 4, entitled "Well Completion Methods", of series entitled "Lessons in Well Servicing and Workover", published by the Petroleum Extension Service of The University of Texas at Austin, Austin, Tex., 1971, that is incorporated herein by reference in its entirety, which series was previously referred to above as "Ref. 2". In FIG. 8, the upper portion of the wireline 394 proceeds to sheaves as are used in the industry and to a wireline drum under computer control as described in the following. However, at this point, it is necessary to further describe relevant attributes of the Smart Shuttle.

The Smart Shuttle shown as element 306 in FIG. 8 is an example of "a conveyance means".

Figure 9:
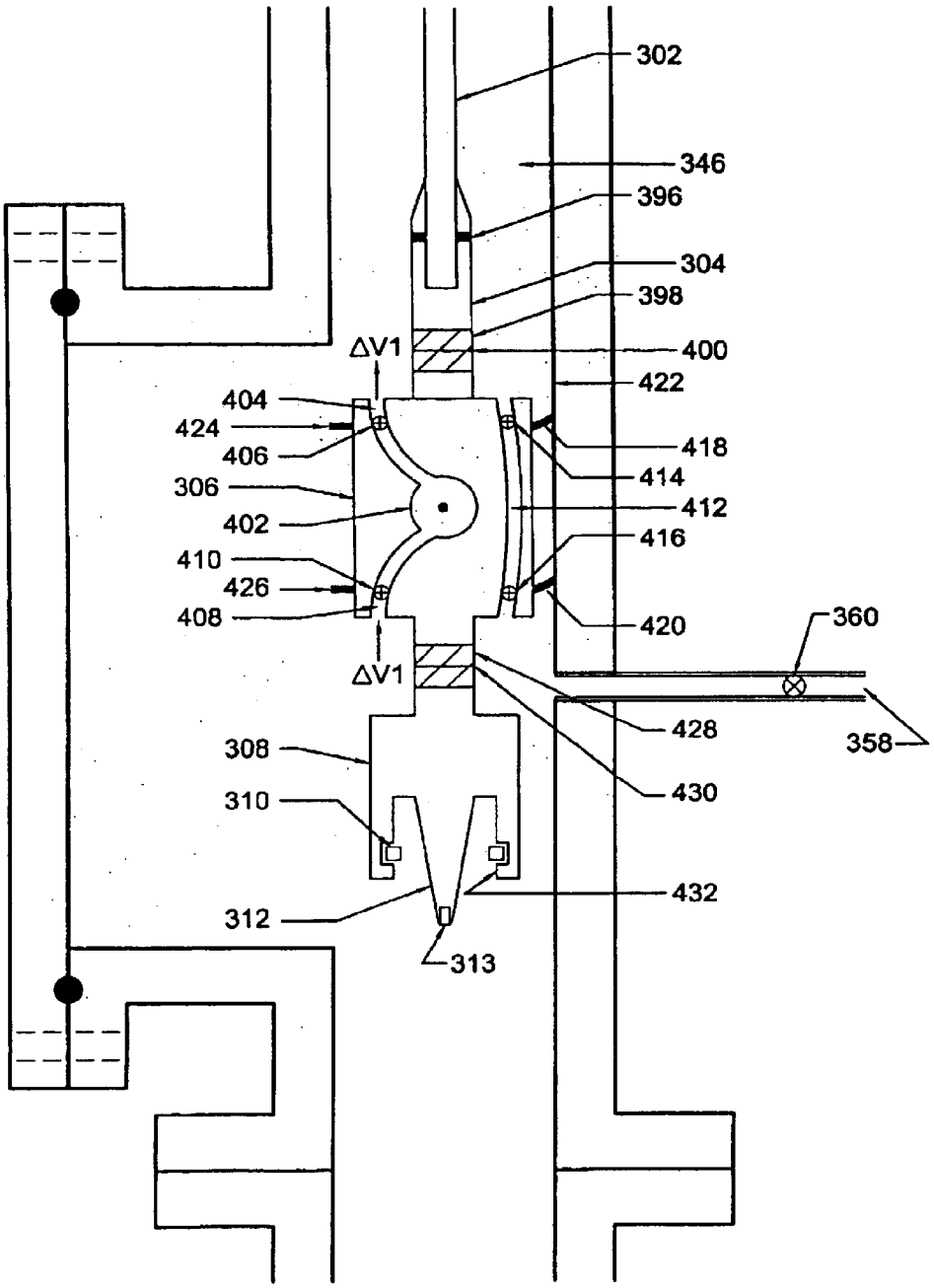
FIG. 9 shows a section view in detail of the Smart Shuttle and the Retrieval Sub while located in the Smart Shuttle Chamber.

FIG. 9 shows an enlarged view of the Smart Shuttle 306 and the "Retrieval Sub" 308 that are attached to the cablehead 304 suspended by wireline 302. The cablehead has shear pins 396 as are typical in the industry. A threaded quick change collar 398 causes the mating surfaces of the cablehead and the Smart Shuttle to join together at the location specified by numeral 400. Typically 7 insulated electrical conductors are passed through the location specified by numeral 400 by suitable connectors and O-rings as are used in the industry. Several of these wires will supply the needed electrical energy to run the electrically operated pump in the Smart Shuttle and other devices as described below.

In FIG. 9, a particular embodiment of the Smart Shuttle is described which, in this case, has an electrically operated internal pump, and this pump is called the "internal pump of the Smart Shuttle" that is designated by numeral 402. Numeral 402 designates an "internal pump means". The upper inlet port 404 for the pump has electronically controlled upper port valve 406. The lower inlet port 408 for the pump has electronically controlled lower port valve 410. Also shown in FIG. 9 is the bypass tube 412 having upper bypass tube valve 414 and lower bypass tube valve 416. In a preferred embodiment of the invention, the electrically operated internal pump 402 is a "positive displacement pump". For such a pump, and if valves 406 and 410 are open, then during any one specified time interval $\Delta t$, a specific volume of fluid $\Delta V1$ is pumped from below the Smart Shuttle to above the Smart Shuttle through inlets 404 and 408 as they are shown in FIG. 9. For further reference, the "down side" of the Smart Shuttle in FIG. 9 is the "first side" of the Smart Shuttle and the "up side" of the Smart Shuttle in FIG. 9 is the "second side" of the Smart Shuttle. Such up and down designations loose their meaning when the wellbore is substantially a horizontal wellbore where the Smart Shuttle will have great utility. Please refer to the legends $\Delta V1$ on FIG. 9. This volume $\Delta V1$ relates to the movement of the Smart Shuttle as described later below.

In FIG. 9, the Smart Shuttle also has elastomer sealing elements. The elastomer sealing elements on the right-hand side of FIG. 9 are labeled as elements 418 and 420. These elements are shown in a flexed state which are mechanically loaded against the right-hand interior cylindrical wall 422 of the Smart Shuttle Chamber 346 by the hanging weight of the Smart Shuttle and related components. The elastomer sealing elements on the left-hand side of FIG. 9 are labeled as elements 424 and 426, and are shown in a relaxed state (horizontal) because they are not in contact with any portion of a cylindrical wall of the Smart Shuttle Chamber. These elastomer sealing elements are examples of "lateral sealing means" of the Smart Shuttle. In the preferred embodiment shown in FIG. 9, it is contemplated that the right-hand element 418 and the left-hand element 424 are portions of one single elastomeric seal. It is further contemplated that the right-hand element 420 and the left-hand element 426 are portions of yet another separate elastomeric seal. Many different seals are possible, and these are examples of "sealing means" associated with the Smart Shuttle.

FIG. 9 further shows quick change collar 428 that causes the mating surfaces of the lower portion of the Smart Shuttle to join together to the upper mating surfaces of the Retrieval Sub at the location specified by numeral 430. Typically, 7 insulated electrical conductors are also passed through the location specified by numeral 430 by suitable mating electrical connectors as are typically used in the industry. Therefore, power, control signals, and measurements can be relayed from the Smart Shuttle to the Retrieval Sub and from the Retrieval Sub to the Smart Shuttle by suitable mating electrical connectors at the location specified by numeral 430. To be thorough, it is probably worthwhile to note here that numeral 431 is reserved to figuratively designate the top electrical connector of the Retrieval Sub, although that connector 431 is not shown in FIG. 9 for the purposes of simplicity. The position of the electronically controllable retrieval snap ring assembly 310 is controlled by signals from the Smart Shuttle. With no signal, the snap ring of assembly 310 is spring-loaded into the position shown in FIG. 9. With a "release command" issued from the surface, electronically controllable retrieval snap ring assembly 310 is retracted so that it does NOT protrude outside vertical surface 432 (i.e., snap ring assembly 310 is in its full retracted position). Therefore, electronic signals from the surface are used to control the electronically controllable retrieval snap ring assembly 310, and it may be commanded from the surface to "release" whatever it had been holding in place. In particular, once suitably aligned, assembly 310 may be commanded to "engage" or "lock-on" retrieval grove 298 in the Retrievable Instrumentation Package 206, or it can be commanded to "release" or "pull back from" the retrieval grove 298 in the Retrievable Instrumentation Package as may be required during deployment or retrieval of that Package, as the case may be.

One method of operating the Smart Shuttle is as follows. With reference to FIG. 8, and if the first Smart Shuttle chamber inlet tube valve 360 is in its open position, fluids, such as water or drilling mud as required, are introduced into the first Smart Shuttle chamber inlet tube 358. With second Smart Shuttle chamber inlet tube valve 364 in its open position, then the injected fluids are allowed to escape through second Smart Shuttle chamber inlet tube 362 until substantially all the air in the system has been removed. In a preferred embodiment, the internal pump of the Smart Shuttle 402 is a self-priming pump, so that even if any air remains, the pump will still pump fluid from below the Smart Shuttle, to above the Smart Shuttle. Similarly, inlets 330, 334, 338, and 342, with their associated valves, can also be used to "bleed the system" to get rid of trapped air using typical procedures often associated with hydraulic systems. With reference to FIG. 9, it would further help the situation if valves 406, 410, 414 and 416 in the Smart Shuttle were all open simultaneously during "bleeding operations", although this may not be necessary. The point is that using typical techniques in the industry, the entire volume within the regions A, B, C, D, and E within the interior of the apparatus in FIG. 8 can be fluid filled with fluids such as drilling mud, water, etc. This state of affairs is called the "priming" of the Automated Smart Shuttle System in this preferred embodiment of the invention.

Figure 10:
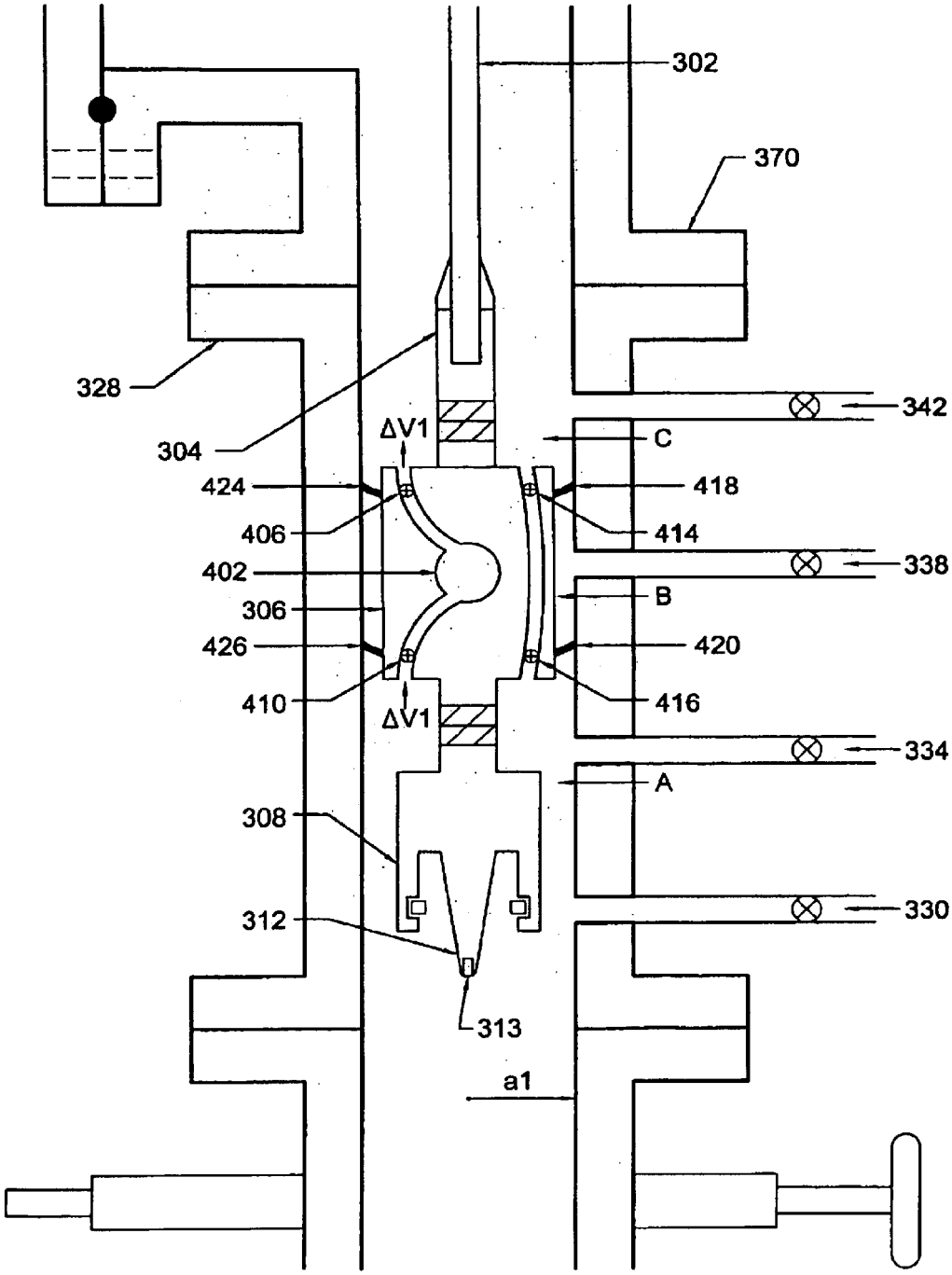
FIG. 10 shows a section view of the Smart Shuttle and the Retrieval Sub in a position where the elastomer sealing elements of the Smart Shuttle have sealed against the interior of the pipe, and the internal pump of the Smart Shuttle is ready to pump fluid volumes $\Delta V1$ from below the Smart Shuttle to above it so that the Smart Shuttle translates downhole.

After the Automated Smart Shuttle System is primed, then the wireline drum is operated to allow the Smart Shuttle and the Retrieval Sub to be lowered from region D of FIG. 8 to the part of the system that includes regions A, B, and C. FIG. 10 shows the Smart Shuttle and Retrieval Sub in that location.

The Smart Shuttle shown as element 306 in FIG. 9 is an example of "a conveyance means".

In FIG. 10, all the numerals and legends in FIG. 10 have been previously defined. When the Smart Shuttle and the Retrieval Sub are located in regions A, B, and C, then the elastomer sealing elements 418, 420, 424, and 426 positively seal against the cylindrical walls of the now fluid filled enclosure. Please notice the change in shape of the elastomer sealing elements 424 and 426 in FIG. 9 and in FIG. 10. The reason for this change is because the regions A, B, and C are bounded by cylindrical metal surfaces with intervening pipes such as inlet tubes 330, 334, 338, and primary injector tube 342. In a preferred embodiment of the invention, the vertical distance between elastomeric units 418 and 420 are chosen so that they do simultaneously overlap any two inlet pipes to avoid loss a positive seal along the vertical extent of the Smart Shuttle.

Then, in FIG. 10, valves 414 and 416 are closed, and valves 406 and 410 are opened. Thereafter, the electrically operated internal pump 402 is turned "on". In a preferred embodiment of the invention, the electrically operated internal pump is a "positive displacement pump". For such a pump, and as had been previously described, during any one specified time interval Δt, a specific volume of fluid ΔV1 is pumped from below the Smart Shuttle to above the Smart Shuttle through valves 406 and 410. Please refer to the legends ΔV1 on FIG. 10. In FIG. 10, The top of the Smart Shuttle is at depth Z, and that legend was defined in FIG. 8 in relation to position 377 in that figure. In FIG. 10, the inside radius of the cylindrical portion of the wellbore is defined by the legend a1. However, first it is perhaps useful to describe several different embodiments of Smart Shuttles and associated Retrieval Subs.

Element 306 in FIG. 8 is the "Smart Shuttle". This apparatus is "smart" because the "Smart Shuttle" has one or more of the following features (hereinafter, "List of Smart Shuttle Features"):

(a) it can provide depth measurement information, ie., it can have "depth measurement means"

(b) it can provide orientation information within the metallic pipe, drill string, or casing, whatever is appropriate, including the angle with respect to vertical, and any azimuthal angle in the pipe as required, and any other orientational information required, ie., it can have "orientational information measurement means"

(c) it can possess at least one power source, such as a battery or batteries, or apparatus to convert electrical energy from the wireline to power any sensors, electronics, computers, or actuators as required, ie., it can have "power source means"

(d) it can possess at least one sensor and associated electronics including any required analogue to digital converter devices to monitor pressure, and/or temperature, such as vibrational spectra, shock sensors, etc., ie., it can have "sensor measurement means"

(e) it can receive commands sent from the surface, ie., it can have "command receiver means from surface"

(f) it can send information to the surface, ie., it can have "information transmission means to surface"

(g) it can relay information to one or more portions of the drill string, ie., it can have "tool relay transmission means"

(h) it can receive information from one or more portions of the drill string, ie., it can have "tool receiver means"

(i) it can have one or more means to process information, ie., it can have at least one "processor means"

(j) it can have one or more computers to process information, and/or interpret commands, and/or send data, ie., it can have one or more "computer means"

(k) it can have one or more means for data storage (l) it can have one or more means for nonvolatile data storage if power is interrupted, ie., it can have one or more "nonvolatile data storage means"

(m) it can have one or more recording devices, ie., it can have one or more "recording means"

(n) it can have one or more read only memories, ie., it can have one or more "read only memory means"

(o) it can have one or more electronic controllers to process information, ie., it can have one or more "electronic controller means"

(p) it can have one or more actuator means to change at least one physical element of the device in response to measurements within the device, and/or commands received from the surface, and/or relayed information from any portion of the drill string (q) the device can be deployed into a pipe of any type including a metallic pipe, a drill string, a composite pipe, a casing as is appropriate, by any means, including means to pump it down with mud pressure by analogy to a wiper plug, or it may use any type of mechanical means including gears and wheels to engage the casing, where such gears and wheels include any well tractor type device, or it may have an electrically operated pump and a seal, or it may be any type of "conveyance means"

(r) the device can be deployed with any coiled tubing device and may be retrieved with any coiled tubing device, ie., it can be deployed and retrieved with any "coiled tubing means"

(s) the device can be deployed with any coiled tubing device having wireline inside the coiled tubing device (t) the device can have "standard depth control sensors", which may also be called "standard geophysical depth control sensors", including natural gamma ray measurement devices, casing collar locators, etc., ie., the device can have "standard depth control measurement means"

(u) the device can have any typical geophysical measurement device described in the art including its own MWD/LWD measurement devices described elsewhere above, ie., it can have any "geophysical measurement means"

(v) the device can have one or more electrically operated pumps including positive displacement pumps, turbine pumps, centrifugal pumps, impulse pumps, etc., ie., it can have one or more "internal pump means"

(w) the device can have a positive displacement pump coupled to a transmission device for providing relatively large pulling forces, ie., it can have one or more "transmission means"

(x) the device can have two pumps in one unit, a positive displacement pump to provide large forces and relatively slow Smart Shuttle speeds and a turbine pump to provide lesser forces at relatively high Smart Shuttle speeds, ie., it may have "two or more internal pump means"

Figure 11:
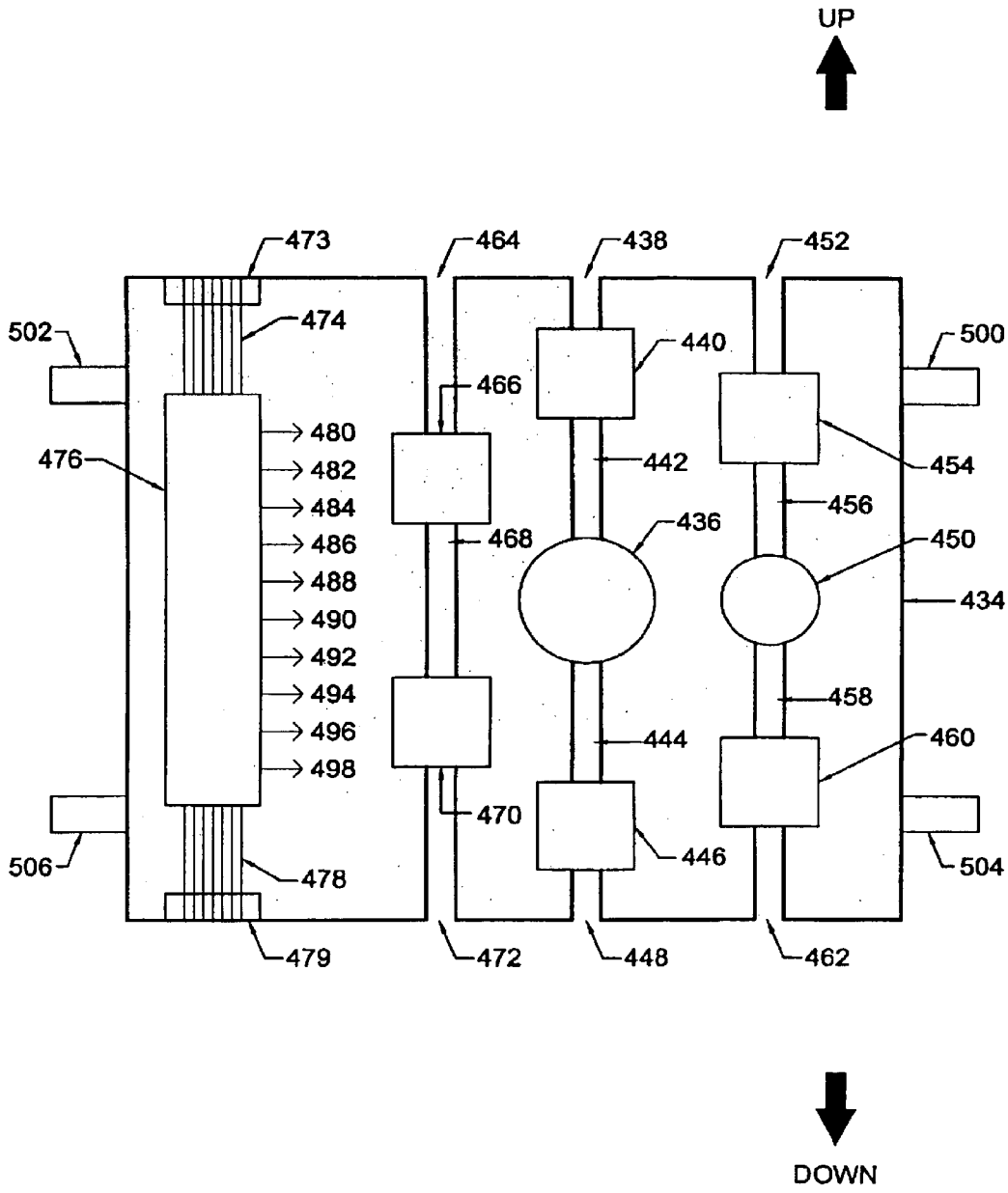
FIG. 11 is a generalized block diagram of one embodiment of a Smart Shuttle having a first electrically operated positive displacement pump and a second electrically operated pump.

(y) the device can have one or more pumps operated by other energy sources (z) the device can have one or more bypass assemblies such as the bypass assembly comprised of elements 464, 466, 468, 470, and 472 in FIG. 11, ie., it may have one or more "bypass means"

(aa) the device can have one or more electrically operated valves, ie., it can have one or more electrically operated "valve means"

(ab) it can have attachments to it, or devices incorporated in it, that install into the well and/or retrieve from the well various "Well Completion Devices"that are defined below As mentioned earlier, a U.S. Trademark Application has been filed for the Mark "Smart Shuttle". This Mark has received a "Notice of Publication Under 12 (a)" and it will be published in the Official Gazette on Jun. 11, 2002. Under "LISTING OF GOODS AND/OR SERVICES" for the Mark "Smart Shuttle" it states: "oil and gas industry hydraulically driven or electrically driven conveyors to move equipment through onshore and offshore wells, cased wells, open-hole wells, pipes, tubings, expandable tubings, liners, cylindrical sand screens, and production flowlines; the conveyed equipment including well completion and production devices, logging tools, perforating guns, well drilling equipment, coiled tubings for well stimulation, power cables, containers of chemicals, and flowline cleaning equipment".

As mentioned earlier, a U.S. Trademark Application has been filed for the Mark "Smart Shuttle". This Mark has received a "Notice of Publication Under 12(a)" and it will be published in the Official Gazette on Jun. 11, 2002. The "LISTING OF GOODS AND/OR SERVICES" for Mark "Well Locomotive" is the same as for "Smart Shuttle".

The "Retrieval & Installation Subassembly", otherwise abbreviated as the "Retrieval/Installation Sub", also simply abbreviated as the "Retrieval Sub", which is generally shown as numeral 308, has one or more of the following features (hereinafter, "List of Retrieval Sub Features"):

(a) it can be attached to, or is made a portion of, the Smart Shuttle (b) it can have means to retrieve apparatus disposed in a pipe made of any material (c) it can have means to install apparatus into a pipe made of any material (d) it can have means to install various completion devices into a pipe made of any material (e) it can have means to retrieve various completion devices from a pipe made of any material (f) it can have at least one sensor for measuring information downhole, and apparatus for transmitting that measured information to the Smart Shuttle or uphole, apparatus for receiving commands if necessary, and a battery or batteries or other suitable power source as may be required (g) it can be attached to, or be made a portion of, a conveyance means such as a well tractor (h) it can be attached to, or be made a portion of, any pump-down means of the types described later in this document Element 402 that is the "internal pump of the Smart Shuttle" may be any electrically operated pump, or any hydraulically operated pump that in turn, derives its power in any way from the wireline. Standard art in the field is used to fabricate the components of the Smart Shuttle and that art includes all pump designs typically used in the industry. Standard literature on pumps, fluid mechanics, and hydraulics is also used to design and fabricate the components of the Smart Shuttle, and specifically, the book entitled "Theory and Problems of Fluid Mechanics and Hydraulics", Third Edition, by R. V. Giles, J. B. Evett, and C. Liu, Schaum's Outline Series, McGraw-Hill, Inc., New York, N.Y., 1994, 378 pages, is incorporated herein in its entirety by reference.

For the purposes of several preferred embodiments of this invention, an example of a "wireline conveyed smart shuttle means having retrieval and installation means" (also "wireline conveyed Smart Shuttle means having retrieval and installation means") is comprised of the Smart Shuttle and the Retrieval Sub shown in FIG. 8. From the above description, a Smart Shuttle may have many different features that are defined in the above "List of Smart Shuttle Features" and the Smart Shuttle by itself is called for the purposes herein a "wireline conveyed smart shuttle means" (also "wireline conveyed Smart Shuttle means), or simply a "wireline conveyed shuttle means". A Retrieval Sub may have many different features that are defined in the above "List of Retrieval Sub Features" and for the purposes herein, it is also described as a "retrieval and installation means". Accordingly, a particular preferred embodiment of a "wireline conveyed shuttle means" has one or more features from the "List of Smart Shuttle Features" and one or more features from the "List of Retrieval Sub Features". Therefore, any given "wireline conveyed shuttle means having retrieval and installation means" may have a vast number of different features as defined above. Depending upon the context, the definition of a "wireline conveyed smart shuttle means having retrieval and installation means" may include any first number of features on the "List of Smart Shuttle Features" and may include any second number of features on the "List of Retrieval Sub Features". In this context, and for example, a "wireline conveyed shuttle means having retrieval and installation means" may have 4 particular features on the "List of Smart Shuttle Features" and may have 3 features on the "List of Retrieval Sub Features". The phrase "wireline conveyed smart shuttle means having retrieval and installation means" is also equivalently described for the purposes herein as "wireline conveyed shuttle means possessing retrieval and installation means".

It is now appropriate to discuss a generalized block diagram of one type of Smart Shuttle. The block diagram of another preferred embodiment of a Smart Shuttle is identified as numeral 434 in FIG. 11. Legends showing "UP" and "DOWN" appear in FIG. 11. Element 436 represents a block diagram of a first electrically operated internal pump, and in this preferred embodiment, it is a positive displacement pump, which is associated with an upper port 438, electrically controlled upper valve 440, upper tube 442, lower tube 444, electrically controlled lower valve 446, and lower port 448, which subsystem is collectively called herein "the Positive Displacement Pump System". In FIG. 11, there is another second electrically operated internal pump, which in this case is an electrically operated turbine pump 450, which is associated with an upper port 452, electrically operated upper valve 454, upper tube 456, lower tube 458, electrically operated lower valve 460, and lower port 462, which system is collectively called herein "the Secondary Pump System". FIG. 11 also shows upper bypass tube 464, electrically operated upper bypass valve 466, connector tube 468, electrically operated lower bypass valve 470, and lower bypass tube 472, which subsystem is collectively called herein "the Bypass System". The 7 conductors (plus armor) from the cablehead are connected to upper electrical plug 473 in the Smart Shuttle. The 7 conductors then proceed through the upper portion of the Smart Shuttle that are figuratively shown as numeral 474 and those electrically insulated wires are connected to Smart Shuttle electronics system module 476. The wire bundle pass through typically having 7 conductors that provide signals and power from the wireline and the Smart Shuttle to the Retrieval Sub are figuratively shown as element 478 and these in turn are connected to lower electrical connector 479. Signals and power from lower electrical connector 479 within the Smart Shuttle are provided as necessary to mating top electrical connector 431 of the Retrieval Sub and then those signals and power are in turn passed through the Retrieval Sub to the retrieval sub electrical connector 313 as shown in FIG. 9. Smart Shuttle electronics system module 476 carries out all the other possible functions listed as items (a) to (z), and (aa) to (ab), in the above defined list of "List of Smart Shuttle Features", and those functions include all necessary electronics, computers, processors, measurement devices, etc. to carry out the functions of the Smart Shuttle. Various outputs from the Smart Shuttle electronics system module 476 are figuratively shown as elements 480 to 498. As an example, element 480 provides electrical energy to pump 436; element 482 provides electrical energy to pump 450; element 484 provides electrical energy to valve 440; element 486 provides electrical energy to valve 446; element 488 provides electrical energy to valve 454; element 490 provides electrical energy to valve 460; element 492 provides electrical energy to valve 466; element 494 provides electrical energy to valve 470; etc. In the end, there may be a hundred or more additional electrical connections to and from the Smart Shuttle electronics system module 476 that are collectively represented by numerals 496 and 498. In FIG. 11, the right-hand and left-hand portions of upper Smart Shuttle seal are labeled respectively 500 and 502. Further, the right-hand and left-hand portions of lower Smart Shuttle seal are labeled respectively with numerals 504 and 506. Not shown in FIG. 11 are apparatus that may be used to retract these seals under electronic control that would protect the seals from wear during long trips into the hole within mostly vertical well sections where the weight of the smart shuttle means (also "Smart Shuttle means") is sufficient to deploy it into the well under its own weight. These seals would also be suitably retracted when the smart shuttle means is pulled up by the wireline.

The preferred embodiment of the block diagram for a Smart Shuttle has a particular virtue. Electrically operated pump 450 is an electrically operated turbine pump, and when it is operating with valves 454 and 460 open, and the rest closed, it can drag significant loads downhole at relatively high speeds. However, when the well goes horizontal, the loads increase. If electrically operated pump 450 stalls or cavitates, etc., then electrically operated pump 436 that is a positive displacement pump takes over, and in this case, valves 440 and 446 are open, with the rest closed. Pump 436 is a particular type of positive displacement pump that may be attached to a pump transmission device so that the load presented to the positive displacement pump does not exceed some maximum specification independent of the external load. See FIG. 12 for additional details.

The Smart Shuttle shown as element 306 in FIG. 10 is an example of "a conveyance means".

Figure 12:
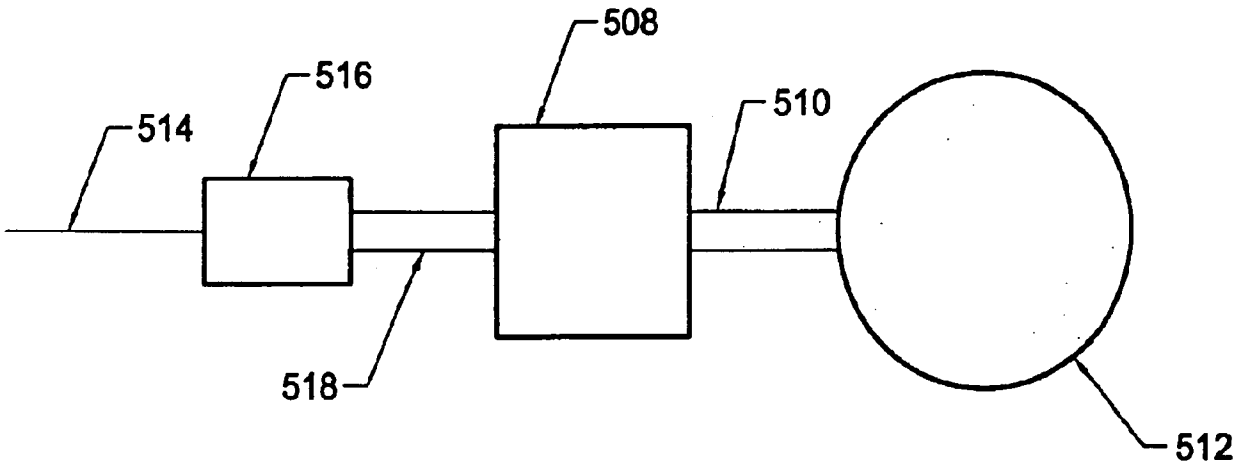
FIG. 12 shows a block diagram of a pump transmission device that prevents pump stalling, and other pump problems, by matching the load seen by the pump to the power available from the motor within the Smart Shuttle.

FIG. 12 shows a block diagram of a pump transmission device 508 that provides a mechanical drive 510 to positive displacement pump 512. Electrical power from the wireline is provided by wire bundle 514 to electric motor 516 and that motor provides a mechanical coupling 518 to pump transmission device 508. Pump transmission device 508 may be an "automatic pump transmission device" in analogy to the operation of an automatic transmission in a vehicle, or pump transmission device 508 may be a "standard pump transmission device" that has discrete mechanical gear ratios that are under control from the surface of the earth. Such a pump transmission device prevents pump stalling, and other pump problems, by matching the load seen by the pump to the power available by the motor. Otherwise, the remaining block diagram for the system would resemble that shown in FIG. 11, but that is not shown here for the purposes of brevity.

Another preferred embodiment of the Smart Shuttle contemplates using a "hybrid pump/wheel device". In this approach, a particular hydraulic pump in the Smart Shuttle can be alternatively used to cause a traction wheel to engage the interior of the pipe. In this hybrid approach, a particular hydraulic pump in the Smart Shuttle is used in a first manner as is described in FIGS. 8–12. In this hybrid approach, and by using a set of electrically controlled valves, a particular hydraulic pump in the Smart Shuttle is used in a second manner to cause a traction wheel to rotate and to engage the pipe that in turn causes the Smart Shuttle to translate within the pipe. There are many designs possible using this "hybrid approach".

Figure 13:
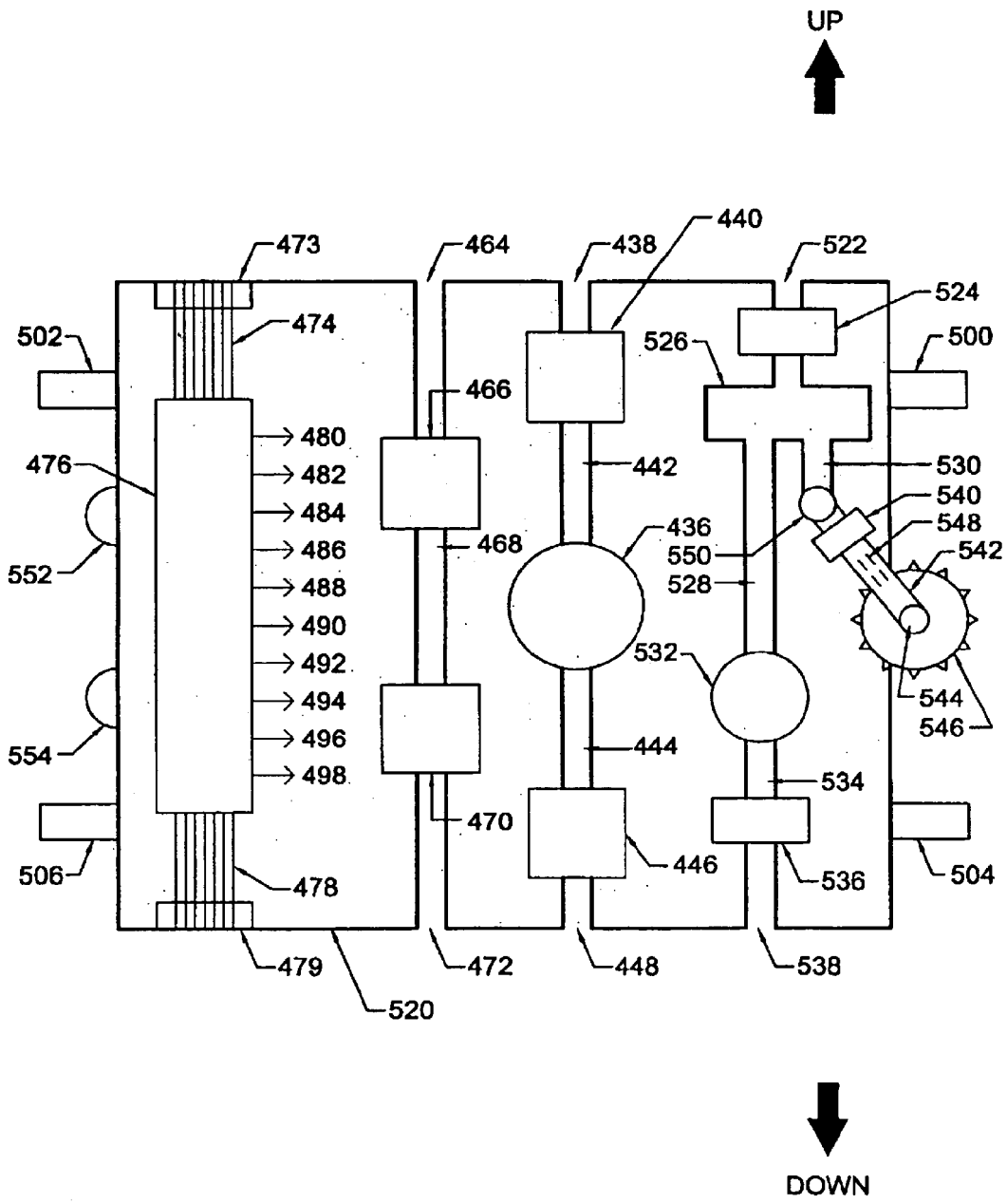
FIG. 13 shows a block diagram of preferred embodiment of a Smart Shuttle having a hybrid pump design that also provides for a turbine assembly that causes a traction wheel to engage the casing to cause translation of the Smart Shuttle.

FIG. 13 shows a block diagram of a preferred embodiment of the Smart Shuttle having a hybrid pump design that is generally designated with the numeral 520. Selected elements ranging from element 436 to element 506 in FIG. 13 have otherwise been defined in relation to FIG. 11. In addition, inlet port 522 is connected to electrically controlled valve 524 that is in turn connected to two-state valve 526 that may be commanded from the surface of the earth to selectively switch between two states as follows: "state 1"—the inlet port 522 is connected to secondary pump tube 528 and the traction wheel tube 530 is closed; or "state 2"—the inlet port 522 is closed, and the secondary pump tube 528 is connected to the traction wheel tube 530. Secondary pump tube 528 in turn is connected to second electrically operated pump 532, tube 534, electrically operated valve 536 and port 538 and operates analogously to elements 452–462 in FIG. 11 provided the two-state valve 526 is in state 1.

In FIG. 13, in "state 2", with valve 536 open, and when energized, electrically operated pump 532 forces well fluids through tube 528 and through two-state valve 526 and out tube 530. If valve 540 is open, then the fluids continue through tube 542 and to turbine assembly 544 that causes the traction wheel 546 to move the Smart Shuttle downward in the well. In FIG. 13, the "turbine bypass tube" for fluids to be sent to the top of the Smart Shuttle AFTER passage through turbine assembly 544 is NOT shown in detail for the purposes of simplicity only in FIG. 13, but this "turbine bypass tube" is figuratively shown by dashed lines as element 548.

In FIG. 13, the actuating apparatus causing the traction wheel 546 to engage the pipe on command from the surface is shown figuratively as element 550 in FIG. 13. The point is that in "state 2", fluids forced through the turbine assembly 544 cause the traction wheel 546 to make the Smart Shuttle go downward in the well, and during this process, fluids forced through the turbine assembly 544 are "vented" to the "up" side of the Smart Shuttle through "turbine bypass tube" 548. Backing rollers 552 and 554 are figuratively shown in FIG. 13, and these rollers take side thrust against the pipe when the traction wheel 546 engages the inside of the pipe.

In the event that seals 500–502 or 504–506 in FIG. 13 were to lose hydraulic sealing with the pipe, then "state 2" provides yet another means to cause the Smart Shuttle to go downward in the well under control from the surface. The wireline can provide arbitrary pull in the vertical direction, so in this preferred embodiment, "state 2" is primarily directed at making the Smart Shuttle go downward in the well under command from the surface. Therefore, in FIG. 13, there are a total of three independent ways to make the Smart Shuttle go downward under command from the surface of the earth ("standard" use of pump 436; "standard" use of pump 532 in "state 1"; and the use of the traction wheel in "state 2").

The "hybrid pump/wheel device" that is an embodiment of the Smart Shuttle shown in FIG. 13 is yet another example of "a conveyance means".

The downward velocity of the Smart Shuttle can be easily determined assuming that electrically operated pump 402 in FIGS. 9 and 10 are positive displacement pumps so that there is no "pump slippage" caused by pump stalling, cavitation effects, or other pump "imperfections". The following also applies to any pump that pumps a given volume per unit time without any such non-ideal effects. As stated before, in the time interval $\Delta t$, a quantity of fluid $\Delta V1$ is pumped from below the Smart Shuttle to above it. Therefore, if the position of the Smart Shuttle changes downward by AZ in the time interval Δt, and with radius a1 defined in FIG. 10, it is evident that:

$$\Delta V1/\Delta t = \Delta Z/\Delta t\{\pi(a1)^2\} \quad \text{Equation 1.}$$

$$\text{Downward Velocity} = \Delta Z/\Delta t = \{\Delta V1/\Delta t\}/\{\pi(a1)^2\}. \quad \text{Equation 2}$$

Here, the "Downward Velocity" defined in Equation 2 is the average downward velocity of the Smart Shuttle that is averaged over many cycles of the pump. After the Smart Shuttle of the Automated Smart Shuttle System is primed, then the Smart Shuttle and its pump resides in a standing fluid column and the fluids are relatively non-compressible. Further, with the above pump transmission device 508 in FIG. 12, or equivalent, the electrically operated pump system will not stall. Therefore, when a given volume of fluid ΔV is pumped from below the Smart Shuttle to above it, the Shuttle will move downward provided the elastomeric seals like elements 500, 502, 504 and 506 in FIGS. 9, 11, and 13 do not lose hydraulic seal with the casing. Again there are many designs for such seals, and of course, more than two seals can be used along the length of the Smart Shuttle. If the seals momentarily loose their hydraulic sealing ability, then a "hybrid pump/wheel device" as described in FIG. 13 can be used momentarily until the seals again make suitable contact with the interior of the pipe.

The preferred embodiment of the Smart Shuttle having internal pump means to pump fluid from below the Smart Shuttle to above it to cause the shuttle to move in the pipe may also be used to replace relatively slow and relatively inefficient "well tractors" that are now commonly used in the industry.

Closed-Loop Completion System

Figure 14:
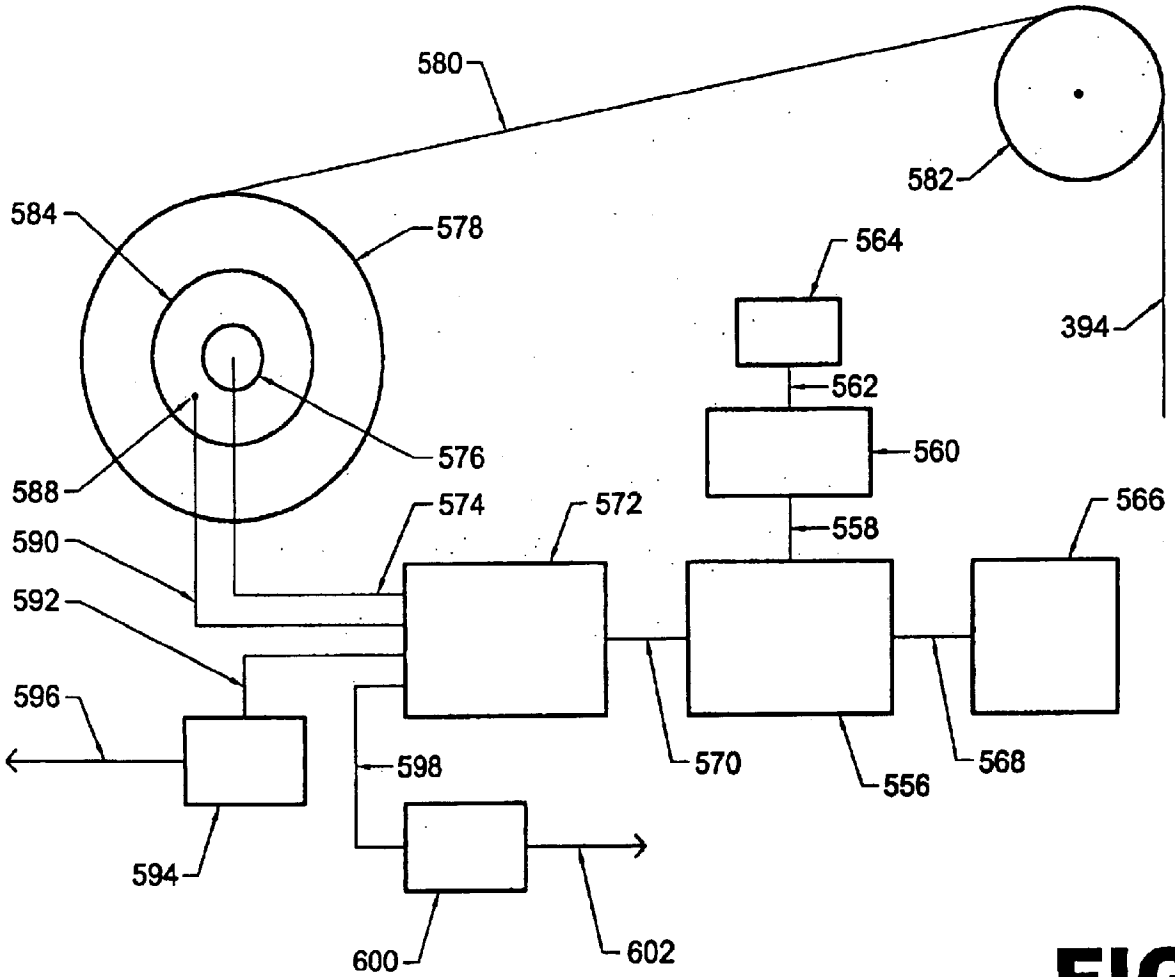
FIG. 14 shows a block diagram of the computer control of the wireline drum and the Smart Shuttle in a preferred embodiment of the invention that allows the system to be operated as an Automated Smart Shuttle System, or "closed-loop completion system", that is useful for the closed-loop completion of one pass drilling operations, and that is also useful for completion operations within a standard casing string.

FIG. 14 shows a remaining component of the Automated Smart Shuttle System. It is a portion of a preferred embodiment of an automated system to complete oil and gas wells. It is also a portion of a preferred embodiment of a closed-loop system to complete oil and gas wells. FIG. 14 shows the computer control of the wireline drum and of the Smart Shuttle in a preferred embodiment of the invention.

In FIG. 14, computer system 556 has typical components in the industry including one or more processors, one or more non-volatile memories, one or more volatile memories, many software programs that can run concurrently or alternatively as the situation requires, etc., and all other features as necessary to provide computer control of the Automated Shuttle System. In this preferred embodiment, this same computer system 556 also has the capability to acquire data from, send commands to, and otherwise properly operate and control all instruments in the Retrievable Instrumentation Package. Therefore LWD and MWD data is acquired by this same computer system when appropriate. Therefore, in one preferred embodiment, the computer system 556 has all necessary components to interact with the Retrievable Instrumentation Package. In a "closed-loop" operation of the system, information obtained downhole from the Retrievable Instrumentation Package is sent to the computer system that is executing a series of programmed steps, whereby those steps may be changed or altered depending upon the information received from the downhole sensor.

In FIG. 14, the computer system 556 has a cable 558 that connects it to display console 560. The display console 560 displays data, program steps, and any information required to operate the Smart Shuttle System. The display console is also connected via cable 562 to alarm and communications system 564 that provides proper notification to crews that servicing is required—particularly if the Smart Shuttle chamber 346 in FIG. 8 needs servicing that in turn generally involves changing various devices connected to the Smart Shuttle. Data entry and programming console 566 provides means to enter any required digital or manual data, commands, or software as needed by the computer system, and it is connected to the computer system via cable 568.

In FIG. 14, computer system 556 provides commands over cable 570 to the electronics interfacing system 572 that has many functions. One function of the electronics interfacing system is to provide information to and from the Smart Shuttle through cabling 574 that is connected to the slip-ring 576, as is typically used in the industry. The slip-ring 576 is suitably mounted on the side of the wireline drum 578 in FIG. 14. Information provided to slip-ring 576 then proceeds to wireline 580 that generally has 7 electrical conductors enclosed in armor. That wireline 580 proceeds to overhead sheave 582 that is suitably suspended above the Wireline Lubricator System in FIG. 8. In particular, the lower portion of the wireline 394 shown in FIG. 14 is also shown as the top portion of the wireline 394 that enters the Wireline Lubricator System in FIG. 8. That particular portion of the wireline 394 is the same in FIG. 14 and in FIG. 8, and this equality provides a logical connection between these two figures.

In FIG. 14, electronics interfacing system 572 also provides power and electronic control of the wireline drum hydraulic motor and pump assembly 584 as is typically used in the industry today (that replaced earlier chain drive systems). Wireline drum hydraulic motor and pump assembly 584 controls the motion of the wireline drum, and when it winds up in the counter-clockwise direction as observed in FIG. 14, the Smart Shuttle goes upwards in the wellbore in FIG. 8, and Z decreases. Similarly, when the wireline drum hydraulic motor and pump assembly 584 provides motion in the clockwise direction as observed in FIG. 14, then the Smart Shuttle goes down in FIG. 8 and Z increases. The wireline drum hydraulic motor and pump assembly 584 is connected to cable connector 588 that is in turn connected to cabling 590 that is in turn connected to electronics interfacing system 572 that is in turn controlled by computer system 556. Electronics interfacing system 572 also provides power and electronic control of any coiled tubing rig designated by element 591 (not shown in FIG. 14), including the coiled tubing drum hydraulic motor and pump assembly of that coiled tubing rig, but such a coiled tubing rig is not shown in FIG. 14 for the purposes of simplicity. In addition, electronics interfacing system 572 has output cable 592 that provides commands and control to drilling rig hardware control system 594 that controls various drilling rig functions and apparatus including the rotary drilling table motors, the mud pump motors, the pumps that control cement flow and other slurry materials as required, and all electronically controlled valves, and those functions are controlled through cable bundle 596 which has an arrow on it in FIG. 14 to indicate that this cabling goes to these enumerated items.

In relation to FIG. 14, a preferred embodiment of a portion of the Automated Smart Shuttle System shown in FIG. 8 has electronically controlled valves, so that valves 392, 384, 378, 364, 360, 344, 340, 336, 332, and 316 as seen from top to bottom in FIG. 8, and are all electronically controlled in this embodiment, and may be opened or shut remotely from drilling rig hardware control system 594. In addition, electronics interfacing system 572 also has cable output 598 to ancillary surface transducer and communications control system 600 that provides any required surface transducers and/or communications devices required for the instrumentation within the Retrievable Instrumentation Package. In a preferred embodiment, ancillary surface and communications system 600 provides acoustic transmitters and acoustic receivers as may be required to communicate to and from the Retrievable Instrumentation Package. The ancillary surface and communications system 600 is connected to the required transducers, etc. by cabling 602 that has an arrow in FIG. 14 designating that this cabling proceeds to those enumerated transducers and other devices as may be required.

With respect to FIG. 14, and to the closed-loop system to complete oil and gas wells, standard electronic feedback control systems and designs are used to implement the entire system as described above, including those described in the book entitled "Theory and Problems of Feedback and Control Systems", "Second Edition", "Continuous(Analog) and Discrete(Digital)", by J. J. DiStefano III, A. R. Stubberud, and I. J. Williams, Schaum's Outline Series, McGraw-Hill, Inc., New York, N.Y., 1990, 512 pages, an entire copy of which is incorporated herein by reference. Therefore, in FIG. 14, the computer system 556 has the ability to communicate with, and to control, all of the above enumerated devices and functions that have been described in this paragraph.

To emphasize one major point in FIG. 14, computer system 556 has the ability to receive information from one or more downhole sensors for the closed-loop system to complete oil and gas wells. This computer system executes a sequence of programmed steps, but those steps may depend upon information obtained from at least one sensor located within the wellbore.

The entire system represented in FIG. 14 provides the automation for the "Automated Smart Shuttle Oil and Gas Completion System", or also abbreviated as the "Automated Smart Shuttle System", or the "Smart Shuttle Oil and Gas Completion System". The system in FIG. 14 is the "automatic control means" for the "wireline conveyed shuttle means having retrieval and installation means" (also wireline conveyed Smart Shuttle means having retrieval and installation means"), or simply the "automatic control means" for the "smart shuttle means" (also "Smart Shuttle means").

Steps to Complete Well Shown in FIG. 6

The following describes the completion of one well commencing with the well diagram shown in FIG. 6. In FIG. 6, it is assumed that the well has been drilled to total depth. Furthermore, it is also assumed here that all geophysical information is known about the geological formation because the embodiment of the Retrievable Instrumentation Package shown in FIG. 6 has provided complete LWD/MWD information.

The first step is to disconnect the top of the drill string 170 in FIG. 6 from the drilling rig apparatus. In this step, the kelly, etc. is disconnected and removed from the drill string that is otherwise held in place with slips as necessary until the next step.

In addition to typical well control procedures, the second step is to attach to the top of that drill pipe first blow-out preventer 316 and top drill pipe flange 320 as shown in FIG. 8, and to otherwise attach to that flange 320 various portions of the Automated Smart Shuttle System shown in FIG. 8 including the "Wiper Plug Pump-Down Stack" 322, the "Smart Shuttle Chamber" 346, and the "Wireline Lubricator System" 374, which are subassemblies that are shown in their final positions after assembly in FIG. 8.

The third step is the "priming" of the Automated Smart Shuttle System as described in relation to FIG. 8.

The fourth step is to retrieve the Retrievable Instrumentation Package. Please recall that the Retrievable Instrumentation Package has heretofore provided all information about the wellbore, including the depth, geophysical parameters, etc. Therefore, computer system 556 in FIG. 14 already has this information in its memory and is available for other programs. "Program A" of the computer system 556 is instigated that automatically sends the Smart Shuttle 306 and its Retrieval Sub 308 (see FIG. 9) down into the drill string, and causes the electronically controllable retrieval snap ring assembly 310 in FIG. 9 to positively snap into the retrieval grove 298 of element 206 of the Retrievable Instrumentation Package in FIG. 7 when the mating nose 312 of the Retrieval Sub in FIG. 9 enters mud passage 198 of the Retrievable Instrumentation Package in FIG. 7. Thereafter, the Retrieval Sub has "latched onto" the Retrievable Instrumentation Package. Thereafter, a command is given by the computer system that pulls up on the wireline thereby disengaging mating electrical connectors 232 and 234 in FIG. 7, and pulling piston 254 through bore 258 in the body of the Smart Drilling and Completion Sub in FIG. 7. Thereafter, the Smart Shuttle, the Retrieval Sub, and the Retrievable Instrumentation Package under automatic control of "Program A" return to the surface as one unit. Thereafter, "Program A" causes the Smart Shuttle and the Retrieval Sub to "park" the Retrievable Instrumentation Package within the "Smart Shuttle Chamber" 346 and adjacent to the Smart Shuttle chamber door 348. Thereafter, the alarm and communications system 564 sounds a suitable "alarm" to the crew that servicing is required—in this case the Retrievable Instrumentation Package needs to be retrieved from the Smart Shuttle Chamber. The fourth step is completed when the Retrievable Instrumentation Package is removed from the Smart Shuttle Chamber. As an alternative, an automated "hopper system" under control of the computer system can replace the functions of the servicing crew therefore making this portion of the completion an entirely automated process or as a part of a closed-loop system to complete oil and gas wells.

Figure 15:
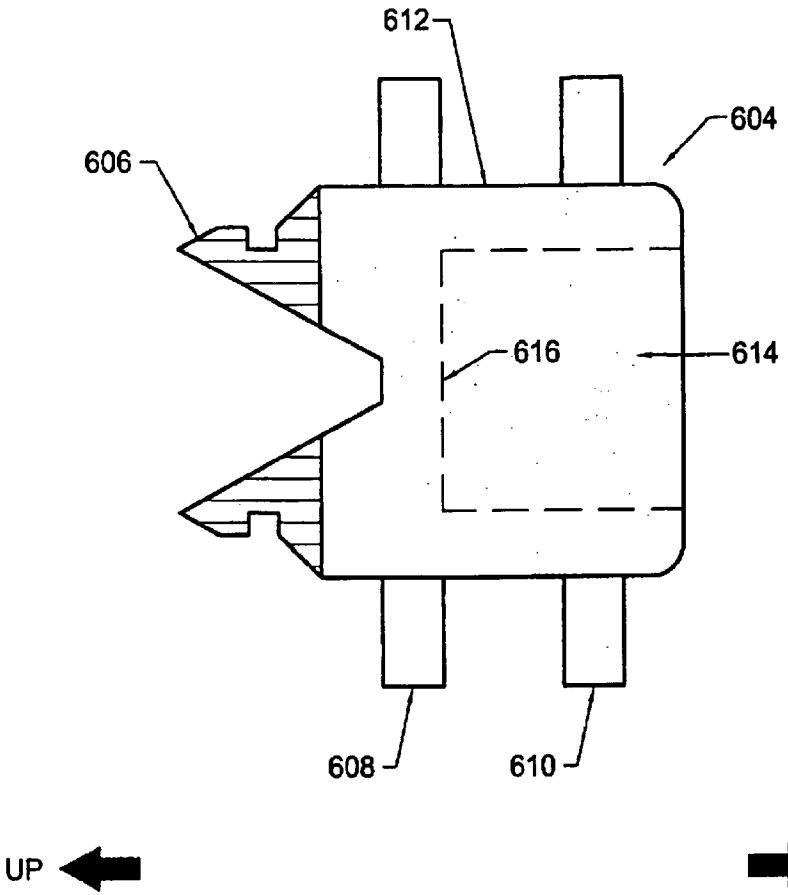
FIG. 15 shows a section view of a rubber-type material wiper plug that can be attached to the Retrieval Sub and placed into the Wiper Plug Pump-Down Stack and subsequently used for the well completion process.

The fifth step is to pump down cement and gravel using a suitable pump-down latching one-way valve means and a series of wiper plugs to prepare the bottom portion of the drill string for the final completion steps. The procedure here is followed in analogy with those described in relation to FIGS. 1–4 above. Here, however, the pump-down latching one-way valve means that is similar to the Latching Float Collar Valve Assembly 20 in FIG. 1 is also fitted with apparatus attached to its Upper Seal 22 that provides similar apparatus and function to element 206 of the Retrievable Instrumentation Package in FIG. 7. Put simply, a device similar to the Latching Float Collar Valve Assembly 20 in FIG. 1 is fitted with additional apparatus so that it may be conveniently deployed in the well by the Retrieval Sub. Wiper plugs are similarly fitted with such apparatus so that they can also be deployed in the well by the Retrieval Sub. As an example of such fitted apparatus, wiper plugs are fabricated that have rubber attachment features so that they can be mated to the Retrieval Sub in the Smart Shuttle Chamber. A cross section of such a rubber-type material wiper plug is generally shown as element 604 in FIG. 15; which has upper wiper attachment apparatus 606 that provides similar apparatus and function to element 206 of the Retrievable Instrumentation Package in FIG. 7; and which has flexible upper wiper blade 608 to fit the interior of the pipe present; flexible lower wiper blade 610 to fit the interior of the pipe present; wiper plug indentation region between the blades specified by numeral 612; wiper plug interior recession region 614; and wiper plug perforation wall 616 that perforates under suitable applied pressure; and where in some forms of the wiper plugs called "solid wiper plugs", there is no such wiper plug interior recession region and no portion of the plug wall can be perforated; and where the legends of "UP" and "DOWN" are also shown in FIG. 15. In part because the wiper plug shown in FIG. 15 may be conveyed downhole with the Retrieval Sub, it is an example of a "smart wiper plug". Further, this smart wiper plug may also possess one or more downhole sensors that provides information to the computer system that controls the well completion process. Accordingly, a pump-down latching one-way valve means is attached to the Retrieval Sub in the Smart Shuttle Chamber, and the computer system is operated using "Program B", where the pump-down latching one-way valve means is placed at, and is released in the pipe adjacent to riser hanger apparatus 315 in FIG. 8. Then, under "Program B", perforable wiper plug #1 is attached to the Retrieval Sub in the Smart Shuttle Chamber, and it is placed at and released adjacent to region A in FIG. 8. Not shown in FIG. 8 are optional controllable "wiper holding apparatus" that on suitable commands fit into the wiper plug indentation region 612 and temporally hold the wiper plug in place within the pipe in FIG. 8. Then under "Program B", perforable wiper plug #2 is attached to the Retrieval Sub in the Smart Shuttle Chamber, and it is placed at and released adjacent to region B in FIG. 8. Then under "Program B", solid wiper plug #3 is attached to the Retrieval Sub in the Smart Shuttle Chamber, and it is placed at and released adjacent to region C in FIG. 8, and the Smart Shuttle and the Retrieval Sub are "parked" in region E of the Smart Shuttle Chamber in FIG. 8. Then the Smart Shuttle Chamber is closed, and the chamber itself is suitably "primed" with well fluids. Then, with other valves closed, valve 332 is the opened, and "first volume of cement" is pumped into the pipe forcing the pump-down latching one-way valve means to be forced downward. Then valve 332 is closed, and valve 336 is opened, and a predetermined volume of gravel is forced into the pipe that in turn forces wiper plug #1 and the one-way valve means downward. Then, valve 336 is closed, and valve 338 opened, and a "second volume of cement" is pumped into the pipe forcing wiper plugs #1 and #2 and the one-way valve means downward. Then valve #338 is closed, and valve 344 is opened, and water is injected into the system forcing wiper plugs #1, #2, and #3, and the one-way valve means downward. Then the latching apparatus of the pump-down latching one-way valve means appropriately seats in latch recession 210 of the Smart Drilling and Completion Sub in FIG. 8 that was previously used to latch into place the Retrievable Instrumentation Package. From this disclosure, the pump-down latching one-way valve means has latching means resembling element 208 of the Retrievable Instrumentation Package so that it can latch into place in latch recession 210 of the Smart Drilling and Completion Sub. In the end, the sequential charges of cement, gravel, and then cement are forced through the respective perforated wiper plugs and the one-way valve means and through the mud passages in the drill bit and into the annulus between the drill pipe and the wellbore. Valve 344 is then closed, and pressure is then released in the drill pipe, and the one-way valve means allows the first and second volumes of cement to set up properly on the outside of the drill pipe. After "Program B" is completed, the communications system 564 sounds a suitable "alarm" that the next step should be taken to complete the well. As previously described, an automated "hopper system" under control of the computer system can load the requirement devices into the Smart Shuttle Chamber, and can also suitably control all valves, pumps, etc. so as to make this a completed automated procedure, or as part of a closed-loop system to complete oil and gas wells.

The sixth step is to saw slots in the drill pipe similar to the slot that is labeled with numeral 178 in FIG. 5. Accordingly, a "Casing Saw" is fitted so that it can be attached to and deployed by the Retrieval Sub. This Casing Saw is figuratively shown in FIG. 16 as element 618. The Casing Saw 618 has upper attachment apparatus 620 that provides similar apparatus and mechanical functions as provided by element 206 of the Retrievable Instrumentation Package in FIG. 7—but, that in addition, it also has top electrical connector 622 that mates to the retrieval sub electrical connector 313 shown in FIG. 9. These mating electrical connectors 313 and 622 provide electrical energy from the wireline, and command and control signals, to and from the Smart Shuttle as necessary to properly operate the Casing Saw. First casing saw blade 624 is attached to first casing saw arm 626. Second casing saw blade 628 is attached to second casing saw arm 630. Casing saw module 632 provides actuating means to deploy the arms, control signals, and the electrical and any hydraulic systems to rotate the casing saw blades. The casing saw may have one or more downhole sensors to provide measured information to the computer system on the surface. Further, this casing saw may also possess one or more downhole sensors that provides information to the computer system that controls the well completion process. FIG. 16 shows the saw blades in their extended "out position", but during any trip downhole, the blades would be in the retracted or "in position". In part because the Casing Saw in FIG. 15 may be conveyed downhole with the Retrieval Sub, it is an example of a "Smart Casing Saw". Therefore, during this sixth step, the Casing Saw is suitably attached to the Retrieval Sub, the Smart Shuttle Chamber 346 is suitably primed, and then the computer system 556 is operated using "Program C" that automatically controls the wireline drum and the Smart Shuttle so that the Casing Saw is properly deployed at the correct depth, the casing saw arms and saw blades are properly deployed, and the Casing Saw properly cuts slots through the casing. The "internal pump of the Smart Shuttle" 402 may be used in principle to make the Smart Shuttle go up or down in the well, and in this case, as the saw cuts slots through the casing, it moves up slowly under its own power—and under suitable tension applied to the wireline that is recommended to prevent a disastrous "overrun" of the wireline. After the slots are cut in the casing, the Casing Saw is then returned to the surface of the earth under "Program C" and thereafter, the communications system 564 sounds a suitable "alarm", indicating that crew servicing is required—and in this case, the Casing Saw needs to be retrieved from the Smart Shuttle Chamber. As an alternative, the previously described automated "hopper system" under control of the computer system can replace the functions of the servicing crew therefore making this portion of the completion an entirely automated process, or as part of a closed-loop system to complete oil and gas wells. For a simple single-zone completion system, a coiled tubing conveyed packer can be used to complete the well. For a simple single-zone completion system, only several more steps are necessary. Basically, the wireline system is removed and a coiled tubing rig is used to complete the well.

The seventh step is to close the first blow-out preventer 316 in FIG. 8. This will prevent any well pressure from causing problems in the following procedure. Then, remove the Smart Shuttle and the Retrieval Sub from the cablehead 304, and remove these devices from the Smart Shuttle Chamber. Then, remove the bolts in flanges 376 and 368, and then remove the entire Wireline Lubricator System 374 in FIG. 8. Then replace the Wireline Lubricator System with a Coiled Tubing Lubricator System that looks similar to element 374 in FIG. 8, except that the wireline in FIG. 8 is replaced with a coiled tubing. At this point, the Coiled Tubing Lubricator System is bolted in place to flange 368 in FIG. 8. FIG. 17 shows the Coiled Tubing Lubricator System 634. The bottom flange of the Coiled Tubing Lubricator System 636 is designed to mate to upper Smart Shuttle chamber flange 368. These two flanges join at the position marked by numeral 638. The Coiled Tubing Lubricator System in FIG. 17 has various additional features, including a second blow-out preventer 640, coiled tubing lubricator top body 642, fluid control pipe 644 and its fluid control valve 646, a hydraulic packing gland generally designated by numeral 648 in FIG. 17, having gland sealing apparatus 650, grease packing pipe 652 and grease packing valve 654. In the industry, the hydraulic packing gland generally designated by numeral 648 in FIG. 17 is often called the "stripper" which has at least the following functions: (a) it forms a dynamic seal around the coiled tubing when the tubing goes into the wellbore or comes out of the wellbore; and (b) it provides some means to change gland sealing apparatus or "packing elements" without removing the coiled tubing from the well. Coiled tubing 656 feeds through the Coiled Tubing Lubricator System and the bottom of the coiled tubing is at the position Y measured from the position marked by numeral 638 in FIG. 17. Attached to the coiled tubing a distance d1 above the bottom of the end of the coil tubing is the pump-down single zone packer apparatus 658. In several preferred embodiments of the invention, one or more downhole sensors, related electronics, related batteries or other power source, and one or more communication systems within the pump-down single zone packer apparatus provide information to a computer system controlling the well completion process. The entire system in FIG. 17 is then primed with fluids such as water using techniques already explained. Then, and with the other appropriate valves closed in FIG. 17, primary injector tube valve 344 is then opened, and water or other fluids are injected into primary injector tube 342. Then the pressure on top surface of the pump-down single zone packer apparatus forces the packer apparatus downward, thereby increasing the distance Y, but when it does so, fluid $\Delta V2$ is displaced, and it goes up the interior of the coiled tubing and to coiled tubing pressure relief valve 660 near the coiled tubing rig (not shown in FIG. 17) and the fluid volume $\Delta V2$ is emptied into a holding tank 662 (not shown in FIG. 17). Alternatively, instead of emptying the fluid into the holding tank, the fluid can be suitably recirculated with a suitably connected recirculating pump, although that recirculating pump is not shown in FIG. 17 for brevity—and such recirculating pump would also minimize the size of the holding tank which is an important feature particularly for offshore use. Still further, the pressure relief valve in the coiled tubing rig is not shown herein, nor is the holding tank, nor is the coiled tubing rig—solely for the purposes of brevity. This hydraulic method of forcing, or "pulling", the tubing into the wellbore will force it down into vertical sections of the wellbore. In such vertical sections of the wellbore, the weight of tubing also assists downward motion within the wellbore. However, of particular interest, this embodiment of the invention also works exceptionally well to force, or "pull", the coiled tubing into horizontal or other highly deviated portions of the wellbore. This is a significant improvement over other methods and apparatus typically used in the industry. This embodiment of the invention can also be used in combination with standard mechanical "injectors" used in the industry. Those mechanical "injectors" provide an axial force on the coiled tubing forcing it into, or out of the well, and there are many commercial manufactures of such devices. For example, please refer to the volume entitled "Coiled Tubing and Its Applications", having the author of Mr. Scott Quigley, presented during a "Short Course" at the "1999 SPE Annual Technical Conference and Exhibition", October 3–6, Houston, Tex., copyrighted by the Society of Petroleum Engineers, which society is located in Richardson, Tex., an entire copy of which volume is incorporated herein by reference. With reference to FIG. 17, the mechanical "injector" 663 (not shown in FIG. 17), the guide arch, the reel, the power pack, and the control cabin normally associated with an entire "coiled tubing rig" is not shown in FIG. 17 solely for the purpose of brevity. If a mechanical "injector" is used to assist forcing the pump-down single zone packer apparatus 658 into the wellbore, then it is prudent to make sure that there is sufficient hydraulic force applied to the packer apparatus 658 so that the tubing along its entire length is under suitable tension so that it will not "overrun" or "override" the packer apparatus 658. So, even if the mechanical "injector" is assisting the entry of the coiled tubing, the tubing should still be "pulled down into the wellbore" by hydraulic pressure applied to the pump-down single zone packer apparatus 658. FIG. 17A shows additional detail in the pump-down single zone packer apparatus 658 which possesses a wiper-plug type elastomeric main body having lobes 659 that slide along the interior of the pipe, and in addition, a portion of the elastomeric unit is permanently attached to the tubing in the region designated as 661 in FIG. 17A. The lobes 659 in the elastomeric unit are similar to the "Top Wiper Plug Lobe" 70 in FIG. 1. Hydraulic force applied to the elastomeric unit causes the tubing to be "pulled" into the pipe disposed in the wellbore, or "forced" into the pipe disposed in the wellbore, and therefore that elastomeric unit acts like a form of a "tractor" to pull that tubing into the pipe that is disposed in wellbore. The pump-down single zone packer apparatus 658 in FIGS. 17 and 17A are very simple embodiments of the a "tubing conveyed smart shuttles means" (also "tubing conveyed Smart Shuttle means"). In general, a "tubing conveyed smart shuttle means" also has "retrieval and installation means" for attachment of suitable "smart completion means" for yet additional embodiments of the invention that are not shown herein for brevity. For additional references on coiled tubing rigs, and related apparatus and methods, the interested reader is referred to the book entitled "World Oil's Coiled Tubing Handbook", M. E. Teel, Engineering Editor, Gulf Publishing Company, Houston, Tex., 1993, 126 pages, an entire copy of which is incorporated herein by reference. The coiled tubing rig is controlled with the computer system 556 in FIG. 14 and through the electronics interfacing system 572 and therefore the coiled tubing rig and the coiled tubing is under computer control. Then, using techniques already described, the computer system 556 runs "Program D" that deploys the pump-down single zone packer apparatus 658 at the appropriate depth from the surface of the earth. In the end, this well is completed in a configuration resembling a "Single-Zone Completion" as shown in detail in FIG. 18 on page 21 of the reference entitled "Well Completion Methods", Lesson 4, "Lessons in Well Servicing and Workover", published by the Petroleum Extension Service, The University of Texas at Austin, Austin, Tex., 1971, total of 49 pages, an entire copy of which is incorporated herein by reference, and that was previously defined as "Ref. 2". It should be noted that the coiled tubing described here can also have a wireline disposed within the coiled tubing using typical techniques in the industry. From this disclosure in the seventh step, it should also be stated here that any of the above defined smart completion devices could also be installed into the wellbore with a tubing conveyed smart shuttle means or a tubing with wireline conveyed smart shuttle means—should any other smart completion devices be necessary before the completion of the above step. It should be noted that all aspects of this seventh step including the control of the coiled tubing rig, actuators for valves, any automated hopper functions, etc., can be completely automated under the control of the computer system making this portion of the well completion an entirely automated process or as part of a closed-loop system to complete oil and gas wells.

The eighth step includes suitably closing first blow-out preventer 316 or other valve as necessary, and removing in sequence the Coiled Tubing Lubricator System 634, the Smart Shuttle Chamber System 372, and the Wiper Plug Pump-Down Stack 322, and then using usual techniques in the industry, adding suitable wellhead equipment, and commencing oil and gas production. Such wellhead equipment is shown in FIG. 39 on page 37 of the book entitled "Testing and Completing", Second Edition, Unit II, Lesson 5, published by the Petroleum Extension Service of the University of Texas, Austin, Tex., 1983, 56 pages total, an entire copy of which is incorporated herein by reference, that was previously defined as "Ref. 4" above.

List of Smart Completion Devices

In light of the above disclosure, it should be evident that there are many uses for the Smart Shuttle and its Retrieval Sub. One use was to retrieve from the drill string the Retrievable Instrumentation Package. Another was to deploy into the well suitable pump-down latching one-way valve means and a series of wiper plugs. And yet another was to deploy into the well and retrieve the Casing Saw.

The deployment into the wellbore of the well suitable pump-down latching one-way valve means and a series of wiper plugs and the Casing Saw are examples of "Smart Completion Devices" being deployed into the well with the Smart Shuttle and its Retrieval Sub. Put another way, a "Smart Completion Device" is any device capable of being deployed into the well and retrieved from the well with the Smart Shuttle and its Retrieval Sub and such a device may also be called a "smart completion means". These "Smart Completion Devices" may often have upper attachment apparatus similar to that shown in elements 620 and 622 in FIG. 16.

Any "Smart Completion Device" may have installed within it one or more suitable sensors, measurement apparatus associated with those sensors, batteries and/or power source, and communication means for transmitting the measured information to the Smart Shuttle, and/or to a Retrieval Sub, and/or to the surface. Any "Smart Completion Device" may also have installed within it suitable means to receive commands from the Smart Shuttle and or from the surface of the earth.

The following is a brief initial list of Smart Completion Devices that may be deployed into the well by the Smart Shuttle and its Retrieval Sub:

(1) smart pump-down one-way cement valves of all types
(2) smart pump-down one-way cement valve with controlled casing locking mechanism
(3) smart pump-down latching one-way cement valve
(4) smart wiper plug
(5) smart wiper plug with controlled casing locking mechanism
(6) smart latching wiper plug
(7) smart wiper plug system for One-Trip-Down-Drilling
(8) smart pump-down wiper plug for cement squeeze jobs with controlled casing locking mechanism
(9) smart pump-down plug system for cement squeeze jobs
(10) smart pump-down wireline latching retriever
(11) smart receiver for smart pump-down wireline latching retriever
(12) smart receivable latching electronics package providing any type of MWD, LWD, and drill bit monitoring information
(13) smart pump-down and retrievable latching electronics package providing MWD, LWD, and drill bit monitoring information
(14) smart pump-down whipstock with controlled casing locking mechanism
(15) smart drill bit vibration damper
(16) smart drill collar
(17) smart pump-down robotic pig to machine slots in drill pipes and casing to complete oil and gas wells
(18) smart pump-down robotic pig to chemically treat inside of drill pipes and casings to complete oil and gas wells
(19) smart milling pig to fabricate or mill any required slots, holes, or other patterns in drill pipes to complete oil and gas wells
(20) smart liner hanger apparatus
(21) smart liner installation apparatus
(22) smart packer for One-Trip-Down-Drilling
(23) smart packer system for One-Trip-Down-Drilling
(24) smart drill stem tester From the above list, the "smart completion means" includes smart one-way valve means; smart one-way valve means with controlled casing locking means; smart one-way valve means with latching means; smart wiper plug means; smart wiper plug means with controlled casing locking means; smart wiper plugs with latching means; smart wiper plug means for cement squeeze jobs having controlled casing locking means; smart retrievable latching electronics means; smart whipstock means with controlled casing locking means; smart drill bit vibration damping means; smart robotic pig means to machine slots in pipes; smart robotic pig means to chemically treat inside of pipes; smart robotic pig means to mill any required slots or other patterns in pipes; smart liner installation means; and smart packer means.

In the above, the term "pump-down" may mean one or both of the following depending on the context: (a) "pump-down" can mean that the "internal pump of the Smart Shuttle" 402 is used to translate the Smart Shuttle downward into the well; or (b) force on fluids introduced by inlets into the Smart Shuttle Chamber and other inlets can be used to force down wiper-plug like devices as described above. The term "casing locking mechanism" has been used above that means, in this case, it locks into the interior of the drill pipe, casing, or whatever pipe in which it is installed. Many of the preferred embodiments herein can also be used in standard casing installations which is a subject that will be described below.

In summary, a "wireline conveyed smart shuttle means" has "retrieval and installation means" for attachment of suitable "smart completion means". A "tubing conveyed smart shuttle means" also has "retrieval and installation means" for attachment of suitable "smart completion means". If a wireline is inside the tubing, then a "tubing with wireline conveyed shuttle means" (also "tubing with wireline conveyed Smart Shuttle means") has "retrieval and installation means" for attachment of "smart completion means". As described in this paragraph, and depending on the context, a "smart shuttle means" may refer to a "wireline conveyed smart shuttle means" or to a "tubing conveyed smart shuttle means", whichever may be appropriate from the particular usage. It should also be stated that a "smart shuttle means" may be deployed into a well substantially under the control of a computer system which is an example of a "closed-loop completion system".

Put yet another way, the smart shuttle means may be deployed into a pipe with a wireline means, with a tubing means, with a tubing conveyed wireline means, and as a robotic means, meaning that the Smart Shuttle provides its own power and is untethered from any wireline or tubing, and in such a case, it is called "an untethered robotic smart shuttle means" (also "an untethered robotic Smart Shuttle means") for the purposes herein.

It should also be stated for completeness here that any means that are installed in wellbores to complete oil and gas wells that are described in Ref. 1, in Ref. 2, and Ref. 4 (defined above, and mentioned again below), and which can be suitably attached to the retrieval and installation means of a smart shuttle means shall be defined herein as yet another smart completion means. For example, in another embodiment, a retrieval sub may be suitably attached to a wireline-conveyed well tractor, and the wireline-conveyed well tractor may be used to convey downhole various smart completion devices attached to the retrieval sub for deployment within the wellbore to complete oil and gas wells.

More Complex Completions of Oil and Gas Wells

Various different well completions typically used in the industry are described in the following references:

(a) "Casing and Cementing", Unit II, Lesson 4, Second Edition, of the Rotary Drilling Series, Petroleum Extension Service, The University of Texas at Austin, Austin, Tex., 1982 (defined earlier as "Ref. 1" above)

(b) "Well Completion Methods", Lesson 4, from the series entitled "Lessons in Well Servicing and Workover", Petroleum Extension Service, The University of Texas at Austin, Austin, Tex., 1971 (defined earlier as "Ref. 2" above)

(c) "Testing and Completing", Unit II, Lesson 5, Second Edition, of the Rotary Drilling Series, Petroleum Extension Service, The University of Texas at Austin, Austin, Tex., 1983 (defined earlier as "Ref. 4")

(d) "Well Cleanout and Repair Methods", Lesson 8, from the series entitled "Lessons in Well Servicing and Workover", Petroleum Extension Service, The University of Texas at Austin, Austin, Tex., 1971.

It is evident from the preferred embodiments above, and the description of more complex well completions in (a), (b), (c), and (d) herein, that Smart Shuttles with Retrieval Subs deploying and retrieving various different Smart Completion Devices can be used to complete a vast majority of oil and gas wells. Here, the Smart Shuttles may be either wireline conveyed, or tubing conveyed, whichever is most convenient. Single string dual completion wells may be completed in analogy with FIG. 21 in "Ref. 4". Single-string dual completion wells may be completed in analogy with FIG. 22 in "Ref. 4". A smart pig to fabricate holes or other patterns in drill pipes (item 19 above) can be used in conjunction with the a smart pump-down whipstock with controlled casing locking mechanism (item 14 above) to allow kick-off wells to be drilled and completed.

It is further evident from the preferred embodiments above that Smart Shuttles with Retrieval Subs deploying and retrieving various different Smart Completion Devices can be also used to complete multilateral wellbores. Here, the Smart Shuttles may be either wireline conveyed, or tubing conveyed, whichever is most convenient. For a description of such multilateral wells, please refer to the volume entitled "Multilateral Well Technology", having the author of "Baker Hughes, Inc.", that was presented in part by Mr. Randall Cade of Baker Oil Tools, that was handed-out during a "Short Course" at the "1999 SPE Annual Technical Conference and Exhibition", October 3–6, Houston, Tex., having the symbol of "SPE International Education Services" on the front page of the volume, a symbol of the Society of Petroleum Engineers, which society is located in Richardson, Texas, an entire copy of which volume is incorporated herein by reference.

During more complex completion processes of wellbores, it may be useful to alternate between wireline conveyed smart shuttle means and coiled tubing conveyed smart shuttle means. Of course, the "Wireline Lubricator System" 374 in FIG. 8 and the Coiled Tubing Lubricator System 634 in FIG. 17 can be alternatively mated in sequence to the upper Smart Shuttle chamber flange 368 shown in FIGS. 8 and 17. However, if many such sequential operations, or "switches", are necessary, then there is a more efficient alternative. One embodiment of this more efficient alternative is to suitably mount on top of the upper Smart Shuttle chamber flange 368, and at the same time, both a Wireline Lubricator System and a Coiled Tubing Lubricator System. There are many ways to design and build such a system that allows for needed space for simultaneously disposing wireline conveyed smart shuttle means and coiled tubing conveyed smart shuttle means within the Smart Shuttle Chamber 346, which chamber is generally shown in FIGS. 8 and 17, and in other pertinent portion of the system. Yet another embodiment comprises at least one "motion means" and at least one "sealing means" so that the Wireline Lubricator System and the Coiled Tubing Lubricator System can be suitably moved back and forth with respect to the upper Smart Shuttle chamber flange 368, so that the unit that is required during any one step is centered directly over whatever pipe is disposed in wellbore. There are many possibilities. For the purposes herein, a "Dual Lubricator Smart Shuttle System" is one that is suitably fitted with both a Wireline Lubricator System and a Coiled Tubing Lubricator System so that either wireline or tubing conveyed Smart Shuttles can be efficiently used in any order to efficiently complete the oil and gas well. Such a "Dual Lubricator Smart Shuttle System" would be particularly useful in very complex well completions, such as in some multilateral well completions, because it may be necessary to change the order of the completion sequence if unforseen events transpire. No drawing is provided herein of the "Dual Lubricator Smart Shuttle System" for brevity, but one could easily be generated by suitable combination of the relevant elements in FIGS. 8 and 17 and at least one "motion means" and at least one "sealing means". Further, any "Dual Lubricator Smart Shuttle System" that is substantially under the control of a computer system that also receives suitable downhole information is another example of a closed-loop completion system to complete oil and gas wells.

Smart Shuttles and Standard Casing Strings

Many preferred embodiments of the invention above have referred to drilling and completing through the drill string. However, it is now evident from the above embodiments and the descriptions thereof, that many of the above inventions can be equally useful to complete oil and gas wells with standard well casing. For a description of procedures involving standard casing operations, see Steps 9, 10, 11, 12, 13, and 14 of the specification under the subtitle entitled "Typical Drilling Process".

Therefore, any embodiment of the invention that pertains to a pipe that is a drill string, also pertains to pipe that is a casing. Put another way, many of the above embodiments of the invention will function in any pipe of any material, any metallic pipe, any steel pipe, any drill pipe, any drill string, any casing, any casing string, any suitably sized liner, any suitably sized tubing, or within any means to convey oil and gas to the surface for production, hereinafter defined as "pipe means".

Figure 18:
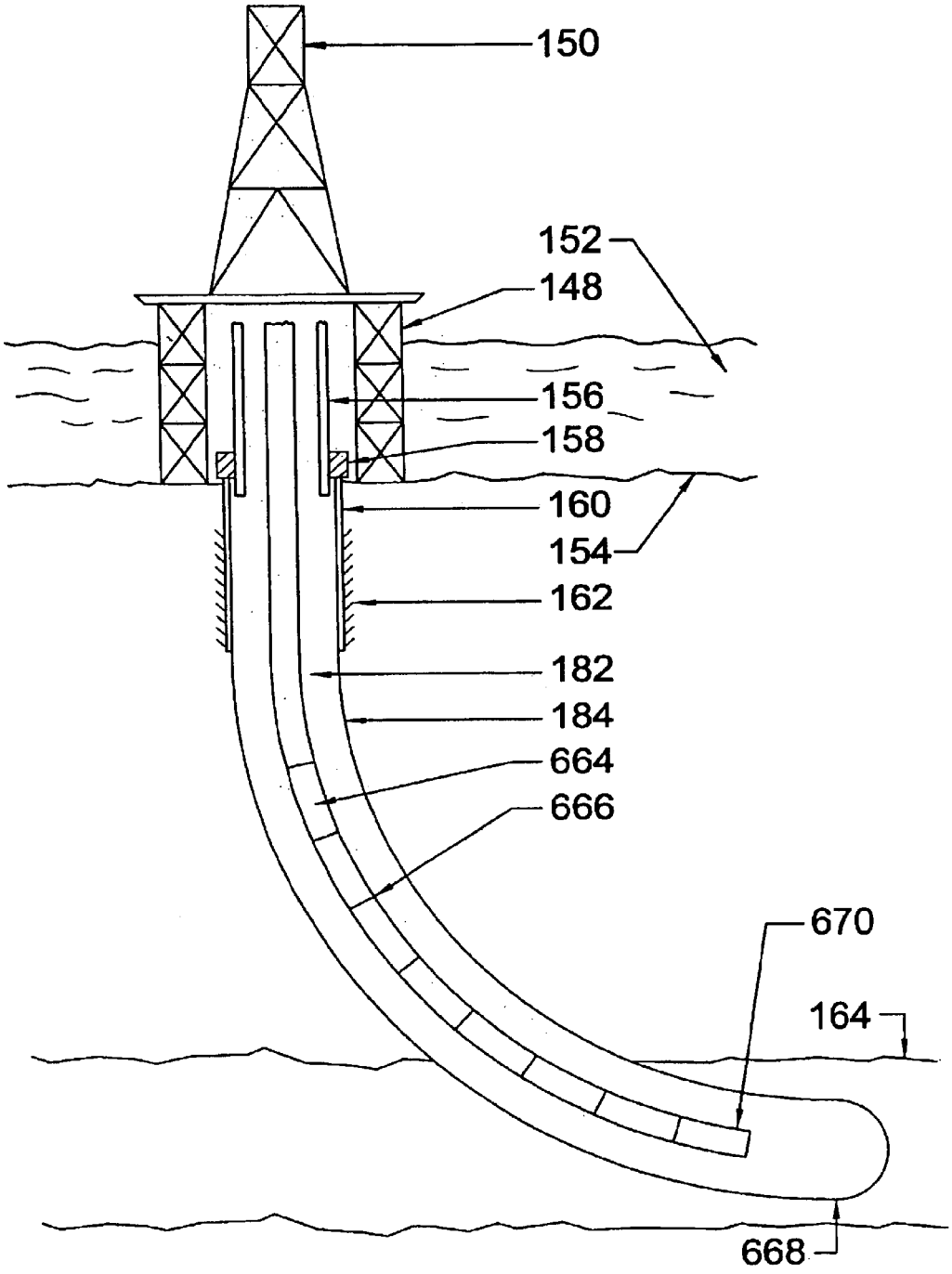
FIG. 18 shows a "pipe means" deployed in the wellbore that may be a pipe made of any material, a metallic pipe, a steel pipe, a composite pipe, a drill pipe, a drill string, a casing, a casing string, a liner, a liner string, tubing, or a tubing string, or any means to convey oil and gas to the surface for production that may be completed using a Smart Shuttle, Retrieval Sub, and Smart Completion Devices. The "pipe means" is explicitly shown here so that it is crystal clear that various preferred embodiments cited above for use during the one pass drilling and completion of oil and gas wells can in addition also be used in standard well drilling and casing operations.
Figure 18A:
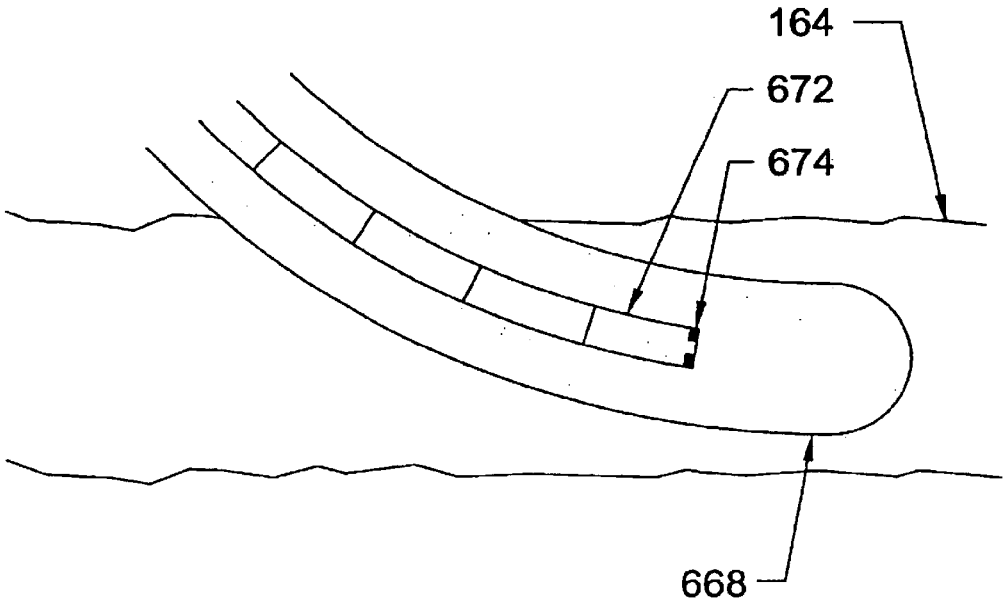
FIG. 18A shows a modified and expanded form of FIG. 18 wherein the last portion of the "pipe means" has "pipe mounted latching means" that may be used for a number of purposes including attaching a retrievable drill bit and/or as a positive "stop" for a pump-down one-way valve means following the retrieval of the retrievable drill bit during one pass drilling and completion operations.

FIG. 18 shows such a "pipe means" disposed in the open hole 184 that is also called the wellbore here. All the numerals through numeral 184 have been previously defined in relation to FIG. 6. A "pipe means" 664 is deployed in the wellbore that may be a pipe made of any material, a metallic pipe, a steel pipe, a drill pipe, a drill string, a casing, a casing string, a liner, a liner string, tubing, or a tubing string, or any means to convey oil and gas to the surface for production. The "pipe means" may, or may not have threaded joints in the event that the "pipe means" is tubing, but if those threaded joints are present, they are labeled with the numeral 666 in FIG. 18. The end of the wellbore 668 is shown. There is no drill bit attached to the last section 670 of the "pipe means". In FIG. 18, if the "pipe means" is a drill pipe, or drill string, then the retractable bit has been removed one way or another as explained in the next section entitled "Smart Shuttles and Retrievable Drill Bits". If the "pipe means" is a casing, or casing string, then the last section of casing present might also have attached to it a casing shoe as explained earlier, but that device is not shown in FIG. 18 for simplicity.

From the disclosure herein, it should now be evident that the above defined "smart shuttle means" having "retrieval and installation means" can be used to install within the "pipe means" any of the above defined "smart completion means". Here, the "smart shuttle means" includes a "wireline conveyed shuttle means" and/or a "tubing conveyed shuttle means" and/or a "tubing with wireline conveyed shuttle means".

Smart Shuttles and Retrievable Drill Bits

A first definition of the phrases "one pass drilling", "One-Trip-Drilling" and "One-Trip-Down-Drilling" is quoted above to "mean the process that results in the last long piece of pipe put in the wellbore to which a drill bit is attached is left in place after total depth is reached, and is completed in place, and oil and gas is ultimately produced from within the wellbore through that long piece of pipe. Of course, other pipes, including risers, conductor pipes, surface casings, intermediate casings, etc., may be present, but the last very long pipe attached to the drill bit that reaches the final depth is left in place and the well is completed using this first definition. This process is directed at dramatically reducing the number of steps to drill and complete oil and gas wells."

This concept, however, can be generalized one step further that is another embodiment of the invention. As many prior patents show, it is possible to drill a well with a "retrievable drill bit" that is otherwise also called a "retractable drill bit". For example, see the following U.S. Patents: U.S. Pat. No. 3,552,508, C. C. Brown, entitled "Apparatus for Rotary Drilling of Wells Using Casing as the Drill Pipe", that issued on Jan. 5, 1971, an entire copy of which is incorporated herein by reference; U.S. Pat. No. 3,603,411, H. D. Link, entitled "Retractable Drill Bits", that issued on Sep. 7, 1971, an entire copy of which is incorporated herein by reference; U.S. Pat. No. 4,651,837, W. G. Mayfield, entitled "Downhole Retrievable Drill Bit", that issued on Mar. 24, 1987, an entire copy of which is incorporated herein by reference; U.S. Pat. No. 4,962,822, J. H. Pascale, entitled "Downhole Drill Bit and Bit Coupling", that issued on Oct. 16, 1990, an entire copy of which is incorporated herein by reference; and U.S. Pat. No. 5,197,553, R. E. Leturno, entitled "Drilling with Casing and Retrievable Drill Bit", that issued on Mar. 30, 1993, an entire copy of which is incorporated herein by reference. Some experts in the industry call this type of drilling technology to be "drilling with casing". For the purposes herein, the terms "retrievable drill bit", "retrievable drill bit means", "retractable drill bit" and "retractable drill bit means" may be used interchangeably.

For the purposes of logical explanation at this point, in the event that any drill pipe is used to drill any extended reach lateral wellbore from any offshore platform, and in addition that wellbore perhaps reaches 20 miles laterally from the offshore platform, then to save time and money, the assembled pipe itself should be left in place and not tripped back to the platform. This is true whether or not the drill bit is left on the end of the pipe, or whether or not the well was drilled with so-called "casing drilling" methods. For typical casing-while-drilling methods, see the article entitled "Casing-while-drilling: The next step change in well construction", World Oil, October, 1999, pages 34–40, and entire copy of which is incorporated herein by reference. Further, all terms and definitions in this particular article, and entire copies of each and every one of the 13 references cited at the end this article are incorporated herein by reference.

Accordingly a more general second definition of the phrases "one pass drilling", "One-Trip-Drilling" and "One-Trip-Down-Drilling" shall include the concept that once the drill pipe means reaches total depth and any maximum extended lateral reach, that the pipe means is thereafter left in place and the well is completed. The above embodiments have adequately discussed the cases of leaving the drill bit attached to the drill pipe and completing the oil and gas wells. In the case of a retrievable bit, the bit itself can be left in place and the well completed without retrieving the bit, but the above apparatus and methods of operation using the Smart Shuttle, the Retrieval Sub, and the various Smart Production Devices can also be used in the drill pipe means that is left in place following the removal of a retrievable bit. This also includes leaving ordinary casing in place following the removal of a retrieval bit and any underreamer during casing drilling operations. This process also includes leaving any type of pipe, tubing, casing, etc. in the wellbore following the removal of the retrievable bit.

In particular, following the removal of a retrievable drill bit during wellboring activities, one of the first steps to complete the well is to prepare the bottom of the well for production using one-way valves, wiper plugs, cement, and gravel as described in relation to FIGS. 4, 5, and 8 and as further described in the "fifth step" above under the subtopic of "Steps to Complete Well Shown in FIG. 6". The use of one-way valves installed within a drill pipe means following the removal of a retrievable drill bit that allows proper cementation of the wellbore is another embodiment of the invention. These one-way valves can be installed with the Smart Shuttle and its Retrieval Sub, or they can be simply pumped-down from the surface using techniques shown in FIG. 1 and in the previously described "fifth step".

FIG. 18A shows a modified form of FIG. 18 wherein the last portion of the "pipe means" 672 has "pipe mounted latching means" 674. This "pipe mounted latching means" may be used for a number of purposes including at least the following: (a) an attachment means for attaching a retrievable drill bit to the last section of the "pipe means"; and (b) a "stop" for a pump-down one-way valve means following the retrieval of the retrievable drill bit. In some contexts this "pipe mounted latching means" 674 is also called a "landing means" for brevity. Therefore, an embodiment of this invention is methods and apparatus to install one-way cement valve means in drill pipe means following the removal of a retrievable drill bit to produce oil and gas. It should also be stated that well completion processes that include the removal of a retrievable drill bit may be substantially under the control of a computer system, and in such a case, it is another example of automated completion system or a part of a closed-loop completion system to complete oil and gas wells.

The above described "landing means" can be used for yet another purpose. This "landing means" can also be used during the one-trip-down-drilling and completion of wellbores in the following manner. First, a standard rotary drill bit is attached to the "landing means". However, the attachment for the drill bit and the landing means are designed and constructed so that a ball plug is pumped down from the surface to release the rotary drill bit from the landing means. There are many examples of such release devices used in the industry, and no further description shall be provided herein in the interests of brevity. For example, relatively recent references to the use of a pumpdown plugs, ball plugs, and the like include the following: (a) U.S. Pat. No. 5,833,002, that issued on Nov. 10, 1998, having the inventor of Michael Holcombe, that is entitled "Remote Control Plug-Dropping Head", an entire copy of which is incorporated herein by reference; and (b) U.S. Pat. No. 5,890,537 that issued on Apr. 6, 1999, having the inventors of Lavaure et. al., that is entitled "Wiper Plug Launching System for Cementing Casing with Liners", an entire copy of which is incorporated herein by reference. After the release of the standard drill bit from the landing means, a retrievable drill bit and underreamer can thereafter be conveyed downhole from the surface through the drill string (or the casing string, as the case may be) and suitably attached to this landing means. Therefore, during the one-trip-down-drilling and completion of a wellbore, the following steps may be taken: (a) attach a standard rotary drill bit to the landing means having a releasing mechanism actuated by a releasing means, such as a pump down ball; (b) drill as far as possible with standard rotary drill bit attached to landing means; (c) if the standard rotary drill bit becomes dull, drill a sidetrack hole perhaps 50 feet or so into formation; (d) pump down the releasing means, such as a pump down ball, to release the standard rotary drill bit from the landing means and abandon the then dull standard rotary drill bit in the sidetrack hole; (e) pull up on the drill string or casing string as the case may be; (f) install a sharp retrievable drill bit and underreamer as desired by attaching them to the landing means; and (f) resume drilling the borehole in the direction desired. This method has the best of both worlds. On the one-hand, if the standard rotary drill bit remains sharp enough to reach final depth, that is the optimum outcome. On the other-hand, if the standard rotary drill bit dulls prematurely, then using the above defined "Sidetrack Drill Bit Replacement Procedure" in elements (a) through (f) allows for the efficient installation of a sharp drill bit on the end of the drill string or casing string, as the case may be. The landing means may also be made a part of a Smart Drilling and Completion Sub. If a Retrievable Instrumentation Package is present in the drilling apparatus, for example within a Smart Drilling and Completion Sub, then the above steps need to be modified to suitably remove the Retrievable Instrumentation Package before step (d) and then re-install the Retrievable Instrumentation Package before step (f). However, such changes are minor variations on the preferred embodiments herein described.

To briefly review the above, many descriptions of closed-loop completion systems have been described. One particular version of a closed-loop completion system uses a preferred embodiment that discloses methods of causing movement of shuttle means having lateral sealing means within a "pipe means" disposed within a wellbore that includes at least the step of pumping a volume of fluid from a first side of the shuttle means within the pipe means to a second side of the shuttle means within the pipe means, where the shuttle means has an internal pump means. Pumping fluid from one side to the other of the smart shuttle means causes it to move "downward" into the pipe means, or "upward" out of the pipe means, depending on the direction of the fluid being pumped. The pumping of this fluid causes the smart shuttle means to move, translate, change place, change position, advance into the pipe means, or come out of the pipe means, as the case may be, and may be used in other types of pipes. The "pipe means" deployed in the wellbore may be a pipe made of any material, and may be a metallic pipe, a steel pipe, a drill pipe, a drill string, a casing, a casing string, a liner, a liner string, tubing, a tubing string, or any means to convey oil and gas to the surface for oil and gas production. There are many embodiments of Smart Shuttles, but the particular embodiment of a Smart Shuttle described in the foregoing is particularly useful for operation within any pipe means and for closed-loop completion systems.

Smart Shuttle with Progressive Cavity Pump

As stated earlier, several embodiments of the Smart Shuttle use a positive displacement pump. There is a particularly useful version of a positive displacement pump called a Progressive Cavity Pump ("PCP"). In turn, that PCP is coupled to a gear box that is in turn driven by an Electrical Submersible Motor ("ESM"). Such a configuration is called a "PCP/ESM" for short. Sometimes, the overall assembly is simply called an Electrical Submersible Pump ("ESP").

Figure 19:
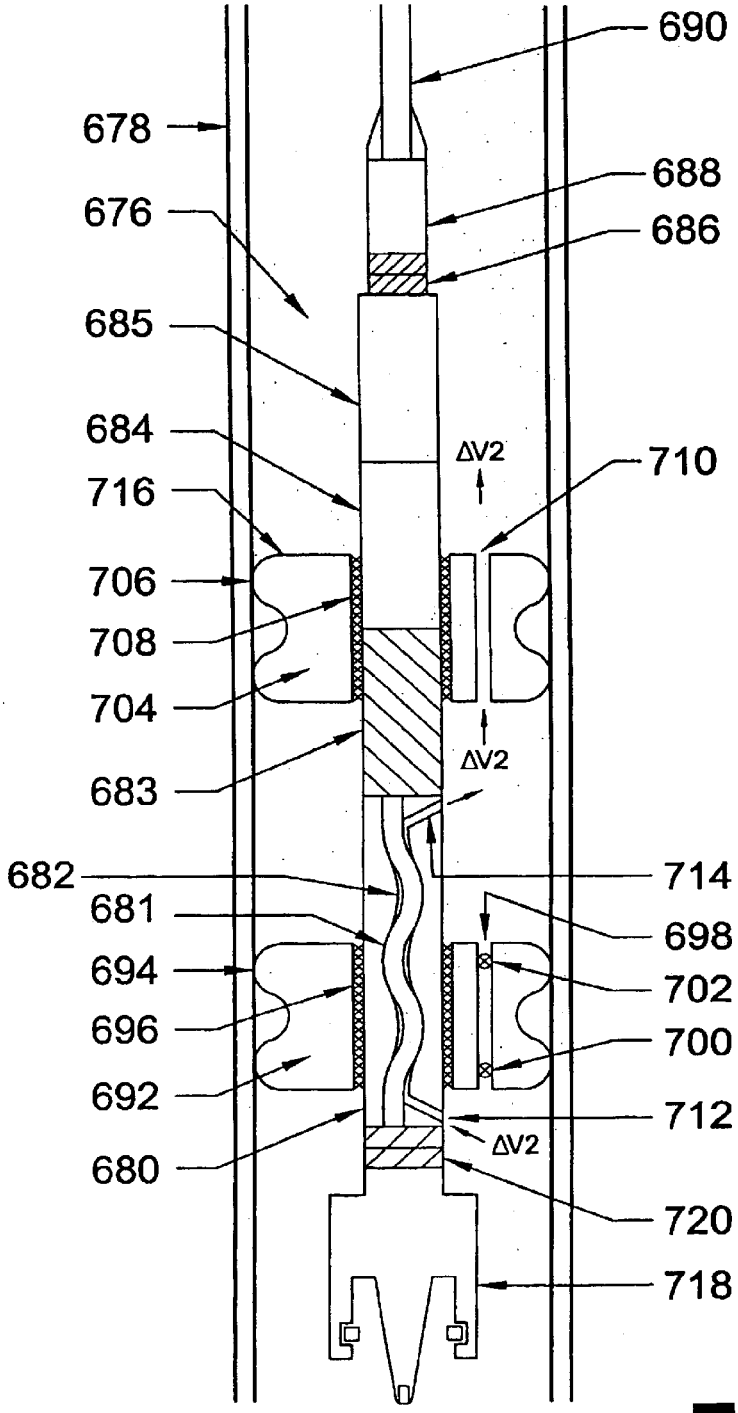
FIG. 19 shows a particular preferred embodiment of a Smart Shuttle having a Progressive Cavity Pump ("PCP") and a gear box that is in turn driven by an Electrical Submersible Motor ("ESM") that is used in drill pipes during one pass drilling and completion operations and that is also used in standard casing strings and within other "pipe means" that is particularly useful for the closed-loop completion of oil and gas wells.

FIG. 19 shows a PCP/ESM Smart Shuttle generally designated with the numeral 676 that is located within a "pipe means" 678 that includes a casing, drill pipe, tubing, etc. The PCP/ESM Smart Shuttle is comprised of a Progressive Cavity Pump 680 of the type typically used in the oil and gas industries such as that manufactured by Tarby Inc., 2205 E. L. Anderson Boulevard, Clarmore, Okla. 74017, that is further described in that firm's catalogue entitled "Progressing Cavity Solutions thru Service, Parts and Pumps". That Progressive Cavity Pump has a rotor 681 and stator 682 as is typical of such pumps. The Progressive Cavity Pump is coupled to gear box 683 that is in turn coupled to the Electrically Submersible Motor 684, which in turn is connected to electronics assembly 685 having any downhole computer, the downhole sensors, and communications system, which in turn is connected by the quick change collar 686 to the cablehead 688 that is suspended by the wireline 690. The lower wiper plug assembly 692 has sealing lobe 694 and this assembly is firmly attached to the body of the Progressive Cavity Pump at the location generally specified by numeral 696 and this assembly further has lower bypass passage 698 which has electrically operated valves 700 and 702. The upper wiper plug assembly 704 has sealing lobe 706 and this assembly is firmly attached to the sections of the apparatus having the gear box and the Electrically Submersible Motor at the location generally designated by numeral 708. The upper wiper assembly also has permanently open upper bypass port 710 in the embodiment shown in FIG. 19.

In terms of FIG. 19, and when the Electrically Submersible Motor is suitably turning the rotor of the Progressive Cavity Pump (PCP), a volume of fluid $\Delta V2$ in the wellbore is pumped into the lower side port 712 of the PCP and out of the upper side port 714 of the PCP. With valves 700 and 702 closed, the fluid $\Delta V2$ is then forced through the upper bypass port 710 into the portion of the well above the upper surface of the upper wiper plug assembly that is identified by numeral 716. In this manner, the Smart Shuttle is then forced downward into the wellbore.

In analogy with previous embodiments, the Retrieval Sub 718 is attached to the body of the Smart Shuttle by quick change collar 720 that in turn is connected to the lower body of the Progressive Cavity Pump. The Smart Shuttle and its Retrieval Sub otherwise operate in manners and for purposes previously described herein. The point is that this embodiment of the invention is particularly relevant to operation within any pipe means which may be a casing, a drill pipe, etc. The electrical wiring from the cablehead and the electronics assembly 685 that passes through the PCP to the Retrieval Sub is not shown in FIG. 19 for the purposes of simplicity only.

In FIG. 19, the lobe 706 of the upper wiper plug assembly 704 must seal against the inside of the pipe means for proper operation of the Smart Shuttle. To that end, various different embodiments of the invention provide for different adjustable sealing means to compensate for variations in the ID of the pipe means present.

The PCT/ESM Smart Shuttle shown as element 676 in FIG. 19 is an example of "a conveyance means".

Figure 20:
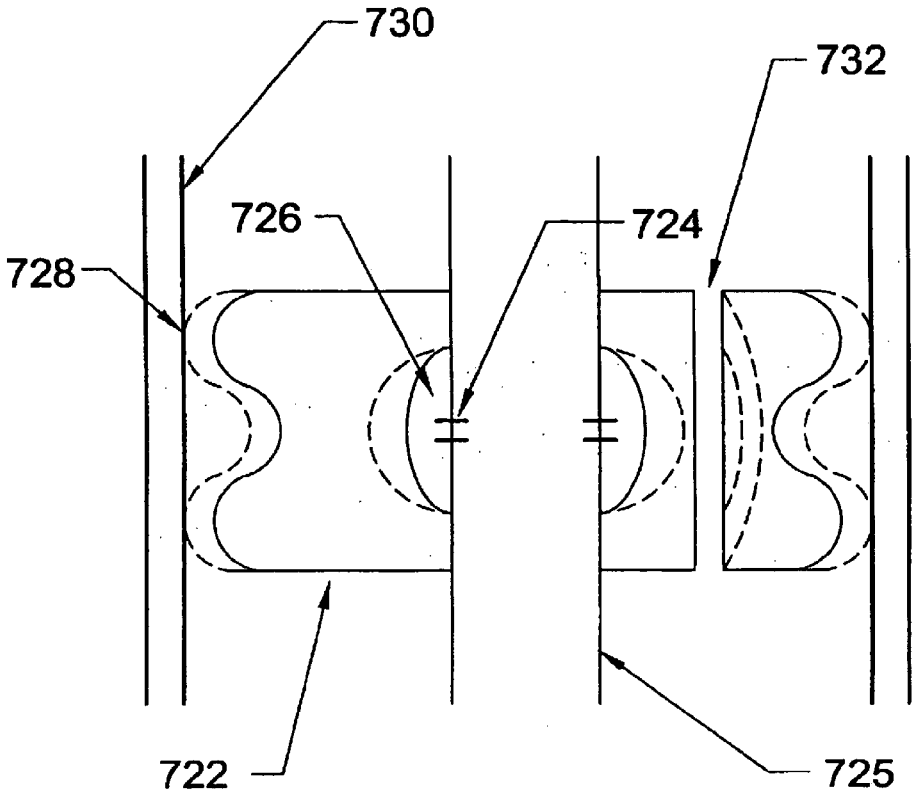
FIG. 20 shows one embodiment of a Smart Shuttle having a PCP and ESM that also has an adjustable sealing means for operation in pipes having variable inside diameters and for other purposes that is particularly useful for the closed-loop completion of oil and gas wells.

FIG. 20 shows one embodiment of the invention that has an adjustable sealing means generally designated by the numeral 722 in FIG. 20. In this case, the adjustable sealing means, or adjustable sealing apparatus 722, is comprised of a hydraulic port 724 from inside of the adjacent tool body 725 that provides hydraulic oil under pressure which inflates inflatable gland 726. With a first hydraulic pressure "P1" on the fluid within the inflatable gland, the solid lines show the outline of the adjustable sealing apparatus. With a second hydraulic pressure "P2" on the fluid within the inflatable gland, the dotted lines show the outline of the adjustable sealing apparatus. With hydraulic pressure "P2", the lobe 728 of the adjustable sealing apparatus makes suitable contact with the interior of the pipe means 730. A bypass port 732 is shown in FIG. 20 which also shows the relaxed state under pressure P1 (solid line) and the energized state under pressure P2 (dotted line).

Closed-Loop System to Complete Cased Wells with Smart Shuttles

Any type of Smart Shuttle with Retrieval Sub may be used to complete cased wells. However, the above PCP/ESM Smart Shuttle is particularly attractive. This PCP/ESM Smart Shuttle may be wireline conveyed as shown in FIG. 19, or may be "tubing conveyed", or may be "tubing with wireline conveyed" as desired. The PCP/ESM Smart Shuttle is particularly useful for the close-loop completion of oil and gas wells. Several embodiments of the invention involving the closed-loop completion of oil and gas wells follow in FIGS. 21 and 22.

Figure 21:
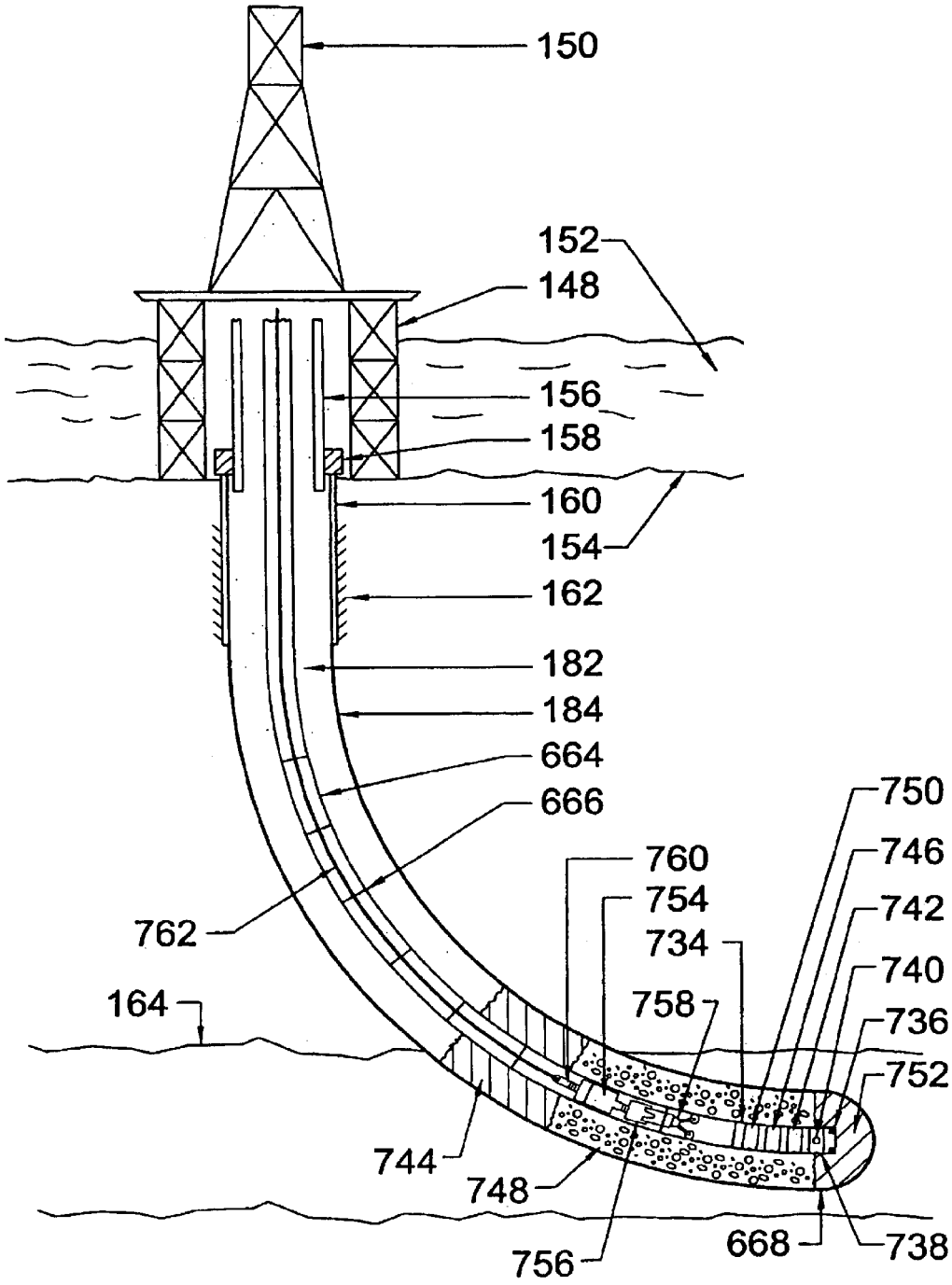
FIG. 21 shows a standard casing string, or other pipe, in the process of being completed with a Smart Shuttle, a Retrieval Sub, and a Casing Saw, along with other completion devices that had previously been installed within the casing string during the closed-loop completion of the well.

As a brief review, FIGS. 18 and 18A showed a casing being disposed in the wellbore. FIGS. 19 and 20 showed a particular type of Smart Shuttle that can be used to complete any "pipe means" disposed in a wellbore, where this "pipe means" specifically includes a casing string. FIG. 21 shows a casing string in the process of being completed with a Smart Shuttle and other devices disposed in the casing string.

All the numerals in FIG. 21 through numeral 666 have been previously defined heretofore in the specification. In FIG. 21, the final length of casing 734 possesses "pipe mounted latching means" 736 that is also called a "landing means". This "landing means" was previously described in relation to FIG. 18A, and in its simplest form, it provides at least a mechanical stop for various devices. Wiper plug 738 with one-way valve means 740 had been pumped down from the surface and it wiped drilling mud off the interior of the casing and it came to rest against the "landing means". Then, perforable wiper plug 742 pumped down a charge of cement 744 shown in FIG. 21. Then, perforable wiper plug 746 pumped down a charge of gravel 748. Then, solid wiper plug 750 pumped down the final charge of cement 752. As further shown in FIG. 21, a Smart Shuttle 754 having a Retrieval Sub 756 is attached to a Casing Saw 758 that in turn saws slots in the casing as previously described. The cable head 760 is attached to the Smart Shuttle as previously described, and in turn, it is attached to the wireline 762. The operations shown in FIG. 21 may be executed substantially under the control of a computer system which is another example of a "closed-loop completion system". One embodiment of such a computer system is shown in FIG. 14. It should also be noted that if the above wiper plugs are deployed into the wellbore by initial attachment to the Retrieval Sub, then these wiper plugs can also be described as "smart wiper plugs".

The Smart Shuttle shown as element 754 in FIG. 21 is an example of "a conveyance means".

Figure 22:
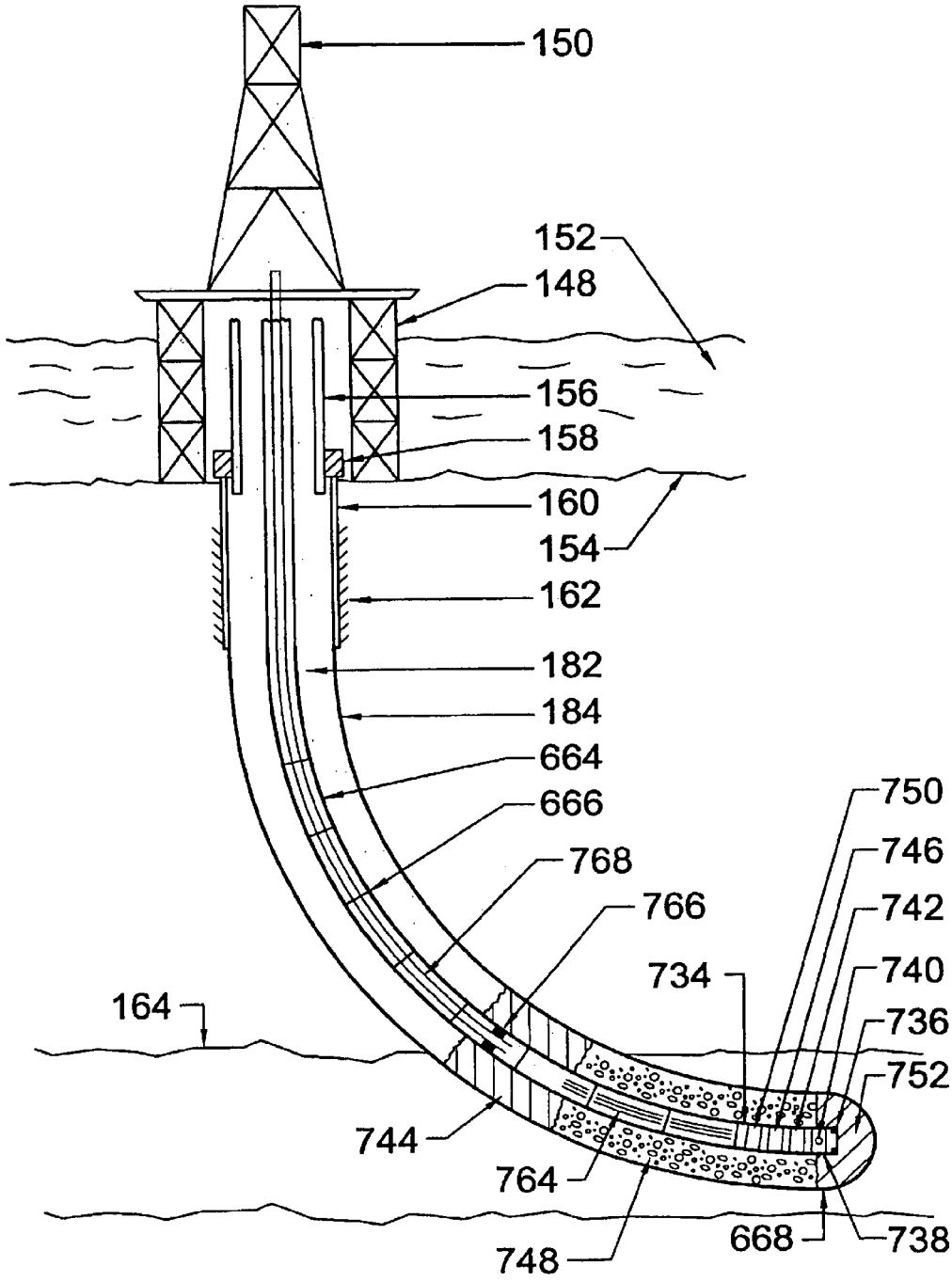
FIG. 22 shows a section view of the pump-down single zone packer apparatus installed in a standard casing string, or other pipe, following completion operations with the Smart Shuttle and other completion devices shown in FIG. 21, and such pump-down single zone packer apparatus is particularly useful for the closed-loop completion of oil and gas wells.

FIG. 22 shows a section view of the pump-down single zone packer apparatus installed in the casing string. The slots 764 made by the Casing Saw are evident in the casing string. The pump-down single zone packer apparatus 766 is shown in FIG. 22 and it had been previously described in relation to element 658 in FIG. 17. As is the case in FIG. 17, in several preferred embodiments of the invention, one or more downhole sensors, related electronics, batteries or other power source, and one or more communication systems within the pump-down single zone packer apparatus 766 provide information to a computer system controlling the well completion process. The pump-down single zone packer apparatus 766 is attached to coiled tubing 768 as previously described in relation to FIG. 17. Again, the operations shown in FIG. 22 may be executed substantially under the control of a computer system which is another example of a "closed-loop completion system". Again, one embodiment of such a computer system is shown in FIG. 14. FIG. 14 provides for the computer operation of a coiled tubing rig because of the following quote from the text that describes FIG. 14: "Electronics interfacing system 572 also provides power and electronic control of any coiled tubing rig designated by element 591 (not shown in FIG. 14), including the coiled tubing drum hydraulic motor and pump assembly of that coiled tubing rig, but such a coiled tubing rig is not shown in FIG. 14 for the purposes of simplicity."

Definitions of Closed-Loop Systems and Automated Systems to Complete Oil and Gas Wells The Glossary of Ref. 4 described earlier defines the term "to complete a well" to be the following: "to finish work on a well and bring it to productive status. See well completion." The term "to complete a well" may also be used interchangeably with the term "to complete a wellbore".

The Glossary of Ref. 4 further defines term "well completion" to be the following: "1. the activities and methods of preparing a well for the production of oil and gas; the method by which one or more flow paths for hydrocarbons is established between the reservoir and the surface. 2. the systems of tubulars, packers, and other tools installed beneath the wellhead in the production casing, that is, the tool assembly that provides the hydrocarbon flow path or paths." To be precise for the purposes herein, the term "completing a well" or the term "completing the well" are each separately equivalent to performing all the necessary steps for a "well completion".

For the purposes herein, in several preferred embodiments of the invention, the term "well completion system" shall mean apparatus and required procedures that are used "to complete a well" and which are capable of providing the equipment and methods of operation necessary for "well completion".

For the purposes herein, in several preferred embodiments of the invention, the term "automated well completion system", or "automated system for well completion", or "automated system to complete an oil and gas well" shall mean the following: a well completion system having at least one downhole component located in the well that may also have one or more uphole components located in the vicinity of a drilling rig which are controlled by a computer executing programmed steps during at least "one significant portion of the well completion process"—a term defined below. Here, "uphole" may be on the ocean bottom near the present location of the drilling rig or near the location were the drilling rig was previously positioned during the drilling of the well.

For the purposes herein, in several embodiments of the invention, the word "automated" as it refers to any process in many embodiments of the invention shall mean that the process is simply under computer control.

For the purposes herein, and for several preferred embodiments of the invention, the term "closed-loop system for well completions", or "a closed-loop system to complete wellbores", or "a closed-loop system to complete oil and gas wells", shall mean the following: an automated well completion system having at least a downhole component and/or one or more uphole components controlled by a computer, that has at least one downhole sensor and at least one uphole sensor that provide information to the computer, whereby the execution of the programmed steps by the computer to control the components takes into account the information from the uphole and the downhole sensors to optimize and/or change the steps executed by the computer to complete the well. Here, "uphole" may be on the ocean bottom near the present location of the drilling rig or near the location were the drilling rig was previously positioned during the drilling of the well. Further, the downhole component may also include the downhole sensor. Yet further, any uphole component may also include any uphole sensor.

For the purposes herein, in several preferred embodiments of the invention, the phrase "closed-loop" as it refers to any process in many embodiments of the invention shall mean that the process is not only under computer control, but in addition, this process uses at least some downhole information that is communicated to the surface to optimize and/or change the steps executed by the computer to complete the well.

As an example of the above, the title of an invention for many preferred embodiments herein described could have read as follows: "CLOSED-LOOP AUTOMATED SYSTEM TO COMPLETE OIL AND GAS WELLS". However, from the above definitions, the term "closed-loop" implies that an automated system is executing steps that depend in part on information communicated from at least one downhole sensor to the surface. Therefore, for certain preferred embodiments, the word "automated" following "closed-loop" would be redundant.

As another example of the above, the title of an invention for many preferred embodiments herein described could also have read as follows: "AUTOMATED SYSTEM TO COMPLETE OIL AND GAS WELLS". However, using the exact phrases as defined herein, this might not necessarily include all "closed-loop" systems having at least one downhole sensor.

For the purposes herein, in several preferred embodiments of the invention, the term "one significant portion of the well completion process", shall be defined as the series of steps executed by the computer that sends a device attached to a wireline or coiled tubing into any depth in the well and returns the wireline or coiled tubing to the surface—whether or not the device is installed in the well or is attached to the wireline or coiled tubing. The definition of the term "one significant portion of the well completion process" also includes the step of sending a device attached to a wireline or coiled tubing into the well during "one trip", meaning "one trip down" into the well and "one trip back" to the surface. Here, the term "one trip" does not necessarily imply any time duration, and this step may be done in an hour, a day, or many years in the case of semi-permanently installed instrumentation for reservoir monitoring purposes that are installed during the well completion process. It should also be stated for clarity that the term "well completion process" in some preferred embodiments also includes the steps of installing into the wellbore devices to monitor production for long periods of time.

Following the above described steps of installing into the wellbore devices to monitor production, several preferred embodiments also provide steps for installing into the wellbore devices to adjust, change, or control the production of oil and gas from within the wells. In several embodiments, the step to monitor production and the step to control production may be executed during the sequence of steps that are necessary to complete the oil and gas well.

Alternatively, and in several embodiments, the step to monitor production and the step to control production may be executed following the sequence of steps that are necessary to complete the oil and gas well. For the sake of brevity, several alternative sequence of events evident from the above disclosure will not be further discussed here. Therefore, production monitoring means to monitor production may be installed during, or after the well completion process. Therefore, production controlling means may be installed during, or after the completing the well. It should also be realized that the means to monitor production may include means to monitor the total hydrocarbon production, and/or to separately monitor the oil and/or gas and or/water production. Further, the means to control production may include means to control the total production of hydrocarbons, and/or to separately control the production of the oil and/or gas and/or water from the wellbore.

To further elaborate on the previous paragraph, various preferred embodiments include at least one sensor remaining in the wellbore as means to monitor the production of hydrocarbons from the wellbore after completing the wellbore. Other preferred embodiments include means to control the production of hydrocarbons that are disposed into the wellbore and remain installed in the wellbore after completing the wellbore. And further, in yet other preferred embodiments, the means to monitor the production of hydrocarbons from the wellbore may also be used to adjust the means to control the production of hydrocarbons from the wellbore following the completion of the wellbore, which latter means may be defined herein as an "adjustable means to control the production of hydrocarbons" from within the wellbore. Yet further, other embodiments provide for the "remote actuation of the adjustable means to control the production of hydrocarbons", a term defined herein. The remote actuation includes remote actuation from the surface of the earth, from an offshore drilling platform, or from any device installed within the wellbore, such as from the means to monitor the production of hydrocarbons within the wellbore. In yet further embodiments of the invention, a closed-loop system to complete a well for producing hydrocarbons from the earth may also be used for the second purpose as a closed-loop system to monitor, control, and maintain production from the well.

For the purposes herein, in several preferred embodiments of the invention, the phrase "computer system", and/or the word "computer", and/or the phrase "computer means", shall mean: one or more electronic machines which by means of stored instructions and information, performs rapid, calculations and/or compiles, correlates, and selects data including remote sensory data, that is used to control the well completion process and related processes through a series of steps executed by the machine or machines, each of which may have a data bus, a processor, a nonvolatile memory, a read only memory, an analogue to digital converter, a controller, electronic systems, and any other means necessary to control an automated well completion system. It should be explicitly stated that the steps actually executed by the computer system may change or be altered as a result of data provided by one or more remote sensors. The term "computer system", or the word "computer", shall also explicitly include one or more "distributed computers" linked together by suitable data communications systems, or "communications means". For example, and for the purposes herein, the term "computer system", or the word "computer", shall mean the combination of any or all computers at the wellsite, and any or all remotely located computers, such as computers onshore during offshore drilling and completion operations, and all of their associated communications links, and other related computation means and data banks, which together comprise a "distributed computer system" or simply as a "computer system means". Accordingly, and under various circumstances, the phrases "computer system", "computer", "computer means", "distributed computer system", and "computer system means" may be used equivalently as the case may be.

For the purposes herein, in many preferred embodiments, the term "wireline" shall mean a flexible, armor encapsulated, collection of insulated wires that may include one or more optical cables, and where the collection of insulated wires often includes 7 conductors, but which may in principle mean any number of such conductors capable of carrying any amount of current, providing any voltage levels required, and providing any net required power that is to be delivered downhole. Such wirelines are routinely used in the oil and gas industries for logging, production, and for other proposes.

Using the above definitions, it should also be noted that another embodiment of a closed-loop system to complete oil and gas wells is comprised of a Retrieval Sub that is suitably attached to a wireline-conveyed well tractor. In this embodiment, the wireline-conveyed well tractor is used to convey downhole various Smart Completion Devices attached to the Retrieval Sub for deployment within the wellbore to complete oil and gas wells. In one embodiment, the Smart Completion Device attached to the Retrieval Sub during conveyance downhole provides information to the computer system, and this information affects the series of steps leading to the completion of the oil and gas well. Therefore, one embodiment is a wireline-conveyed well tractor automated under the control of a computer system that also possesses means to convey uphole various sensory data that affects the series of steps to complete the well. Consequently, this embodiment is also yet another example of a closed-loop system to complete oil and gas wells.

It is also to be noted that in preferred embodiments of the invention, the well is initially completed using a closed-loop system. Consequently, this initially completed well is "completed a first time", a term defined herein. If there are problems with the initial production, or if there are ongoing production problems, the well may be "completed a second time", a term defined herein. As is often the case with aging reservoirs, initially satisfactory hydrocarbon producing intervals may begin to produce progressively unacceptably large amounts of water in time. Accordingly, it may be required to complete the well a second time, or using other words, it may be necessary to "recomplete the well", a term defined herein. The term "to recomplete the well" may also refer to any successive third, fourth, fifth, etc. completion of a given well. Therefore, after completing a well a first time, the well may be recompleted, thereby completing the well a second time to optimize the production of hydrocarbons from the earth.

Closed-Loop Systems and Automated Systems in Relation to FIGS. 21 and 22

In relation to FIG. 21, the Smart Shuttle, the Retrieval Sub, and any one of the Smart Completion Devices including the smart wiper plugs, may have one or more downhole sensors, related electronics, batteries or other power source, and one or more communications systems to provide measured information to the computer system controlling the well completion process.

In relation to FIG. 22, and in several preferred embodiments of the invention, one or more downhole sensors, related electronics, batteries or other power source, and one or more communication systems within the pump-down single zone packer apparatus 766 provide information to the computer system controlling the well completion process.

Therefore, in relation to FIGS. 21 and 22, many different devices may be conveyed into the well having sensors that provide information to a computer system. An example of such a computer system is element 556 in FIG. 14. Various embodiments describe the computer system in FIG. 14 controlling the steps to complete the oil and gas well as shown in FIGS. 21 and 22.

Put differently, in various embodiments shown in FIGS. 21 and 22, the computer system 556 is used to control the well completion process. The steps in this well completion process depend in part upon information provided from the downhole sensors described in relation to FIGS. 21 and 22.

Accordingly, it is now evident that the disclosure related to FIGS. 21 and 22 describe an automated well completion system for producing hydrocarbons from a wellbore in the earth that is substantially under the control of a computer system that executes a sequence of programmed steps.

Further, disclosure related to FIGS. 21 and 22 describe a closed-loop system to complete a well for producing hydrocarbons from the earth.

Yet further, disclosure related to FIGS. 21 and 22 provide a method of completing a wellbore to produce hydrocarbons from the earth that is substantially under the control of an automated computer system that executes a sequence of programmed steps.

And finally, disclosure related to FIGS. 21 and 22 provide a method to complete a wellbore to produce hydrocarbons from the earth that is substantially under the control of a closed-loop automated system that executes a sequence of programmed steps, whereby the steps depend upon information obtained from at least one sensor located within the wellbore, and whereby the steps are executed during one significant portion of the well completion process.

In relation to FIGS. 1, 2, 3, 4, 5, 6, 7, 8, 9, 10, 17, 17A, 18, 18A, 19, 20, 21, and 22, it is evident that after completing the wellbore, the wellbore is comprised of at least a borehole in a geological formation that surrounds a pipe located within the borehole, and this pipe may be any one of the following: a metallic pipe; a casing string; a casing string with any retrievable drill bit removed from the wellbore; a steel pipe; a drill string; a drill string possessing a drill bit that remains attached to the end of the drill string after completing the wellbore; a drill string with any retrievable drill bit removed from the wellbore; a coiled tubing; a coiled tubing possessing a mud-motor drilling apparatus that remains attached to the coiled tubing after completing the wellbore; or a liner.

Smart Shuttle Assisted Coiled Tubing Deployment

As a brief review, FIG. 22 shows a section view of the pump-down single zone packer apparatus installed in the casing string. In this simple application of coiled tubing technology, the pump-down single zone packer apparatus 766 was pumped down with pressure from the surface and with the assistance of force added by the mechanical "injectors" that were described in relation to FIG. 17.

Figure 23:
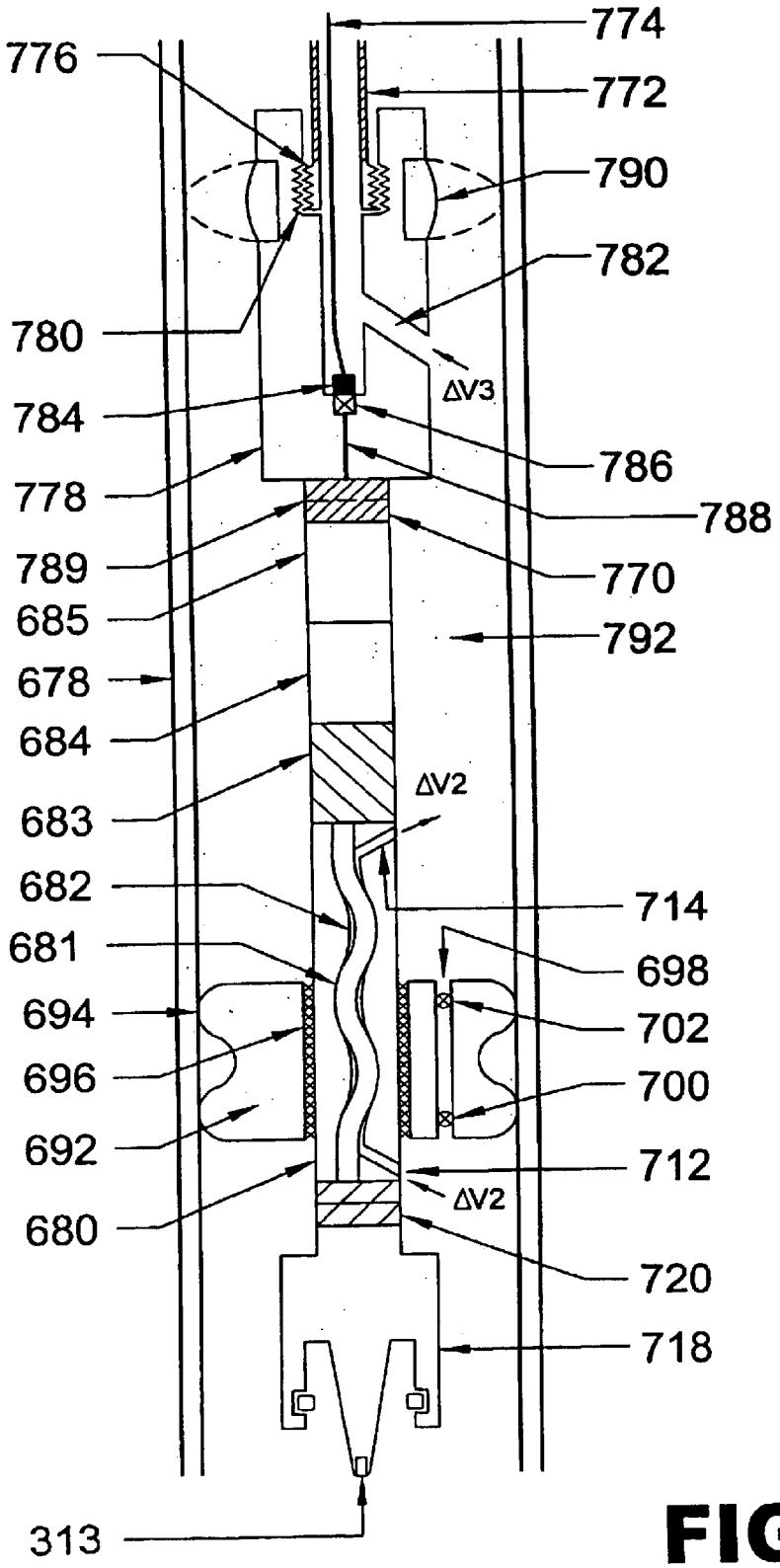
FIG. 23 shows a Smart Shuttle and Retrieval Sub in a standard casing, or other pipe, being conveyed downhole which are attached to a coiled tubing having a wireline within the tubing that is particularly useful for the closed-loop completion of oil and gas wells.

However, the Smart Shuttles may be conveyed downhole with coiled tubing. Such a Smart Shuttle with Retrieval Sub that is conveyed downhole by coiled tubing is shown in FIG. 23. In fact, the coiled tubing conveyed Smart Shuttle in FIG. 23 is forced downhole by three different mechanisms: (a) mechanical "injectors" at the surface force the coiled tubing downward at the wellhead; (b) the PCP/ESM assembly may be used to assist by "pulling" the Smart Shuttle into the wellbore; and (c) yet further, hydraulic forces from the surface also force the Smart Shuttle into the wellbore. That these three independent methods may be used to force the Smart Shuttle with its attached Retrieval Sub downward into the wellbore will become better apparent with the following description of the elements in FIG. 23.

All the elements in FIG. 23 through element 720 have been previously described. The Progressive Cavity Pump is labeled with element 680. The Progressive Cavity Pump is coupled to gear box 683 that is in turn coupled to the Electrically Submersible Motor 684, which in turn is connected electronics assembly 685 having any downhole computer, sensors, and communications system, which in turn is connected to the quick change collar 770. The assembly below the quick change collar in FIG. 23 is often referred to as the Progressive Cavity Pump/Electrical Submersible Motor assembly that is abbreviated as the "PCP/ESM assembly". Therefore, the "PCP/ESM assembly" is attached to the quick change collar 770 in FIG. 23.

Coiled tubing 772 has wireline 774 installed within it. Coiled tubing 772 also has threaded end 776. Tubing Termination Assembly 778 has threads 780 that mate to the threaded end 776 of the coiled tubing. So, the Tubing Termination Assembly is suspended within the casing from the threaded end 776 of the coiled tubing. Any fluids that flow into, or out of, the coiled tubing are conducted to and from the interior of the casing through fluid channel 782. Valve 783 located within fluid channel 782 can be used to positively shut off fluid flow through the channel, but valve 783 is not shown in FIG. 23 solely for the purposes of simplicity. For many of he following embodiments, it is assumed that this valve 783 is open unless explicitly stated otherwise. The wireline 774 is connected to top submersible plug 784 that connects to lower submersible plug 786 which in turn passes the electrical conductors from the wireline to the quick change collar. The bundle of electrical conductors passing to the quick changer collar is designated with the numeral 788 in FIG. 23. Within the quick change collar is yet another electrical plug assembly that provides power and electrical signals through a bundle of wires to the "PCP/ESM assembly" that is not shown in FIG. 23 solely for the purposes of simplicity. Typical design and assembly procedures used in the industry are assumed throughout this application. It is often the case that a quick change collar surrounds male and female mating electrical connectors, which is typically the case in "logging tools" used in the wireline logging industry. Those connectors mate at the location specified by the dashed line 789 shown on the interior of the quick change collar in FIG. 23.

In addition, the Tubing Termination Assembly 778 also possesses expandable packer 790. Upon command from the surface, this expandable packer can be inflated within the casing to seal against the casing as may be required during typical well completion procedures, and typical workover procedures, that are used in the industry. This expandable packer can also be used for a second purpose of forcing the Smart Shuttle into the wellbore as described below.

With reference to FIG. 23, the Smart Shuttle may be forced downhole by three mechanisms that are described in separate paragraphs as follows.

First, mechanical "injectors" at the surface force the coiled tubing downward at the wellhead. These mechanical "injectors" have been previously described.

Second, the electrically energized Progressive Cavity Pump forces fluid ΔV2 into the lower side port 712 of the PCP and out of the upper side port 714 of the PCP, and the Smart Shuttle is conveyed downhole. If this method is used by itself, then no fluid would necessarily flow to the surface through fluid channel 782. It could, but it is not necessary in this embodiment, and under the circumstances described.

Third, and in analogy with the pump-down single zone packer apparatus 658 described in FIG. 17, the expandable packer 790 in FIG. 23 is inflated so as to make a reasonable seal against the casing, but not so firmly so as to lock the device in place. In FIG. 23, the solid line labeled with numeral 790 shows the uninflated state of the expandable packer, and the dotted line shows the expanded state of expandable packer 790. Then, in analogy with fluid flow described in FIG. 17, fluid forced into the upper wellbore will force the apparatus attached to the expandable packer downward into the wellbore, and any fluid ΔV3 displaced is forced upward through fluid channel 782 and into the interior of the coiled tubing which in turn flows to the surface in analogy with previous description of fluid flow through coiled tubing to the surface in relation to FIG. 17.

In principle, all first, second, and third methods of conveyance downhole can be used simultaneously, provided that valves 698 and 700 are closed, and provided the Progressive Cavity Pump 680 is suitably energized.

For simplicity, the particular embodiment of the invention shown in FIG. 23 will be called in certain portions of the text that follows a "coiled tubing with wireline Smart Shuttle" abbreviated "CTWWSS", that is generally designated as numeral 792 in FIG. 23.

Any smart completion device may be attached to the Retrieval Sub 718 during any such conveyance downhole. For example, a casing saw or another packer can be installed on the Retrieval Sub so that many different services can be performed during one trip downhole. These include perforating, squeeze cementing, etc.—in fact many of the methods to complete oil and gas wells defined in the book entitled "Well Completion Methods", "Well Servicing and Workover", Lesson 4, from the series entitled "Lessons in Well Servicing and Workover", Petroleum Extension Service, The University of Texas at Austin, Austin, Tex., 1971 (previously defined as "Ref. 2" above), an entire copy of which is incorporated herein by reference.

The apparatus in FIG. 23 may be used to test production or to assist production if it is used in another manner. In this embodiment, an electrically actuated casing lock 794 (not shown in FIG. 23) is attached to the Retrieval Sub 718. It has passages through it so that hydrocarbons below it can pass through it if necessary, but it otherwise locks the apparatus in FIG. 23 to the inside of the casing. Once locked in place, the PCP/ESM assembly can pump hydrocarbons through lower side port 712 of the PCP and out of the upper side port 714 of the PCP. Thereafter, hydrocarbons are pumped through fluid channel 782 of the Tubing Termination Assembly 778 in FIG. 23 provided that the expandable packer 790 is suitably inflated. There are many variations on this embodiment of the invention but they are not further described here solely in the interests of brevity.

The "coiled tubing with wireline Smart Shuttle" abbreviated "CTWWSS" as generally designated as numeral 792 in FIG. 23 is an example of "a conveyance means".

Figure 24:
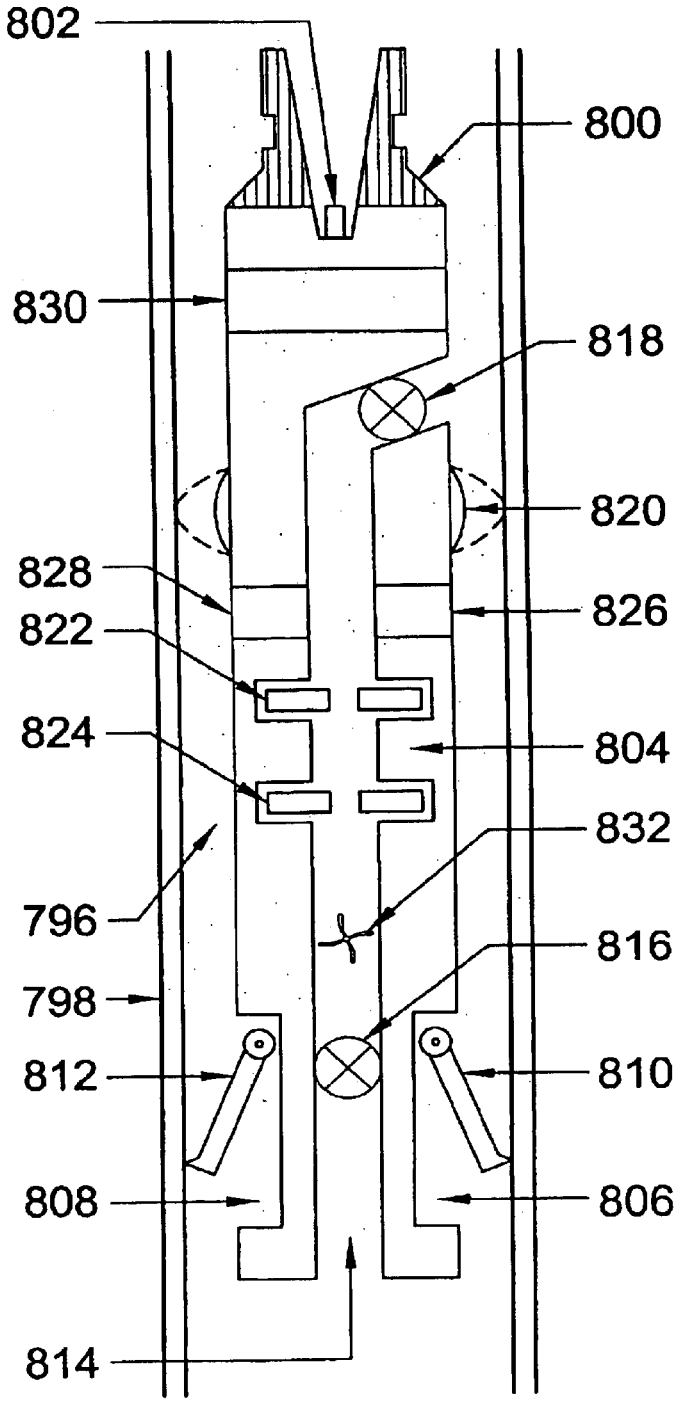
FIG. 24 shows a Universal Smart Completion Device (USCD) that is conveyed downhole by attachment to a Smart Shuttle and its Retrieval Sub that is particularly useful as an element in a closed-loop system to complete oil and gas wells.

Universal Smart Completion Devices for Closed-Loop Systems to Complete Oil and Gas Wells FIG. 24 shows a Universal Smart Completion Device (USCD) that is generally designated by the element 796. The USCD in FIG. 24 is used in several preferred embodiments of closed-loop systems to complete oil and gas wells. The USCD is disposed within "pipe means" 798 that includes a casing, drill pipe, tubing, a metallic pipe of any type, any type of pipe, etc. Upper attachment apparatus 800 of the USCD provides similar apparatus and mechanical functions as provided by element 620 in FIG. 16, and by element 206 of the Retrieval Instrumentation Package in FIG. 7. The USCD also has top electrical connector 802 that mates to the retrieval sub electrical connector 313 shown in FIG. 9 and to connector 313 shown in FIG. 23. The body 804 of the USCD has first recession 806 and second recession 808. First controlled casing locking mechanism 810 is conveyed downhole with its arm retracted within the first recession. Upon a suitable command, it is locked into place against the inside of the casing or pipe. Second controlled casing locking mechanism 812 is conveyed downhole with its arm retracted within the second recession. Upon a suitable command, it is also locked into place against the inside of the casing or pipe. Internal bore 814 within the USCD allows fluids to flow through the interior of the USCD under certain circumstances. Lower valve 816 of the USCD may be opened or closed on command. Upper valve 818 of the USCD may be opened or closed on command.

The USCD in FIG. 24 also possesses expandable packer 820. Upon command from the surface, this expandable packer can be inflated within the casing (or pipe) to seal against the casing as may be required during typical well completion procedures and typical workover procedures that are used in the industry. The solid line shows the expandable packer in a position where fluids can flow by it between the USCD and the pipe wall. The dashed line shows the expandable packer in a position where fluids cannot flow by it between the USCD and the pipe wall.

First internal fluid flow control valve 822 is used to control the flow of fluids through the internal bore 814 within the USCD. Second internal fluid flow control valve 824 is also used to control the flow of fluids through the internal bore 814 within the USCD. The pressure in the fluids flowing through the internal bore of the USCD is measured with pressure gauge 826 in FIG. 24. Ancillary measurement package 828 measures the temperature, and provides any other desirable physical measurements such as measurements of the "basic flow rate, or the detailed measurements of the relative amounts of water, oil and gas flowing by this measurement package. Ancillary measurement package 828 provides any downhole sensors, or sensor means, and any downhole monitors, or monitoring means.

In FIG. 24, USCD electronics package 830 provides all necessary electronics to operate the upper and lower valves, to operate the first and second controlled casing locking mechanisms, to operate the first and second internal fluid flow control valves, to accept communicated commands from the surface and/or from the Smart Shuttle and its Retrieval Sub, to provide all desired downhole sensors, to provide measurements from the downhole sensors, and to provide communications to the surface and/or the Smart Shuttle and its Retrieval Sub. Virtually any electronic, sensor, or sensor measurement function previously described with regards to a Smart Shuttle, a Retrieval Sub, a Smart Completion Device, and/or a Retrievable Instrumentation Package may be incorporated into the USCD as different embodiments of the invention herein.

Electronics package 830 also possesses suitable power sources to provide any required power to the USCD such as batteries and/or batteries that may be recharged through the wireline if the USCD is connected to the Retrieval Sub of a Smart Shuttle. Such rechargeable batteries may be recharged downhole or uphole as desired by the operator. It may be desirable to have additional features incorporated into the USCD for different classes of well completions. However, such additional electronics and other features would be conveniently added to the USCD in a modular fashion so that in this preferred embodiment, no substantial changes would be required to the mechanical apparatus shown in FIG. 24.

In addition to batteries, or rechargeable batteries to suitably power the USCD as described above, a motor generator system may be also provided in several embodiments of the USCD shown in FIG. 24 that is generally designated with the numeral 832 (which comprises equivalent individual elements such as elements 264, 266, 268, 270, and 272 of the mud-motor generator system in FIG. 7). Fluids flowing through the motor generator are used to generate power in analogy with the mud-motor generator system described in FIG. 7. These fluids are often production fluids under high pressure that are in the process of flowing to the surface. In low pressure reservoirs, fluids pumped to the surface may also similarly impart energy to the USCD. Therefore, even after the USCD has been disconnected from the Retrieval Sub, it may still communicate to the Smart Shuttle and/or to the surface by using power from the motor generator, any batteries present, and suitable acoustic telecommunication devices, located in the electronics package 830—which is just one example of this preferred embodiment. Other communications systems located in electronics package 830 may be used in yet other embodiments to communicate between the USCD and the surface. In another embodiment, the motor generator may be used to charge rechargeable batteries in the electronics package 830 if the USCD is disconnected from the Retrieval Sub and its associated Smart Shuttle and wireline.

Measurements performed by the USCD, and the status of various valves, etc. are conveyed to a computer system, such as computer system 556 in FIG. 14. That computer system processes the information, and determines a sequence of steps in part related to the information that it has received. Accordingly, suitable commands are sent downhole during the process of completing a well. Therefore, the USCD in FIG. 24 is a portion of one embodiment of a closed-loop system to complete oil and gas wells.

Communications from the USCD to the computer system may be accomplished in at least the following manners: (a) if the USCD is attached to its Retrieval Sub, Smart Shuttle, and wireline, then communications may be sent from the USCD over the wireline to the computer system; or (b), if the USCD is not attached to its Retrieval Sub, then an acoustic signal or an electromagnetic signal generated within the USCD may be sent to the Smart Shuttle, and that signal may then be interpreted in the Smart Shuttle and suitably electronically relayed to the surface over the wireline; or (c) Smart Cricket Repeaters may be used as described in the U.S. Disclosure Document No. 465344 that is entitled "Smart Cricket Repeaters In Drilling Fluids for Wellbore Communications While Drilling Oil and Gas Wells" that was previously described above. Similar methods to (a), (b), and (c) may be used to convey commands and other information sent downhole to the USCD from the computer system on the surface.

Therefore, it is evident that any one USCD may be installed within any pipe means such as within a casing, a drill pipe, etc. In several preferred embodiments related to FIG. 24, any USCD installed within a wellbore possesses at least one sensor as means to monitor the production of hydrocarbons from the wellbore after completing the oil or gas well. In other preferred embodiments, means to control the production of hydrocarbons that are disposed into the wellbore and remain installed in the wellbore after completing the wellbore are provided such as internal fluid flow control valves 822 and 824 of the USCD. In yet other preferred embodiments of the USCD in FIG. 24, the means to monitor the production of hydrocarbons from the wellbore may also be used to adjust the means to control the production of hydrocarbons from the wellbore following the completion of the wellbore, which latter means may be defined herein as an "adjustable means to control the production of hydrocarbons" from within the wellbore. Yet further, other embodiments provide for the "remote actuation of the adjustable means to control the production of hydrocarbons", a term previously defined. The remote actuation includes remote actuation from the surface of the earth, from an offshore drilling platform, or from any device installed within the wellbore, such as from the means to monitor the production of hydrocarbons within the wellbore. In yet further embodiments of the invention, a closed-loop system to complete a well for producing hydrocarbons from the earth may also be used for the second purpose as a closed-loop system to monitor, control, and maintain production from the well.

Closed-Loop Completions of Multilateral Wellbores

Figure 25:
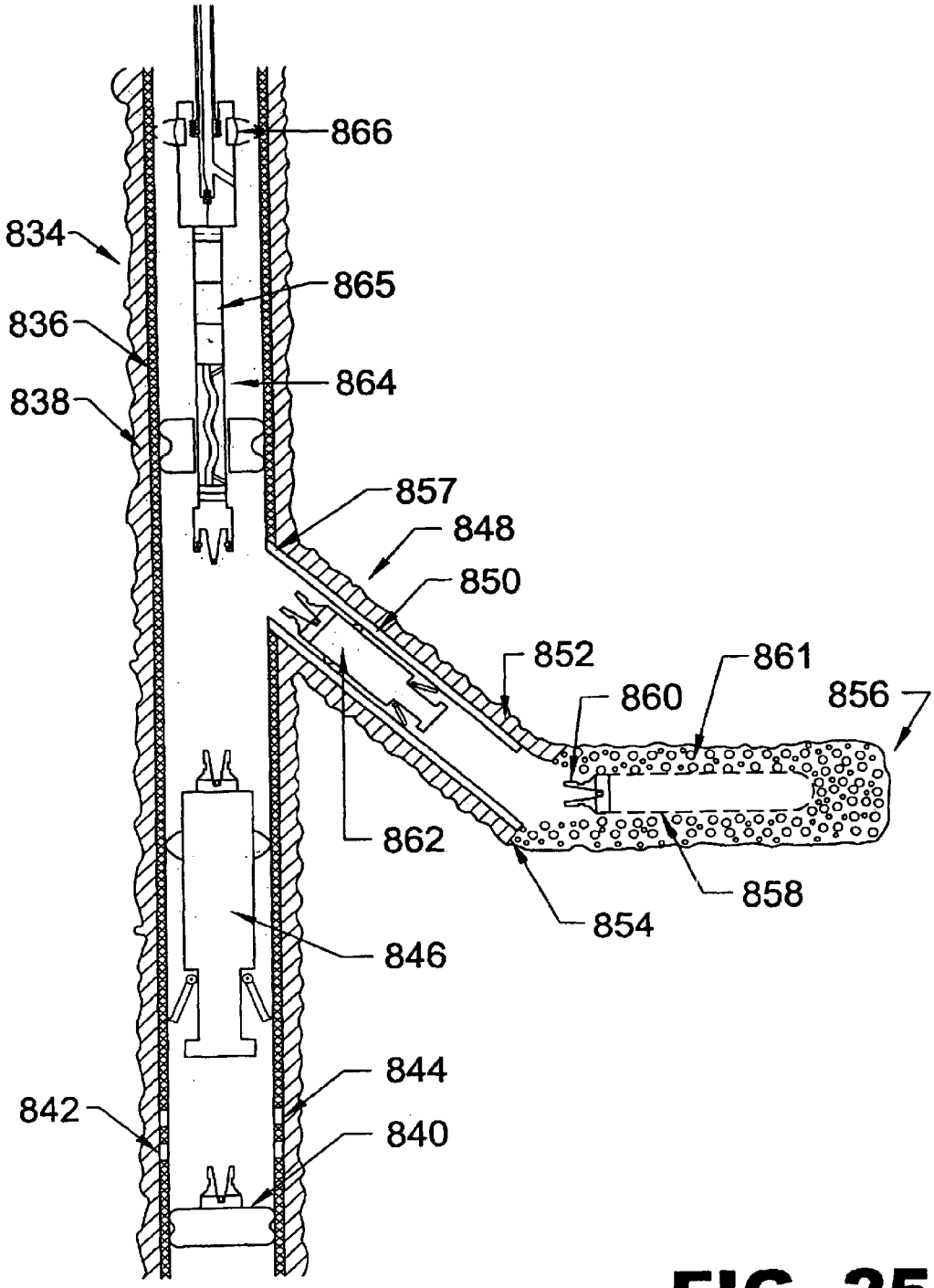
FIG. 25 shows two Universal Smart Completion Devices installed during closed-loop completion operations to make a TAML Level 5 Well Completion.

As another embodiment of closed-loop well completions, FIG. 25 shows two Universal Smart Completion Devices installed in wellbores to make a TAML Level 5 Well Completion. This is one category of well completion configurations defined by an industry group generally known as the "Technology Advancement of Multilaterals" ("TAML") group. The definitions of TAML Level well completions appear in at least the following references: (a) the article entitled "Multilateral Classification System with Example Applications" by Alan MacKenzie and Cliff Hogg, World Oil, January 1999, pages 55–61, an entire copy of which is incorporated herein by reference; and (b) Section 2, page 19, of the volume entitled "Multilateral Well Technology", having the author of "Baker Hughes, Inc.", that was presented in part by Mr. Randall Cade of Baker Oil Tools, that was handed-out during a "Short Course" at the "1999 SPE Annual Technical Conference and Exhibition", October 3–6, Houston, Tex., having the symbol of "SPE International Education Services" on the front page of the volume, a symbol of the Society of Petroleum Engineers, which society is located in Richardson, Tex., which was previously described above, an entire copy of which is incorporated herein by reference.

In FIG. 25, the main wellbore 834 has casing 836 installed that has been cemented into place with cement 838. That main wellbore was completed using Smart Shuttles, Retrieval Subs, and Universal Smart Completion Devices. A smart bridge plug 840 was set in place by a Smart Shuttle, and perforations 842 and 844 were made in the casing by a Smart Shuttle conveyed perforation gun.

In a preferred embodiment, a first USCD is shown installed in the main wellbore and it is labeled with numeral 846 in FIG. 25. The first USCD has its expandable packer in its inflated position, has its casing locking mechanisms deployed thereby locking the first USCD into place, has its upper and lower valves closed, and has the first and second fluid control valves set at some nominal level as described below.

Lateral wellbore 848 has casing 850 that is cemented in place with cement 852 to a point defined with numeral 854 and has an open-hole segment 856 in FIG. 25. The lateral wellbore casing 850 joins into the main wellbore casing 836 at the location generally designated with numeral 857 in FIG. 25. A screen 858 having upper attachment apparatus 860 capable of connecting to a Retrieval Sub was deployed into the open-hole lateral by a Smart Shuttle and its Retrieval Sub. Gravel 861 surrounds the screen 858 as is typically installed in certain completions. A second USCD is installed within the cased section of the lateral wellbore and it is labeled with numeral 862. The second USCD has its expandable packer in its inflated position, has its casing locking mechanisms deployed thereby locking the first USCD into place, has its upper and lower valves closed, and has the first and second fluid control valves set at some nominal level as described below.

As shown in FIG. 24, the particular embodiment of the Smart Shuttle and Retrieval Sub that deployed the various elements into the wellbore is the "coiled tubing with wireline Smart Shuttle" abbreviated "CTWWSS", previously generally designated as element 792 in relation to FIG. 23, which is generally designated with numeral 864 in FIG. 25. Other preferred embodiments of the CTWWSS may have suitable flex joints installed along its length so that the radius of curvature of the length of the tool can match what is required to complete the well, although no such flex joints are explicitly shown in FIG. 25. For example, such a flex joint designated by numeral 865 (not shown) may be installed in the CTWWSS between elements 684 and 685 in FIG. 23, however no such flex joint having numeral 865 is shown in FIG. 23, nor is it shown in FIG. 25, solely for the purposes of simplicity (although numeral 865 is reserved for this purpose in the event that future elaborations on this, and related, preferred embodiments are provided at a later time). From this disclosure, any Smart Shuttle and Retrieval Sub having at least one flex joint is yet another embodiment of this invention. Further, the CTWWSS has suitable measurement apparatus used in the industry such as MWD sensors, mechanical diverters, orientational apparatus, etc., to locate the position of the entry to the cased lateral wellbore at location 857, but that apparatus is not shown in FIG. 25 for the purposes of simplicity only.

Commingled production to the surface is perfectly acceptable for many applications provided that the production rates from the main wellbore and the lateral are acceptable and cause positive flow rates out of each portion of the geological formation produced. There are many ways to monitor commingled production.

A first way to monitor commingled production is as follows. Open the upper and lower valves in the first USCD, measure the flow rates, and send this information acoustically to the "CTWWSS" for relay to the surface. Then close these two valves. Then, open the upper and lower valves in the second USCD, measure the flow rates, and send this information acoustically to the CTWWSS to relay to the surface. Then, suitably adjust the first and second fluid control valves within either the first or second USCD to achieve the proper flow rates. Then, remove the CTWWSS, and replace with a "pump-down single-zone packer apparatus" of the type shown in FIG. 17. Here, of course, there is commingled production to the surface from perhaps several zones.

A second way is to actually sample the flow rates separately from the first USCD and from the second USCD. Please note that with expandable packer 866 of the CTWWSS in FIG. 25 expanded to form a seal on the inside of the casing, that any flow through the first USCD will be directed towards the surface. The Progressive Cavity Pump can be used to assist this flow, or valves 700 and 702 shown in FIG. 23 can be opened instead. The flow rate through the first USCD can the be adjusted by communications provided from the CTWWSS. Similarly, the flow rate can be sampled and adjusted through the second USCD by communications provided from the CTWWSS.

Third, the flow rates through the first and second USCD can be controlled from the surface, and suitable determinations made of the respective flow rates. There are many alternative preferred embodiments of this invention.

It should be noted that the Progressive Cavity Pump can be used to assist production, but in several preferred embodiments, it helps to have the CTWWSS suitably anchored in place. If the Retrieval Sub of the CTWWSS engages the first USCD, and if the first USCD is locked in place, the CTWWSS will also be locked in place. Similar comments apply to the second USCD. Alternatively, the Retrieval Sub of the CTWWSS can be fitted with a separate smart casing lock to be conveyed downhole that will lock the CTWWSS in place. Of course, production would need to bypass the casing lock, but there are many suitable designs for such a smart casing lock.

In the various preferred embodiments of the invention, measurements performed by the first and second USCD, and the status of various valves, etc. are conveyed to a computer system, such as computer system 556 in FIG. 14. That computer system processes the information, and determines a sequence of steps in part related to the information that it has received from remote sensors located downhole. Accordingly, suitable commands are sent downhole to optimize the steps to complete the wellbore.

Therefore, the first and second USCD's in FIG. 25 are a portion of a closed-loop system to complete oil and gas wells.

It should also be evident from the previous description how Smart Shuttles, Retrieval Subs, Smart Completion Devices, Universal Smart Completion Devices, and the associated computer system, or computer systems, communications systems, and downhole and uphole sensors, may be used to complete TAML Level 1, 2, 3, 4, 6, and 6s well completions.

Following the initial completion of the multilateral well a first time that is shown in FIG. 25, it may be necessary to recomplete the well a second time using apparatus and procedures already described herein. An example of such a recompletion might call for plugging the perforations 842 and 844, re-perforating the well at different vertical positions, and recompleting the well. It is evident from the above description how this may be accomplished. As another example, the screen 858 may become clogged in time, and it may be necessary to replace that screen. It is also evident from the above description how this may be accomplished. There are many variations on the invention to recomplete wells. However, a closed-loop system to complete and oil and gas well a first time can be used a second time to recomplete the well. Therefore, recompleting the wellbore in FIG. 25 is a minor variation of the invention. According, a closed-loop system to recomplete an oil and gas well is preferred embodiment of this invention.

The "coiled tubing with wireline Smart Shuttle" abbreviated "CTWWSS" as generally designated as numeral 864 in FIG. 25 is an example of "a conveyance means".

Closed-Loop Systems and Automated Systems in Relation to FIGS. 23, 24 and 25

Accordingly, it is now evident that the disclosure related to FIGS. 23, 24 and 25 describe an automated well completion system for producing hydrocarbons from a wellbore in the earth that is substantially under the control of a computer system that executes a sequence of programmed steps.

Further, disclosure related to FIGS. 23, 24, and 25 describe a closed-loop system to complete a well for producing hydrocarbons from the earth.

Yet further, disclosure related to FIGS. 23, 24 and 25 provide a method of completing a wellbore to produce hydrocarbons from the earth that is substantially under the control of an automated computer system that executes a sequence of programmed steps.

And finally, disclosure related to FIGS. 23, 24 and 25 provide a method to complete a wellbore to produce hydrocarbons from the earth that is substantially under the control of a closed-loop automated system that executes a sequence of programmed steps, whereby the steps depend upon information obtained from at least one sensor located within the wellbore, and whereby the steps are executed during one significant portion of the well completion process.

In relation to FIGS. 23, 24, and 25, and in further reference to FIGS. 1, 2, 3, 4, 5, 6, 7, 8, 9, 10, 17, 17A, 18, 18A, 19, 20, 21, and 22, it is evident that after completing the wellbore, the wellbore is comprised of at least a borehole in a geological formation that surrounds a pipe located within the borehole, and this pipe may be any one of the following: a metallic pipe; a casing string; a casing string with any retrievable drill bit removed from the wellbore; a steel pipe; a drill string; a drill string possessing a drill bit that remains attached to the end of the drill string after completing the wellbore; a drill string with any retrievable drill bit removed from the wellbore; a coiled tubing; a coiled tubing possessing a mud-motor drilling apparatus that remains attached to the coiled tubing after completing the wellbore; or a liner.

In view of the fact that any USCD may have downhole sensors and downhole monitors, it is evident that disclosure related to FIGS. 23, 24, and 25 describe well completion methods wherein at least one sensor remains in the wellbore as means to monitor the production of hydrocarbons from the wellbore after completing the wellbore.

In view of the fact that any USCD may have downhole adjustable means to control production, it is evident that disclosure related to FIGS. 23, 24 and 25 describe well completion methods wherein adjustable means to control the production of hydrocarbons are disposed into the wellbore and remain installed in the wellbore after completing the wellbore.

In view of the fact that the USCD may further have suitable monitoring means, it is evident that disclosure related to FIGS. 23, 24, and 25 describe well completion methods wherein the means to monitor the production of hydrocarbons from the wellbore is used to adjust the means to control the production of hydrocarbons from the wellbore.

In view of the disclosure particularly related to FIG. 25, it is evident that disclosure related to FIGS. 23, 24, and 25 describe a closed-loop system to complete a well for producing hydrocarbons from the earth, whereby following the completion of the well, the closed-loop system is also used to monitor, control, and maintain production from the completed well.

Closed-Loop Subsea Systems to Complete Oil and Gas Wells

Figure 26:
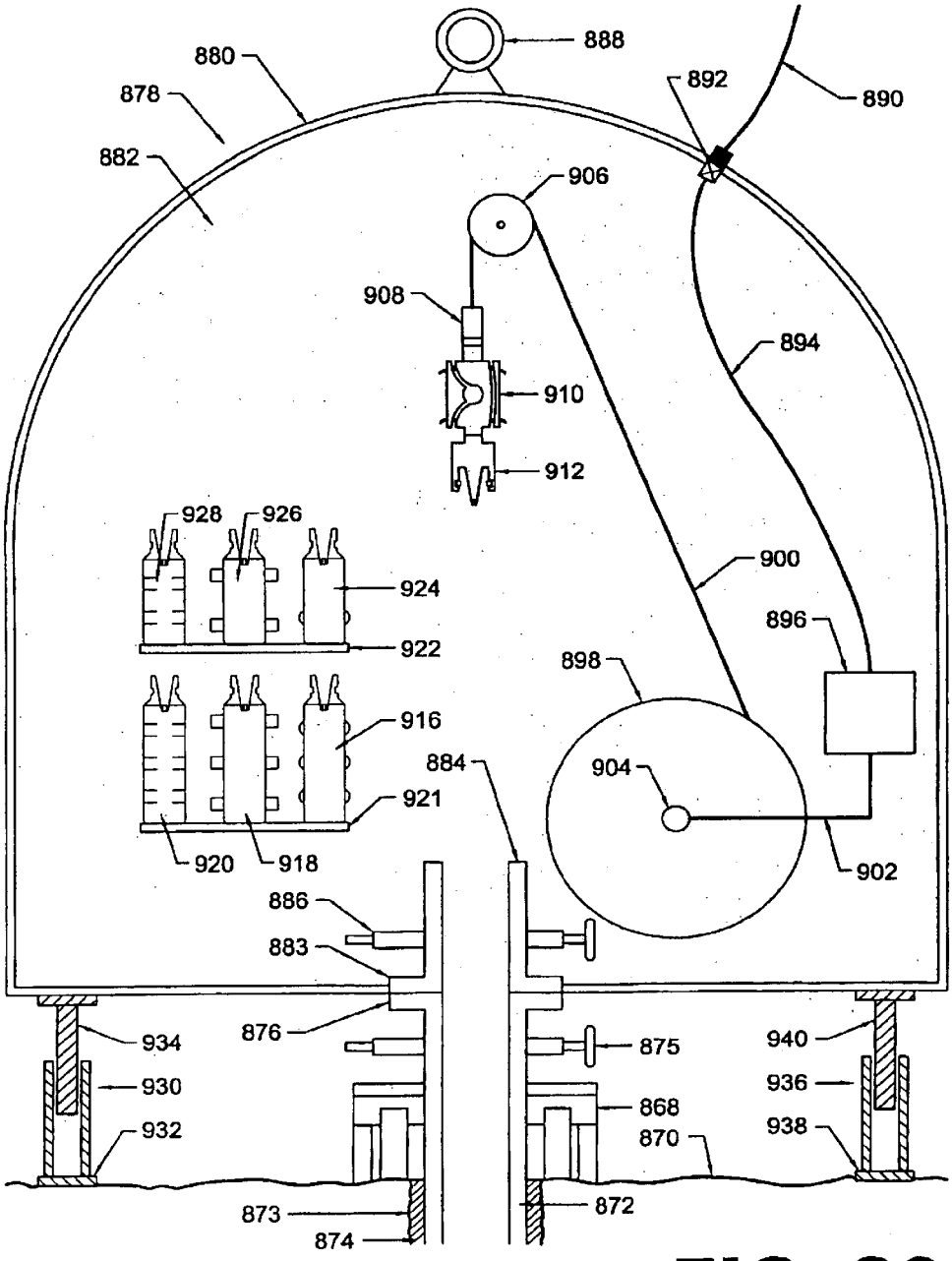
FIG. 26 shows in diagrammatic form a closed-loop subsea completion system.

FIG. 26 shows, in diagrammatic form, a closed-loop subsea completion system. Subsea tree 868 is located on the ocean floor 870 and it is attached to casing 872 that is installed in wellbore 873 with cement 874. The subsea tree has at least one hydraulically actuated ram 875 to prevent blowouts and it has top mating flange 876. The Subsea Completion Module 878, abbreviated as "SCM", has a wall 880 so that the pressure may be controlled inside the SCM at location 882, for example. The SCM has a bottom mating flange 883 that suitably engages the top mating flange of the subsea tree. Attached to the SCM bottom mating flange is pipe 884 that has hydraulic ram 886 to control blowouts and for other purposes.

The SCM in FIG. 26 may be used, and deployed, as if it were a simple "diving bell" by hook support 888. In one embodiment, the SCM is lowered through a large hole, or bay, in the bottom of a suitably designed surface vessel, although that surface vessel is not shown in FIG. 26 solely for the purposes of brevity. Such a surface vessel has a suitable crane with drum having cable that is suitably attached to the hook support, although again, that crane is not shown in FIG. 26 solely for the purposes of brevity. Known art in the industry may be used to design and build a suitable surface vessel. Similarly, and in different embodiments, the SCM may also be deployed from a drilling platform, a drillship, a semisubmersible, a submarine, a remotely operated vehicle (ROV), or from any ocean going vessel or ocean going means.

When the SCM is in place on the subsea tree, umbilical 890 is connected to the surface vessel, or instead to a platform, drillship, semisubmersible, or other support vessel on the surface as may be desirable. Electrical power, control signals, measurements, etc. are sent to and from the surface through the umbilical. It should be noted that for completeness, in various embodiments, the umbilical can also provide hydraulic controls, and fluids, etc., but solely for the purposes of simplicity, those features are not explicitly shown in FIG. 26.

Umbilical 890 feeds through the wall of the SCM through the pressure feedthrough 892. The signals to and from the umbilical proceed along wire bundles 894 to the computer and electronics system 896. Computer and electronics system 896 controls the wireline drum 898 having wireline 900. Signals from the computer and electronics system 896 are sent via wire bundle 902 to the slip-ring 904 as is typical in the wireline industry. The wireline proceeds to overhead sheave 906. Suspended on the wireline are cablehead 908, Smart Shuttle 910, and Retrieval Sub 912. Various Smart Completion Devices are figuratively shown as elements 916, 918, and 920 on first automated rack 921. For example, any of these elements can be one or more Universal Smart Completion Devices as shown in FIGS. 24 and 25. Second automated rack 922 holds more Smart Completion devices including a Casing Saw 924, Smart Wiper Plug 926, and Smart Perforation Gun 928.

The automated racks are under the control of the computer and electronics system 896, which in turn, may receive commands from a surface computer, and/or a computer onshore, which together comprise an entire distributed computer system. Upon suitable computer commands, the automated racks position the Smart Completion Devices in suitable orientation so that they may be grasped by the Retrieval Sub during sequential completion steps of the wellbore. Various sensors in the Smart Shuttles provide for the closed-loop control of the automated system to complete oil and gas wells shown in FIG. 26. Universal Smart Completion Devices or other Smart Completion Devices having sensors also provide for the closed-loop control of the automated system to complete oil and gas wells shown in FIG. 26. There are many variations of the embodiment shown in FIG. 26 that provide for the closed-loop control of the automated completion system.

It should be noted that it is not necessary to have any human presence or operation in the SCM, although it is possible. Without human presence, then the pressure within the SCM can be raised to typical pressures available at the wellhead so that entering and leaving the well head does not necessarily require lubricators, etc. of the type already described in relations to FIGS. 8 and 17.

To keep excessive weight off the subsea tree, the weight of the SCM in FIG. 26 is substantially supported by jack-up devices in contact with the ocean floor. First jack-up support is generally designated by numeral 930 in FIG. 26, and it has first jack-up foot 932 in contact with the ocean floor and first piston apparatus 934 attached to the bottom of the SCM. Typical art in the industry is used to construct and operate the jack-up apparatus. Second jack-up support is generally designated by numeral 936 in FIG. 26, and it has second jack-up foot 938 in contact with the ocean floor and second piston apparatus 940 attached to the bottom of the SCM. Not shown in FIG. 26 is third jack-up support that is numeral 942, and third jack-up foot 944, and third piston apparatus 946 attached to the bottom of the SCM.

The alignment apparatus in FIG. 26 used to align the SCM with the subsea tree is not shown for the purposes of simplicity only. Any alignment means located on the SCM is designated here as element 948, and any alignment means located on, or near, the subsea tree is designated herein as element 950, although these elements are not shown in FIG. 26 solely for the purposes of brevity. These alignment means in several embodiments are completely automatic, in that no commands from the surface are necessary for the alignment means to properly guide the SCM into place over the subsea tree. Buoyancy controls 952 within the SCM are not shown in FIG. 26 for brevity.

Accordingly, FIG. 26 shows an automated well completion system for producing hydrocarbons from a wellbore in the earth that is substantially under the control of a computer system that executes a sequence of programmed steps. FIG. 26 also shows a closed-loop system to complete a well for producing hydrocarbons from the earth.

The embodiment of a subsea completion system shown in FIG. 26 is the Subsea Completion Module 878. However, the SCM may itself have its own thrusters and controls. Therefore, in several preferred embodiments, the SCM is in reality itself a remotely operated vehicle ("ROV"). In several embodiments, the automatic alignment means are used to guide the ROV into place over the subsea tree. Not shown in FIG. 26 solely for the purposes of simplicity are suitable ROV thrusters 954 and suitable ROV thruster controls 956. In other embodiments, separate remotely operated vehicles, or ROV's, or submarines, are be used to guide the SCM in FIG. 26 into place over the subsea tree. Using other ROV's operated remotely from an offshore drilling platform to help guide the SCM into place over the subsea tree is yet another embodiment of the invention.

FIG. 26 shows a wireline within the SCM. However, a separate coiled tubing apparatus can be similarly be added within the SCM as another embodiment of the invention. That coiled tubing apparatus is numeral 958 in FIG. 26 that is not shown solely for the purposes of brevity. Further, in another preferred embodiment, this coiled tubing apparatus can be fitted with a mud-motor assembly 960, also not shown in FIG. 26, that may be used to drill holes with a mud-motor drilling apparatus of the types previously described herein. In an embodiment, sea water is used in part for the drilling fluid, and it is obtained through water intake port 962, also not shown in FIG. 26. Any drilling cuttings and the like will be exhausted into the ocean through drilling cutting exhaust port 964 in the SCM, but that is not shown in FIG. 26 for the purposes of simplicity. Yet further, the mount for the coiled tubing apparatus can also be fitted to rotate about its base further enhancing the efficiency of the coiled tubing drilling apparatus.

Accordingly, it is now evident that the disclosure related to FIG. 26 describes an automated well completion system for producing hydrocarbons from a wellbore in the earth that is substantially under the control of a computer system that executes a sequence of programmed steps.

Further, disclosure related to FIG. 26 describes a closed-loop system to complete a well for producing hydrocarbons from the earth.

Yet further, disclosure related to FIG. 26 provides a method of completing a wellbore to produce hydrocarbons from the earth that is substantially under the control of an automated computer system that executes a sequence of programmed steps.

And finally, disclosure related to FIG. 26 provides a method to complete a wellbore to produce hydrocarbons from the earth that is substantially under the control of a closed-loop automated system that executes a sequence of programmed steps, whereby the steps depend upon information obtained from at least one sensor located within the wellbore, and whereby the steps are executed during one significant portion of the well completion process.

Closed-Loop Tractor Conveyance System

Figure 27:
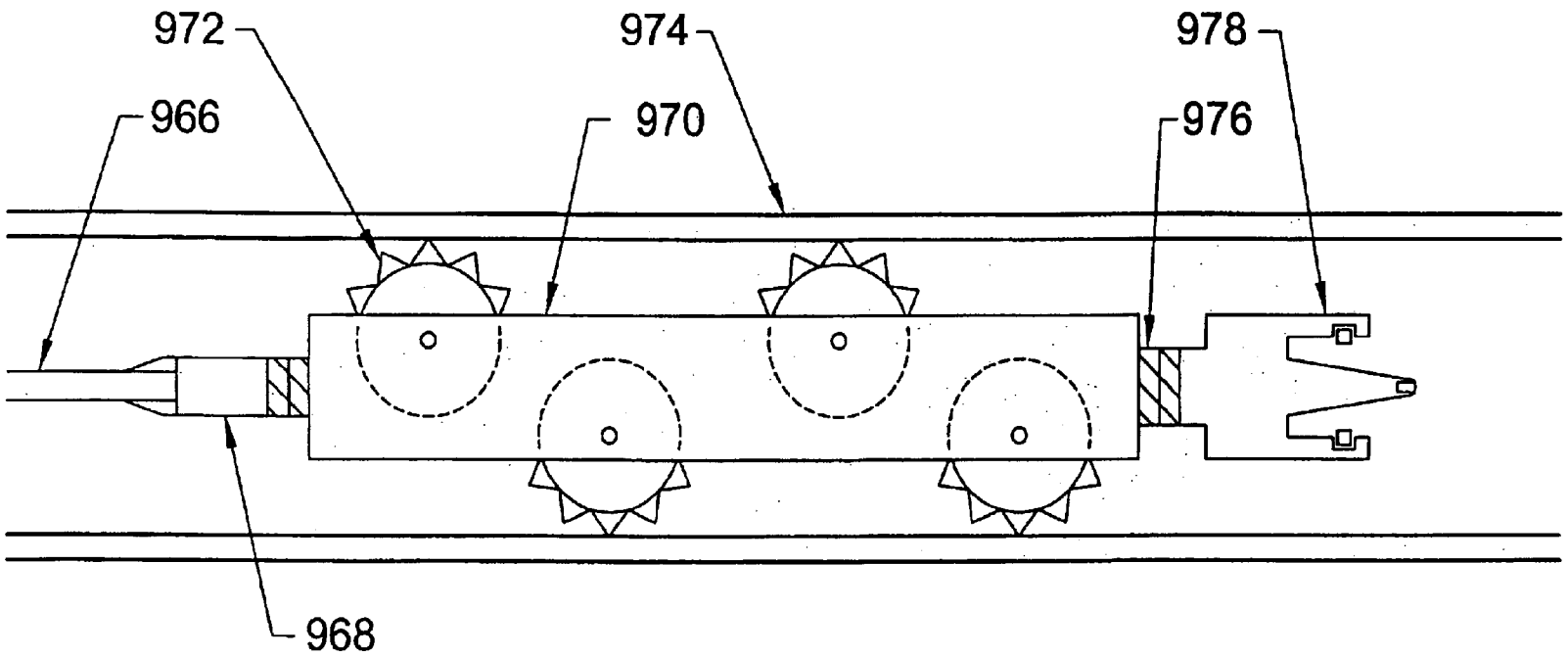
FIG. 27 shows the tractor deployer operated by a wireline.

FIG. 27 shows another well conveyance means. FIG. 27 was originally filed in the U.S.P.T.O. on the date of Oct. 2, 2000 as a portion of U.S. Disclosure Document 480550. Wireline 966 possesses one or more electrical conductors. In several preferred embodiments, wireline 966 possesses one or more high power electrical conductors. Wireline 966 also provides means for two-way data communications as may be provided by one or more electrical conductors or by one or more optical fibers. Wireline 966 also provides means for two-way data communications as may be provided with two or more electrical conductors or by one or more optical fibers. This wireline 966 provides first and second communications means. The wireline may conduct large amounts of power downhole and may have any number of current carrying conductors, and any number of signal conductors, or may have one or more optical fibers. In the case of an optical fiber, the first and second communications means are combined into a single bidirectional communications system, or into a single communication system means. Cablehead 968 connects the wireline 966 to tractor conveyor 970. The tractor conveyor has at least one friction wheel 972 which engages the interior of pipe 974. The tractor conveyor has four friction wheels as shown in FIG. 27. This friction wheel is analogous to element 546 in FIG. 13. Quick change collar assembly 976 connects the tractor conveyor to the Retrieval Sub 978.

The tractor conveyor 970 with its Retrieval Sub 976 installed in FIG. 27 is an example of a "tractor conveyance means", a "tractor deployer", or a "downhole tractor deployment device". Electrical energy delivered via the wireline to the tractor conveyor is used to drive electrical motors and/or electro-hydraulic systems to provide rotational energy to the friction wheels. That rotational energy causes the tractor conveyor to move within the well.

The tractor conveyance means in FIG. 27 provides similar operational features as different embodiments previously described heretofore as Smart Shuttles. The instrumentation described in FIG. 14 is used to provide the automated control of the tractor conveyance means. The tractor conveyance means may have any one or more of the features described in the above "List of Smart Shuttle Features" under items (a), (b), . . . (z), (aa), and (ab). Any of the completions devices listed under the section entitled "List of Smart Completion Devices" may be attached to the Retrieval Sub. Here, for the tractor conveyance means, the Retrieval Sub performs analogous functions as previously described for the Smart Shuttle in the above "List of Retrieval Sub Features".

By analogy with the Smart Shuttle, the tractor conveyance means may be used as a portion of an "automated well servicing system" for producing hydrocarbons from a wellbore in the earth. Herein, this automated system is called the "tractor conveyance system" or the "automated tractor conveyance system". The tractor conveyance means is substantially under the control of a computer system that executes a sequence of programmed steps that has at least one computer system located on the surface of the earth and has means to convey at least one completion device into the wellbore under the automated control of the computer system. The automated system has at least one sensor means located within the tractor conveyance means, has first communications means that provides commands from the computer system to the tractor conveyance means, has second communications means that provides information from the sensor means to the computer system, where the execution of the programmed steps of the computer system to control the tractor conveyance means takes into account information received from the sensor means to optimize the steps executed by the computer system to service the well.

Figure 28:
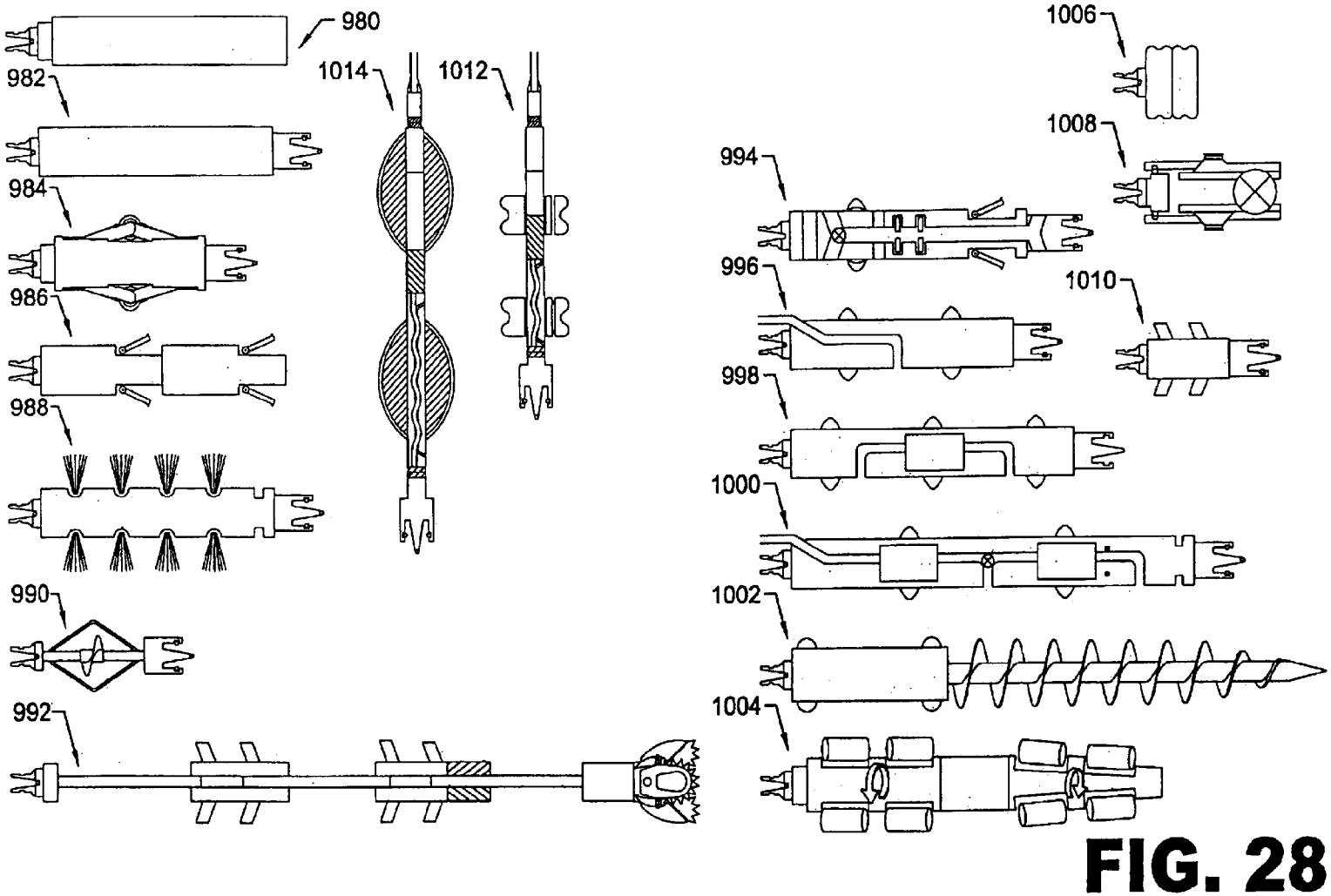
FIG. 28 shows various devices that may be attached to the Retrieval Sub of the Smart Shuttle and the tractor conveyor.

The Retrieval Sub can be attached to a number of the devices shown in FIG. 28. Those devices include any commercial tool or device 980; any logging tool 982; any torque reaction centralizer 984; any scraper 986; an perforating tool 988; any flow meter 990; any Downhole Rig with rotary bit 992; any Universal Completion Device 994; any straddle packer 996; any injection tool 998; any oil/gas separator 1000; any flow line cleaning tool 1002; any casing expanding tool 1004; any plug 1006; any valve 1008; and any locking mechanism 1010. These different tools are either defined in applicant's applications or are tools used in the oil and gas industry. The point is that any of these devices can be attached to the Retrieval Sub of the Cased Hole Smart Shuttle 1012 or to the Retrieval Sub of the Open Hole Smart Shuttle 1014. These devices may similarly be attached to the Retrieval Sub of the tractor conveyance means. Each such device in this paragraph may be called a "completion device" and collectively, these may be referenced as "completion devices".

Figure 29:
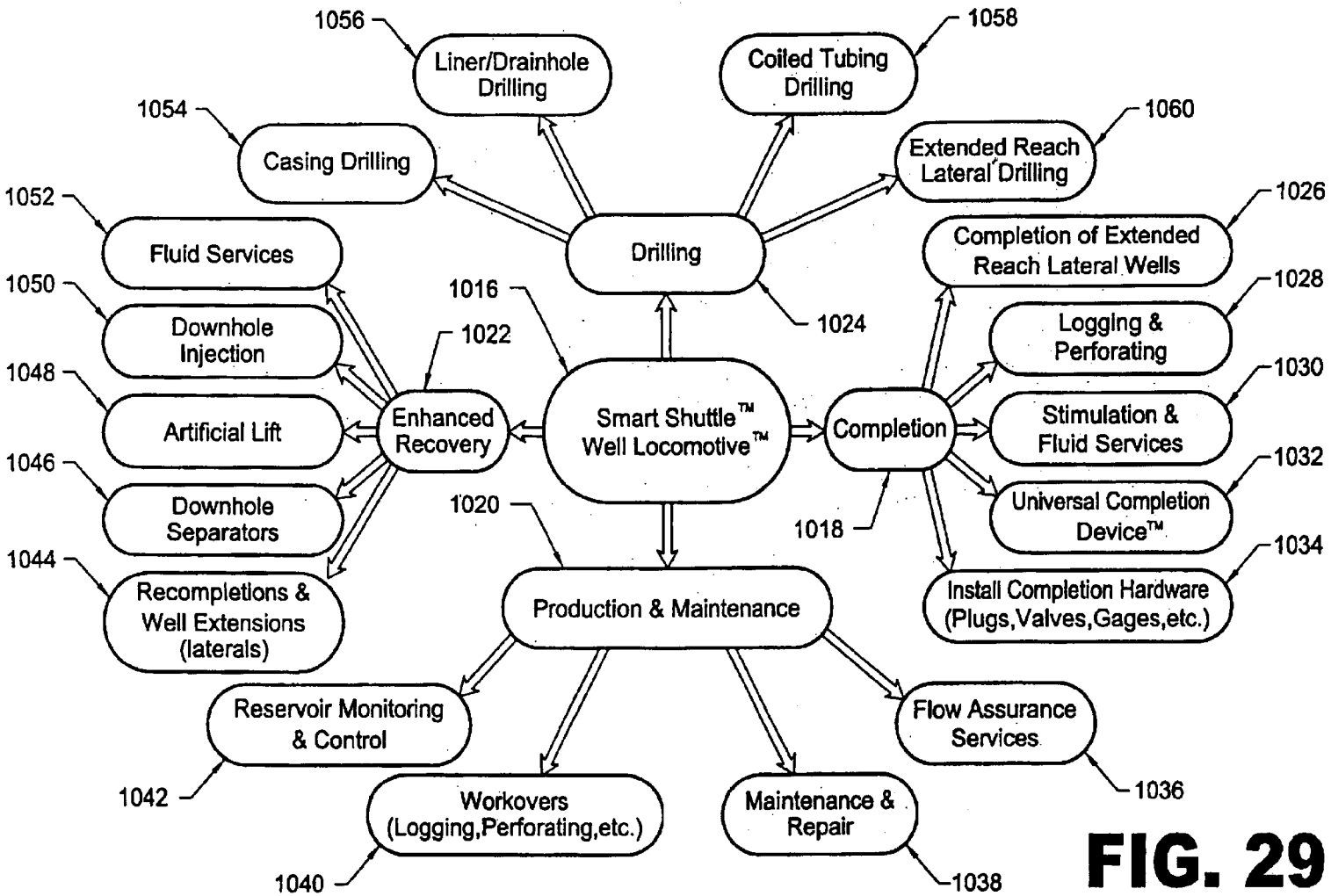
FIG. 29 that shows a diagrammatic representation of functions that may be performed with the Smart Shuttle and the tractor conveyance system.

These devices specified in the previous paragraph may be used for a variety of different purposes in the oil and gas industry. Many of those tools can be used to serve wells. Please refer to FIG. 29 that shows a diagrammatic representation of functions that may be performed with the Smart Shuttle or the Well Locomotive. FIG. 29 shows that the Smart Shuttle or the Well Locomotive shown diagrammatically as element 1016 may be used for the purposes of completion 1018 (ie., to perform completion services on a well); production & maintenance 1020 (ie., to perform production and maintenance services on a well); enhanced recovery 1022 (ie., to perform enhanced recovery services on a well); and for drilling 1024. Under completion functions, or "completion services", the Smart Shuttle and Well Locomotive may be used for the completion of extended reach lateral wells 1026; for logging and perforating 1028; for stimulation and fluid services 1030; may be used to install the Universal Completion Devices 1032; and may be used to install completion hardware such as plugs, valves, gages, etc. 1034. Under production and maintenance functions, or "production and maintenance services", the Smart Shuttle and Well Locomotive may be used for flow assurance services 1036; for maintenance and repair 1038; for workovers, that include logging, perforating, etc., 1040; and for reservoir monitoring and control 1042. Under enhanced recovery functions, or "enhanced recovery services", the Smart Shuttle and Well Locomotive may be used for recompletions, well extensions, and laterals 1044; to install downhole separators 1046; to perform artificial lift 1048; to facilitate downhole injection 1050; and for fluid services 1052. Under drilling functions, or under "drilling services", the Smart Shuttle and the Well Locomotive may be used for casing drilling purposes 1054; for liner drainhole drilling purposes 1056; for coiled tubing drilling 1058; and for extended reach lateral drilling 1060. Extensive details are provided in about each of these functions in the related U.S. Disclosure Documents and in the related Provisional Patent Applications cited above.

Any one or more of the functions provided in the previous paragraph is called a "well service". Two or more of such functions are called "well services". The execution of the programmed steps of the automated computer system to control the tractor conveyance means takes into account information received from the sensor means within the tractor conveyance means to optimize the steps executed by the computer system to service the well.

The tractor conveyance means may be used to perform analogous services as enumerated above in FIG. 29 with the Smart Shuttle and the Well Locomotive. A tractor conveyance means includes downhole devices that use electrical energy to turn at least one wheel, or cam, or spiral gear, or any other means that generates direct friction against the pipe to cause the tractor conveyance means to move within the pipe.

Accordingly, FIG. 27 describes an automated well servicing system for producing hydrocarbons from a wellbore in the earth that is substantially under the control of a computer system that executes a sequence of programmed steps that has at least one computer system located on the surface of the earth, has at least one tractor conveyance means to convey at least one completion device into said wellbore under the automated control of the computer system, has at least one sensor means located within the tractor conveyance means, has first communications means that provides commands from the computer system to the tractor conveyance means, has second communications means that provides information from the sensor means to the computer system, where the execution of the programmed steps of the computer system to control the tractor conveyance means takes into account information received from the sensor means to optimize the steps executed by the computer system to service the well.

Figure 30:
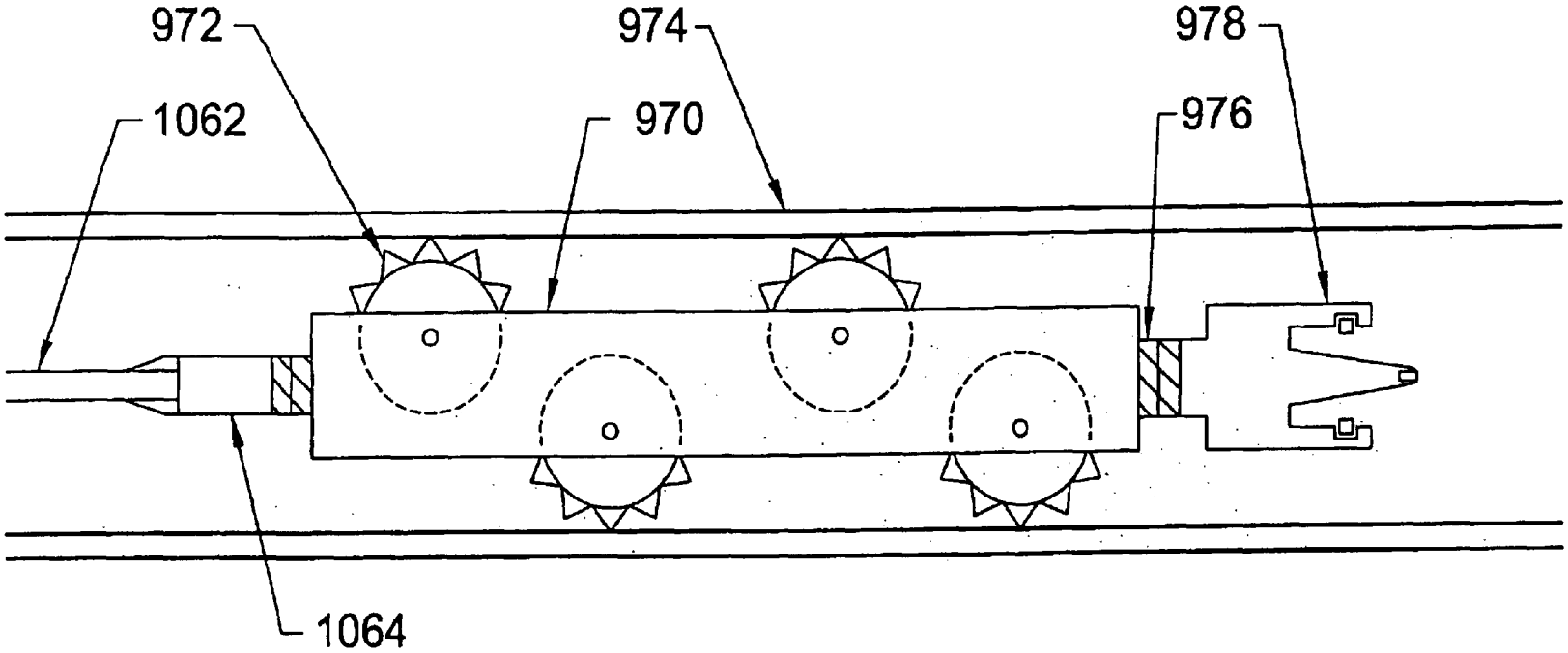
FIG. 30 shows the tractor deployer operated from an umbilical.

FIG. 30 shows another well conveyance means. FIG. 30 was originally filed in the U.S.P.T.O. on the date of Oct. 2, 2000 as a portion of U.S. Disclosure Document 480550. Element is 1062 is an umbilical. In one preferred embodiment, the umbilical is fabricated from a composite material and possesses one or more high power electrical conductors and means for two-way data communications. Such umbilicals may be manufactured on a custom basis by ABB Ltd. of Zurich, Switzerland. A specific division of ABB Ltd. that is ABB Offshore Systems Inc. which is based in Houston, Tex., can manufacture the umbilicals. A specific example of a composite is a material made from carbon fiber-epoxy resin. Umbilical terminator 1064 connects the high power umbilical 1062 to tractor conveyor 970. The other elements are the same as in FIG. 27. The tractor conveyor has at least one friction wheel which engages the interior of pipe 974. This friction wheel is analogous to element 546 in FIG. 13. Quick change collar assembly 974 connects the tractor conveyor to the Retrieval Sub 976. The tractor conveyor 970 and the Retrieval Sub 976 are an example of a "conveyance means". The conveyance means in FIG. 30 provides similar operational features as different embodiments previously described as Smart Shuttles.

Electrical energy delivered via the high power umbilical to the tractor conveyor is used to drive electrical motors and/or electro-hydraulic systems to provide rotational energy to the friction wheels. That rotational energy causes the tractor conveyor to move within the well.

The umbilical is mounted on an umbilical drum analogous to wireline drum 578 shown in FIG. 14. The motion of the tractor conveyor is monitored with computer system analogous to computer system 556 in FIG. 14 which provides the closed-loop automated control of the tractor conveyance means during well servicing operations.

The above has described one embodiment of the umbilical 1062 in FIG. 30. In different preferred embodiments, the umbilical 1062 may be selected to be any one of the following: (a) a coiled tubing, or a coiled tubing that encapsulates electrical conductors; (b) a coiled tubing made from steel that encapsulates one or more electrical conductors within the interior of the steel coiled tubing; (c) a steel coiled tubing that encapsulates a wireline that is disposed within the interior of the coiled tubing that in turns possesses one or more electrical conductors; (d) a steel coiled tubing that encapsulates electrical conductors protected by any sheath, or other protection means; (e) tubing made from composite material, or a composite coiled tubing that encapsulates one or more electrical conductors that are disposed within the interior of the coiled tubing; (f) a composite coiled tubing that encapsulates a wireline that is disposed within the interior of the coiled tubing that in turns possesses electrical conductors; (g) a composite coiled tubing that possesses one or more electrical conductors that are disposed within the walls of said coiled tubing made from composite material; (h) a composite coiled tubing that encapsulates electrical conductors protected by any sheath or other protection means; (i) any tubular structure including one or more tubes, one within another, at least one of which has an electrical conductor disposed within regions between the walls of the tubes or within the walls of the tubes; and (j) any "tubular means possessing at least one electrical conductor" that includes (a), (b), (c), (d), (e), (f), (g), (h), and (i), and in this paragraph. Element 1062 having any of the above attributes of (a), (b), (c), (d), (e), (f), (g), (h), (i), and (j) may also be called an "umbilical means having at least one electrical conductor". Any umbilical means may be intentionally designed to be neutrally buoyant in any fluids within a well. Accordingly, there are many different types of umbilicals that correspond to element 1062 in FIG. 30. Element 30 in FIG. 30 is an "umbilical means".

Figure 31:
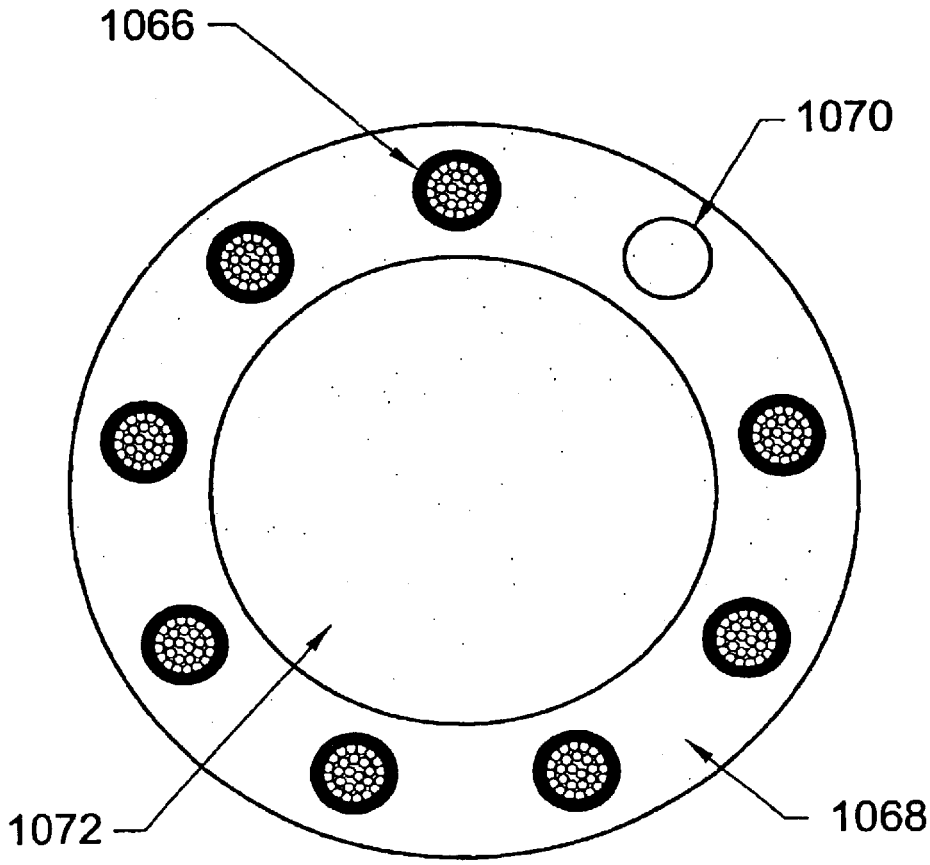
FIG. 31 shows a cross section of an embodiment of the umbilical shown in FIG. 30.

FIG. 31 shows a cross section of an embodiment of umbilical 1062 in FIG. 30. FIG. 31 was originally filed in the U.S.P.T.O. on the date of Oct. 2, 2000 as a portion of U.S. Disclosure Document 480550. In one embodiment of FIG. 31, at least one insulated electrical conductor 1066 is encapsulated by first composite material 1068. (In other embodiments, the wire is not insulated.) An optical fiber 1070 for two-way data communications is also encapsulated by first composite material 1068. First composite material 980 surrounds second composite material 1072. (Alternatively, other separate electrical conductors can be encapsulated within the composite material 1068 for data communications purposes or for other purposes.)

The first composite material is chosen for its good strength, durability against abrasion in the well, and perhaps for its electrical insulation properties. In one embodiment of FIG. 31, the second composite material is chosen so with a particular specific gravity such that the overall umbilical is neutrally buoyant in typical well fluids (in 12 lb per gallon mud, for example, or in salt water, as another example). Syntactic foam materials having silica microspheres as provided by the Cumming Corporation (www.emersoncumming.com) for such purposes. The details on pressure balanced silica microspheres in syntactic foam may be reviewed in Attachment 28 to the Provisional Patent Application mailed to the USPTO under a Certificate of Express Mailing on the date of Jun. 3, 2002, an entire copy of which is incorporated herein by reference.

In yet another embodiment of FIG. 31, the above composite materials is left out of the interior, and the interior forms a tube through which fluids can be conducted downhole. In this case, element 1072 on FIG. 31 would be replaced with element 1074 which would point to a void (not shown for the purposes of brevity). In this particular embodiment, the first composite material would be also be chosen to be as neurally buoyant as possible.

Therefore, different embodiments of umbilicals provide electric power downhole, bidirectional communications, which are neutrally buoyant in well fluids. In addition, yet other umbilicals also provide the ability to conduct fluids to and from the borehole. Umbilicals handling well fluids are useful with a number of well services including the use with straddle packers, injection tools, oil gas separators, flow line cleaning tools, valves, etc.

Figure 32:
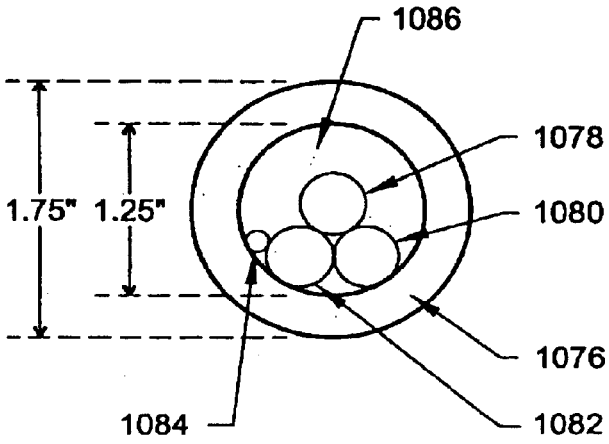
FIG. 32 shows another neutrally buoyant composite umbilical in 12 lb per gallon mud.

FIG. 32 shows yet another neutrally buoyant composite umbilical in 12 lb per gallon mud. Outer spoolable composite tubing 1076 is 1.75 inches O.D. and 1.25 inches I.D. having a specific gravity of 1.50. Three each 0.355 inch O.D. insulated No. 4 AWG Wires 1078, 1080 and 1082 are disposed within the I.D. of the spoolable composite tubing. Optical fiber 1084 is also disposed within the spoolable composite tubing. The remaining available volume within the spoolable composite is then filled with pressure balanced silica microspheres in syntactic foam that has a specific gravity of 0.60. A simple calculation shows that this umbilical in 12 lbs/gallon mud weighs −50 lbs for every 1,00 feet. Assuming a coefficient of friction of 0.2, at 20 miles the umbilical could pull back with a frictional force of 1,056 lbs. So, this umbilical is substantially neutrally buoyant (or simply "neutrally buoyant" as defined below). The insulated wire is rated at 14,000 volts. This particular wire is Part Number FEP4FLEXSC available through Allied Wire & Cable located in Bridgeport, Pa.

Figure 33:
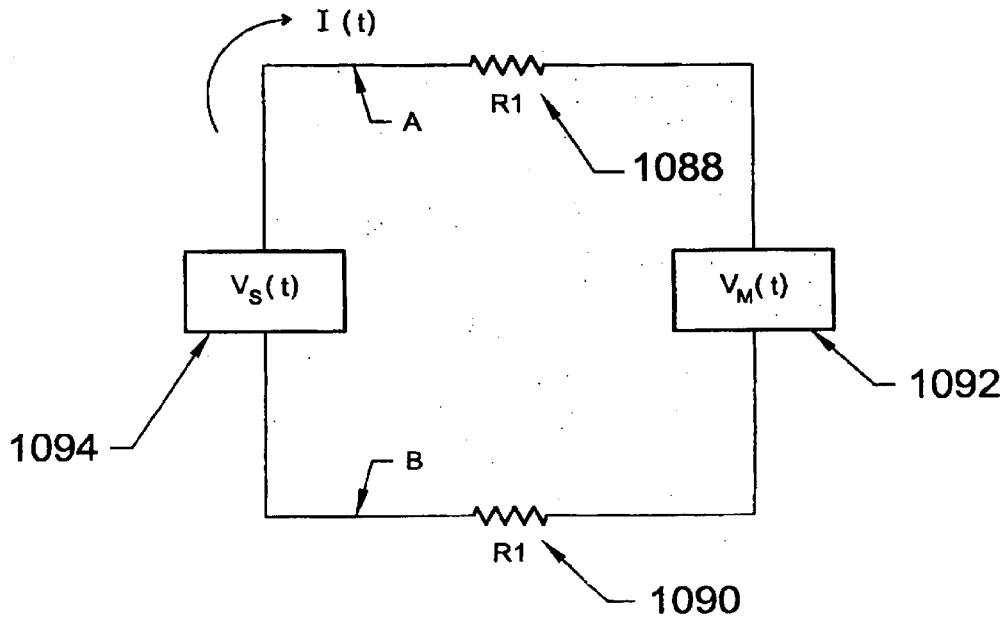
FIG. 33 shows an electrical block diagram representing two conductors from a three phase delta system providing up to 160 horsepower of electrical power at a distance of 20 miles.

FIG. 33 shows how three phase power of 160 horsepower (119 kilowatts) can be delivered through the conductors in FIG. 32 to distances of 20 miles. Two "legs" of the three phase delta circuit are shown in FIG. 33 as wires "A" and "B" (wire "C" of the three phase delta circuit is not shown for simplicity). The resistances of a length of 20 miles of the wire is simulated with resistors having the magnitude of resistance in ohms of "R1". These two resistors are respectively labeled as elements 1088 and 1090. The load at the end of the umbilical is simulated with a downhole electric motor 1092 requiring 2,500 volts 0-peak at 45 amps 0-peak between any two wires of the three phase wiring system operating at 60 Hz. A variable voltage supply on the surface 1094 is continually adjusted to provide the required voltage at the downhole motor. Typically, the variable voltage supply on the surface 1094 will operate at 6,182 volts 0-peak and will provide 45 amps 0-peak between any two legs of the three phase circuit. The point of this is that using such a variably voltage supply and reasonably gauge wiring, it is possible to actually deliver 160 horsepower (119 kilowatts) at a distance of 20 miles. The density of the pressure balanced silica microspheres in syntactic foam is chosen to make this umbilical neutrally buoyant in 12 lb per gallon mud. Detailed calculations of the power calculations are provided in "Attachment C" to Provisional Patent Application No. 60/353,457, an entire copy of which is incorporated herein by reference. The details on the pressure balanced silica microspheres in syntactic foam can referred to in Attachment 28 to the Provisional Patent Application mailed to the USPTO under a Certificate of Express Mail on the date of Jun. 3, 2002, an entire copy of which is incorporated herein by reference. As stated above, such materials are available from the Cumming Corporation (www.emersoncumming.com).

Figure 34:
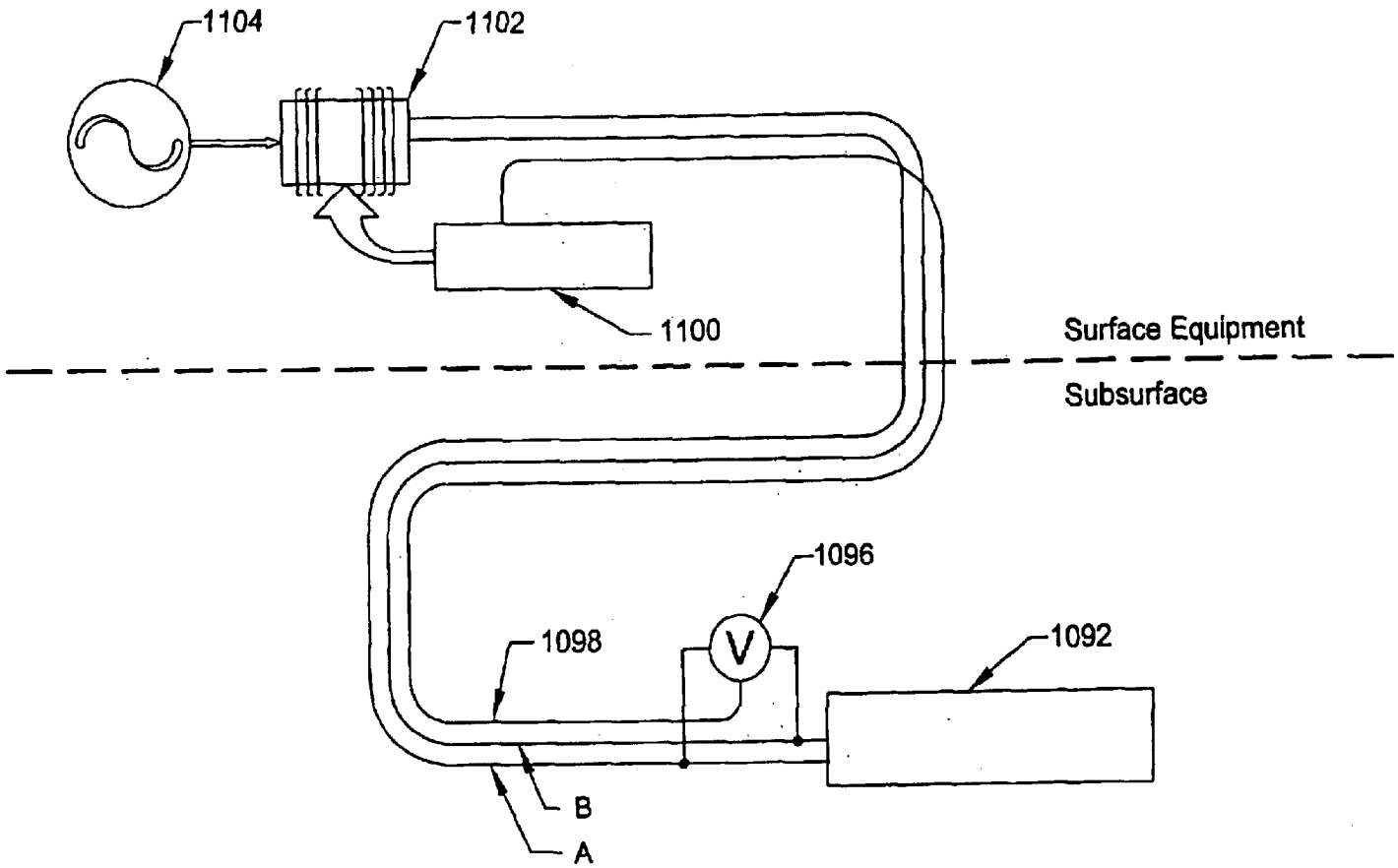
FIG. 34 shows a block diagram showing feedback control of voltage delivered downhole to an electrical motor.

The voltage to the downhole motor 1092 is controlled by a feedback system shown in FIG. 34. Wires A and B, and downhole motor 1092 have been identified in FIG. 33. The voltage across two legs of the three phase motor is measured with voltmeter 1096, and this voltage is digitized with related instrumentation (not shown for the purposes of simplicity), and the related voltage information is forwarded uphole by light pulses sent through optical fiber 1098. That information is received by computer system 1100 and related electronics (not shown for the purposes of simplicity). The output of the computer system adjusts the voltage and frequency by surface control electronics 1102. The power is supplied by generator 1104. So, the correct voltage is provided to the downhole motor by this very practical feedback system. FIG. 33 is Attachment (h) to Provisional Patent Application No. 60/367,638, an entire copy of which is incorporated herein by reference.

Figure 35:
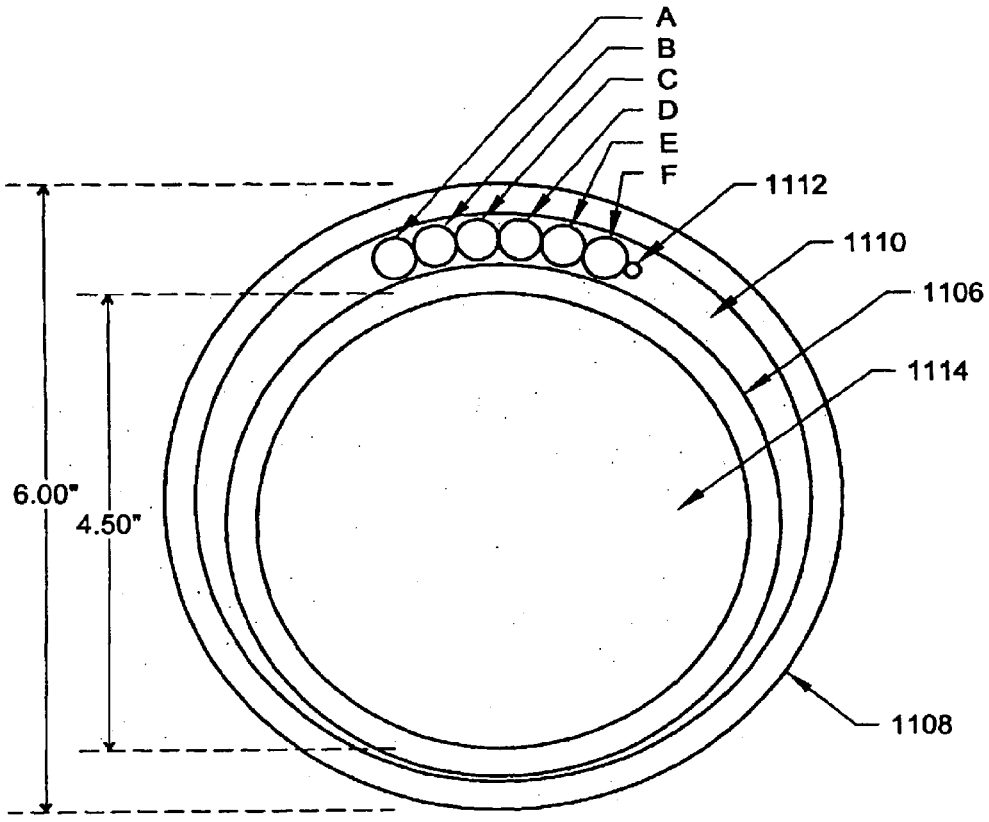
FIG. 35 shows an umbilical that is substantially neutrally buoyant in 12 lb per gallon mud which also provides a conduit for fluids.

FIG. 35 shows an umbilical that is substantially neutrally buoyant in 12 lb per gallon mud. It has an OD of 6.00 inches and an ID of 4.5 inches. The ID forms a pipe through which fluids may be sent to and from downhole. Put another way, the ID forms a provides a conduit for fluids. For example, drilling mud may be sent downhole through the 4.5 inch ID. The ID of this pipe is also called the interior of this pipe.

The umbilical in FIG. 35 has a 4.5 inch ID pipe labeled with element 1106 having a wall thickness of 0.25 inches that is made from a carbon-based composite material having a specific gravity of 1.5. Also shown in FIG. 35 is a 6.0 inch OD pipe labeled with element 1108 having wall thickness of 0.25 inches that is made from a carbon-based composite material having a specific gravity of 1.5. In the asymmetric volume 1110 between the two pipes are insulated electric wires A, B, C, D, E, and F. Also shown is fiber optic cable 1112. The asymmetric volume 1110 between the two pipes that contains wires A, B, C, D, E, and F, and fiber optic cable 1112, is otherwise filled with silica microspheres that are embedded in syntactic foam material called herein a "filler material". This "filler material" is described above. The specific gravity of the "filler material"0.825 in this example. In 12 gallon mud, the upward buoyant force is plus 5.9 lbs per 1000 feet of this umbilical. Assuming a coefficient of friction of 0.2, the total frictional "pull-back" on 20 miles of this umbilical is only 124 lbs. This "pull-back" does not include any differential fluid drag forces. This umbilical was chosen to have an extreme length which shows that the essentially neutrally buoyant umbilical overcomes most friction problems associated with umbilicals disposed in wells. The ID of pipe 1106 forms a conduit for fluids. Therefore, the apparatus in FIG. 35 shows an umbilical that provides a conduit for fluids.

Wires A, B, C, D, E, and F are 0.355 inches O.D. insulated No. 4 AWG Wire. The insulation is rated at 14,000 volts. Wires A, B, and C comprises the first independent thee phase delta circuit. Wires A and B are shown in FIG. 33. Wires D, E, and F comprise the second independent three phase delta circuit. Each separate circuit is capable of providing 160 horsepower (119 kilowatts) at 20 miles at the temperature of 150 degrees C. So, combined, the umbilical can deliver a total of 320 horsepower (238 kilowatts) at 20 miles.

The first independent circuit provides 2,500 volts 0-peak to a load, a motor in this preferred embodiment, at 20 miles between wires A, B, and C respectively, and the motor may draw up to 45 amps 0-peak between any pairs of wires, A-B, B-C, or C-A. The second independent circuit also provides 2,500 volts 0-peak to a motor at 20 miles between wires D, E, and F respectively, and the motor may draw up to 45 amps 0-peak from any wire D,E, and F. Such voltages and currents are necessary for two series operated REDA 4 Pole Motors, each rated for 80 Horsepower. REDA is a manufacturer located in Bartlesville, Okla.

In different preferred embodiments of the invention, umbilicals described in this section can substitute for wireline 302 in FIG. 8; wireline 302 in FIG. 9; wireline 302 in FIG. 10; wireline 580 in FIG. 14; coiled tubing 656 in FIG. 17; coiled tubing 656 in FIG. 17A; wireline 690 in FIG. 19; wireline 762 in FIG. 21; coiled tubing 768 in FIG. 22; coiled tubing 772 that has wireline 774 installed within it as shown in FIG. 23; and wireline 900 in FIG. 26.

The above umbilicals have stated calculations pertaining to lengths of 20 miles. However, the umbilicals can be any length from 100's of feet to 20 miles. The extreme distanced of 20 miles was chosen to show neutrally buoyant umbilicals can provide high power and high speed data communications at great distances that has heretofore not been recognized in the oil and gas industry.

The term "neutrally buoyant" has been used above. Another equivalent term is "substantially neutrally buoyant". In one preferred embodiment, the meaning of these terms is that in the presence of the well fluids, that the buoyancy of the umbilical causes the typical friction of the umbilical against the well to be reduced by at least 90% than would otherwise be the case.

As stated earlier, the tractor conveyor 970 with its Retrieval Sub 976 in FIG. 27 is an example of a "conveyance means", a "tractor conveyance means", a "tractor deployer", or a "downhole tractor deployment device". There are many "well tractors", or devices related to well tractors, a selection of which are described in the following documents: U.S. Pat. Nos. 6,347,674; 6,345,669; 6,318,470; 6,296,066; 6,273,189; 6,257,332; 6,241,031; 6,241,028; 6,225,719; 6,179,058; 6,179,055; 6,173,787; 6,089,323; 6,082,461; 5,954,131; 5,794,703; 5,547,314; 5,375,668; 5,209,304; 5,184,676; 5,121,694; 5,018,451; 5,040,619; 4,960,173; 4,686,653; 4,643,377; 4,624,306; 4,570,709; 4,463,814; 4,243,099; 4,192,380; 4,085,808; 4,071,086; 4,031,750; 3,969,950; 3,890,905; 3,888,319; 3,827,512; in EP0564500B1; and in WO9806927; WO9521987; WO9318277; and WO9116520; entire copies of which are incorporated herein by reference. Entire copies of the 39 cited references in this paragraph are incorporated herein by reference. Many of these devices are means to cause or generate movement within wellbores. Such "movement means" may be attached to a device similar to the Retrieval Sub 976. Devices similar to Retrieval Sub 976 are called "retrieval means". So, movement means may be coupled to retrieval means to make a "tractor conveyance means", or tractor deployers, or downhole tractor deployment devices.

In view of the above, preferred embodiments of this invention disclose a closed-loop system to service a well for producing hydrocarbons from a borehole in the earth having at least one computer system located on the surface of the earth, which possess at least one conveyance means to convey at least one completion device into the borehole under the automated control of the computer system that executes a series of programmed steps, which possess at least one sensor means located within the conveyance means, which have first communications means that provides commands from the computer system to the conveyance means and possessing second communications means that provides information from the sensor means to the computer system, whereby the execution of the programmed steps by the computer system to control the conveyance means takes into account information received from the sensor means to optimize the steps executed by the computer to service the well. Such system is called a "closed-loop tractor conveyance system". The closed-loop system may also be used to monitor and control production of hydrocarbons from the wellbore.

While the above description contains many specificities, these should not be construed as limitations on the scope of the invention, but rather as exemplification of preferred embodiments thereto. As have been briefly described, there are many possible variations. Accordingly, the scope of the invention should be determined not only by the embodiments illustrated, but by the appended claims and their legal equivalents.

What is claimed is:

1. An automated well servicing system for producing hydrocarbons from a wellbore in the earth that is substantially under the control of a computer system that executes a sequence of programmed steps comprising:

(a) at least one computer system located on the surface of the earth;

(b) at least one tractor conveyance means to convey at least one completion device into said wellbore under the automated control of said computer system;

(c) at least one sensor means located within said tractor conveyance means;

(d) first communications means that provides commands from said computer system to said tractor conveyance means;

(e) second communications means that provides information from said sensor means to said computer system, whereby the execution of the programmed steps of said computer system to control said tractor conveyance means takes into account information received from said sensor means to optimize the steps executed by the computer system to service the well.

2. The apparatus in claim 1 that is used to perform completion services on a well.

3. The apparatus in claim 1 that is used to perform production and maintenance services on a well.

4. The apparatus in claim 1 that is used to perform enhanced recovery services on a well.

5. The apparatus in claim 1, whereby said tractor conveyance means is connected to said automated well servicing system by a wireline.

6. The apparatus in claim 5, whereby said wireline provides electrical power to said tractor conveyance means.

7. The apparatus in claim 6, whereby said wireline provides said first and second communications means.

8. The apparatus in claim 1, whereby said tractor conveyance means is connected to said automated well servicing system by an umbilical.

9. The apparatus in claim 8, whereby said umbilical is substantially neutrally buoyant in any well fluids present in the well.

10. The apparatus in claim 9, whereby said umbilical provides electrical power to said tractor conveyance means.

11. The apparatus in claim 9, whereby said umbilical provides said first and second communications means.

12. The apparatus in claim 11 whereby said first and second communications means are combined into a single bidirectional communications system means.

13. The apparatus in claim 12, whereby said first and second communications means are one optical fiber disposed within the umbilical.

14. The apparatus in claim 11, whereby said first and second communications means are two or more electrical wires within said umbilical.

15. The apparatus in claim 8, whereby said umbilical provides a conduit for fluids.

16. The apparatus in claim 8 whereby said umbilical is made from materials that includes at least one composite material.

17. The apparatus in claim 16 whereby said composite material is a carbon-based composite material.

18. The apparatus in claim 17 whereby said composite material encapsulates a volume containing silica microspheres that are embedded in syntactic foam material, whereby said volume is used to adjust the buoyancy of the umbilical.

19. The apparatus in claim 1, whereby said tractor conveyance means is connected to said automated well servicing system by an umbilical means.

20. The apparatus in claim 19 whereby said umbilical means is a coiled tubing.

21. The apparatus in claim 20 whereby said coiled tubing is made from steel.

22. The apparatus in claim 21 whereby one or more electrical conductors are disposed within the interior of said steel coiled tubing.

23. The apparatus in claim 21 whereby a wireline is disposed within the interior of said steel coiled tubing.

24. The apparatus in claim 20 whereby said coiled tubing is made from a composite material.

25. The apparatus in claim 24 whereby one or more electrical conductors are disposed within the interior of said coiled tubing made from composite material.

26. The apparatus in claim 24 whereby one or more electrical conductors are disposed within the walls of said coiled tubing that is made from said composite material.

27. The apparatus in claim 24 whereby a wireline is disposed within the interior of the coiled tubing that is made from said composite material.

28. The apparatus in claim 1, whereby said tractor conveyance means is connected to said automated well servicing system by any tubular means possessing at least one electrical conductor.

29. The apparatus in claim 1, whereby said tractor conveyance means is connected to said automated well servicing system by an umbilical means having at least one electrical conductor.

* * * * *